US011633059B2

(12) United States Patent
Mullet et al.

(10) Patent No.: US 11,633,059 B2
(45) Date of Patent: Apr. 25, 2023

(54) TUG ACTIVATED MOTORIZED WINDOW COVERING HAVING AN EXTERNAL BATTERY TUBE

(71) Applicants: Willis Jay Mullet, Gulf Breeze, FL (US); Daniel T. Matthews, Pensacola, FL (US); Michael D. Fox, Pensacola, FL (US); Richard Scott Hand, Pensacola, FL (US)

(72) Inventors: Willis Jay Mullet, Gulf Breeze, FL (US); Daniel T. Matthews, Pensacola, FL (US); Michael D. Fox, Pensacola, FL (US); Richard Scott Hand, Pensacola, FL (US)

(73) Assignee: Current Products Corp., Pensacola, FL (US)

( * ) Notice: Subject to any disclaimer, the term of this patent is extended or adjusted under 35 U.S.C. 154(b) by 490 days.

(21) Appl. No.: 16/571,288

(22) Filed: Sep. 16, 2019

(65) Prior Publication Data

US 2020/0069100 A1 Mar. 5, 2020

Related U.S. Application Data

(63) Continuation of application No. 15/450,892, filed on Mar. 6, 2017, now Pat. No. 10,799,056, which is a (Continued)

(51) Int. Cl.
*A47H 5/032* (2006.01)
*A47H 5/06* (2006.01)
(Continued)

(52) U.S. Cl.
CPC ..... *A47H 5/06* (2013.01); *A47H 1/02* (2013.01); *A47H 5/0325* (2013.01); *A47H 13/02* (2013.01);
(Continued)

(58) Field of Classification Search
CPC ..... A47H 5/032; A47H 5/06; A47H 5/0325; A47H 1/02; A47H 13/02;
(Continued)

(56) References Cited

U.S. PATENT DOCUMENTS 6,910,515 B2 * 6/2005 Nien ..... E06B 9/32 160/168.1 P
2015/0284990 A1 * 10/2015 Hall ..... E06B 9/326 74/606 R
2017/0095103 A1 * 4/2017 Pham ..... E06B 9/70

FOREIGN PATENT DOCUMENTS

WO WO-2017022632 A1 * 2/2017 ..... E05F 15/603

* cited by examiner

*Primary Examiner* — Johnnie A. Shablack
*Assistant Examiner* — Jeremy C Ramsey
(74) *Attorney, Agent, or Firm* — BrownWinick Law Firm; Christopher A. Proskey

(57) ABSTRACT

A motorized window covering system is presented having a rotatable drive element having a guide structure and a plurality of idler attachment elements and at least one drive element positioned over the rotatable drive element. A motor is connected to the rotatable drive element and controls operation of the window covering. An external battery tube assembly is connected by a conduit to the rotatable drive element and is configured to provide power to the motor. The external battery tube assembly includes a switch and controls operation of the motorized window covering. When pulled or lifted the external battery tube assembly initiates movement, stops movement or reverses movement of the motor. In this way, the system provides a unique way of controlling operation of a motorized window covering.

37 Claims, 83 Drawing Sheets

Related U.S. Application Data continuation-in-part of application No. 15/439,071, filed on Feb. 22, 2017, now Pat. No. 10,874,242, which is a continuation-in-part of application No. 14/719,438, filed on May 22, 2015, now Pat. No. 9,615,687, which is a continuation of application No. 14/029,210, filed on Sep. 17, 2013, now Pat. No. 9,095,908, said application No. 15/450,892 is a continuation-in-part of application No. 14/786,877, filed as application No. PCT/US2014/033602 on Apr. 10, 2014, now Pat. No. 9,999,313.

(60) Provisional application No. 61/702,093, filed on Sep. 17, 2012, provisional application No. 61/810,949, filed on Apr. 11, 2013, provisional application No. 61/817,954, filed on May 1, 2013.

(51) Int. Cl.

| | |
|---|---|
| ***A47H 1/02*** | (2006.01) |
| ***A47H 13/02*** | (2006.01) |
| *E06B 9/72* | (2006.01) |

(52) U.S. Cl.

CPC ..... *A47H 2001/0215* (2013.01); *E06B 9/72* (2013.01)

(58) Field of Classification Search

CPC ... A47H 2001/0215; E06B 9/36; E06B 9/361; E06B 9/362; E06B 9/364; E06B 9/365; E06B 9/367; E06B 9/368

See application file for complete search history.

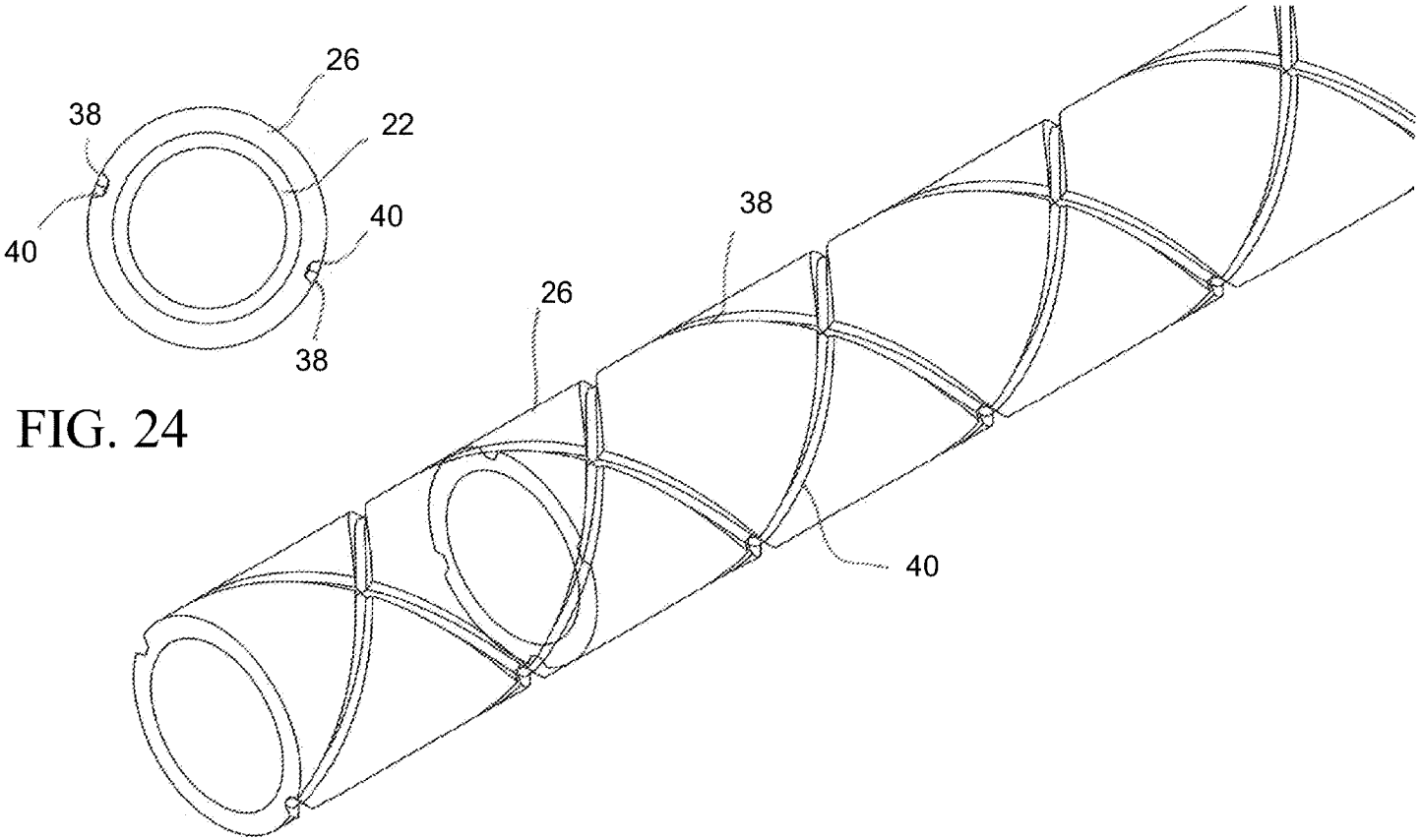
FIG. 24
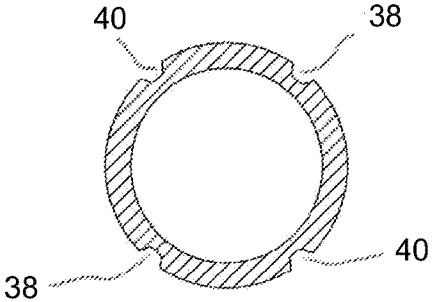
FIG. 22
FIG. 23

Inner and outer drapery deployed, outer drapery driver stops tube and inner drapery driver in stall area Inner drapery deployed outer drapery driver engaged, inner drapery driver in stall area Inner drapery stored and inner drapery driver stops tube, outer drapery stored and driver in stall area

| "Satellite" Drapery Motor Controller Operation – Mode 1 | | | | |
|---|---|---|---|---|
| Single Motor | Motor State | Pull Down | Lift Up | Note |
| Motor 1 | Moving Open | Stop | Stop | |
| | Not Moving | Close | Open | |
| | Moving Close | Stop | Stop | |
| Dual Motor | Motor State | Pull Down | Lift Up | Note |
| Motor 1 | Moving | Stop | Stop | |
| | Not Moving | Move | None | Direction is opposite last move. |
| Motor 2 | Moving | Stop | Stop | |
| | Not Moving | None | Move | Direction is opposite last move. |

| "Satellite" Drapery Motor Controller Operation – Mode 2 | | | | |
|---|---|---|---|---|
| Single Motor | Motor State | Pull Down | Lift Up | Note |
| Motor 1 | Moving Open | Stop | Stop | |
| | Not Moving | Move | Move | Direction is opposite last move. |
| | Moving Close | Stop | Stop | |
| Dual Motor | Motor State | Pull Down | Lift Up | Note |
| Motor 1 | Moving | Stop | Stop | |
| | Not Moving | Move | None | Direction is opposite last move. |
| Motor 2 | Moving | Stop | Stop | |
| | Not Moving | None | Move | Direction is opposite last move. |

FIG. 108

TUG ACTIVATED MOTORIZED WINDOW COVERING HAVING AN EXTERNAL BATTERY TUBE

CROSS-REFERENCE TO RELATED APPLICATIONS

This application is a continuation of U.S. patent application Ser. No. 15/450,892 which was filed on Mar. 6, 2017; which is a continuation in part of U.S. patent application Ser. No. 15/439,071 filed Feb. 22, 2017; which is a continuation in part of U.S. patent application Ser. No. 14/719,438 filed May 22, 2015; which is a continuation of U.S. patent application Ser. No. 14/029,210 filed Sep. 17, 2013; which claims priority to U.S. Provisional Application No. 61/702,093 filed Sep. 17, 2012.

This application is also a continuation in part of U.S. patent application Ser. No. 14/786,877 filed Oct. 23, 2015; which is a 371 of International Application No. PCT/US14/33602 filed Apr. 10, 2014; which claims priority to U.S. Provisional Application No. 61/817,954 filed on May 1, 2013; which also claims priority to U.S. Provisional Application No. 61/810,949 filed on Apr. 11, 2013.

All of these applications and any continuations, divisions, reissues, and other related applications are hereby fully incorporated by reference herein.

FIELD OF THE INVENTION

Embodiments of the present invention relate generally to a window covering assembly used to cover windows. Specific embodiments of the invention relate to a window covering assembly with a rotatable drive element that has a structure formed into or on the outer surface of the rotatable drive element such that a window covering moves axially along the rotatable drive element when the rotatable drive element rotates. Further specific embodiments relate to a window covering assembly in which two different curtains are operated by the same rotating drive element such that the user is able to independently move each curtain.

BACKGROUND OF THE INVENTION

Window coverings, such as curtains, are frequently used to provide privacy and to limit the amount of light that is permitted to pass through a window and into a room.

There are numerous types of window coverings known in the art. Curtains can be composed of panel(s) of fabric. For example, a curtain may be a single panel curtain that opens and closes from left to right. There is also a center closing curtain that is composed of two fabric panels that meet in the center of the window to close and cover the window.

Many different types of fabrics may be used depending on the user's needs and preferences. For example, sometimes it is necessary not only to cover but to also fully black-out the window such that no light passes through. In this instance, a blackout curtain composed of opaque fabric that completely darkens the window may be useful. There may also be other situations, however, where some light is desired and some visibility is desired. A sheer curtain composed of a translucent fabric may be useful in this instance.

The curtain panels are attached to and suspended from a transverse curtain rod that is hung above the window. The panels are usually joined to the curtain rod by hooks or rings. The curtains are able to be moved manually across the curtain rod(s) as desired by a pull rod or the like to either cover or uncover the window.

There are various mechanisms, both electrical and manual, to mechanically move a curtain back and forth across an opening. Typical designs use a curtain guide track where the curtains are suspended. Some curtain assemblies use a series of pulleys, cables, and belts to move the curtain. In some cases these mechanisms are motorized. In these cases, the number of components used adds complexity to the assembly and also increases the cost of the assembly.

Many different types of fabrics may be used depending on the user's needs and preferences. For example, some-times it is preferred to not only cover but to also fully blackout the window such that no light passes through. In this instance, a blackout curtain composed of opaque fabric that completely darkens the window may be useful. There may also be other situations, however, where some light is desired and some visibility is desired. A sheer curtain composed of a translucent fabric may be useful in this instance.

A sheer curtain is often hung with a blackout curtain on the same window to accommodate different preferences for light and visibility at different times. For example, a blackout curtain may be used to block out unwanted early morning sun. The blackout curtain may then be opened to allow the sun to filter through the sheer curtain later in the day. When a blackout curtain is hung with a sheer curtain, utility bills may also be lowered by using the different curtains to keep a home cool or warm, depending on the weather.

Hanging two different curtains, however, requires the installation of two different curtain guide tracks, one guide track for each curtain. If two curtains are hung from the same curtain guide track, there is not the ability to move one curtain without moving the other curtain and it prevents both curtains from being in the deployed position simultaneously.

Therefore, it would be advantageous to have a simple curtain assembly that will move a curtain from the deployed position to the stored position with the minimum number of components that can be motorized as well as manually operated. It would further be advantageous to have a dual curtain assembly that will move two separate curtains.

SUMMARY OF THE INVENTION

Embodiments of the present invention relate to a window covering assembly. For convenience, various embodiments will be described with respect to curtains with the understanding that the description applies to other window coverings as well. Embodiments of the curtain assembly include a drive element wherein at least one guide structure is formed on or into the outer surface of the drive element; a drive attachment element having a corresponding structure that communicates with the at least one guide structure to move the drive attachment element axially along the drive element when the drive element is rotated; and a rotation assembly for rotating the drive element. In some embodiments of the invention, the guide structure forms a helical pattern on the rotatable drive element and the corresponding structure is a tooth that is moved by the groove when the drive element is rotated. The guide structure can also be a ridge or other structure that can cause the corresponding structure to move axially along the drive element when the drive rotates.

In specific embodiments the drive element can be a tube.

In specific embodiments according to the present invention, the curtain assembly includes a rotatable drive element having a clockwise helical guide structure and a counter clockwise helical guide structure formed on, or into, the outer surface of the drive element; a first drive attachment element having a structure that communicates with the clock-wise helical guide structure to move the drive attachment element axially along the drive element when the drive element is rotated; and a second drive attachment element having a structure that communicates with the counterclockwise helical guide structure to move the drive attachment element axially along the drive element when the drive element is rotated; and a rotation assembly for rotating the drive element.

In accordance with some embodiments of the present invention, a dual curtain assembly is provided. A specific embodiment of dual curtain assembly includes a rotatable drive element having at least one guide structure formed on, or into, the outer surface of the drive element; at least two drive attachment elements having a corresponding at least two structures that communicate with the at least one guide structure to move the at least two drive attachment elements axially along the drive element when the drive tube is rotated Further specific embodiments can also incorporate a rotation assembly for rotating the drive element. The rotation assembly can be manual or motorized.

In accordance with some embodiments of the invention, a dual curtain assembly includes a drive element having at least one guide structure formed on, or into, the outer surface of the drive element; at least one outer drive attachment element having a corresponding at least one outer structure that communicates with the at least one guide structure to move the at least one drive attachment element axially along the drive element when the drive element is rotated; at least one inner drive attachment element having a corresponding at least one feature that communicates with the at least one guide structure to move the at least one inner drive attachment element axially along the drive element when the drive element is rotated; and a rotation assembly for rotating the drive element.

In accordance with yet other embodiments of the invention, applicable, for example, to a center closing curtain system, the curtain assembly may include a drive element having at least one guide structure formed on, or into, the outer surface of the drive element; a left outer drive attachment element having a corresponding left outer structure that communicates with the at least one guide structure to move the left outer drive attachment element axially along the drive element when the drive element rotates; a right outer drive attachment element having a right outer structure that communicates with the at least one guide structure to move the right outer drive attachment element axially along the drive element when the drive element rotates; a left inner drive attachment element having a corresponding left inner structure that communicates with the at least one guide structure to move the left inner drive attachment element axially along the drive element when the drive element is rotated; a right inner drive attachment element having a corresponding right inner structure that communicates with the at least one guide structure to move the right inner drive attachment element axially along the drive element when the drive element is rotated; and a rotation assembly for rotating the drive element, wherein the rotation of the drive element moves the left and right outer drive attachment elements axially along the drive element when the drive element is rotated and independently moves the left and right inner drive attachment elements along the drive element when the drive element is rotated.

These features and aspects of the invention as well as its advantages are understood by referring to the following description, appended claims, and accompanying drawings, in which:

Figure 17:
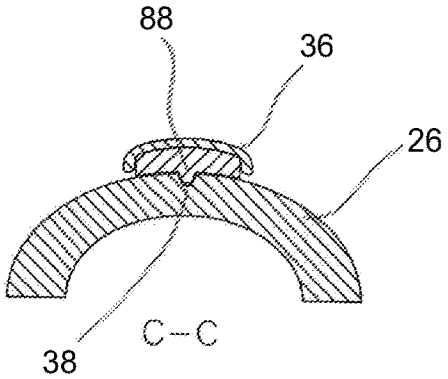

FIG. 17 is a section view of the tube 26 and the drive attachment element 36 showing the engagement of the first drive tooth 88 in the first helical groove 38.

Figure 18:
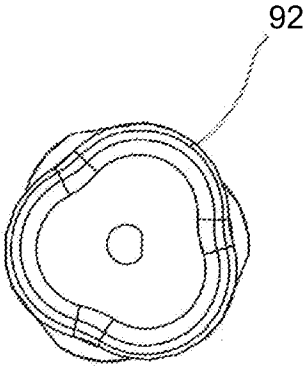

FIG. 18 is an enlarged end view of a motor drive adapter according to one embodiment of the curtain assembly.

Figure 19:
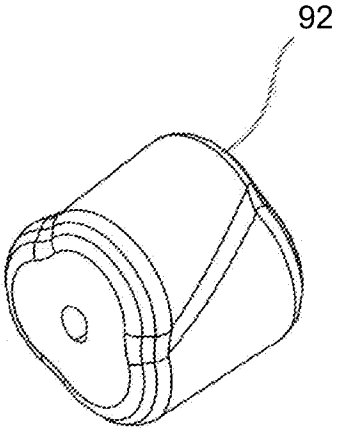

FIG. 19 is an enlarged perspective view of a motor drive adapter according to one embodiment of the curtain assembly.

Figure 20:
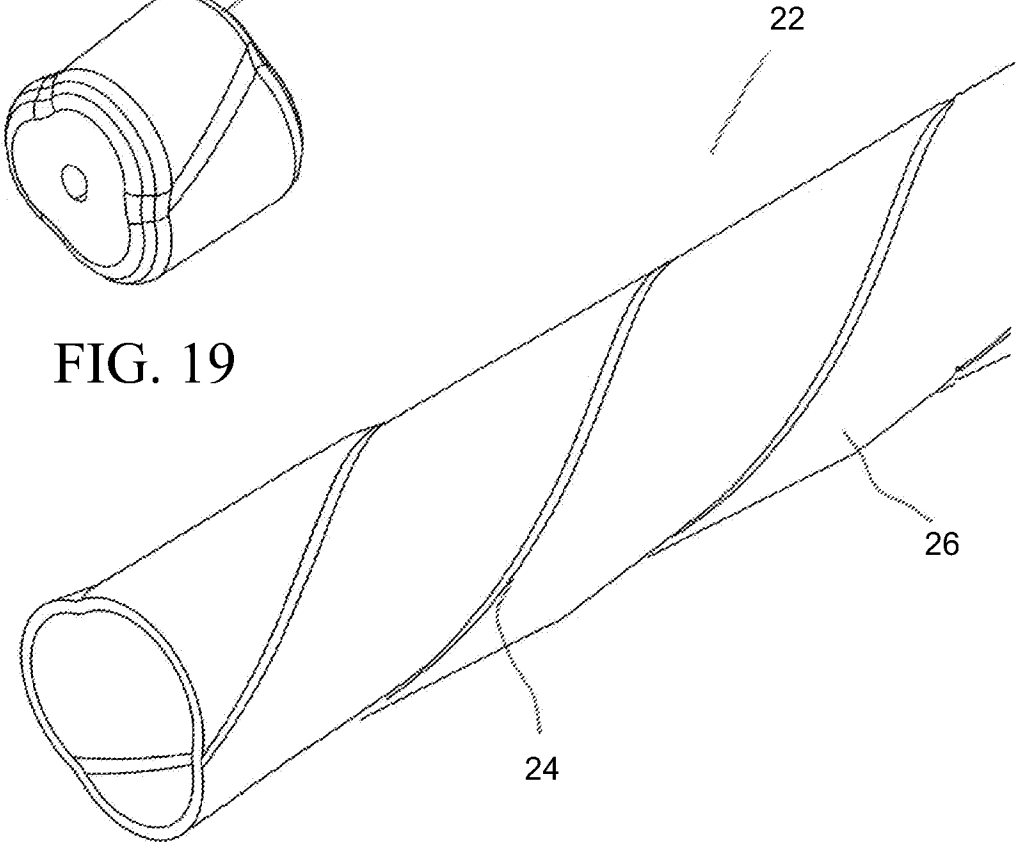

FIG. 20 is an enlarged perspective view of the rotatable drive element according to one embodiment.

Figure 21:
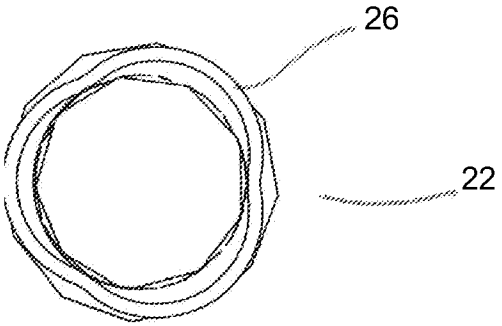

FIG. 21 is an enlarged end view of the rotatable drive element according to one embodiment.

FIG. 22 is an enlarged perspective view of the preferred tube embodiment with the position a section was taken to reflect the two clockwise helical grooves 38 and two counter clockwise grooves 40 in the tube 26.

FIG. 23 is an end view of the drive element assembly of the preferred embodiment showing the starting points of the clockwise helical grooves 38 and the counter clockwise grooves 40.

FIG. 24 is the cross section view taken from FIG. 22.

Figure 25:
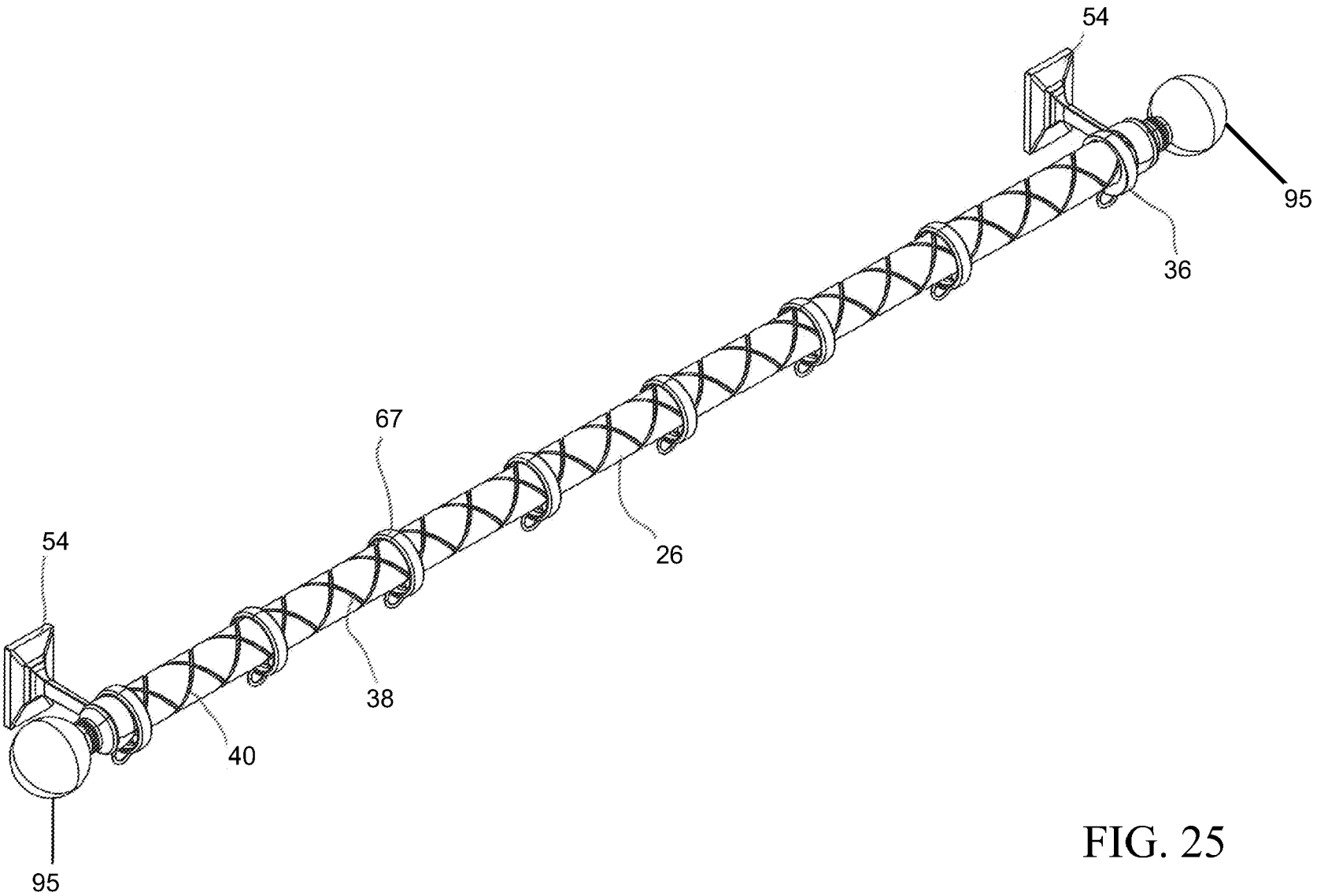

FIG. 25 is the preferred embodiment curtain assembly.

Figure 26:
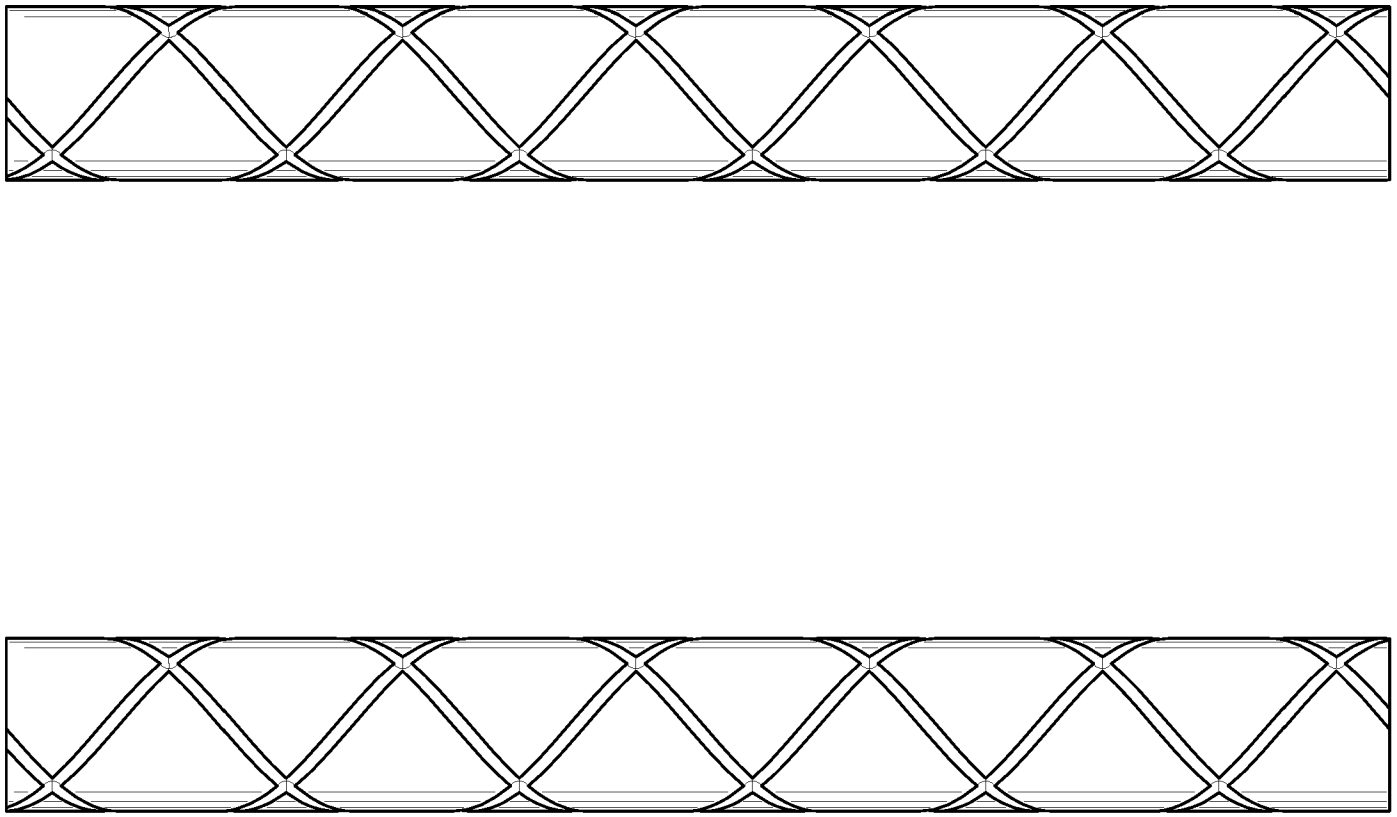

FIG. 26 is a drawing of the functional relationship of the helical grooves 38 and 40 to the midpoint of the drive element to assure the drive attachment elements meet in the midpoint of the drive element on center close draperies.

Figure 27:
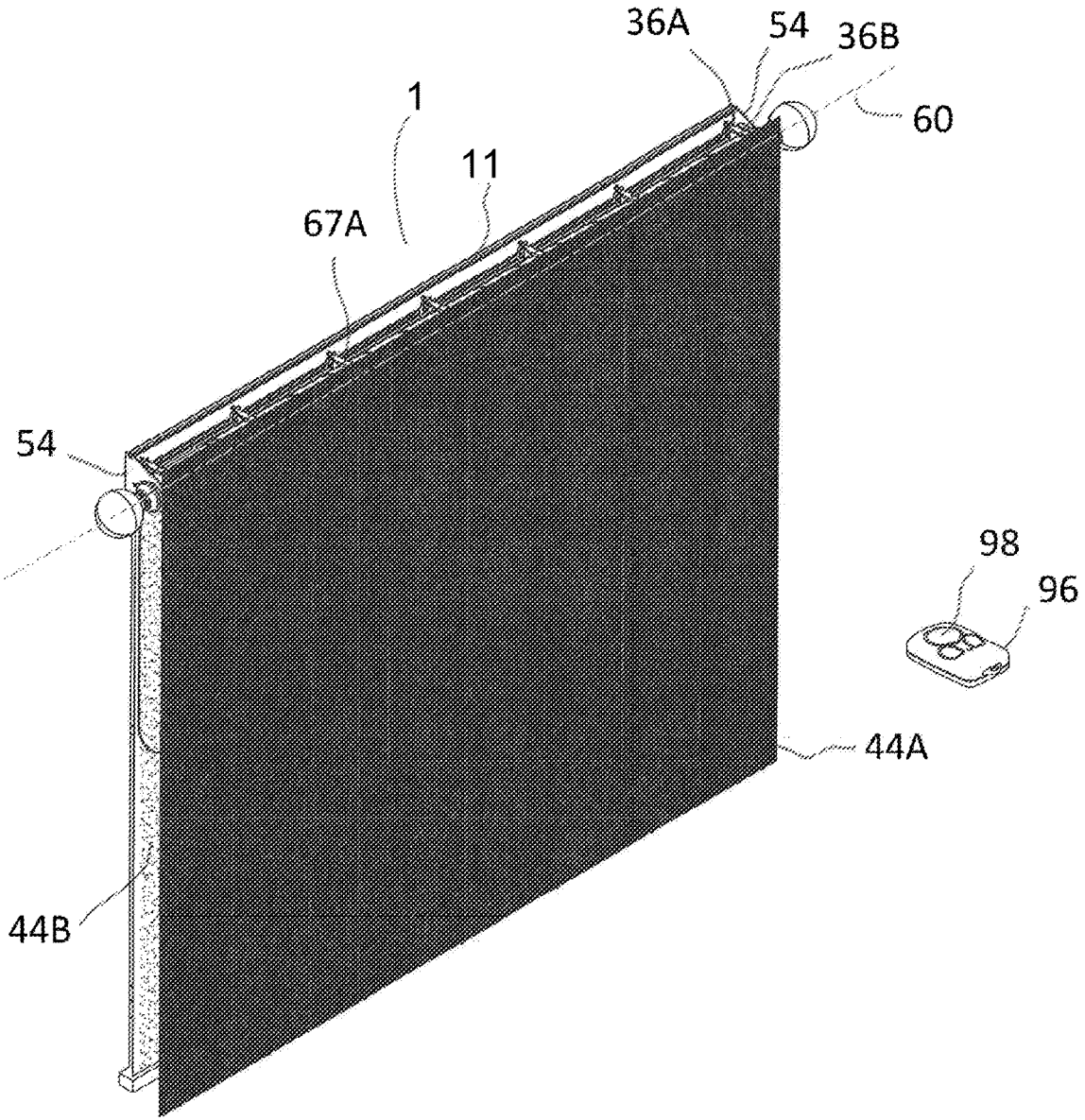

FIG. 27 is a perspective view of one embodiment of the curtain assembly when the outer curtain is a blackout curtain in the deployed position and the inner curtain is a sheer curtain in the deployed position.

Figure 28:
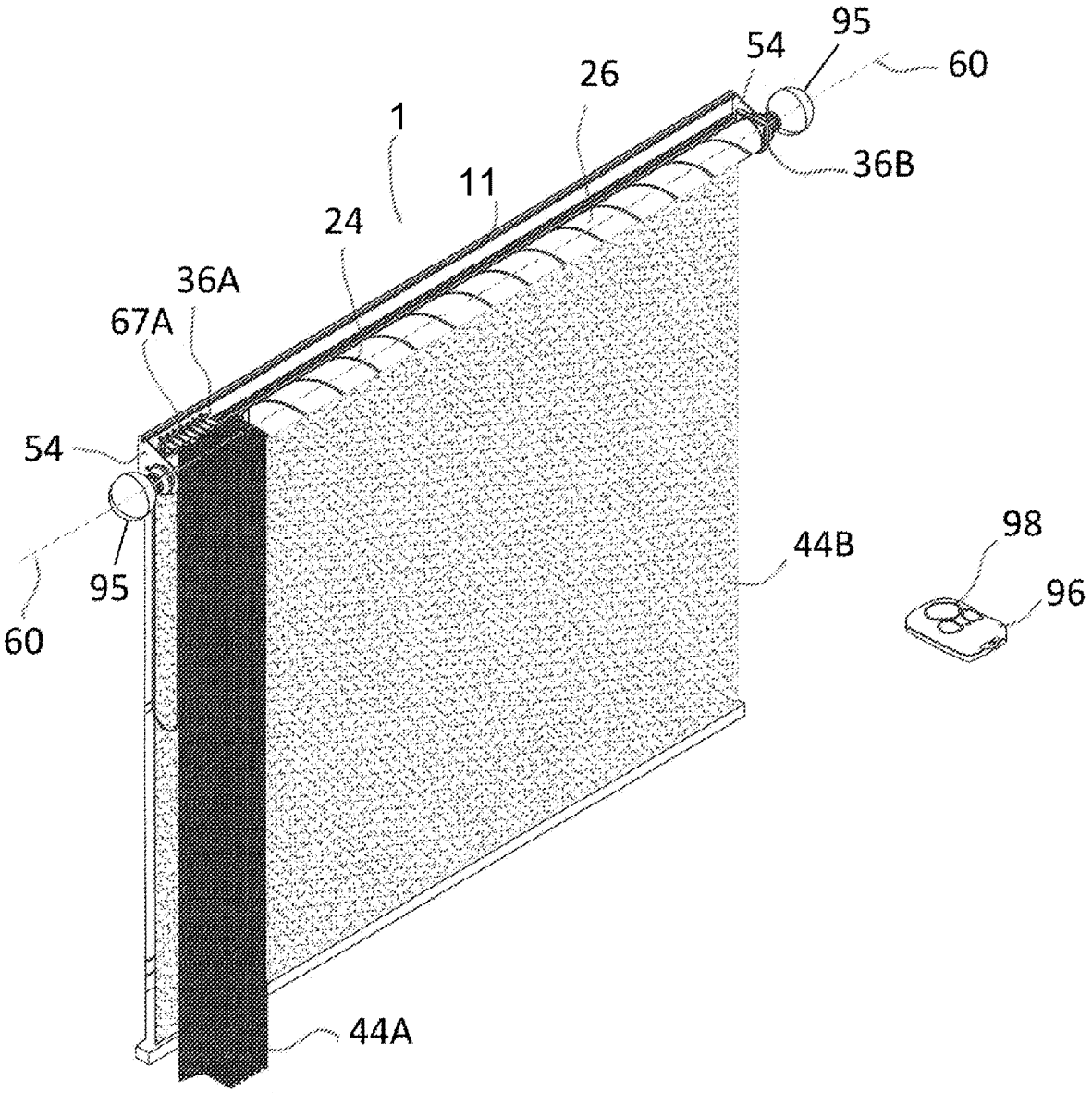

FIG. 28 is a perspective view of one embodiment of the curtain assembly when the outer curtain is a blackout curtain in the stored position and the inner curtain is a sheer curtain in the deployed position.

Figure 29:
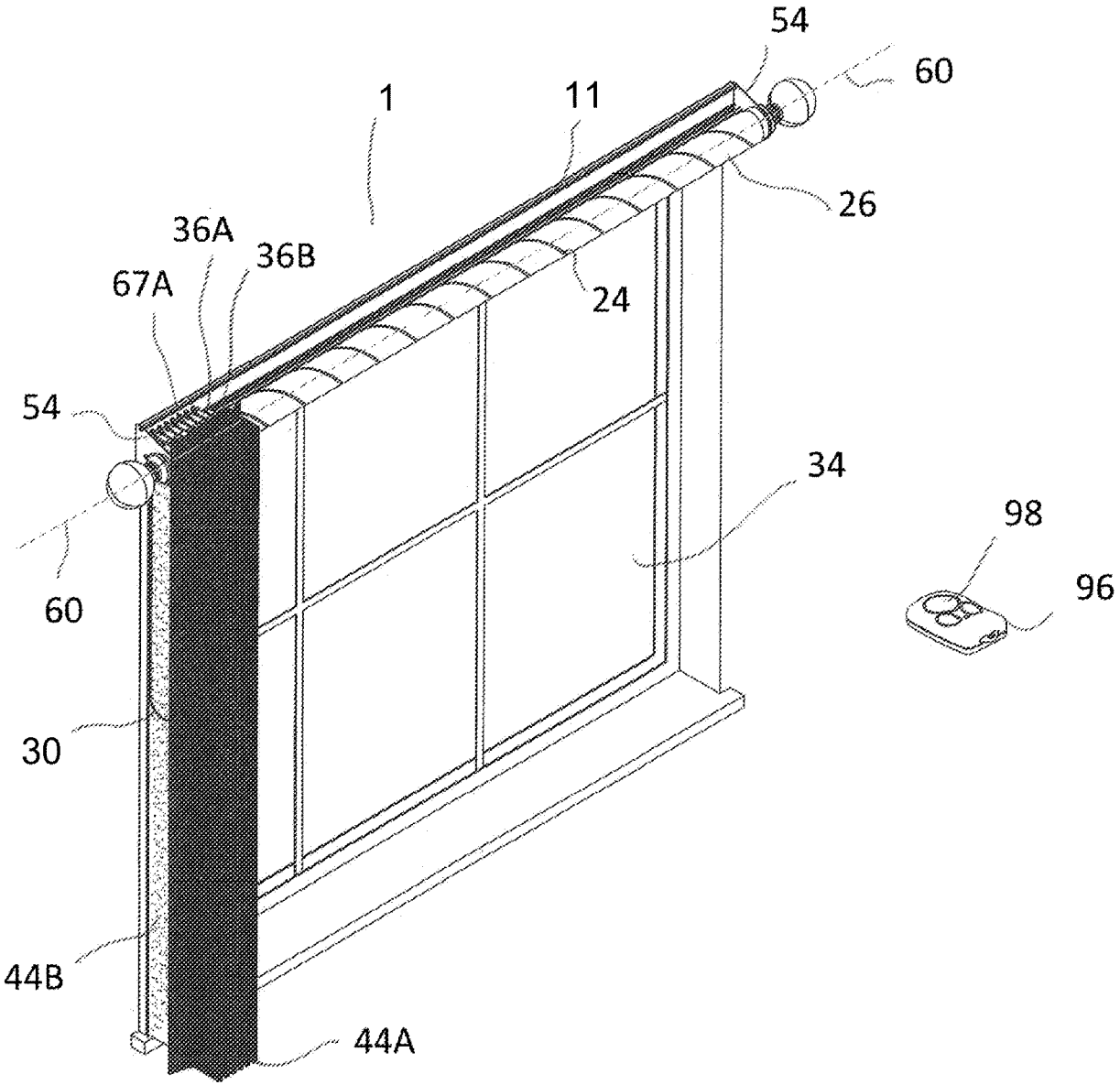

FIG. 29 is a perspective view of the embodiment of the curtain assembly when both the outer and inner curtains are in the stored position.

Figure 6:
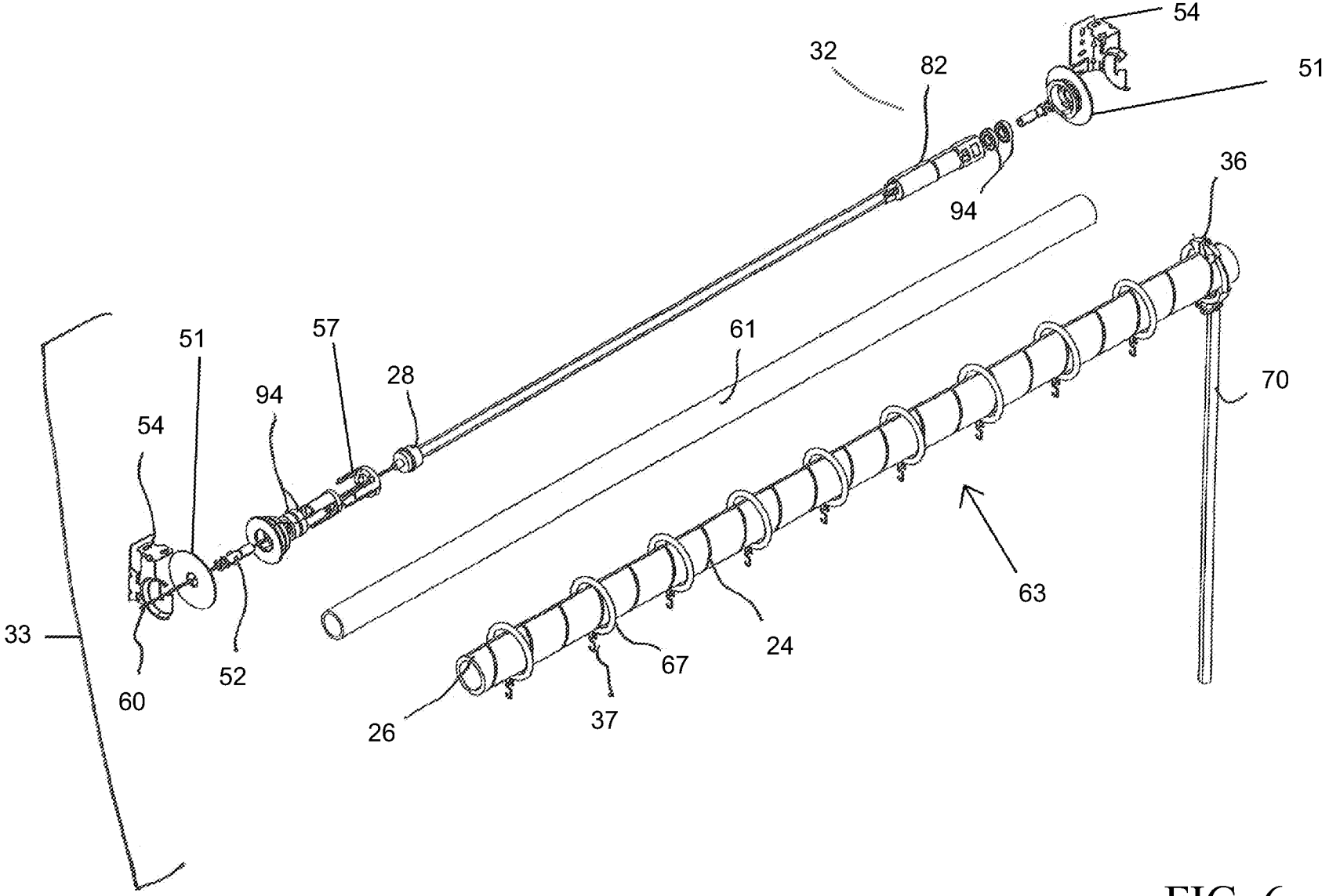
FIG. 6 is an enlarged perspective view of the components of the rotatable drive element according to one embodiment of the curtain assembly in which the power supply to the motor is external to the drive element.
Figure 30:
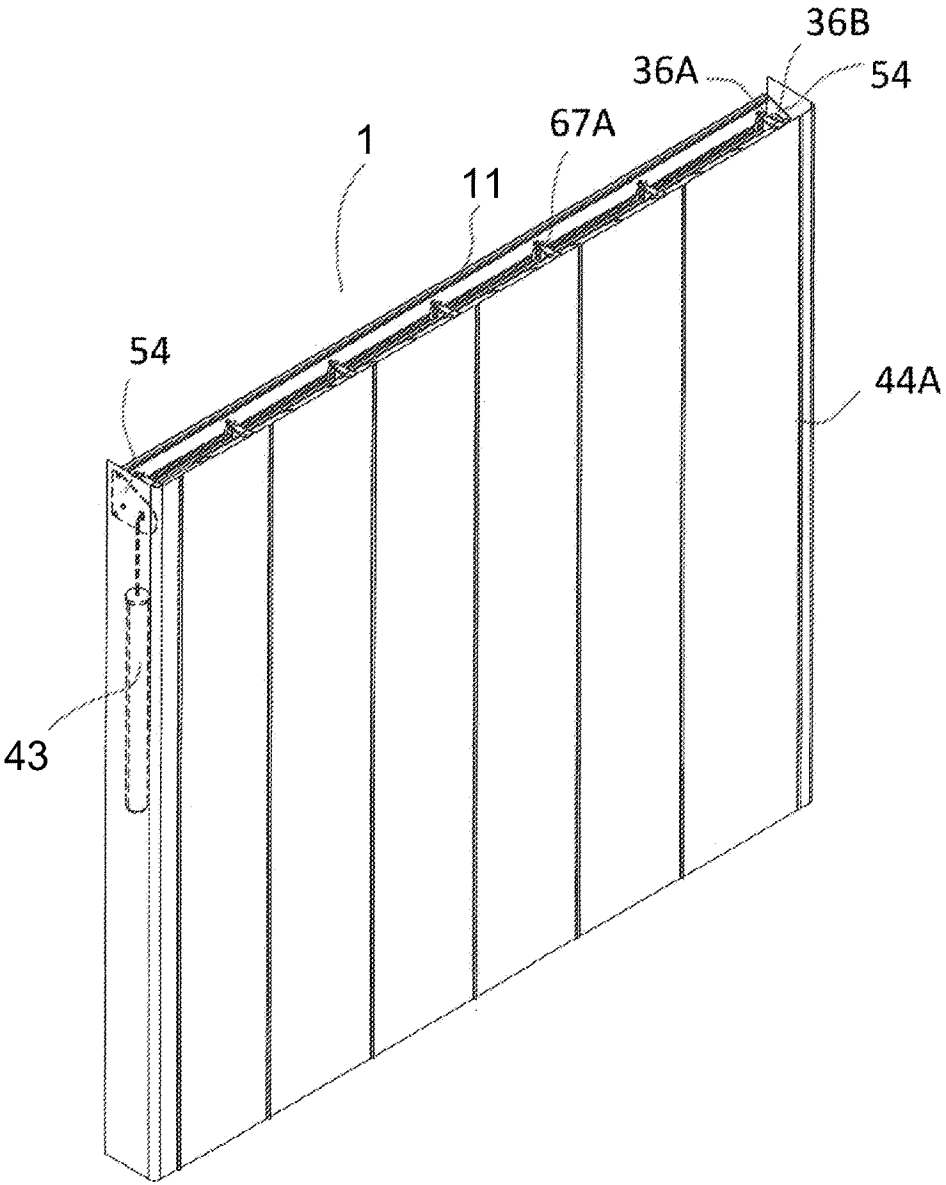

FIG. 30 is a perspective view of the preferred embodiment with the outer curtain is a blackout curtain with a portion cut away to show the position of the external battery pack from FIG. 6.

Figure 31:
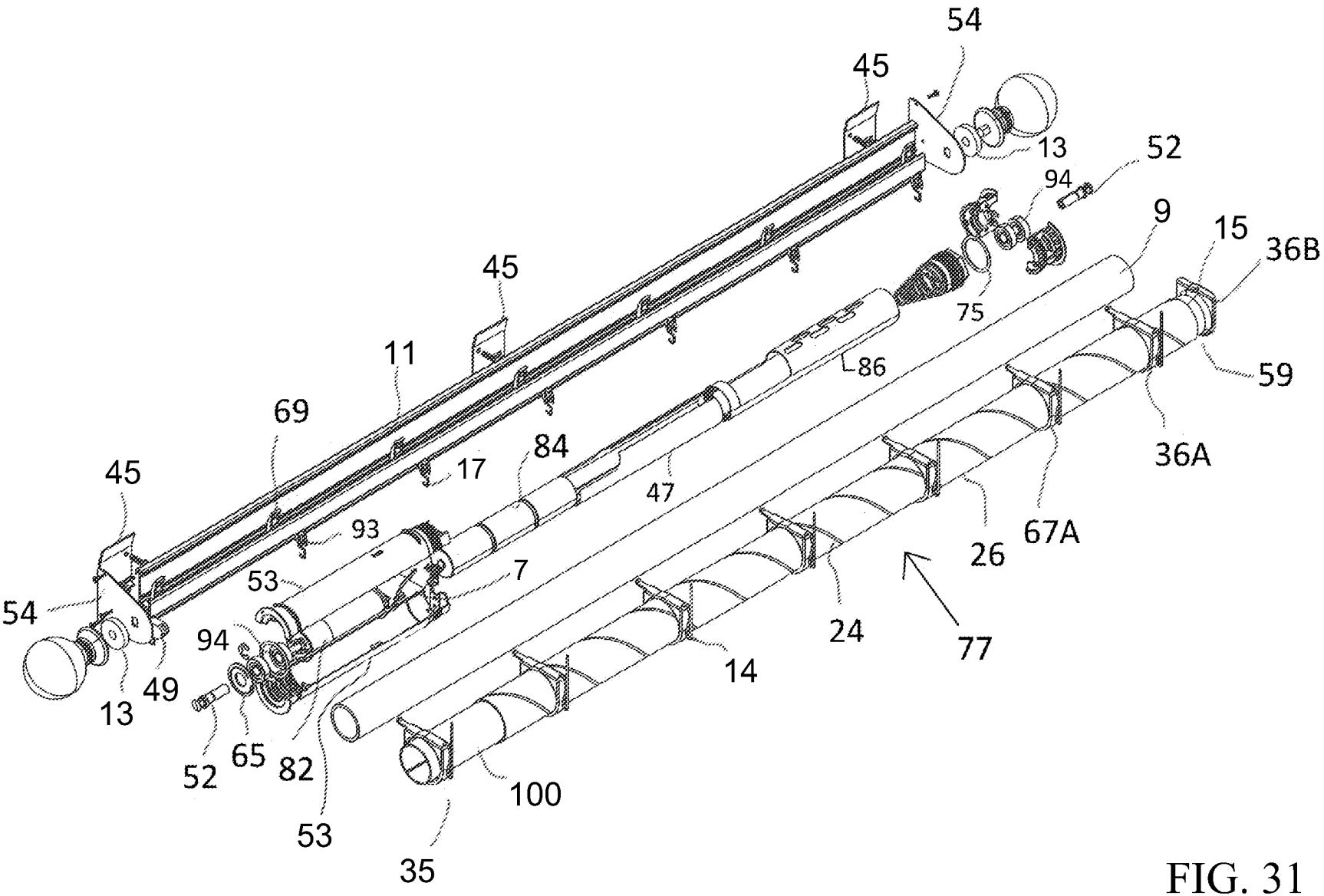

FIG. 31 is an enlarged perspective view of the components of the rotatable drive element according to one embodiment of the curtain assembly showing an internal battery power supply.

Figure 32:
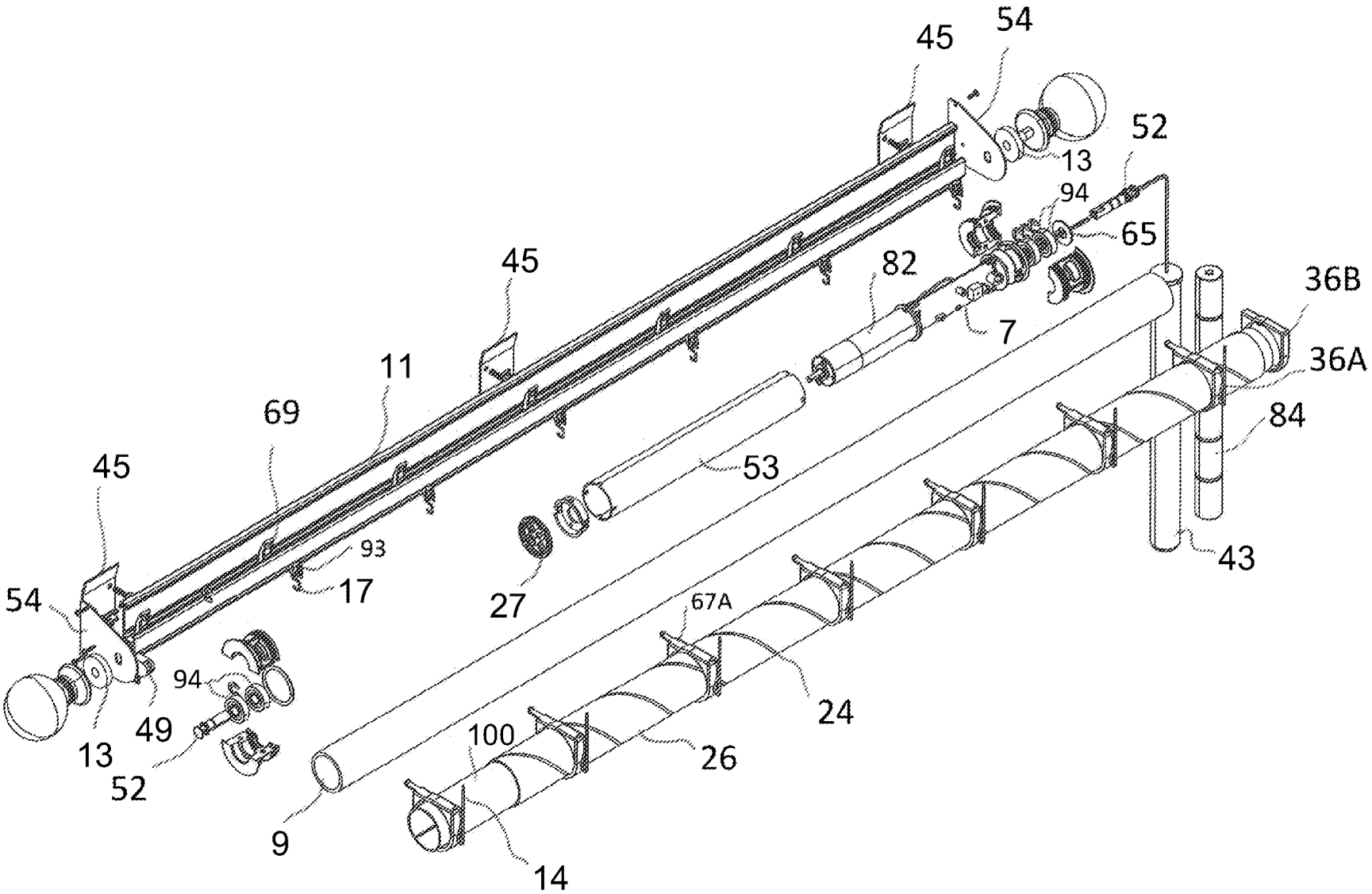

FIG. 32 is an enlarged perspective view of the components of the rotatable drive element according to one embodiment of the curtain assembly show an external power supply.

Figure 33:
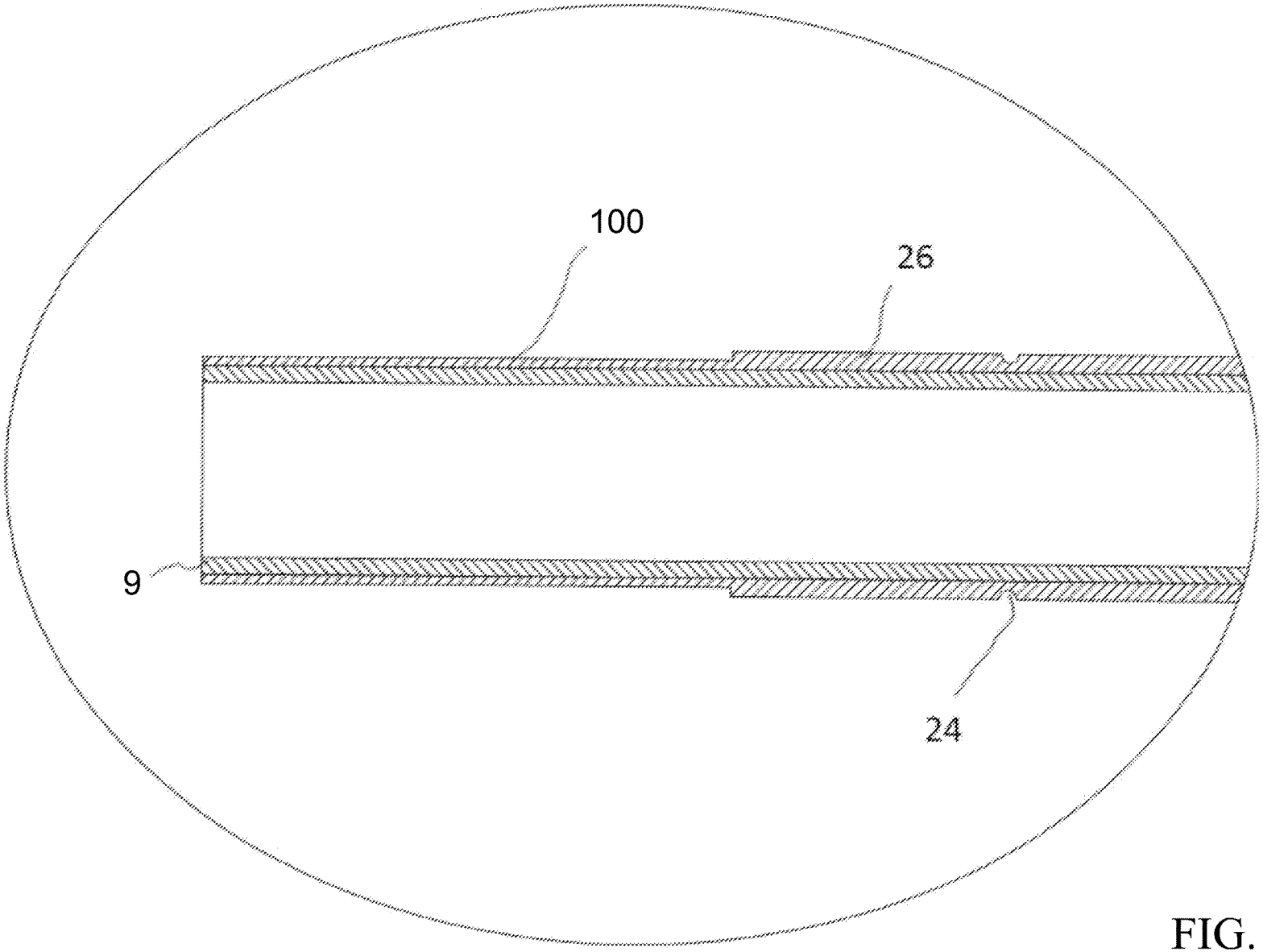

FIG. 33 is a cross-sectional view of the drive section of the rotatable drive element showing the helical groove and a non-driving groove according to one embodiment of the curtain assembly.

Figure 34:
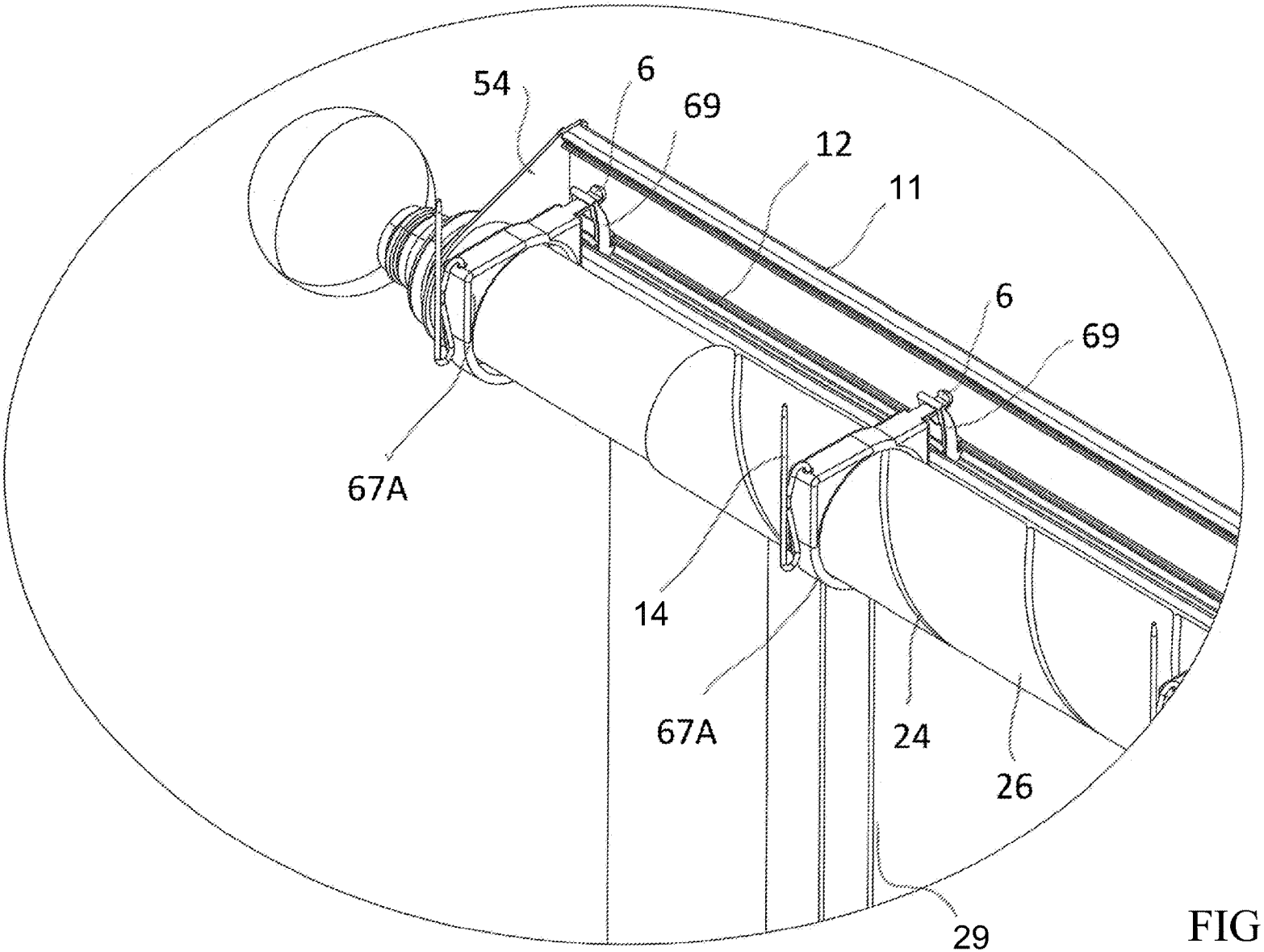

FIG. 34 is an enlarged perspective view of one embodiment of the curtain assembly non-driving groove.

Figure 35:
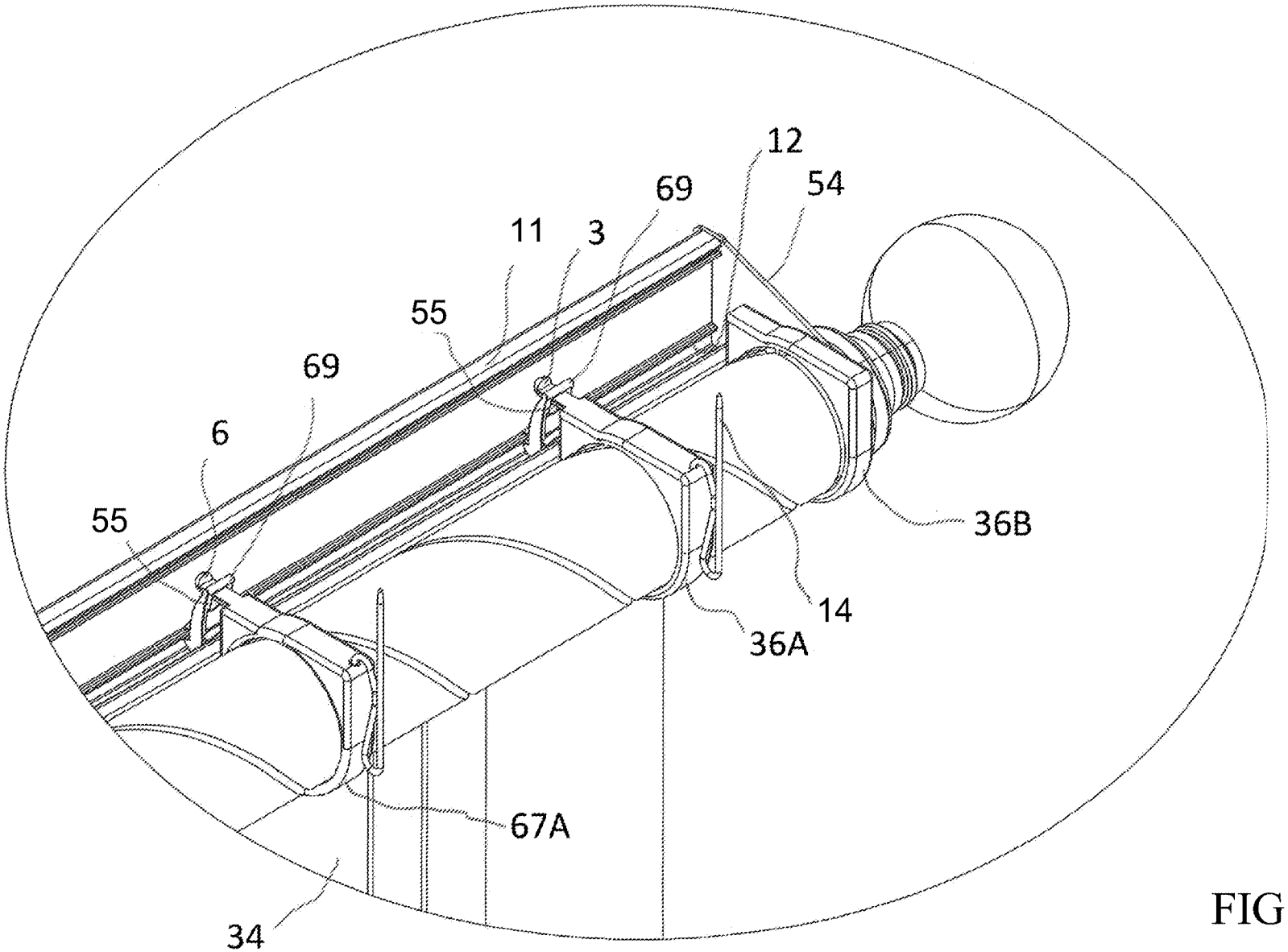

FIG. 35 is an enlarged perspective view of one distal end of the rotatable drive element showing the inner drive attachment element and the inner driver stall area according to the same embodiment of the curtain assembly shown in FIG. 34.

Figure 36:
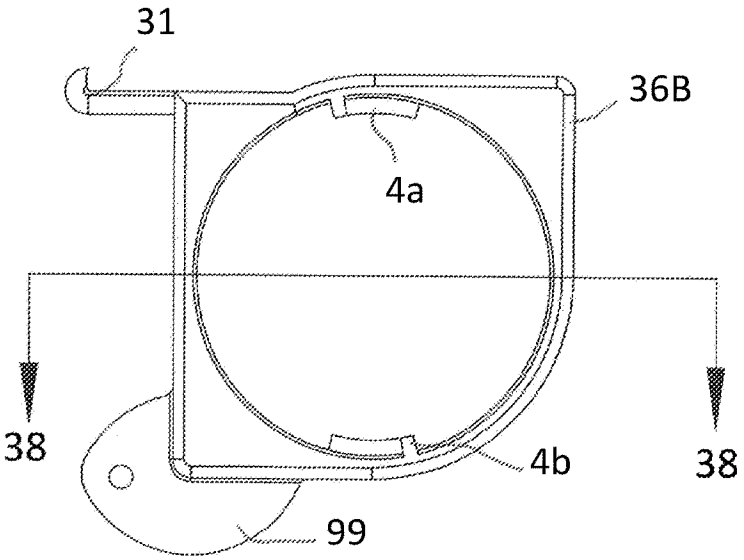

FIG. 36 is an enlarged side view of the inner drive attachment element according to one embodiment of the curtain assembly.

Figure 37:
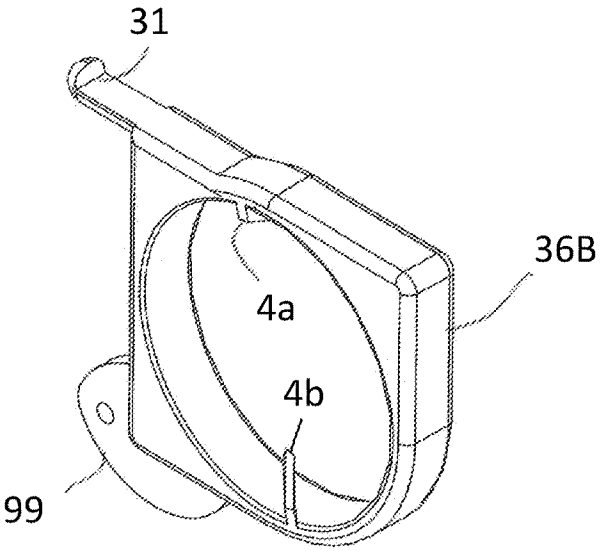

FIG. 37 is an enlarged perspective view of the inner drive attachment element according to one embodiment of the curtain assembly.

Figure 38:
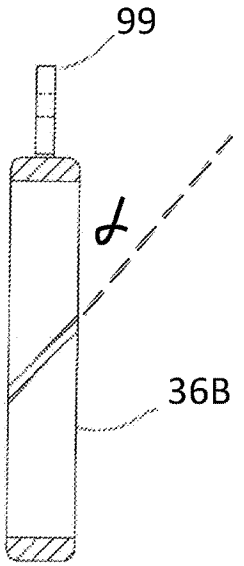

FIG. 38 is an enlarged sectioned view of the inner drive attachment element according to one embodiment of the curtain assembly.

Figure 39:
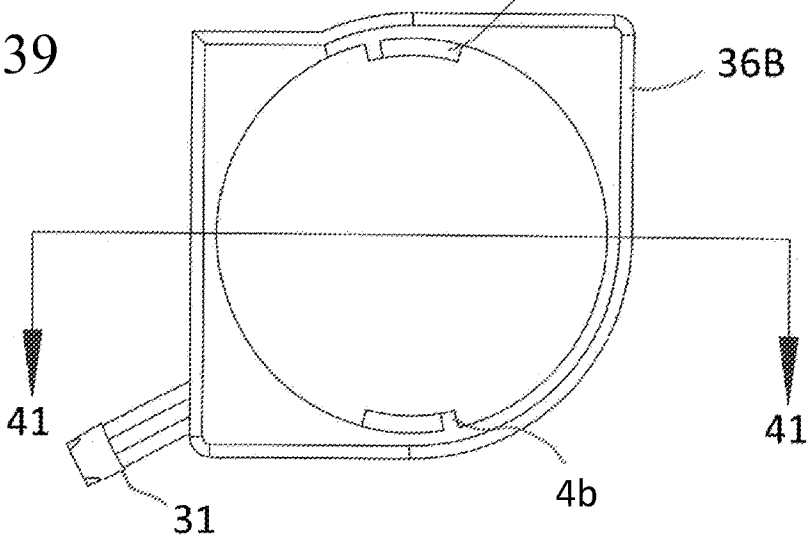

FIG. 39 is an enlarged side view of the inner drive attachment element according to one embodiment of the curtain assembly.

Figure 40:
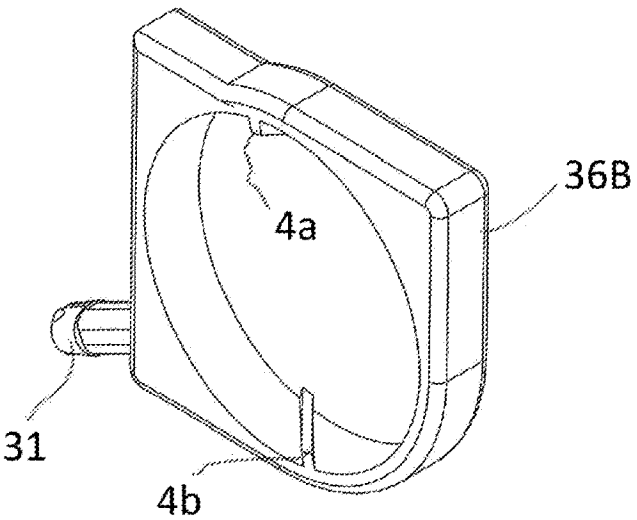

FIG. 40 is an enlarged perspective view of the inner drive attachment element according to one embodiment of the curtain assembly.

Figure 41:
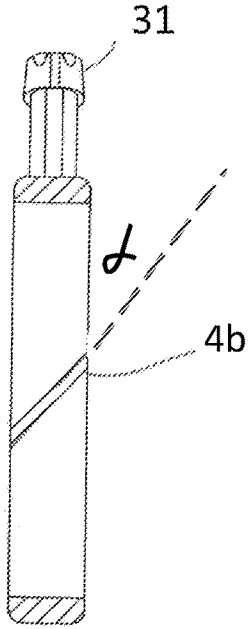
Figure 42:
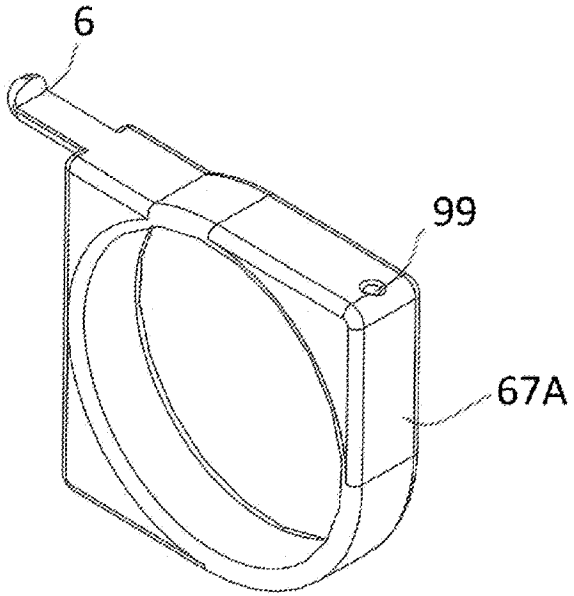

FIG. 41 is an enlarged sectioned view of the inner drive attachment element according to one embodiment of the curtain assembly FIG. 42 is an enlarged perspective view of an outer idler attachment element according to one embodiment of the curtain assembly.

Figure 43:
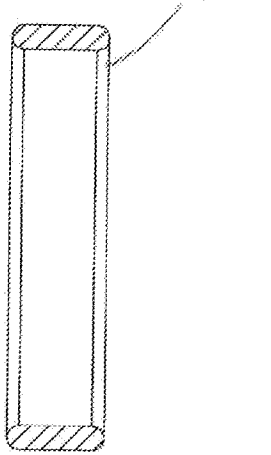

FIG. 43 is an enlarged sectioned view of an outer idler attachment element according to one embodiment of the curtain assembly.

Figure 44:
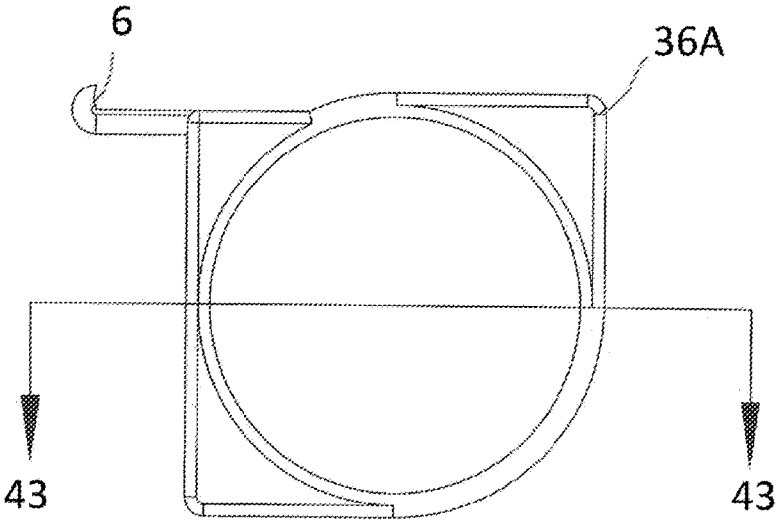

FIG. 44 is an enlarged side view of an outer idler attachment element according to one embodiment of the curtain assembly.

Figure 46:
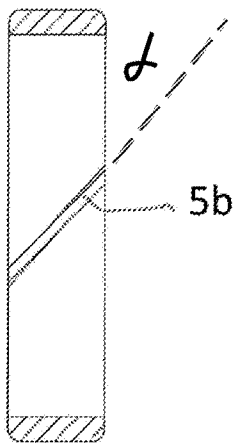
Figure 45:
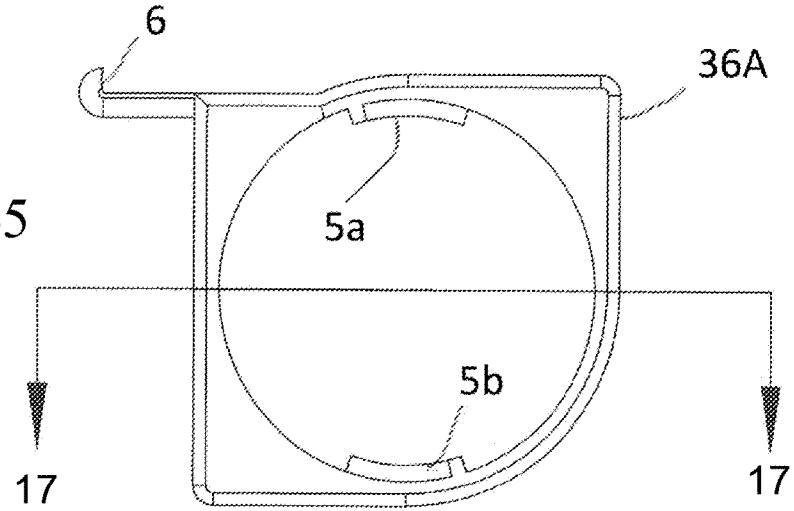

FIG. 45 is an enlarged side view of an outer drive attachment element according to one embodiment of the curtain assembly FIG. 46 is an enlarged sectioned view of an outer drive attachment element according to one embodiment of the curtain assembly.

Figure 47:
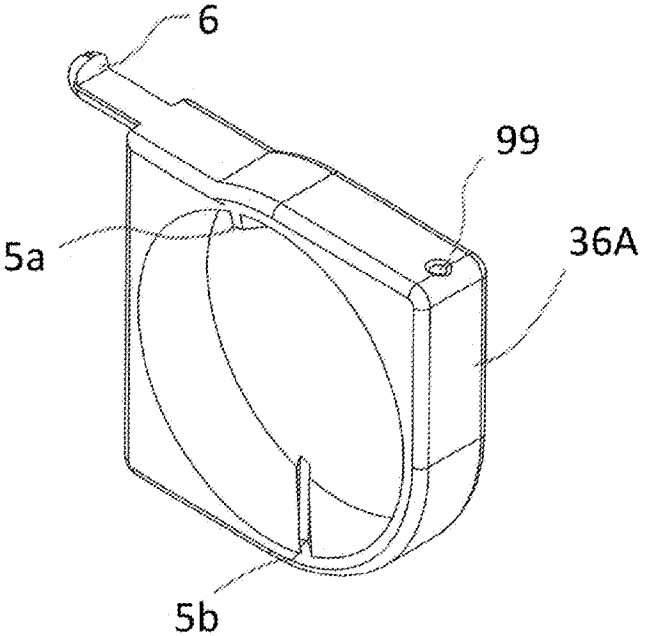

FIG. 47 is an enlarged perspective view of an outer drive attachment element according to one embodiment of the curtain assembly.

Figure 48:
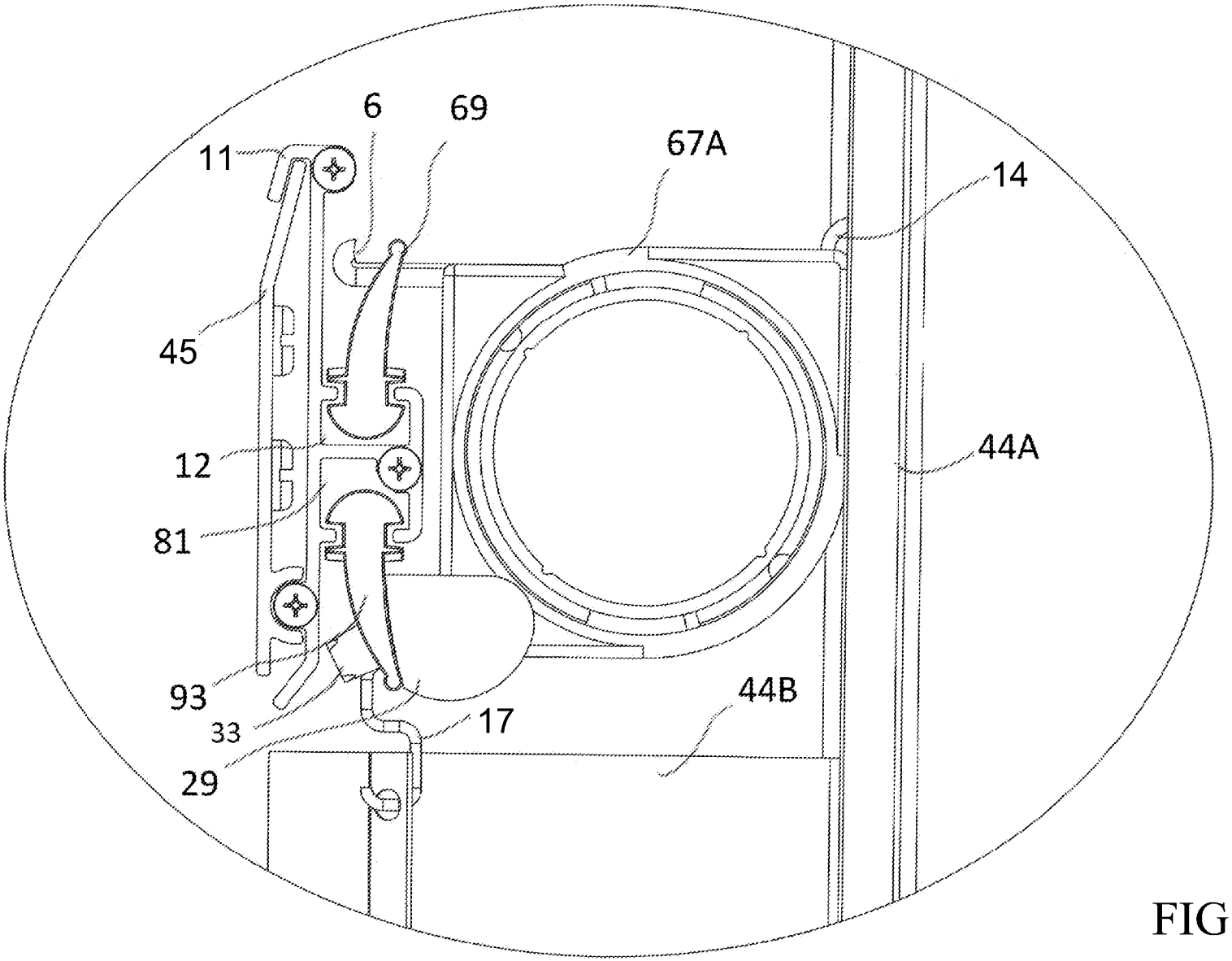

FIG. 48 is an end view of the curtain assembly showing the guide track, guides, attachment elements, and the position of the inter-curtain engager.

Figure 49:
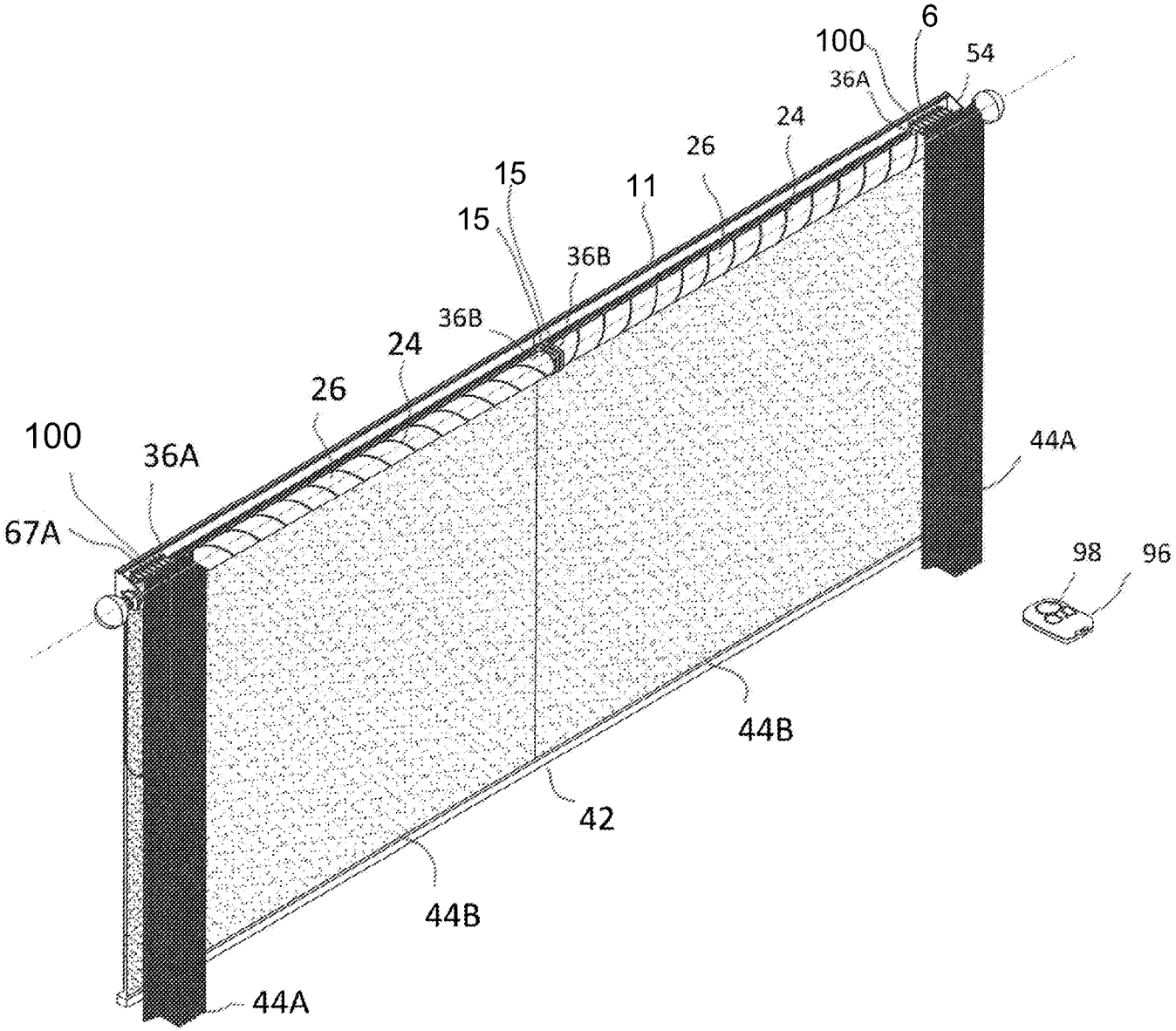
Figure 50:
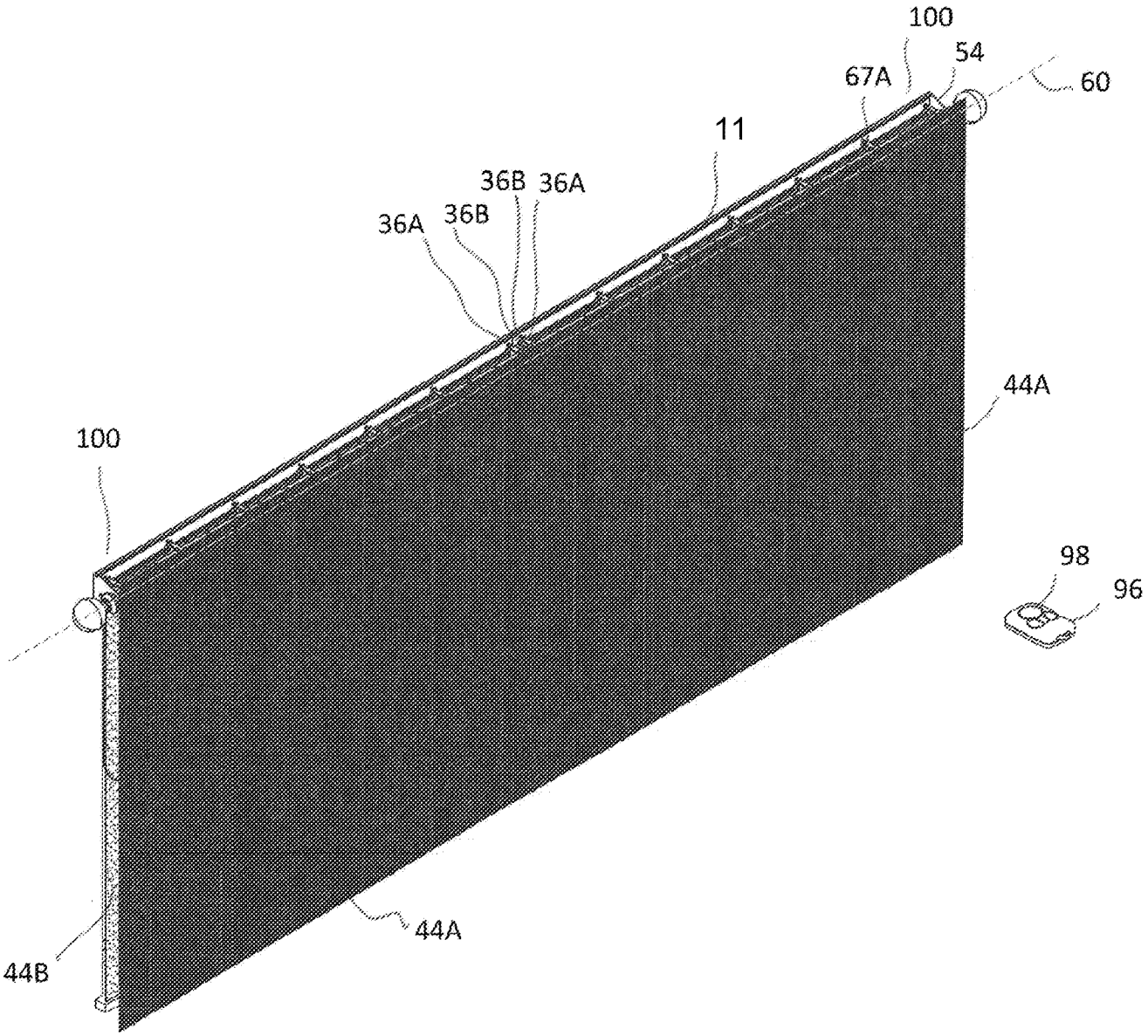

FIG. 49 is a is a perspective view of a curtain assembly according to one embodiment when the outer curtains are center closing blackout curtains in the stored position and the inner curtains are center closing sheer curtains in the deployed position FIG. 50 is a perspective view of a curtain assembly according to one embodiment when the outer curtains are center closing blackout curtains in the deployed position and the inner curtains are center closing sheer curtains in the stored position.

Figure 51:
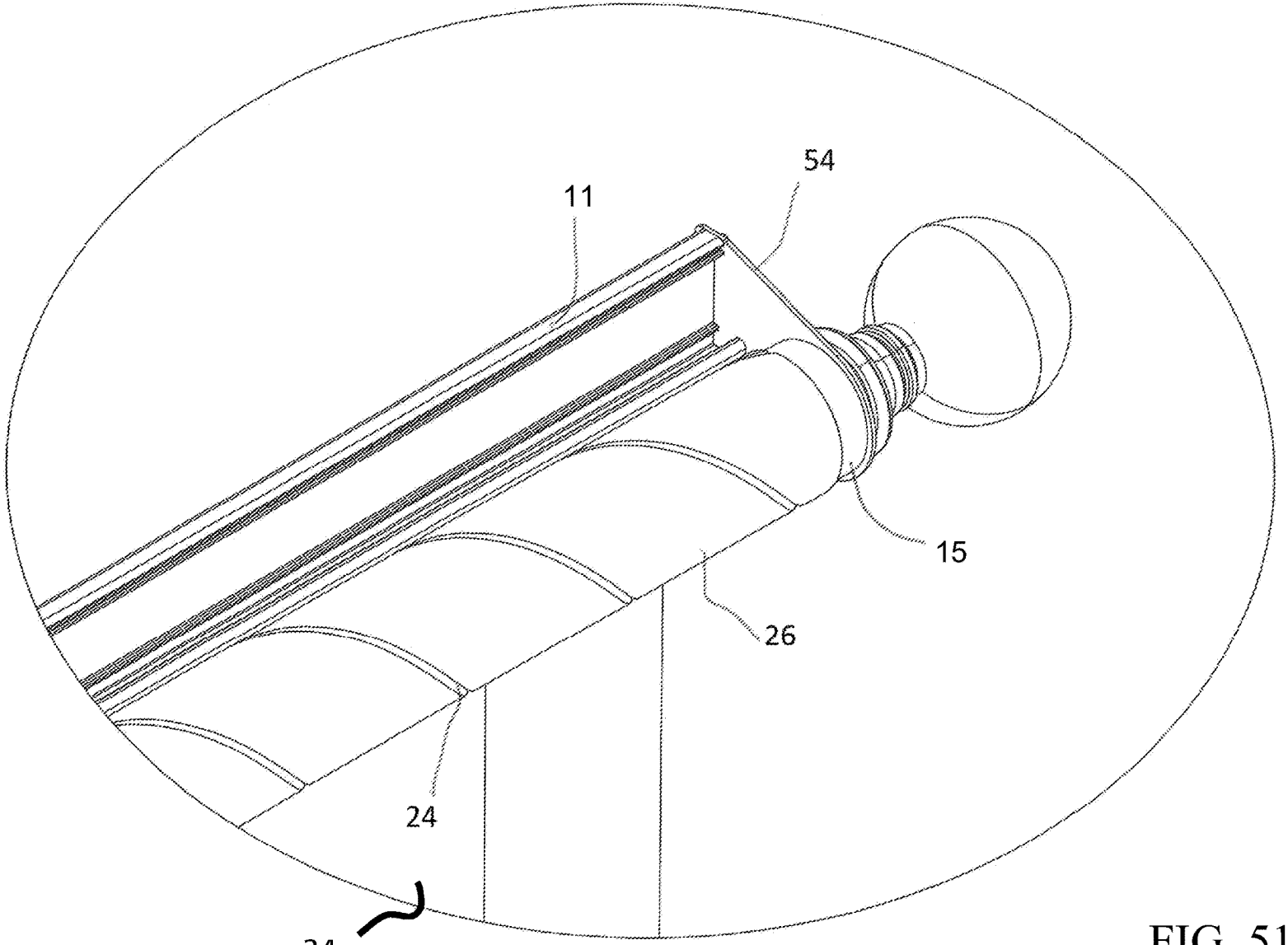

FIG. 51 is a perspective view of the tube end with the inner driver stall area.

Figure 52:
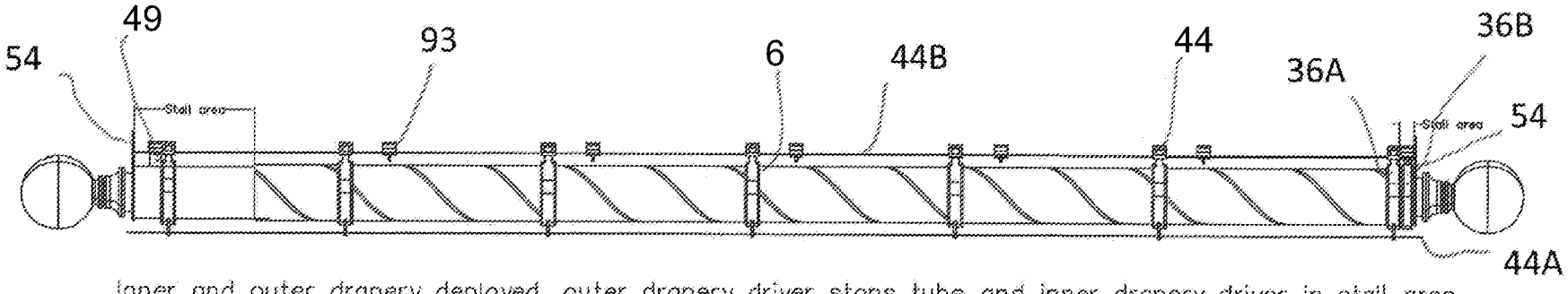

FIG. 52 is a top view of the curtain assembly with the guide track removed to see the position of the guides and attachment elements with the inner and outer curtains deployed and the outer drive attachment element can stop the tube from rotation when it stalls against the inner attachment element in the stall area.

Figure 53:
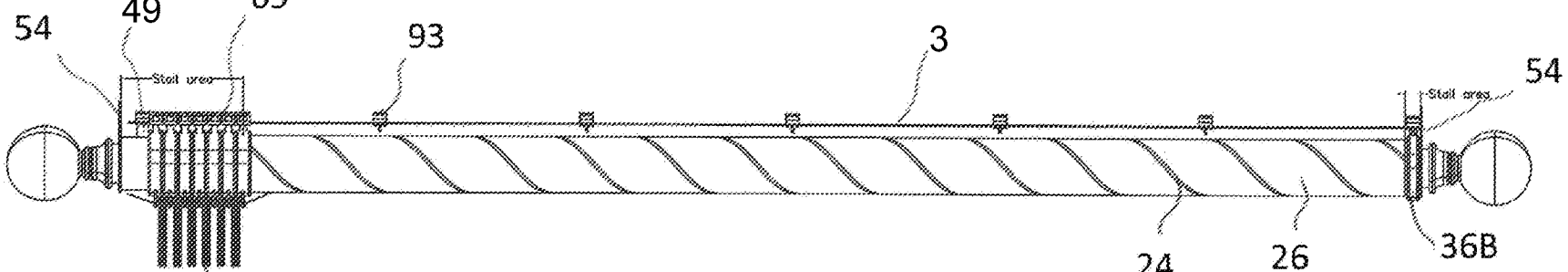

FIG. 53 is a top view of the curtain assembly with the guide track removed to see the position of the guides and attachment elements with the inner curtains deployed and the inter-curtain engager is in the engage-outer-drive-attachment-element position and the inner drive attachment element is in the stall area.

Figure 54:
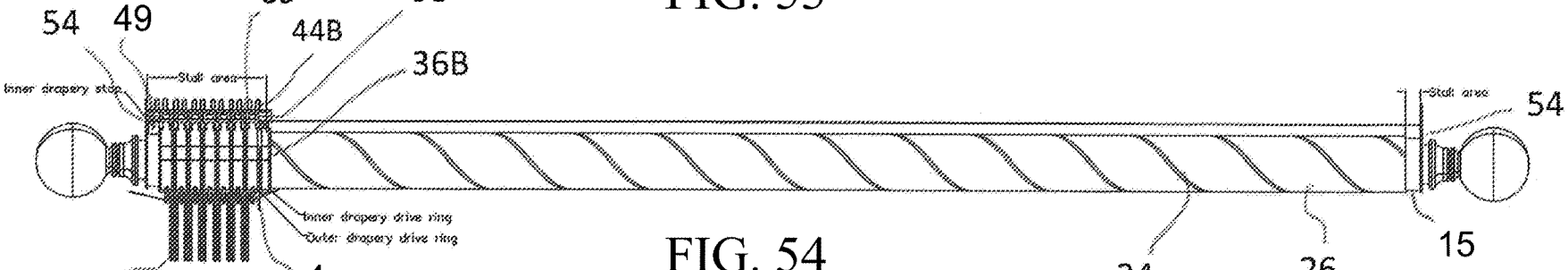

FIG. 54 is a top view of the curtain assembly with the guide track removed to see the position of the guides and attachment elements with the inner and outer curtains in the stored position and the outer simple attachment elements and the outer drive attachment element are in the non-driving or stall area. The inner curtain drive attachment element can stop the tube from rotation when it contacts the outer curtain drive attachment element.

Figure 55:
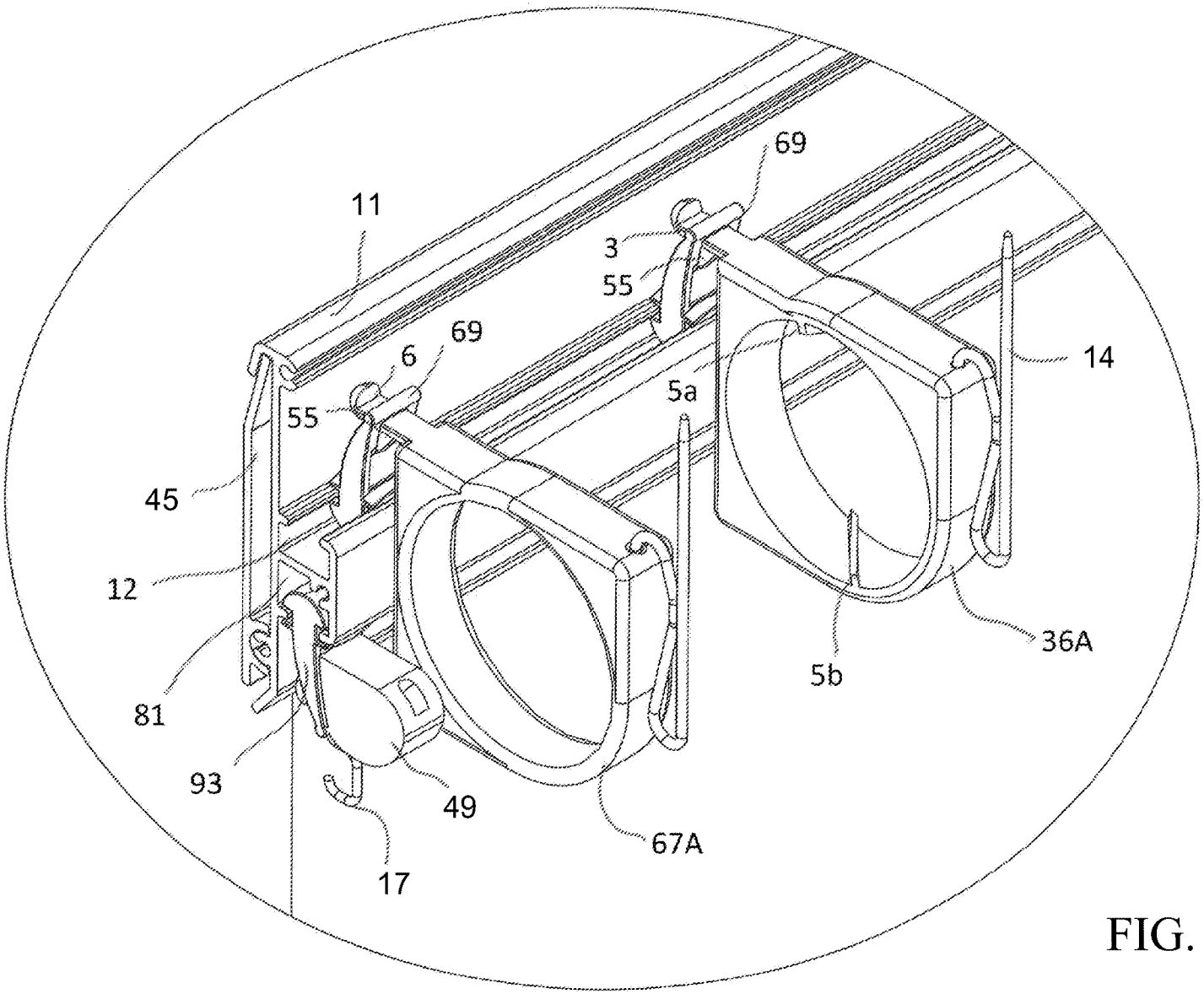

FIG. 55 is a perspective view of the area where the outer attachments are stored with the tube, inner and outer curtains removed to show the position of the inter-curtain engager and the carrier tracks.

Figure 56:
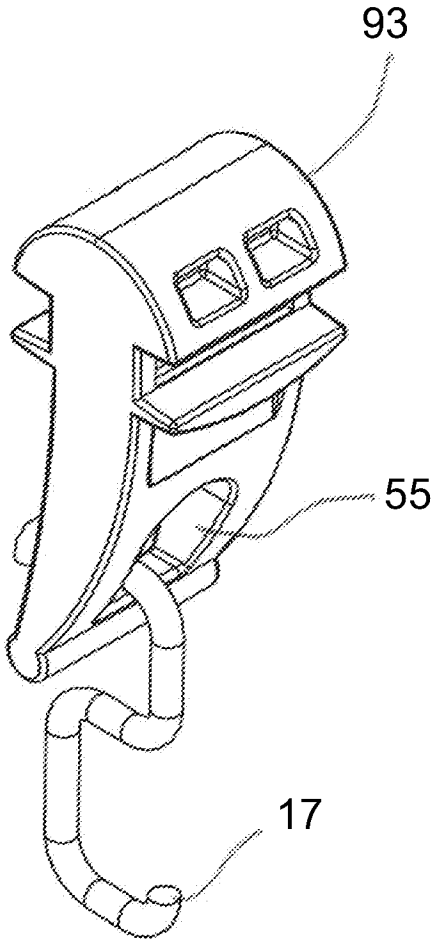

FIG. 56 is a perspective view of the inner curtain carrier and S-hook.

Figure 57:
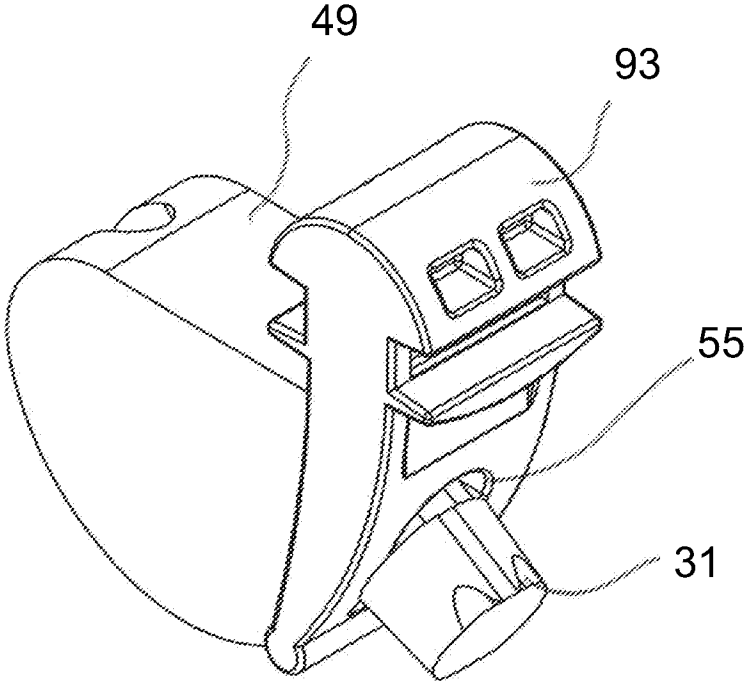

FIG. 57 is a perspective view of the inner curtain carrier with the inner curtain engager.

Figure 58:
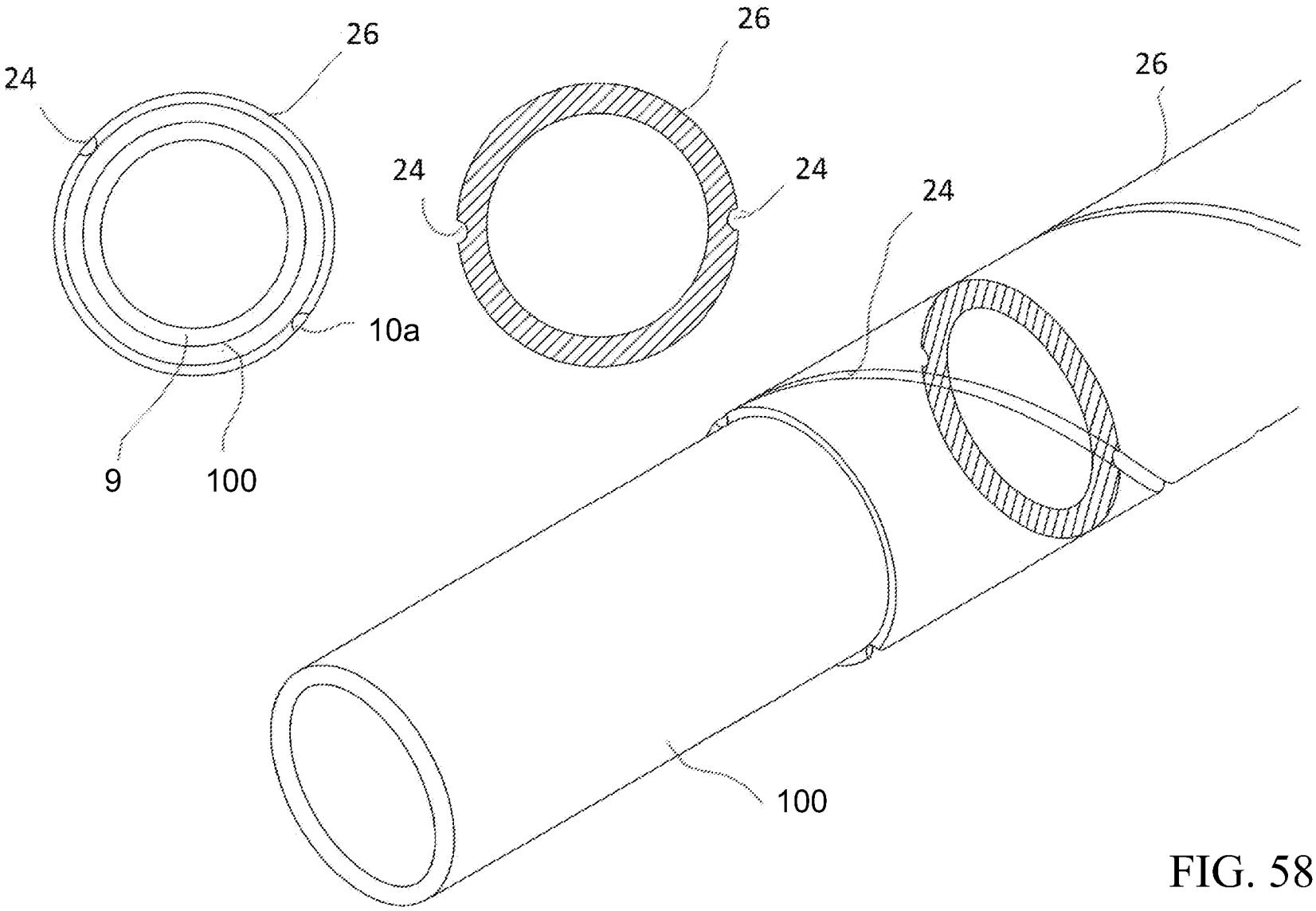

FIG. 58 is three views of the preferred tube embodiment with an outer driver stall area and two helical grooves spaced 180 degrees apart.

Figure 59:
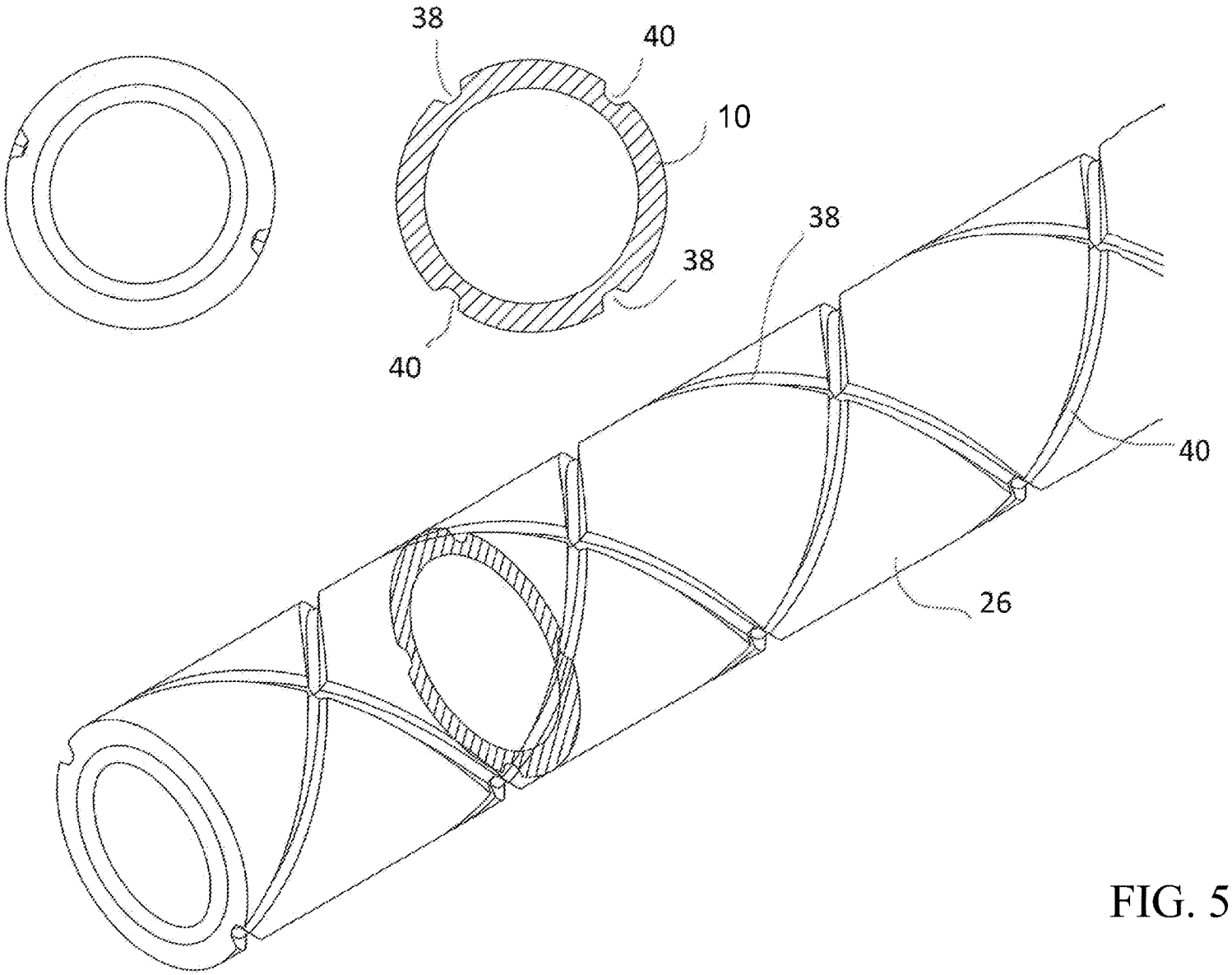

FIG. 59 is another tube embodiment with four helical grooves, two are counter clockwise spaced 180 degrees apart and two are clockwise spaced 180 degrees apart.

Figure 60:
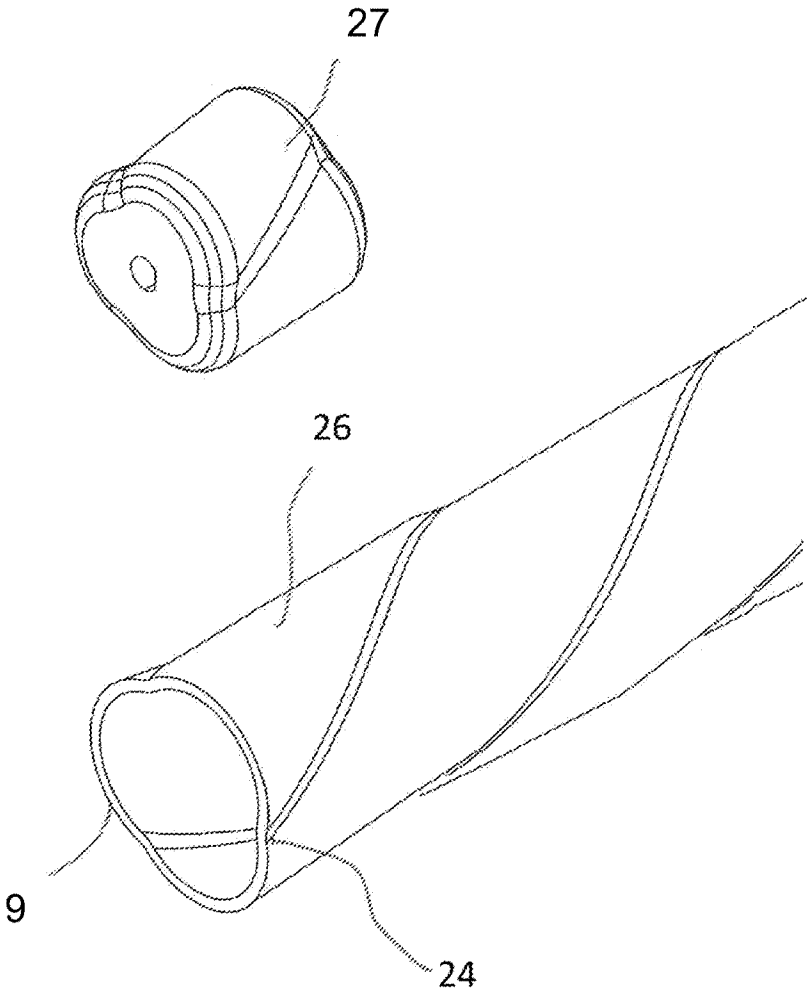
Figure 60:
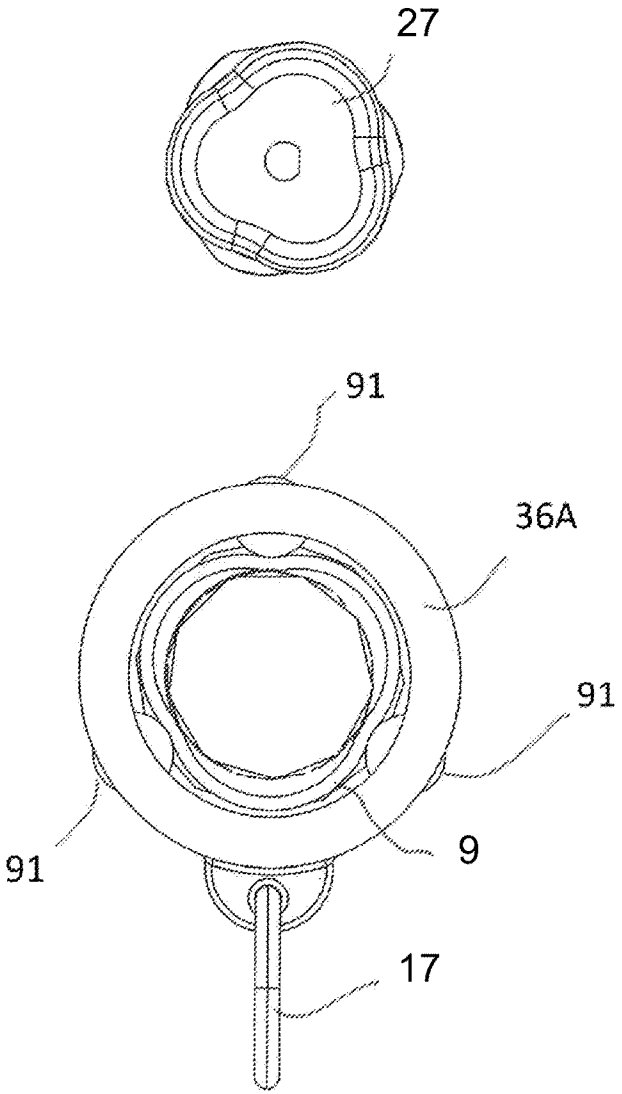

FIG. 60 is another embodiment of a tri-lobed tube, drive element, and internal tube driver.

Figure 61:
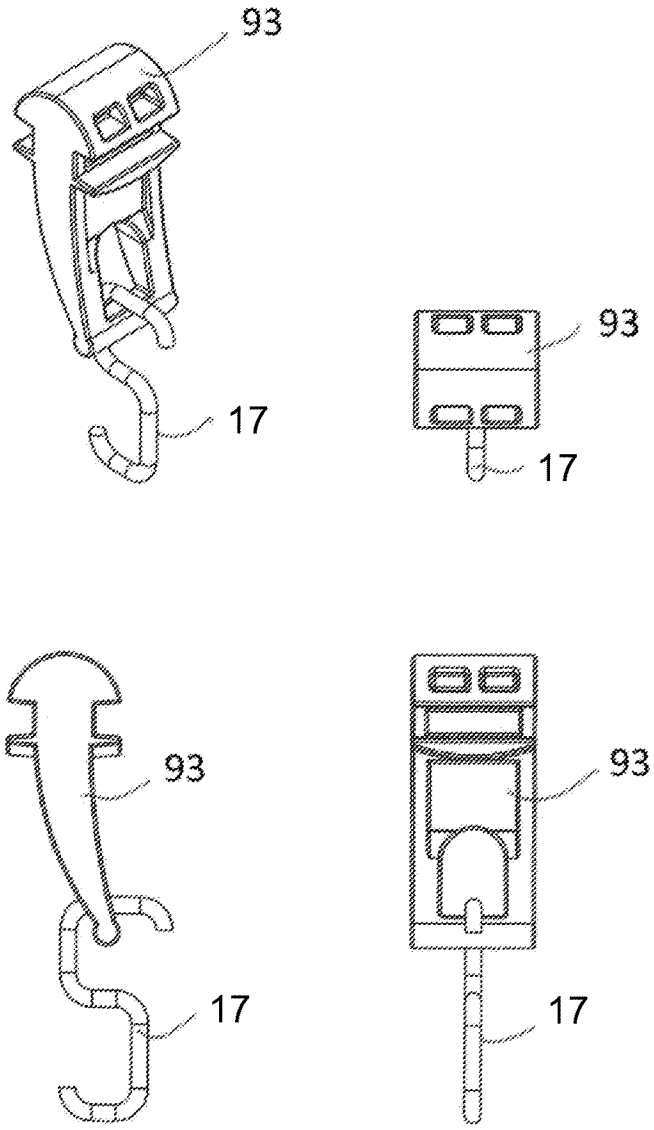

FIG. 61 shows four views of the inner curtain carrier and S-hook.

Figure 62:
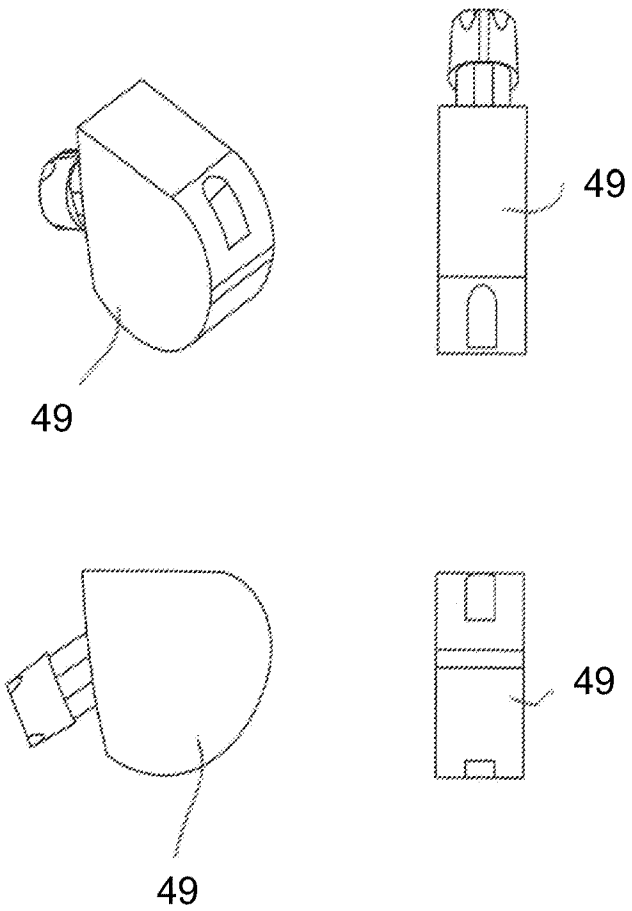

FIG. 62 shows four views of the inter-curtain engager.

Figure 63:
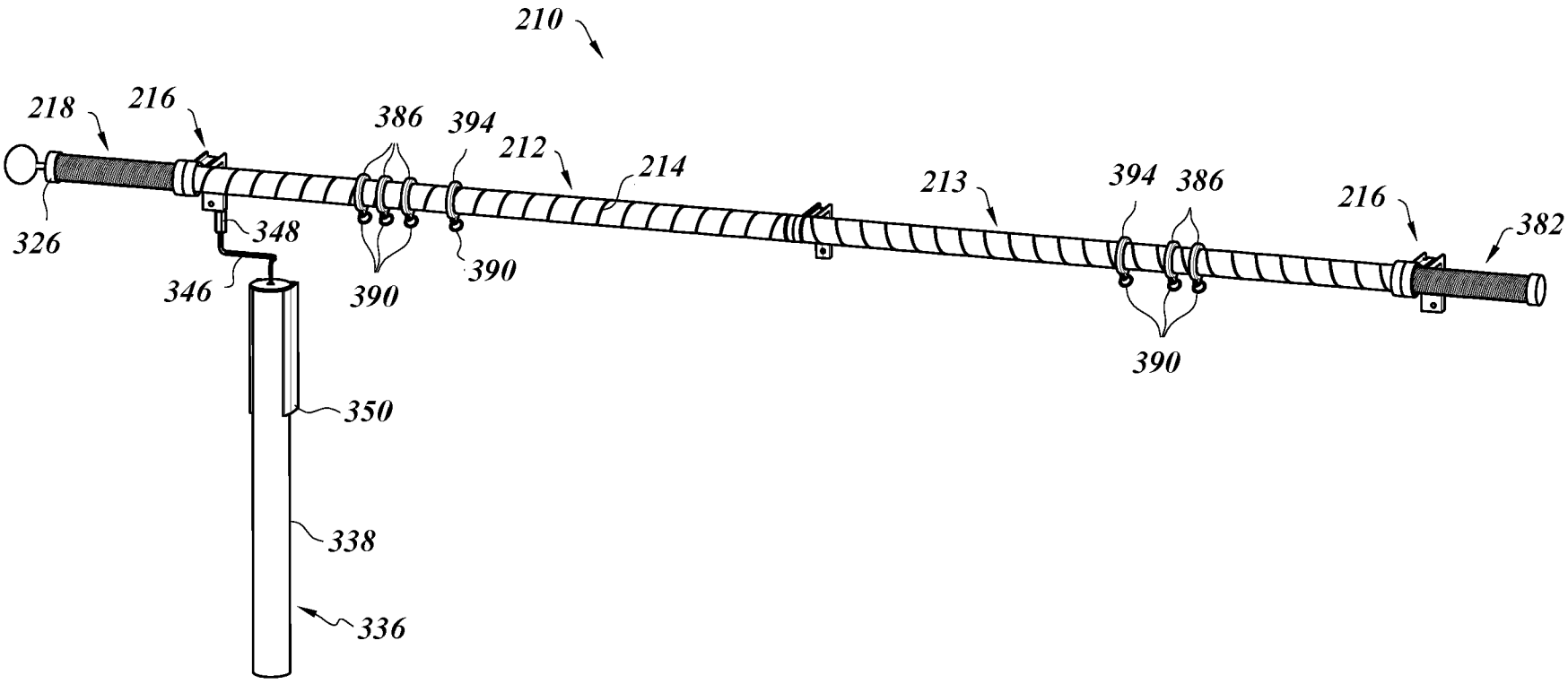

FIG. 63 is a perspective view of an architectural covering having two rotatable drive elements having a helical guide structure therein; the rotatable drive elements are connected at their inward ends by a center coupler; the rotatable drive elements are connected to a bracket at their outward ends, a motor housing with a finial is connected to one end of the rotatable drive element with a battery assembly electrically connected to the bracket adjacent the motor housing which supplies power to the motor housing; a dummy rotatable drive element extension is connected to the bracket on the opposite; driver attachment elements for driving shade material open and closed are shown on the rotatable drive element.

Figure 64:
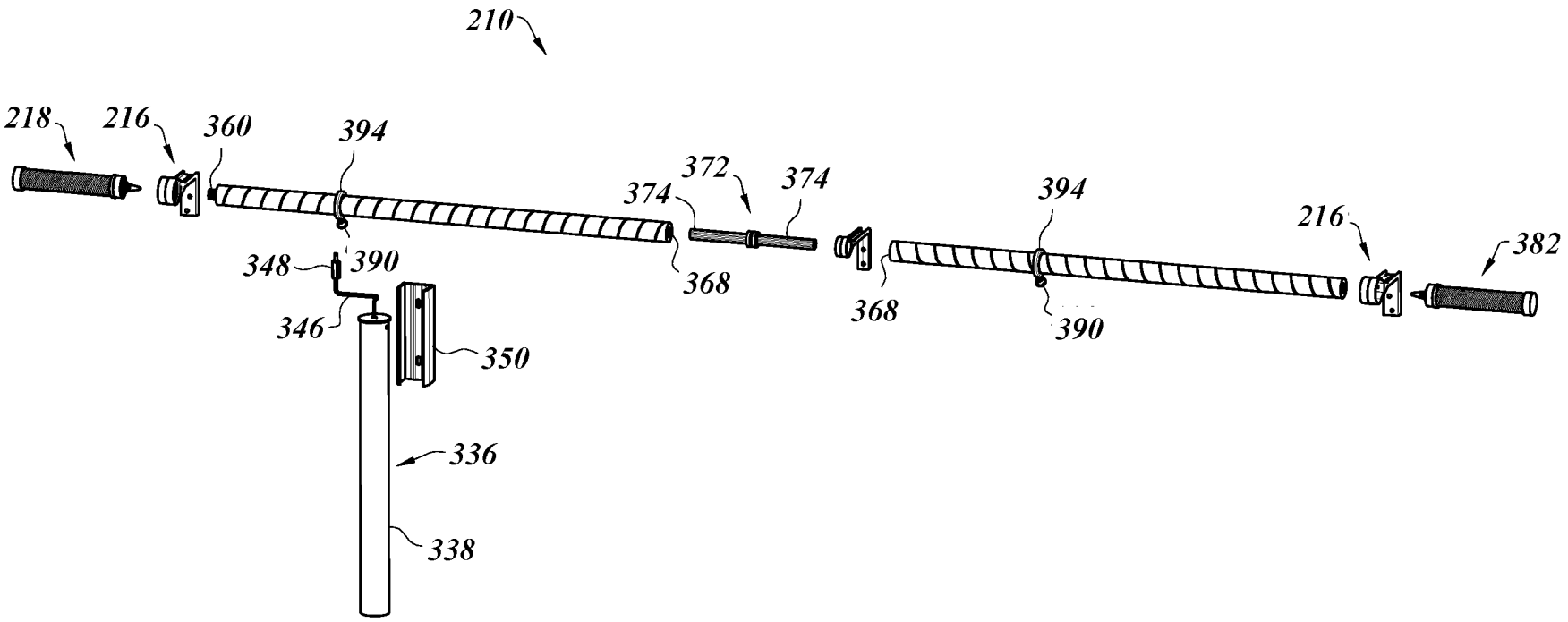

FIG. 64 is a perspective exploded view of the elements shown in FIG. 63

Figure 65:
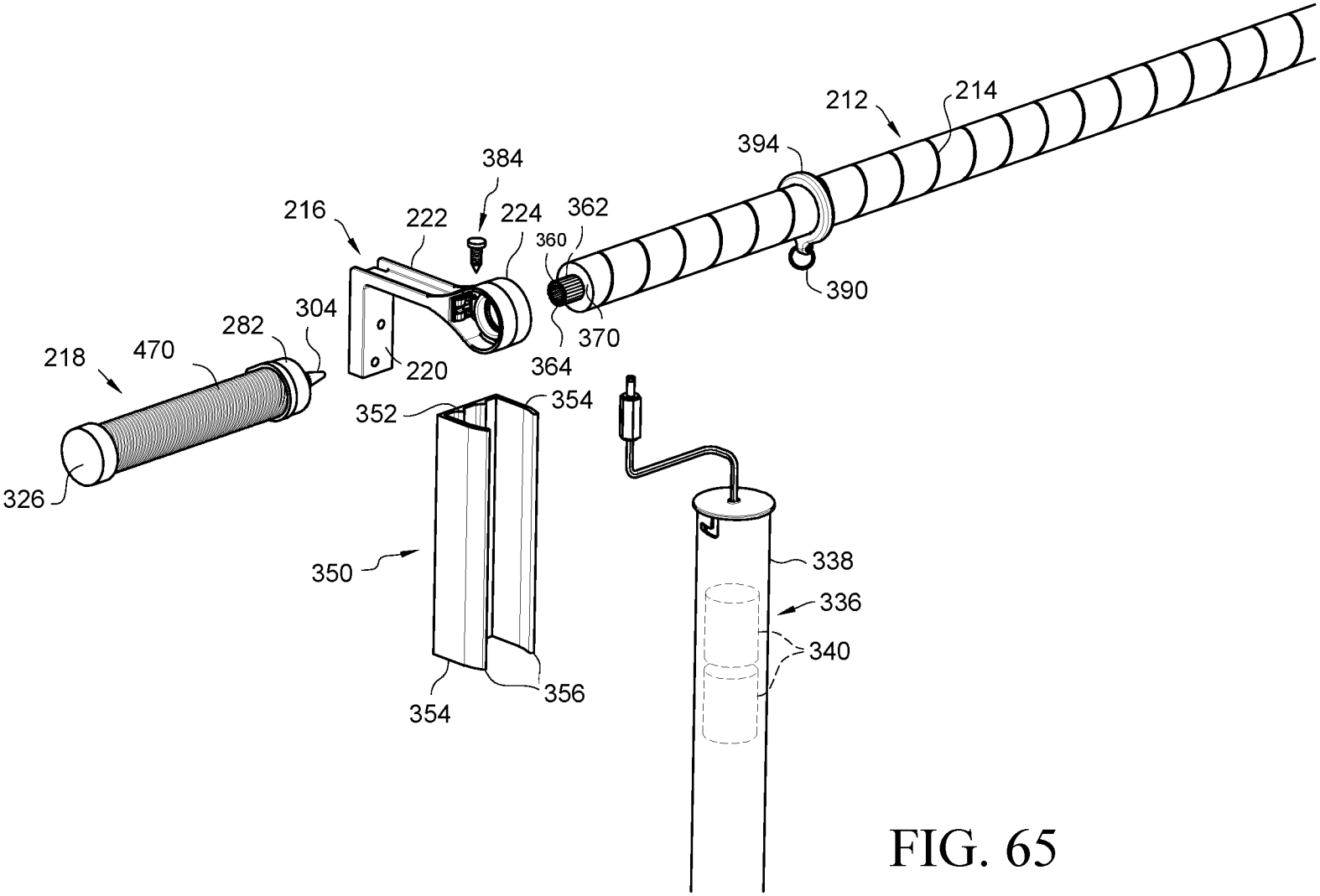

FIG. 65 is a close-up perspective exploded view of FIG. 64 showing the motor housing, bracket having a key feature and electrical contacts, a motor coupler sleeve positioned within the outward end of the rotatable drive element.

Figure 66:
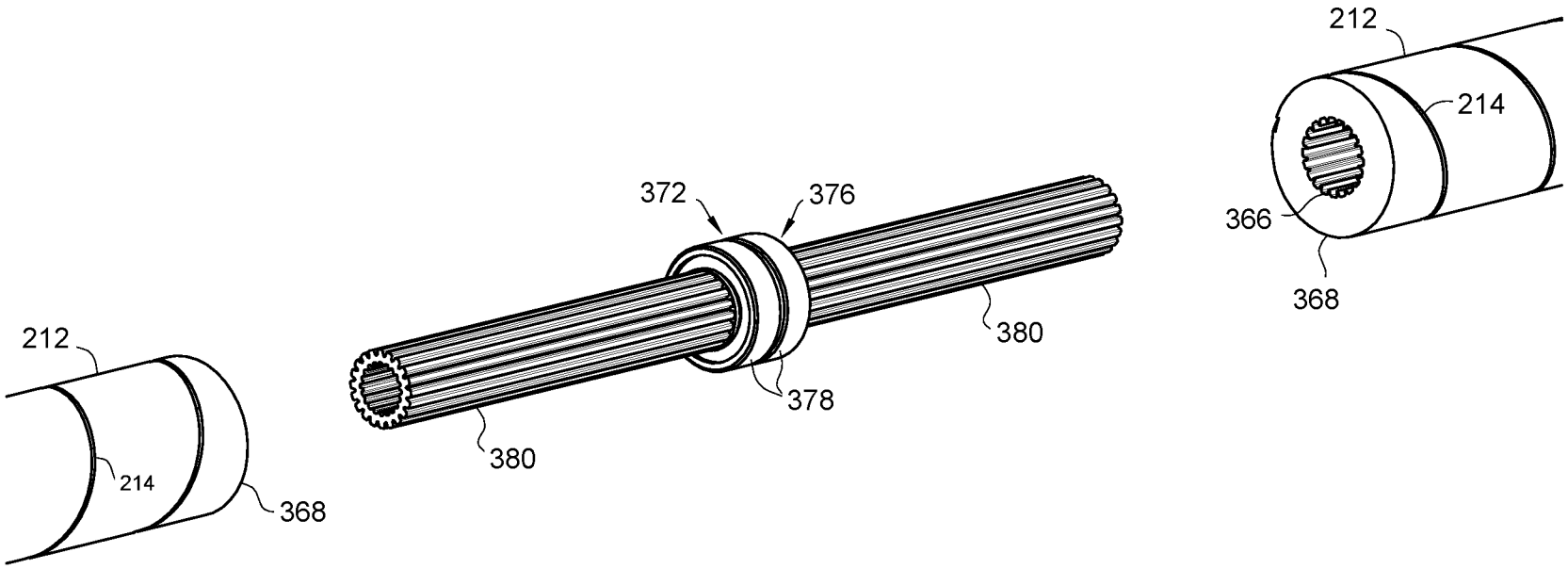

FIG. 66 is a close-up perspective exploded view of FIG. 64 showing the center coupler and the ends of rotatable drive elements.

Figure 67:
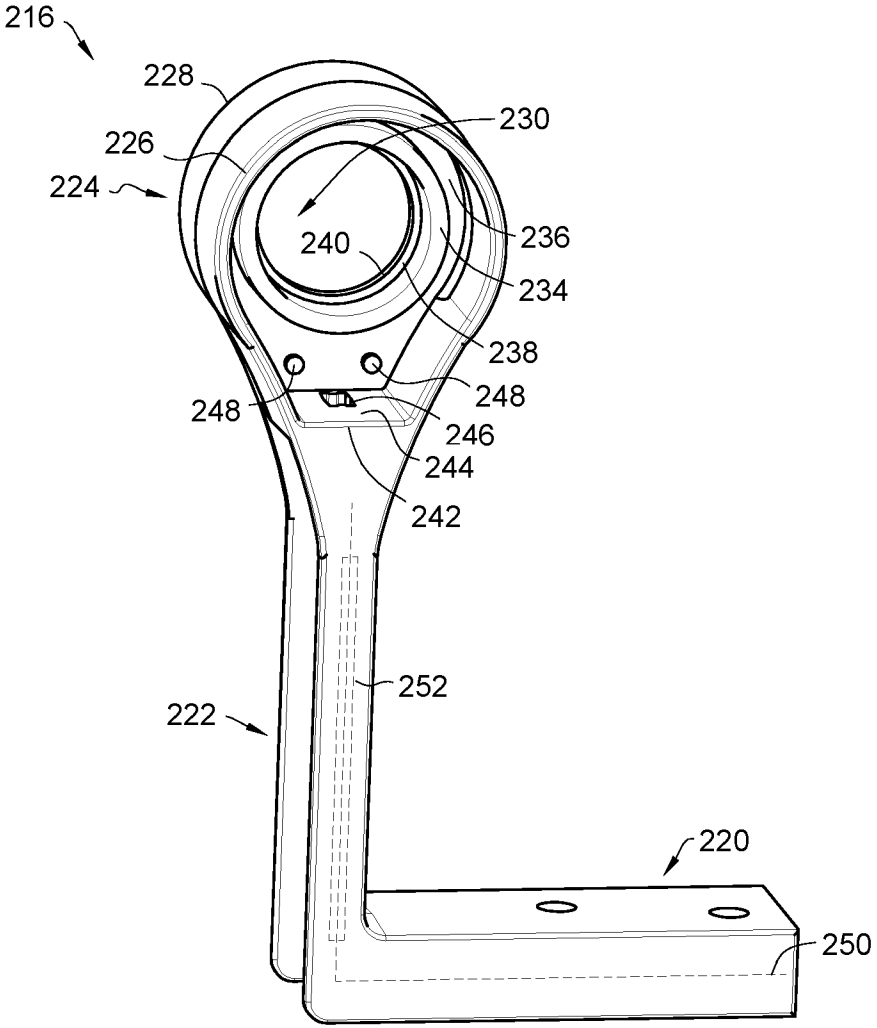

FIG. 67 is a close-up perspective view of a bracket which connects a motor housing to a rotatable drive element, the view showing the side which engages a motor housing, the view showing the key feature and the electrical contacts.

Figure 68:
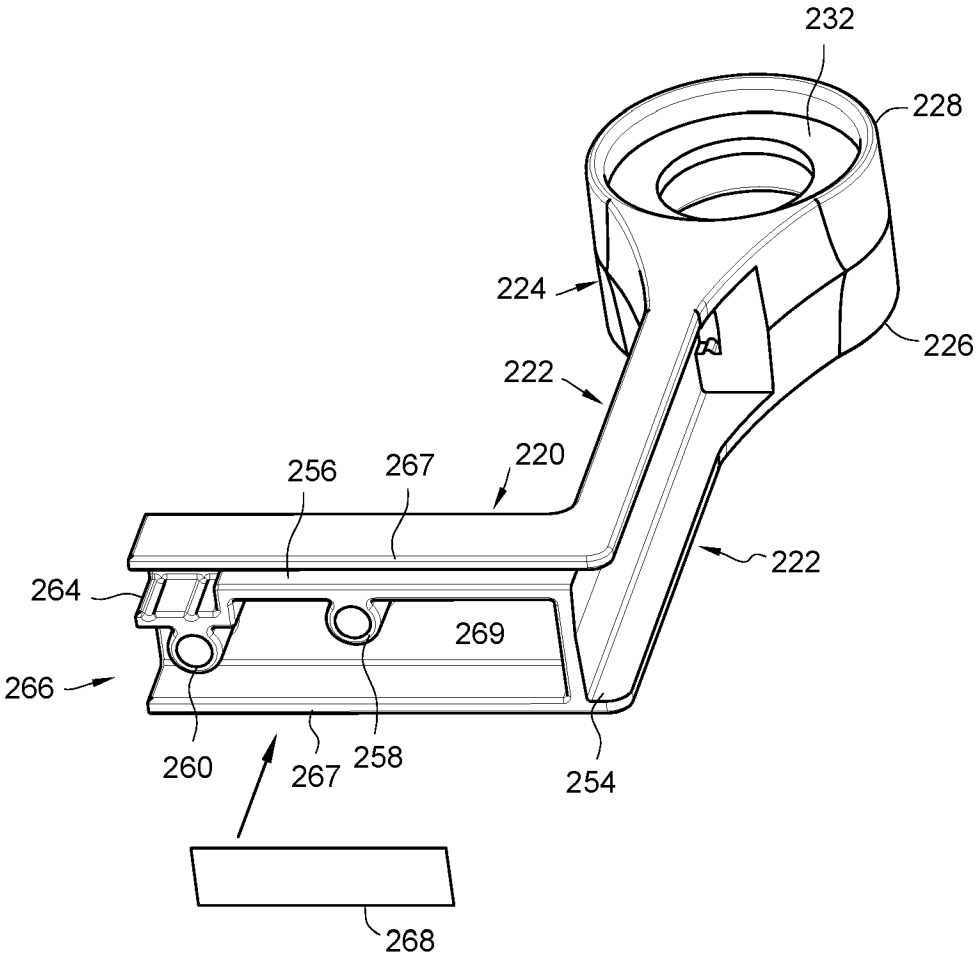

FIG. 68 is a close-up perspective view of a bracket which connects a motor housing to a rotatable drive element, the view showing the side of the bracket which engages a rotatable drive element, the view also showing the electrical socket and passageway, as well as a cavity which provides a spot for mounting and housing electronics for controlling the motor housing.

Figure 69:
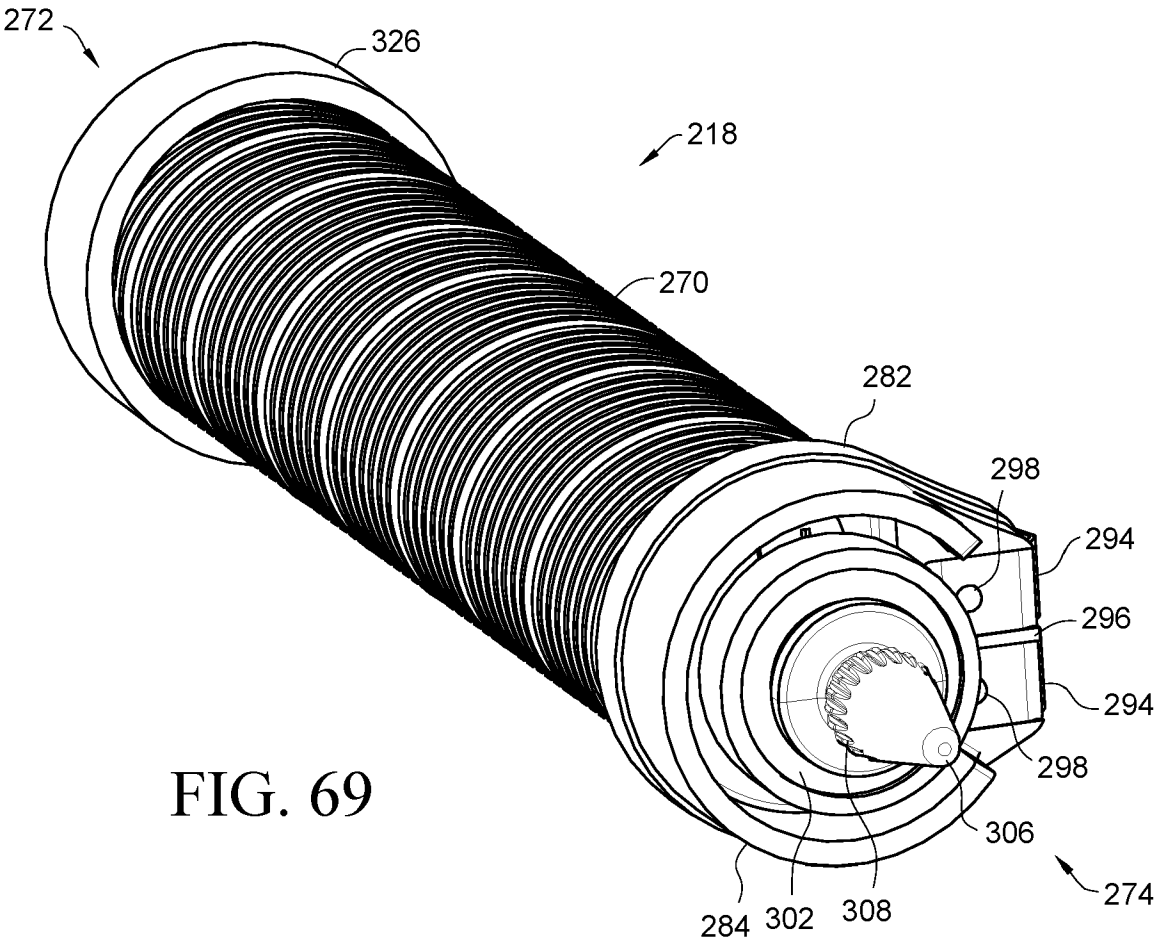

FIG. 69 is a close up perspective exploded view of a motor housing showing a threaded surface structure, an exterior end cap, a bearing a motor coupler a motor end cap and a key feature having electrical contacts.

Figure 70:
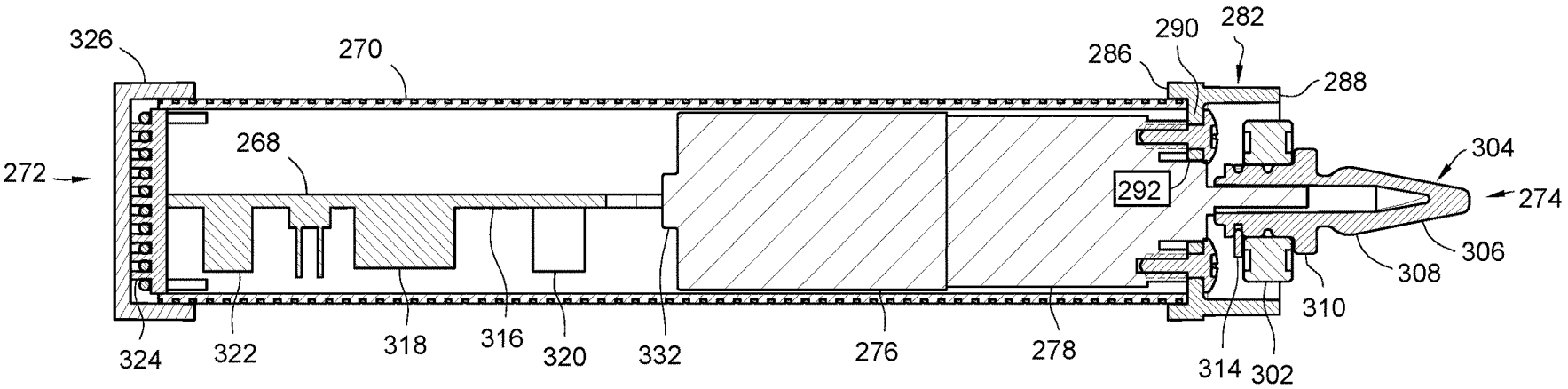

FIG. 70 is side elevation cut-away view of the motor housing shown in FIG. 69, the view showing the motor coupler, bearing, planetary gear box, electrical motor, sensor assembly, motor controller assembly, and antenna.

Figure 71:
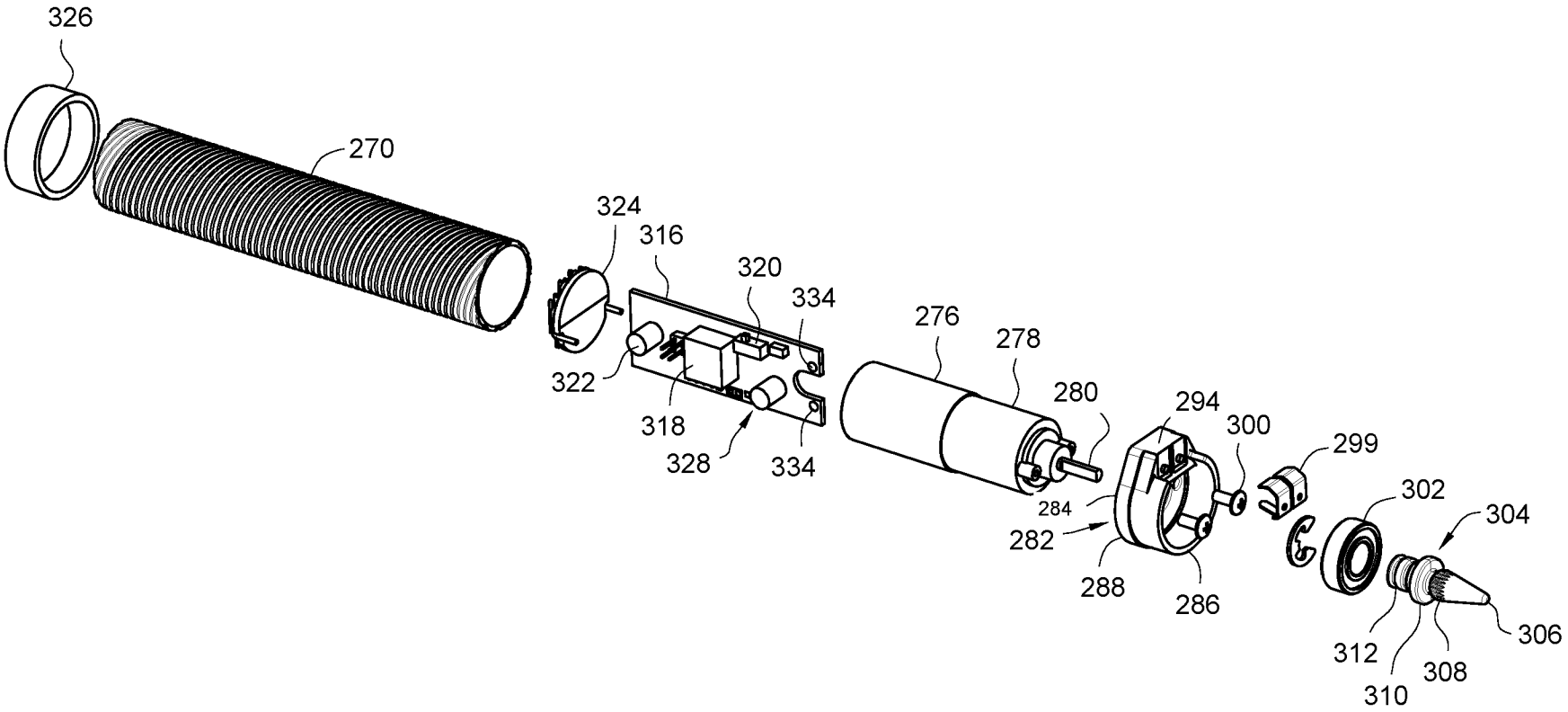

FIG. 71 is an exploded perspective view of the motor housing shown in FIG. 69, the view showing the motor coupler, bearing, planetary gear box, electrical motor, sensor assembly, motor controller assembly, antenna motor end cap and exterior end cap.

Figure 72:
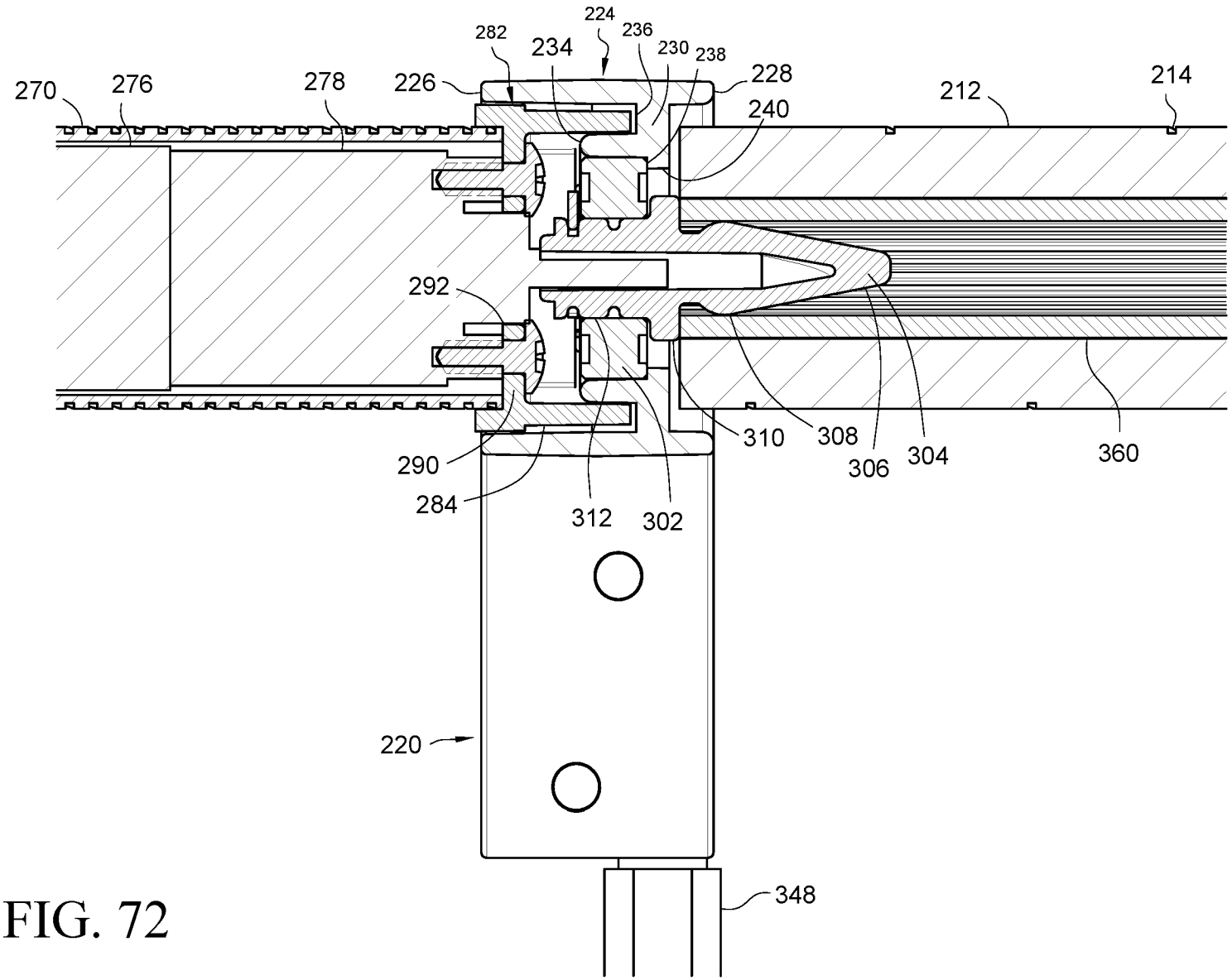

FIG. 72 is side elevation cut-away view of the motor housing shown in FIG. 69 connected to a rotatable drive element through a motor bracket, the view showing the motor coupler, bearing, planetary gear box, electrical motor, electrical plug and rotatable drive element.

Figure 73:
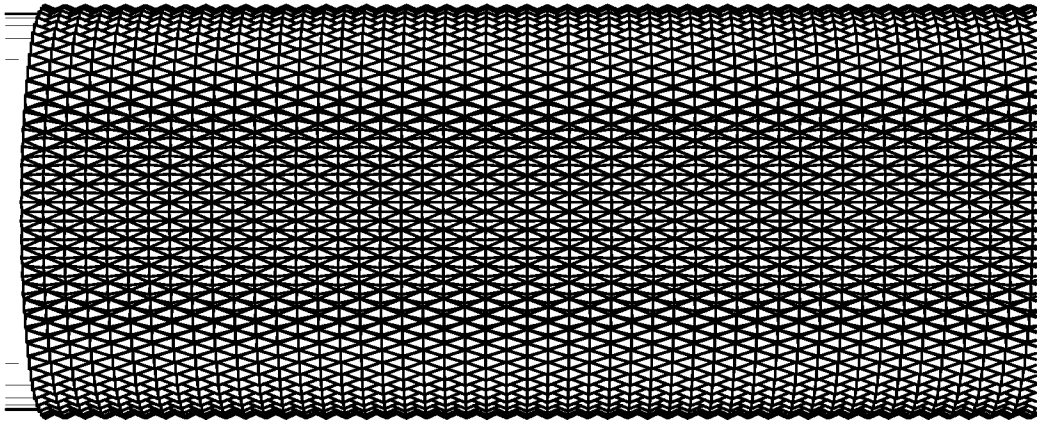

FIG. 73 is a side plan view of a diamond shaped, cross-threaded, or crisscrossed knurled pattern in the surface of a rotatable drive element.

Figure 74:
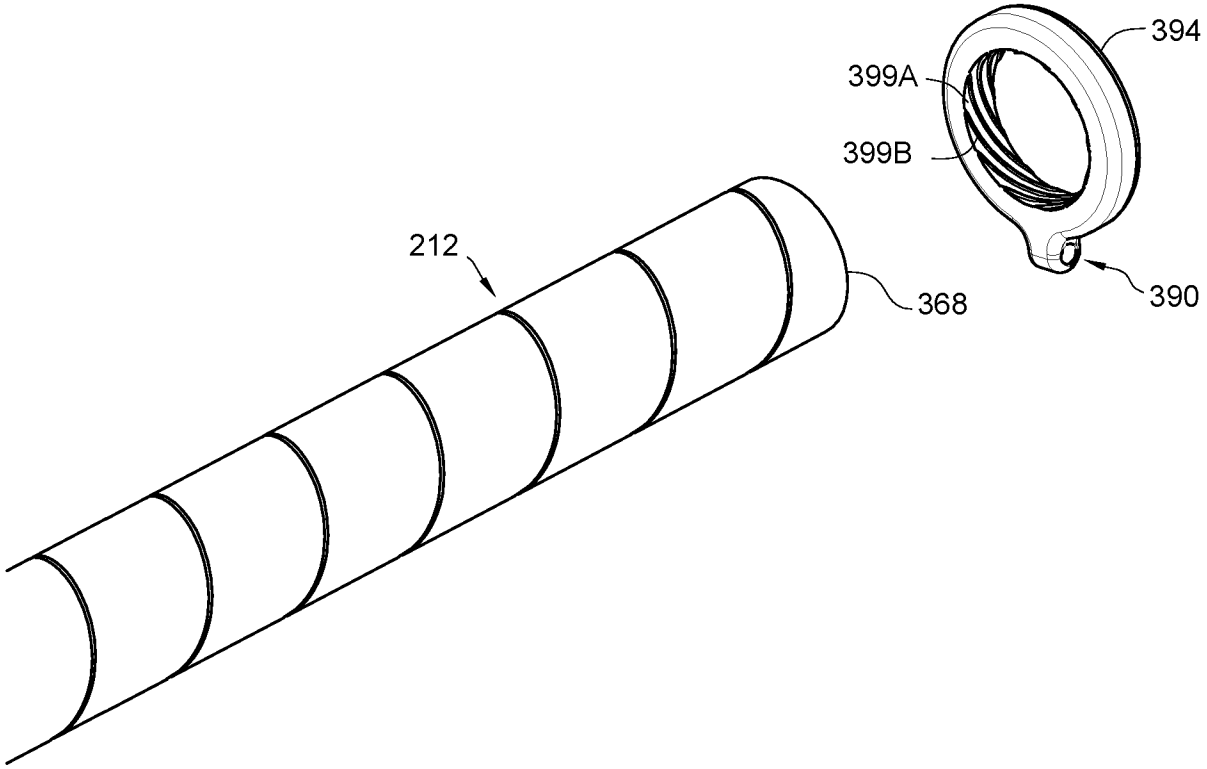

FIG. 74 is a perspective view of a rotatable drive element having a threaded surface and a driver attachment element showing a lower density of teeth on the interior surface of the driver element than the number of threads in the surface of the rotatable drive element.

Figure 75:
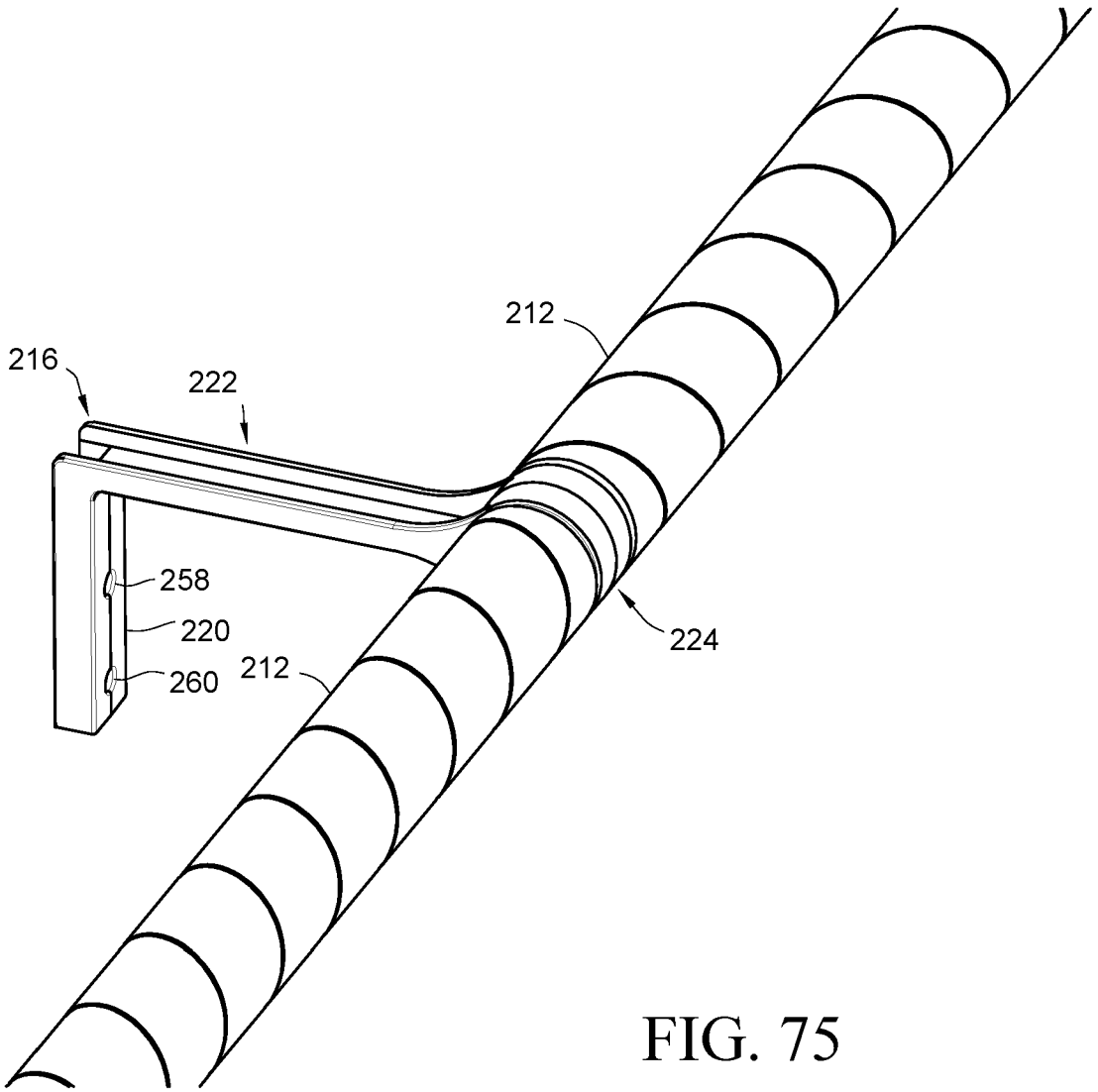

FIG. 75 is a perspective view of the rotatable drive elements connected together at a center bracket, the center coupler being positioned within the bracket and the open interior of the rotatable drive element.

Figure 76:
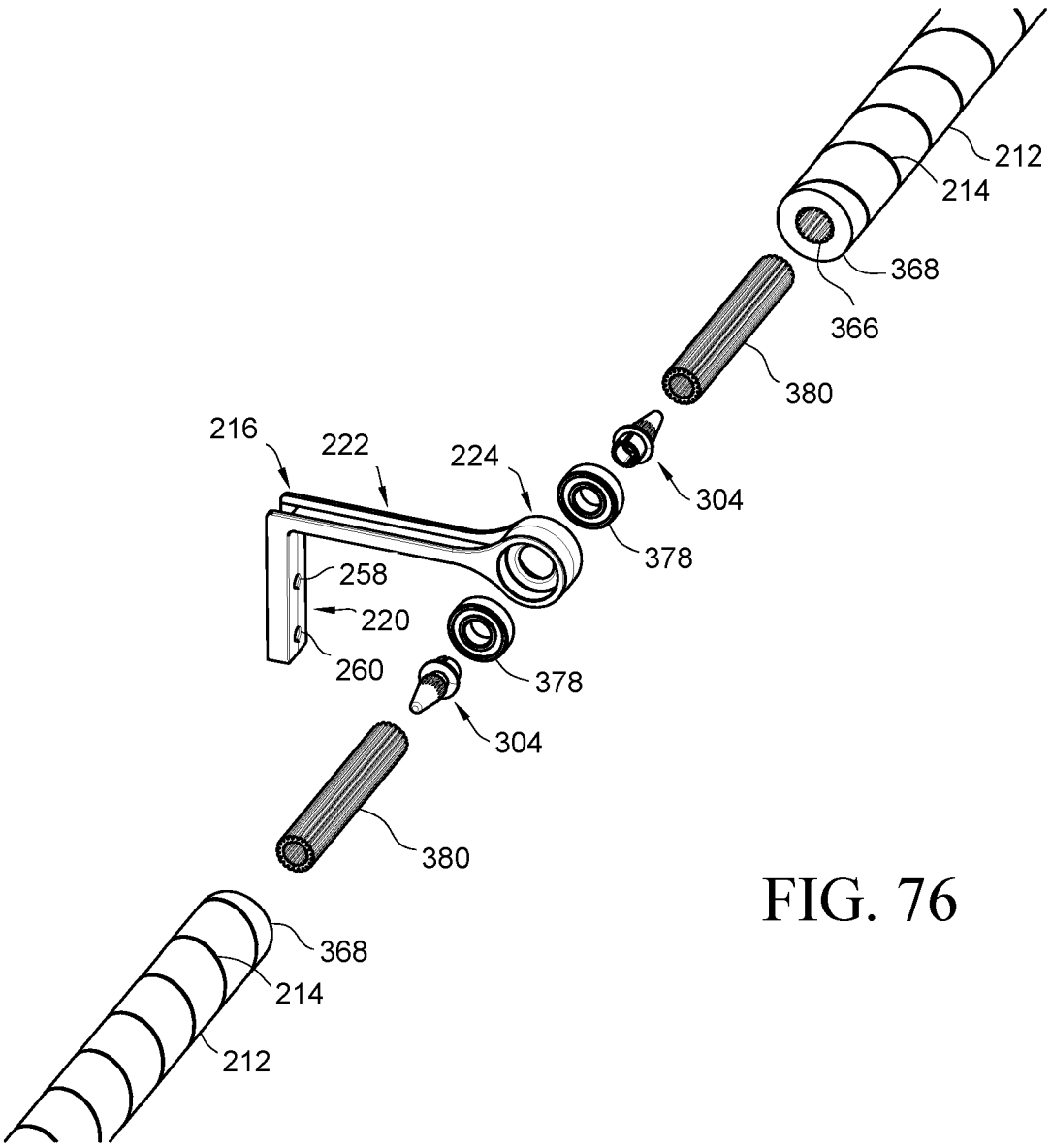

FIG. 76 is a perspective exploded view of FIG. 75.

Figure 77:
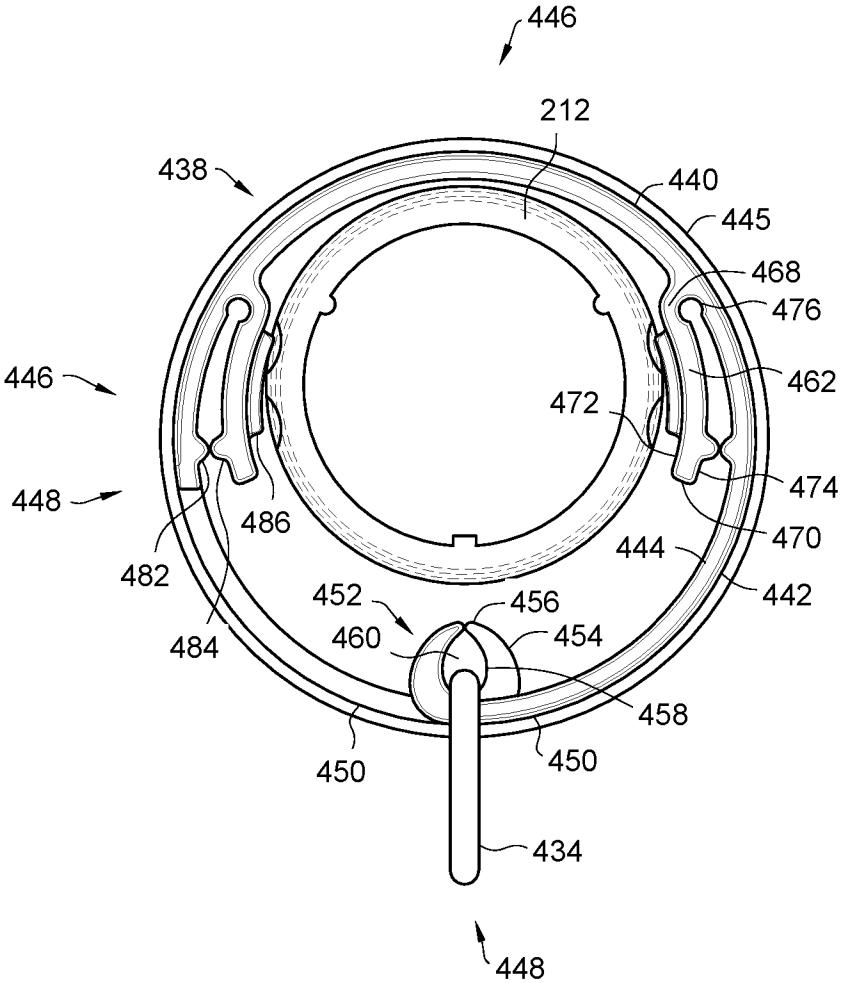

FIG. 77 is a side elevation view of a drive attachment element.

Figure 78:
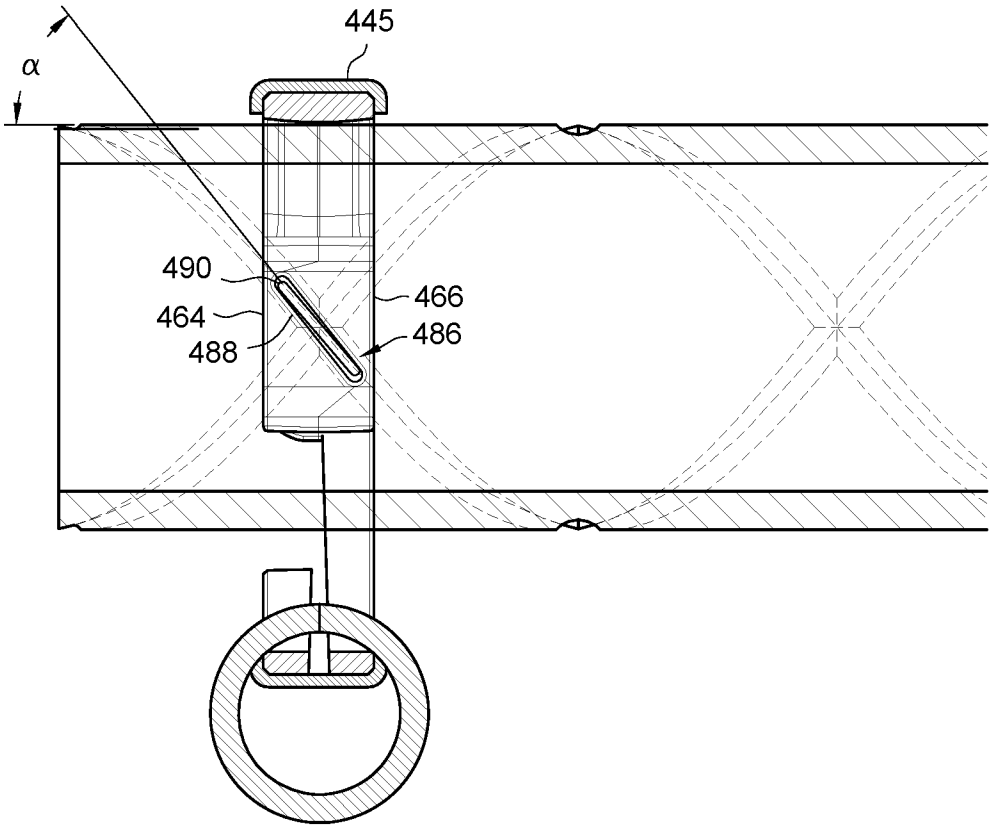

FIG. 78 is a front elevation cut-away view of the drive attachment element of FIG. 77 positioned over rotatable drive element.

Figure 79:
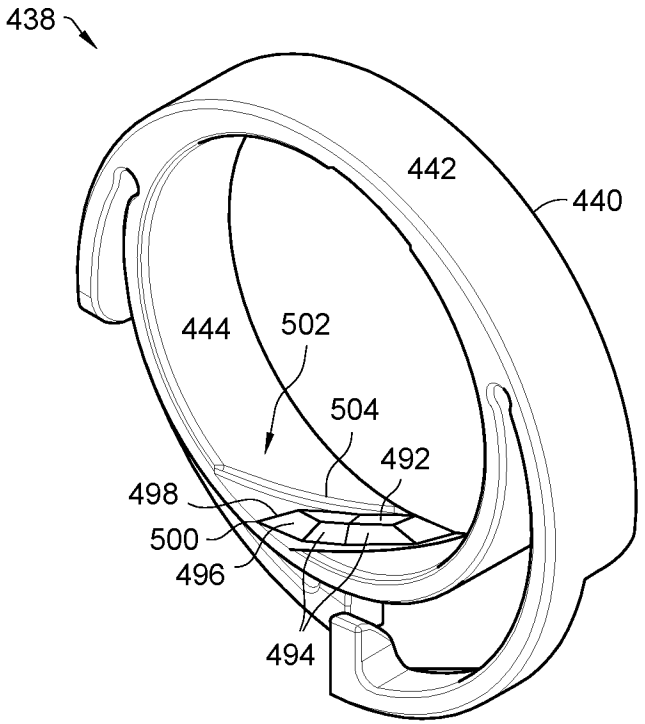

FIG. 79 is a perspective view of the drive attachment element of FIG. 77.

Figure 80:
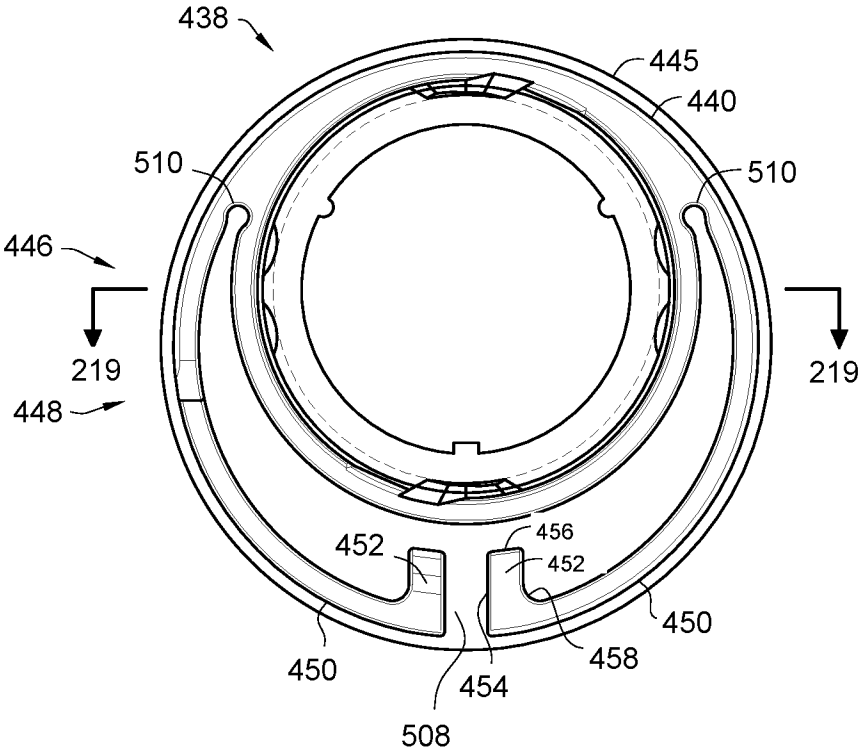

FIG. 80 is a front elevation view of another embodiment of a drive attachment element.

Figure 81:
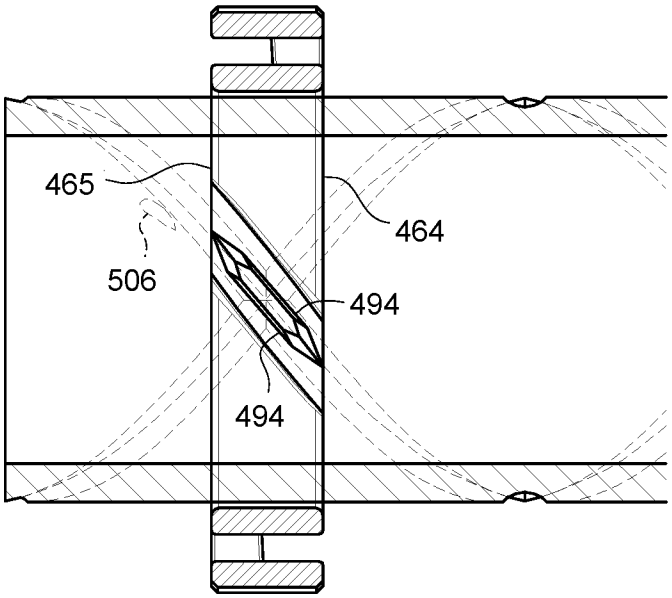

FIG. 81 is a front elevation cut-away view of the drive attachment element of FIG. 80 positioned over rotatable drive element.

Figure 82:
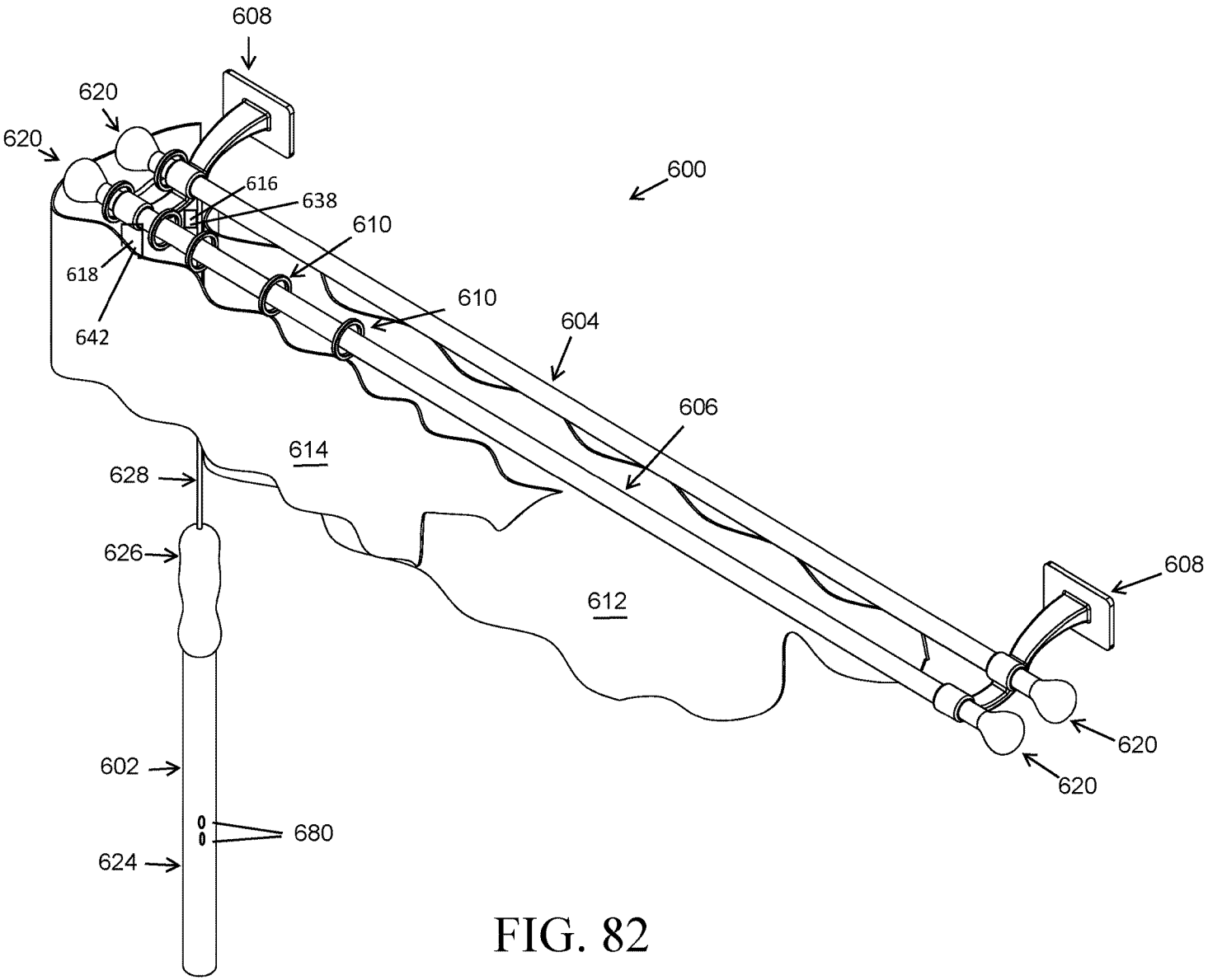
Figure 83:
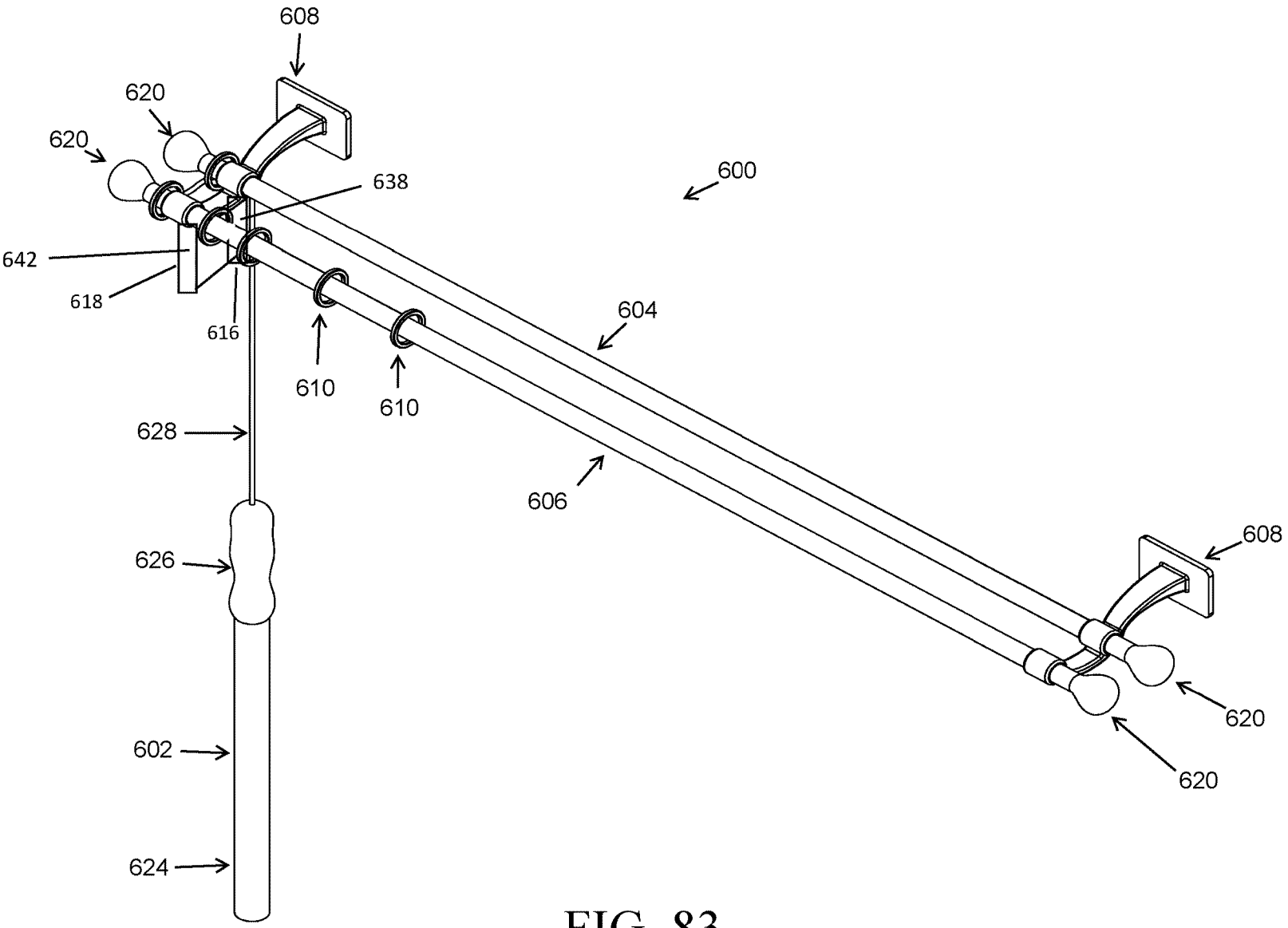
Figure 84:
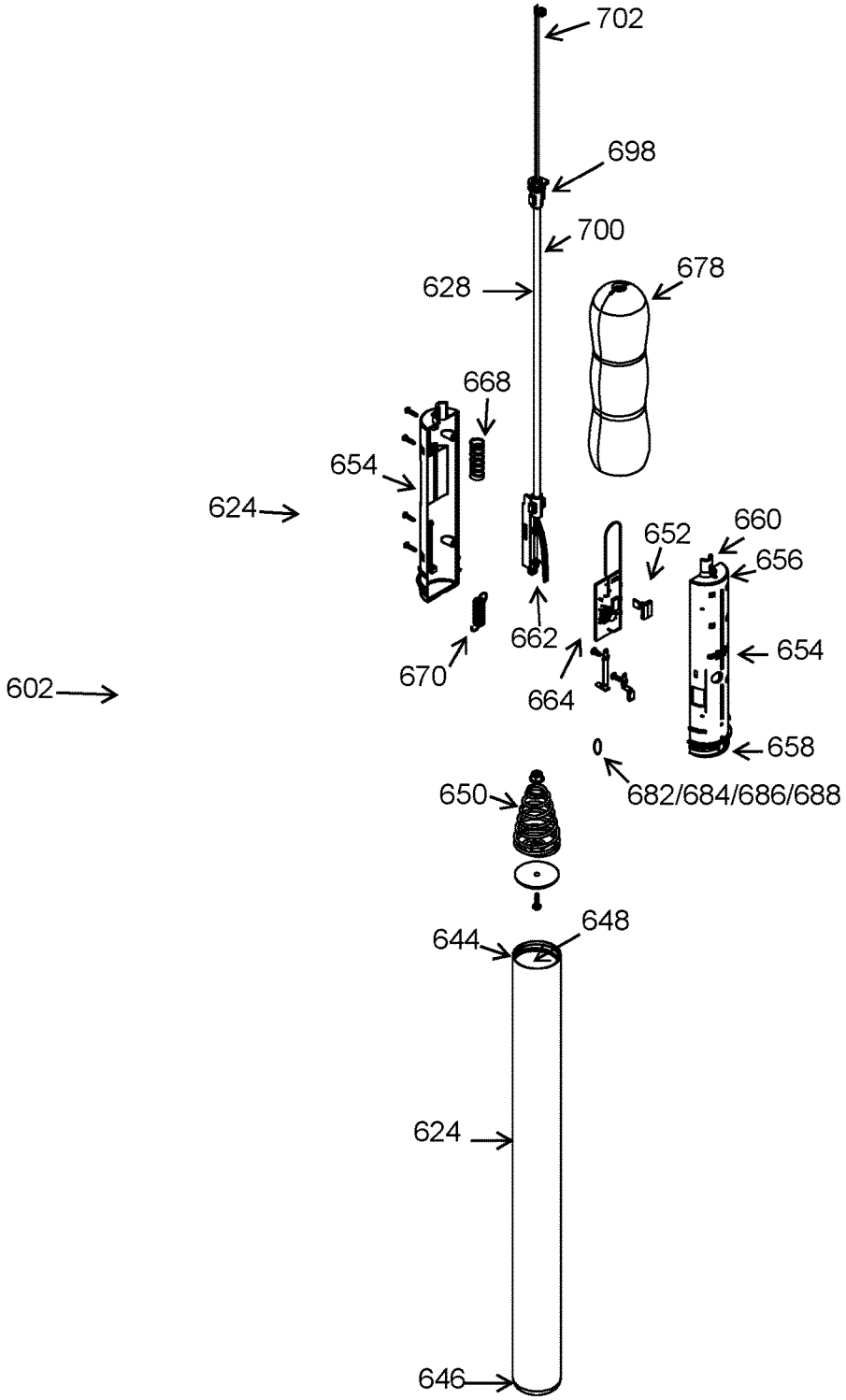
Figure 85:
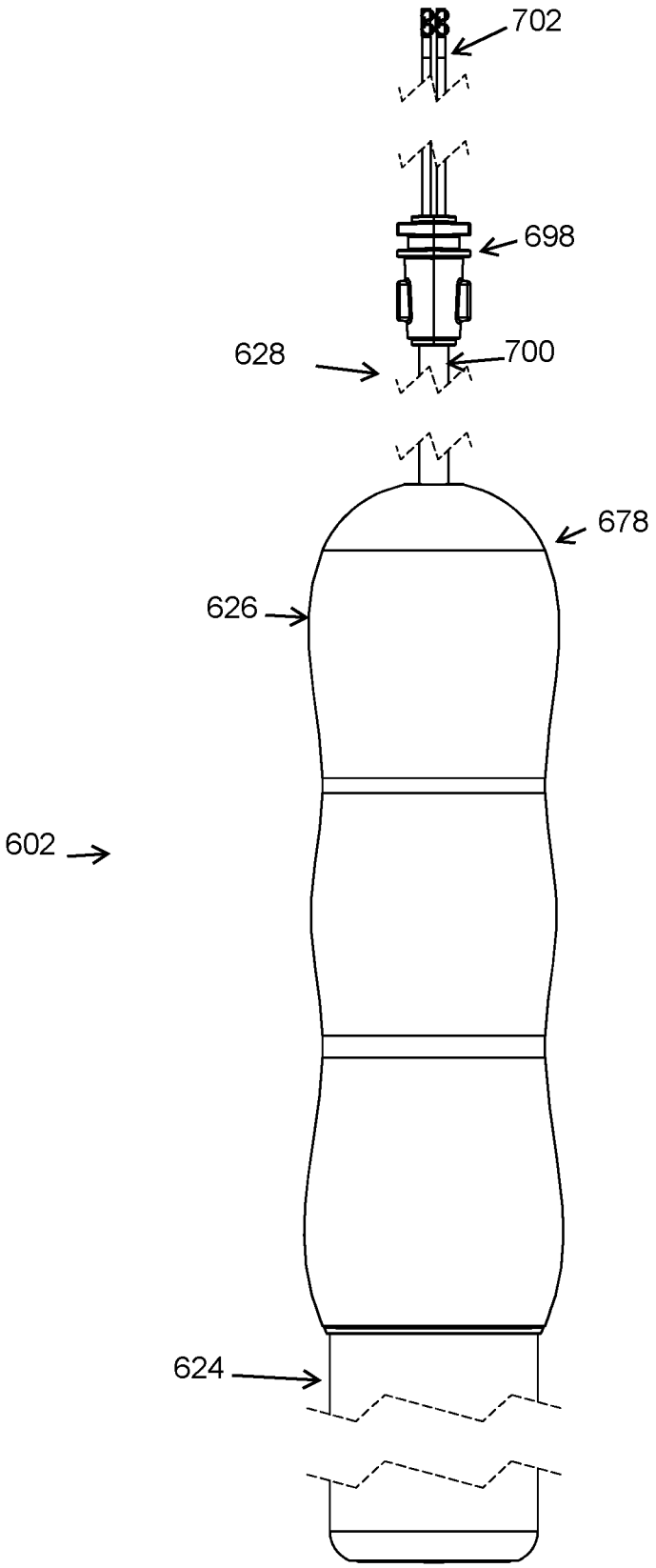
Figure 86:
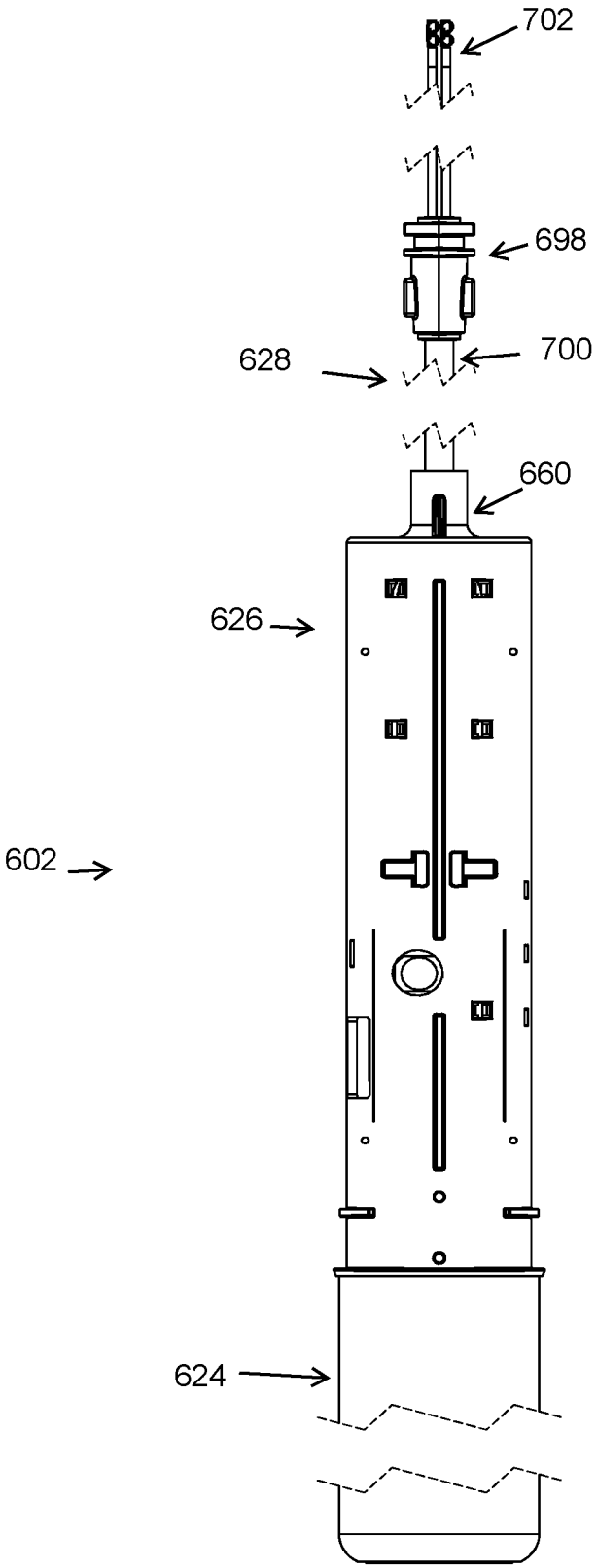
Figure 87:
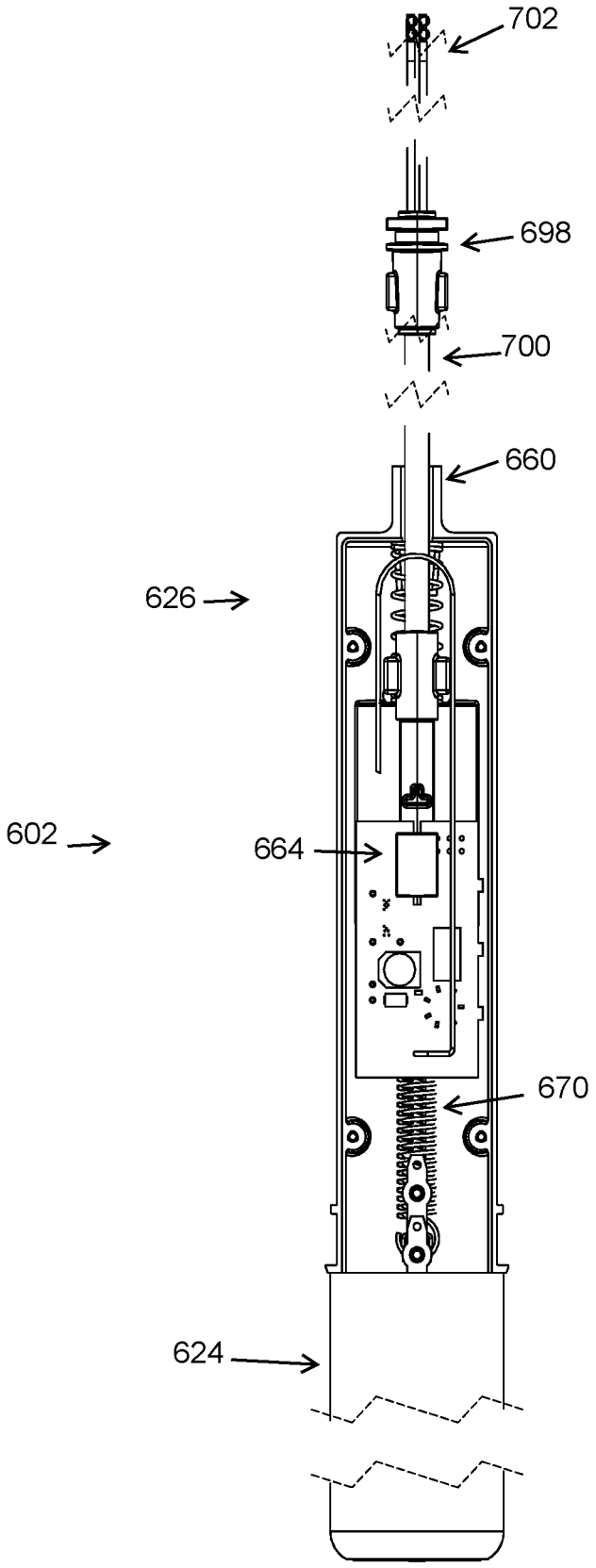
Figure 88:
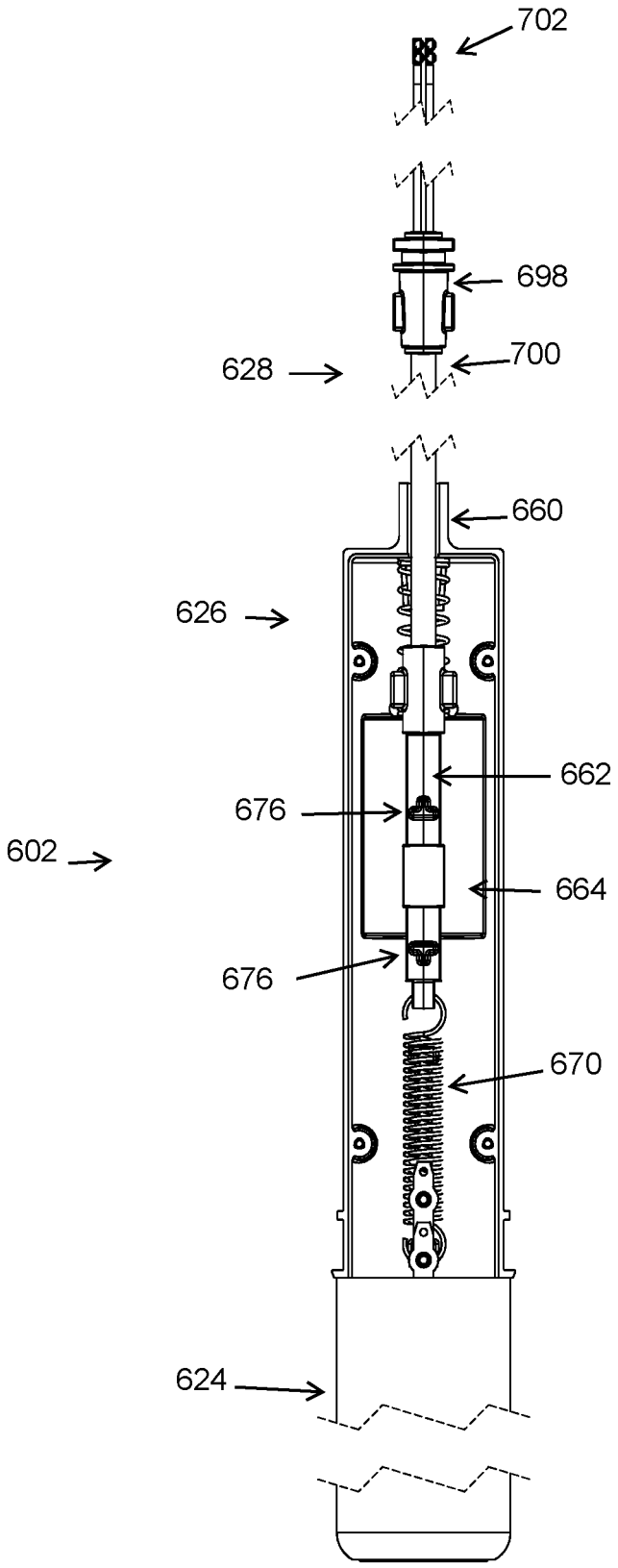
Figure 89:
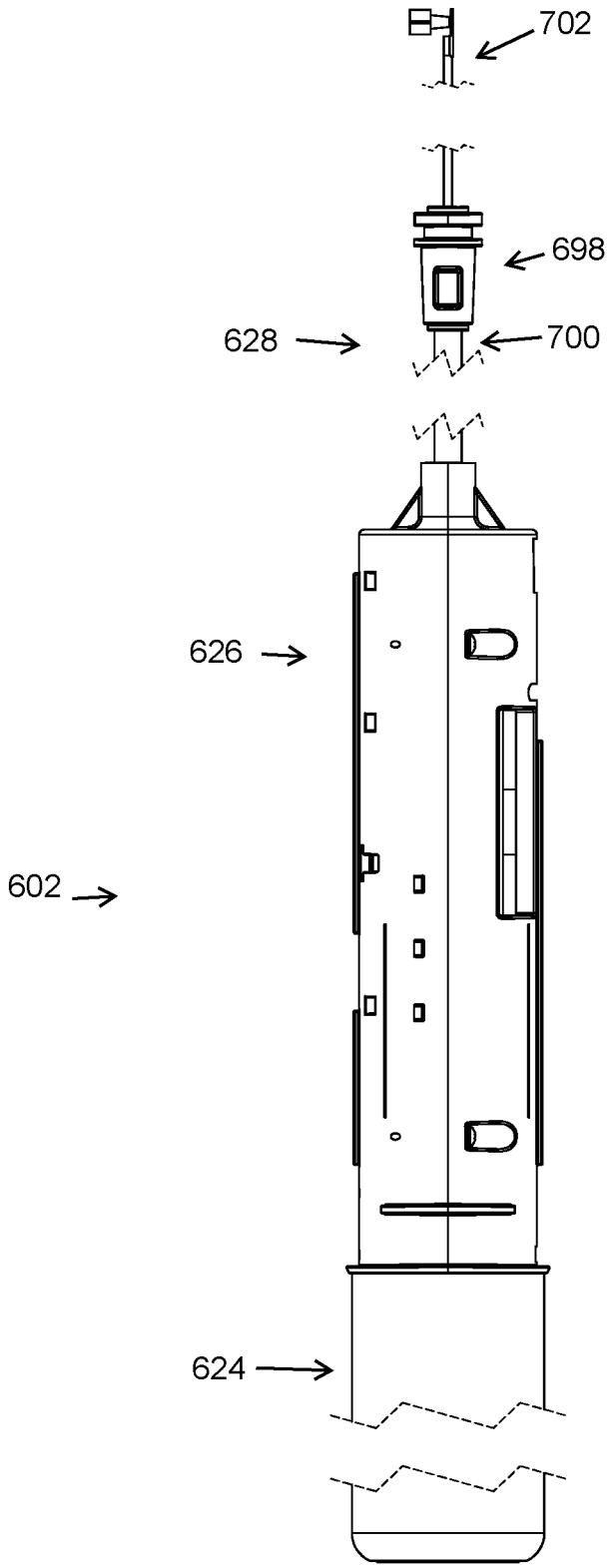
Figure 90:
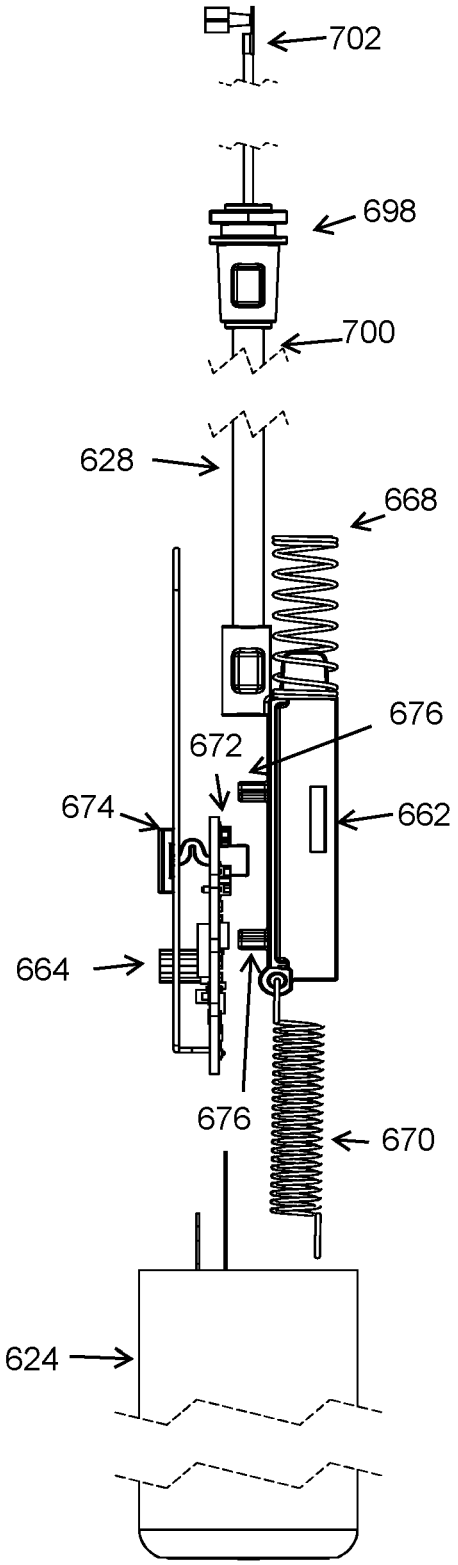
Figure 91:
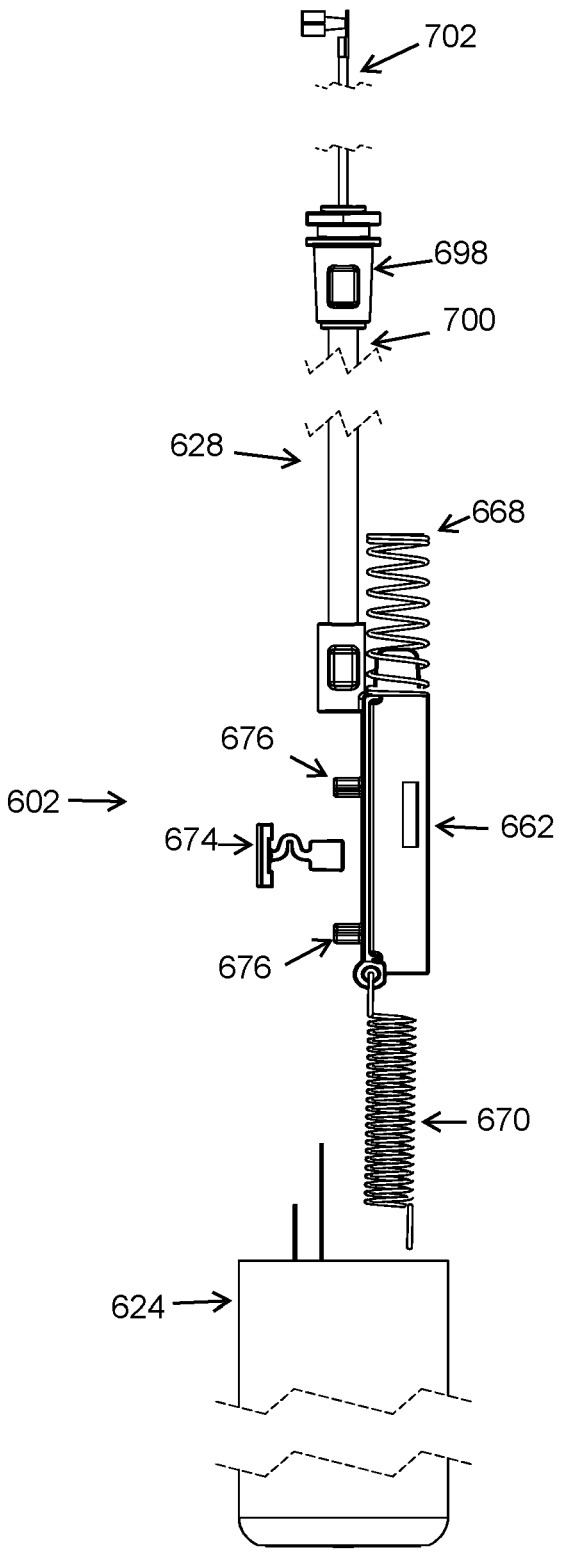
Figure 92:
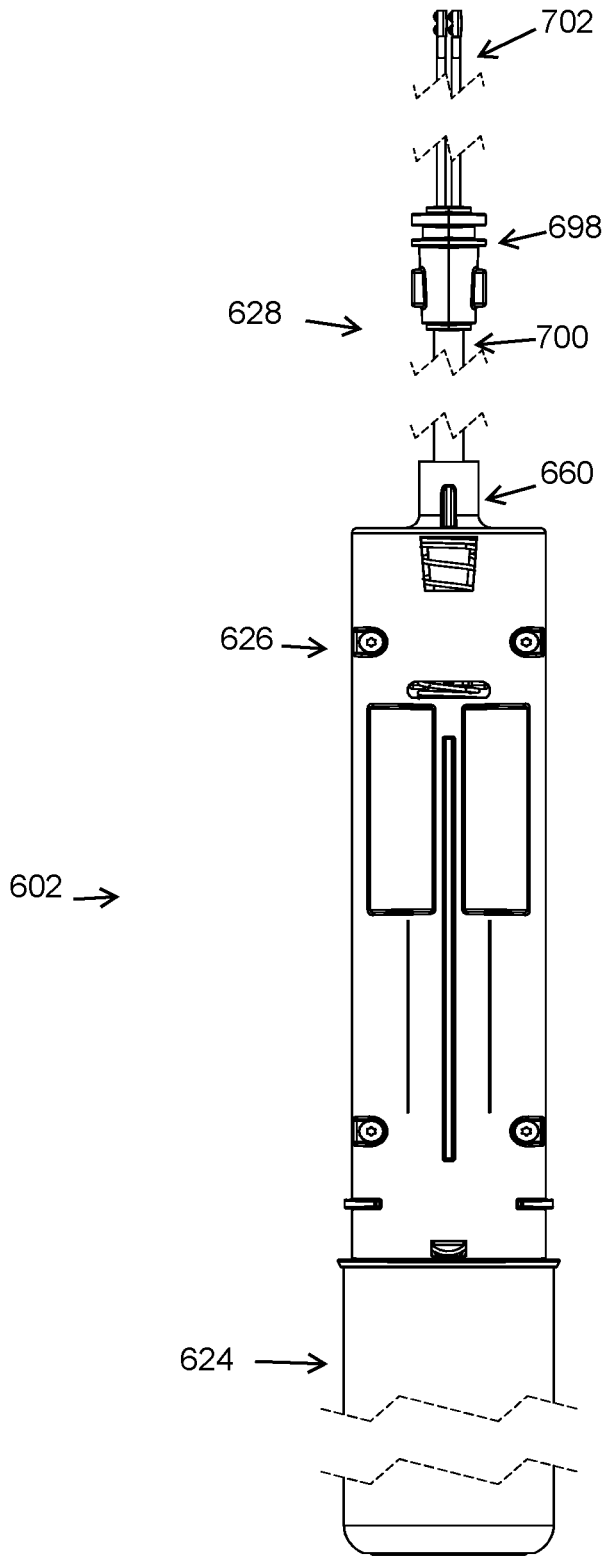
Figure 93:
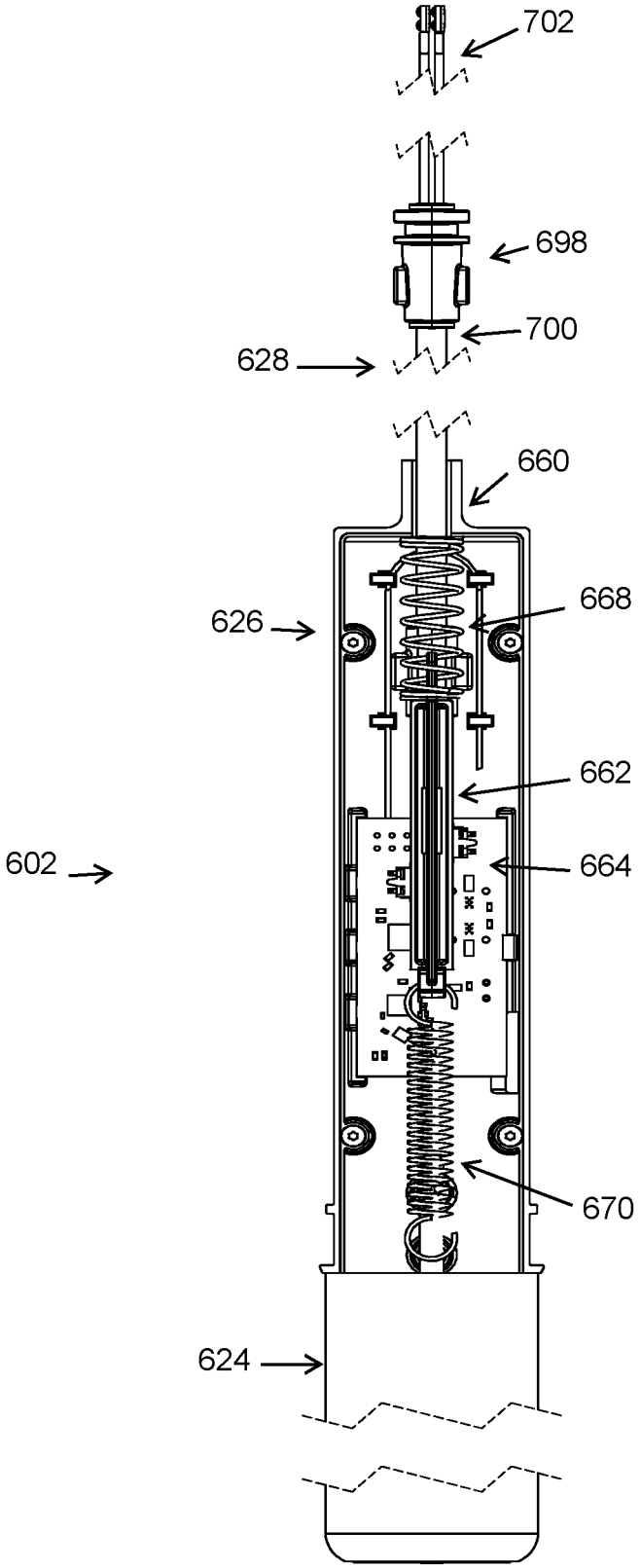
Figure 94:
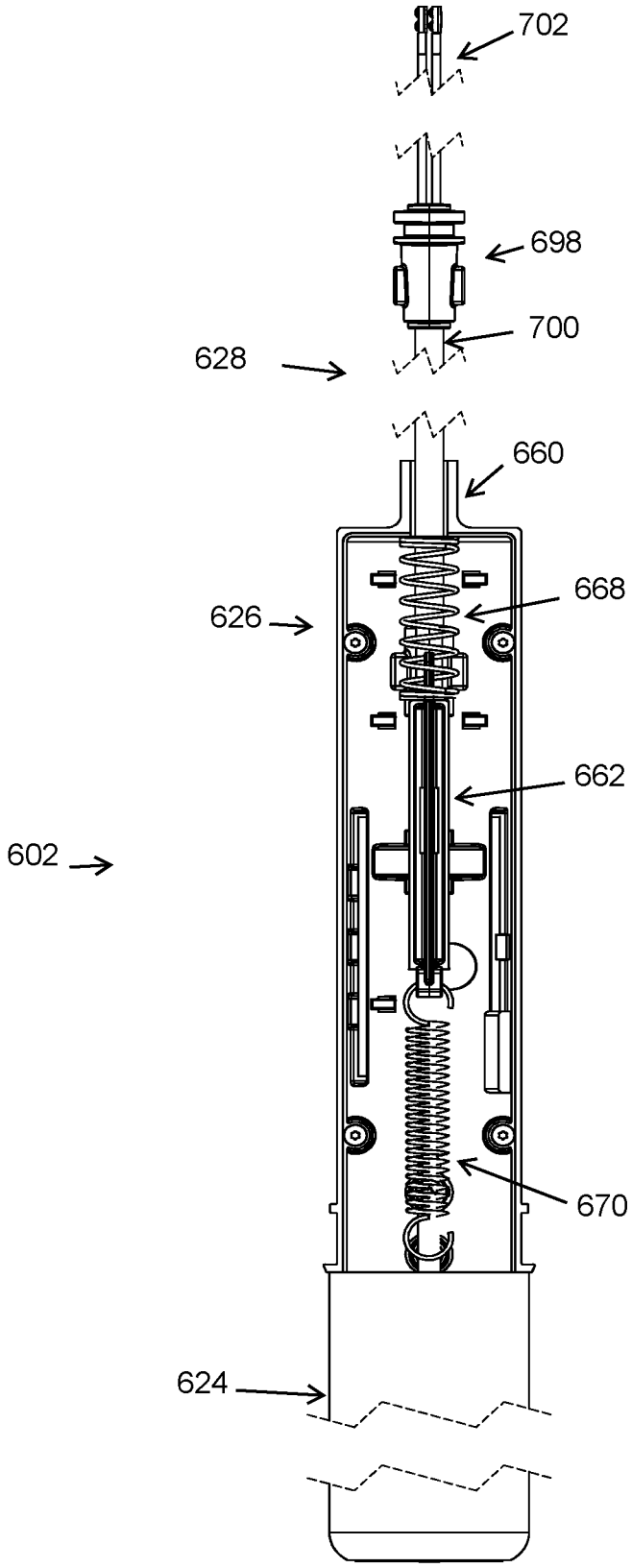
Figure 95:
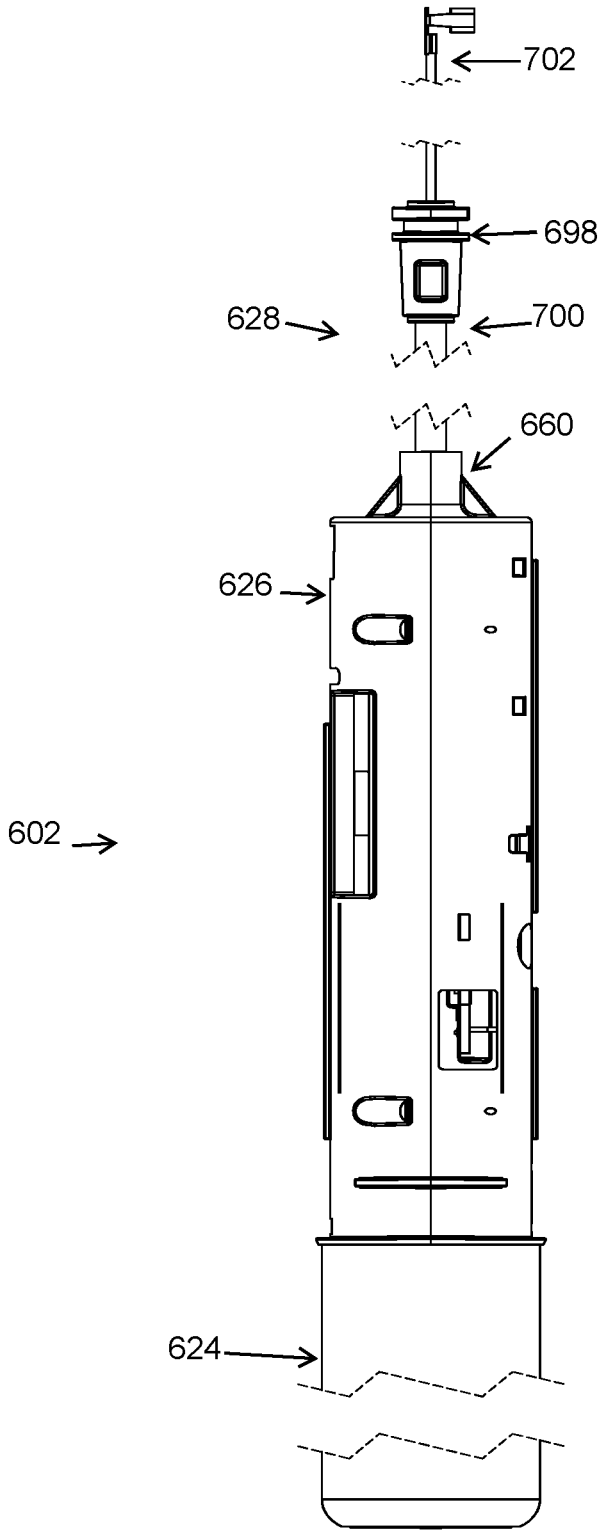
Figure 96:
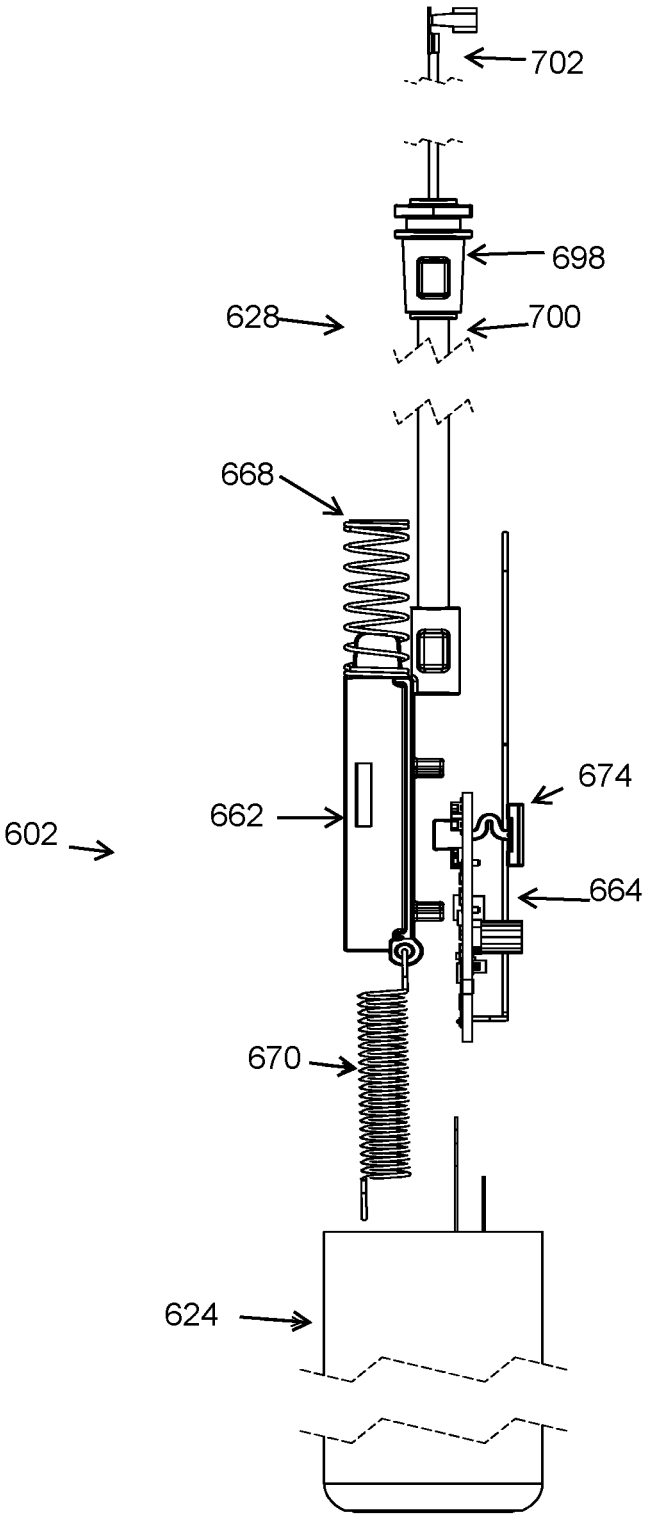
Figure 97:
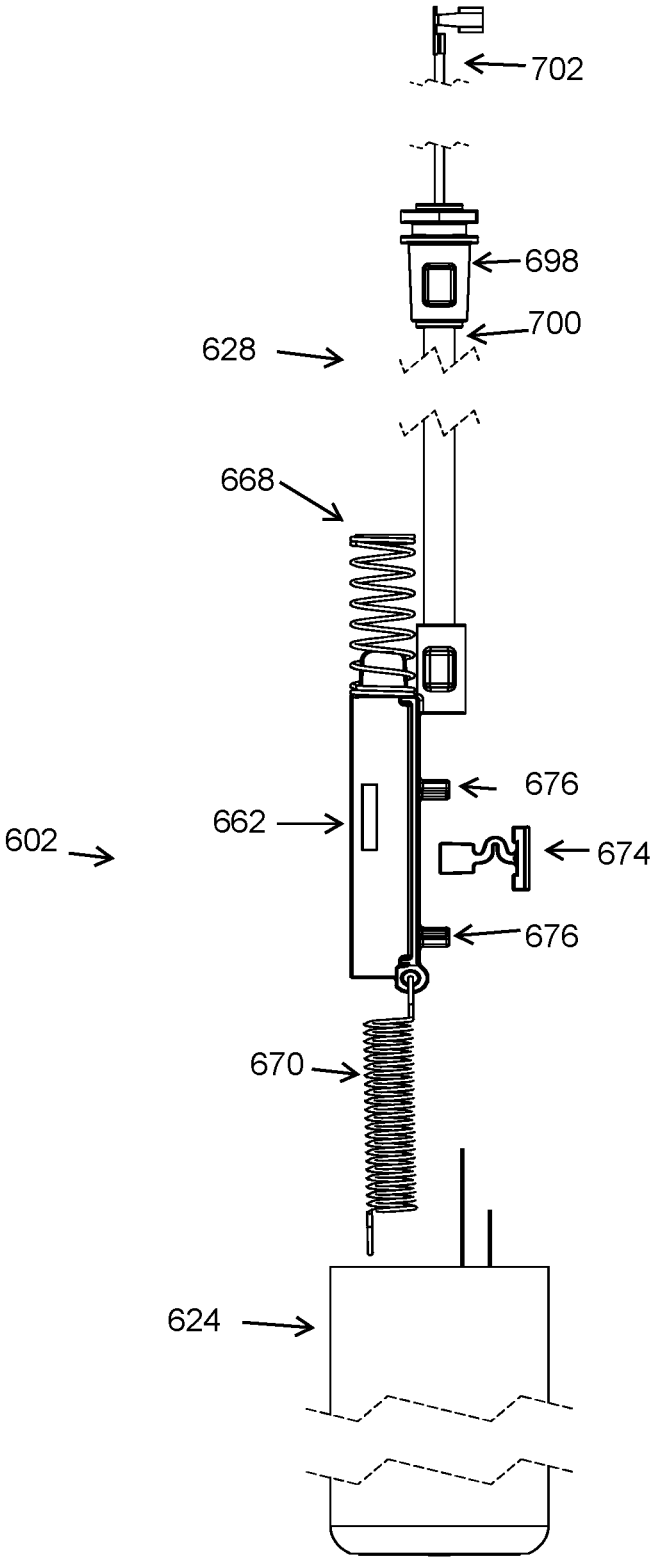
Figure 98:
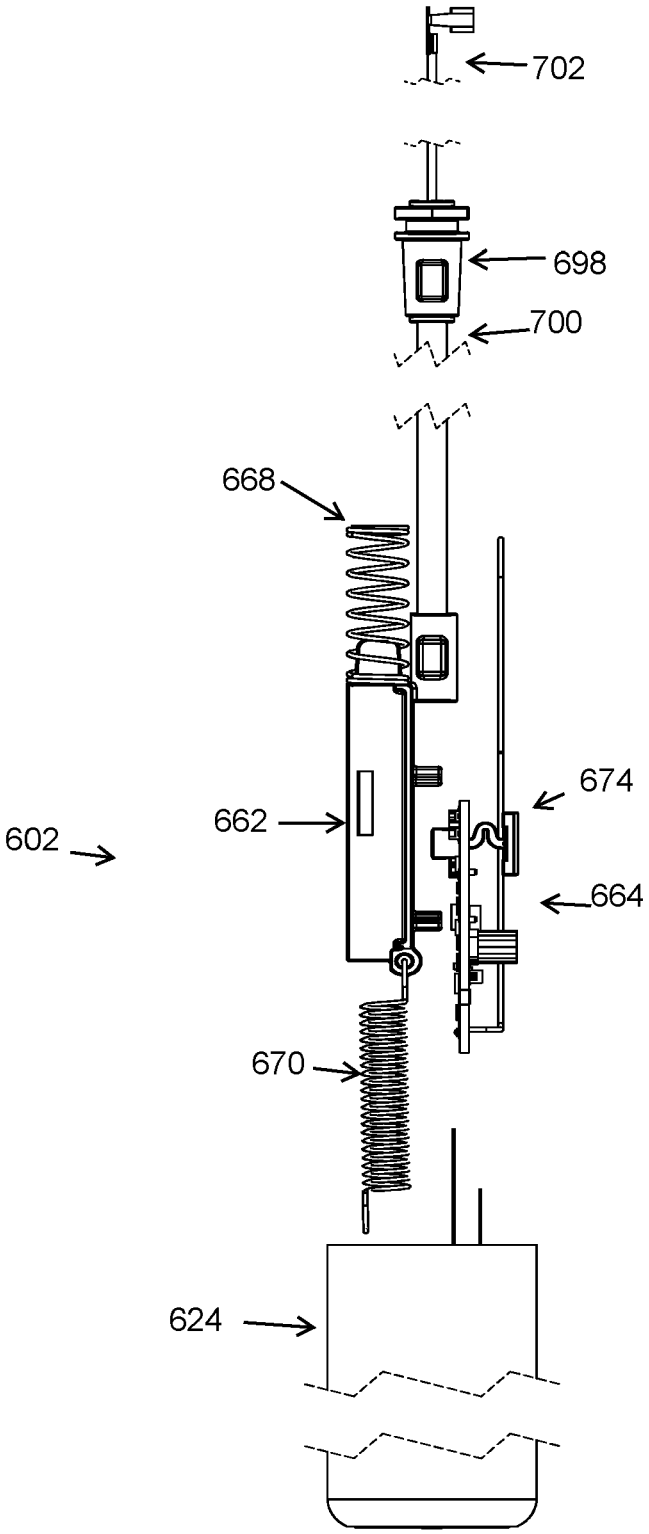
Figure 99:
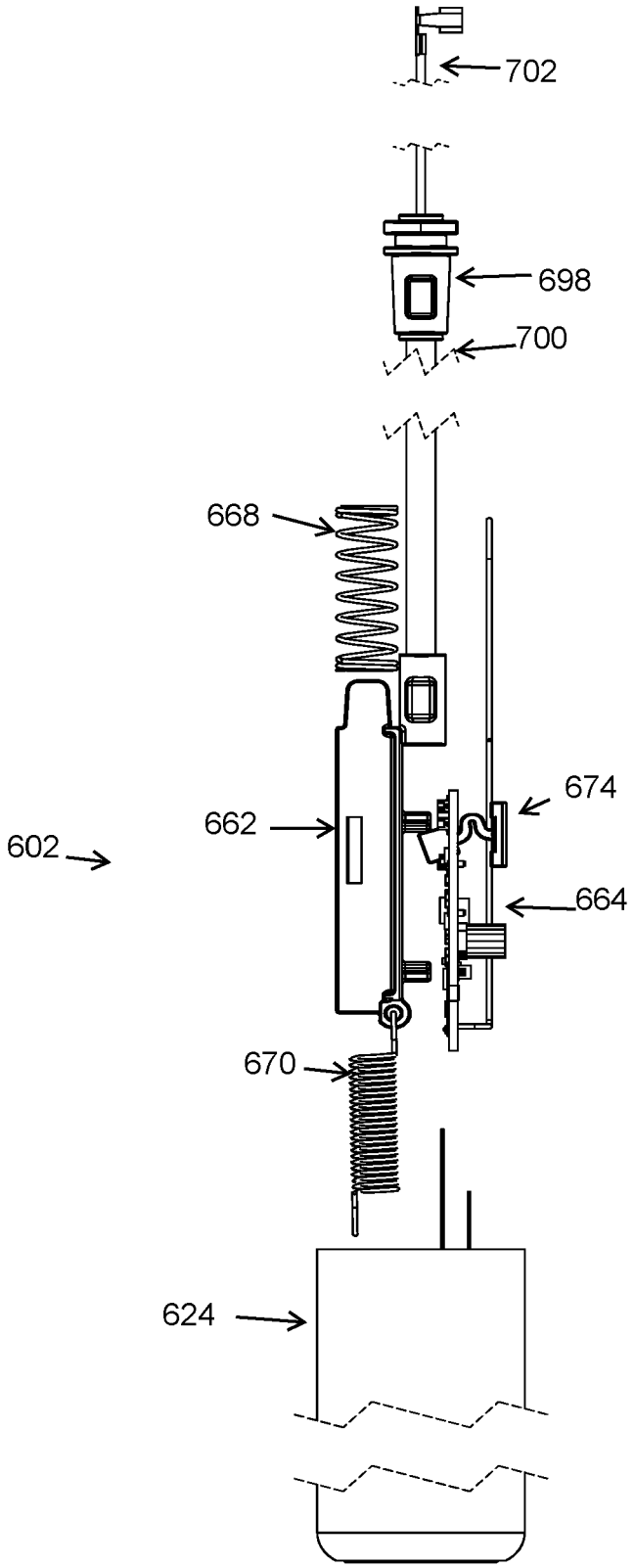
Figure 100:
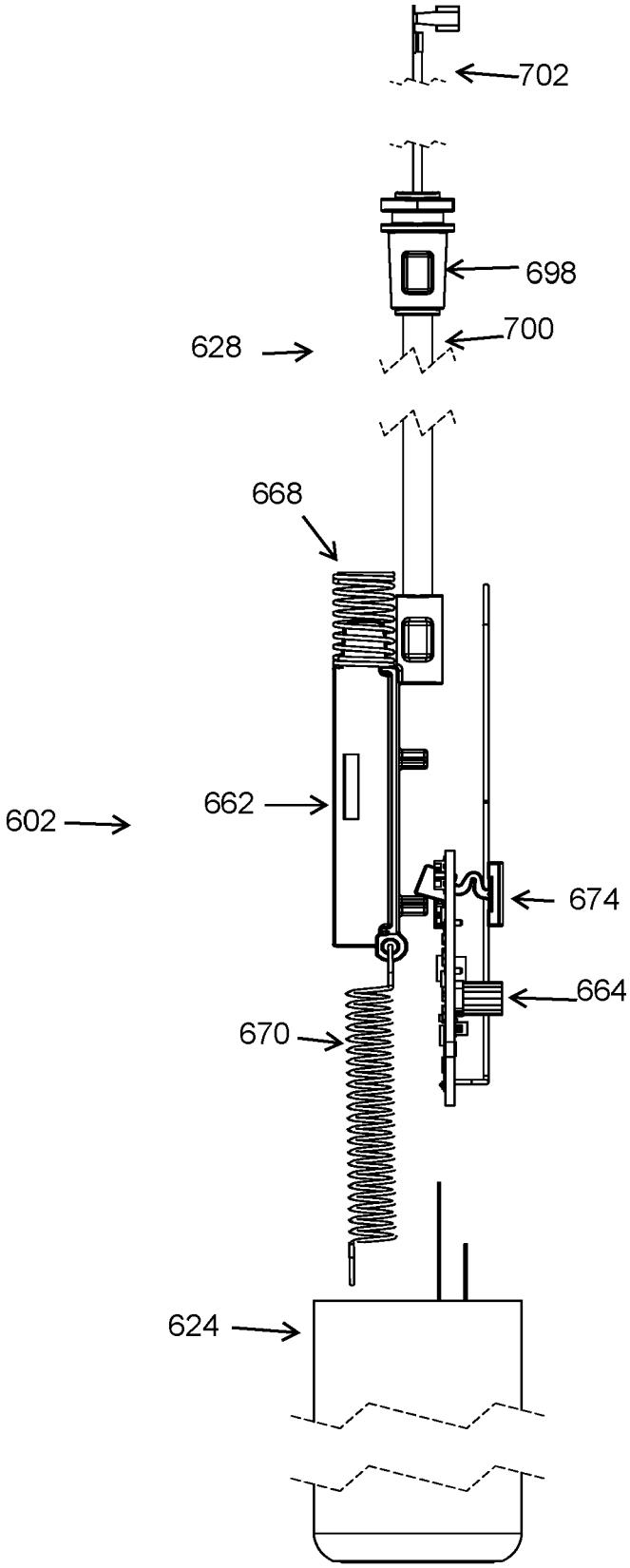
Figure 101:
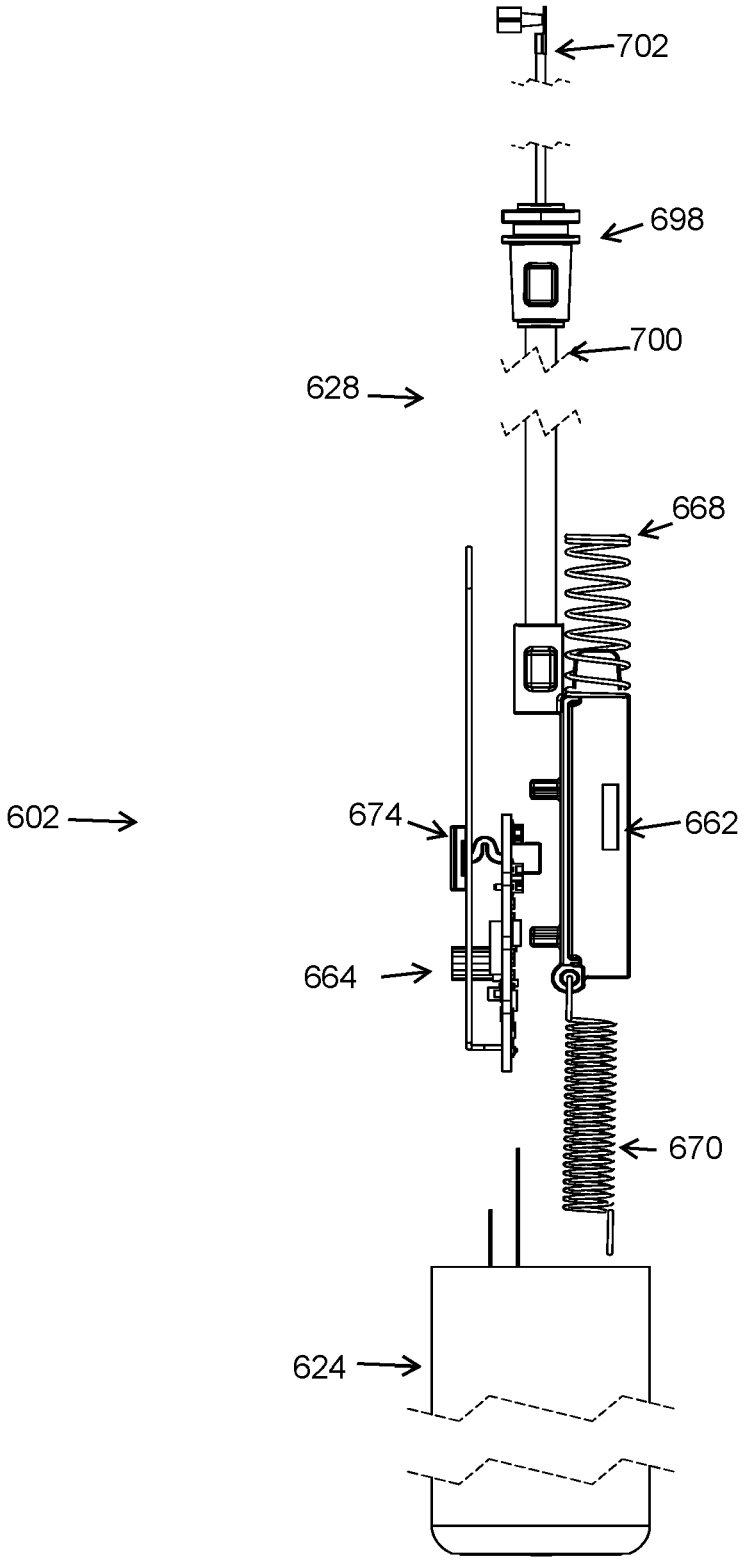
Figure 102:
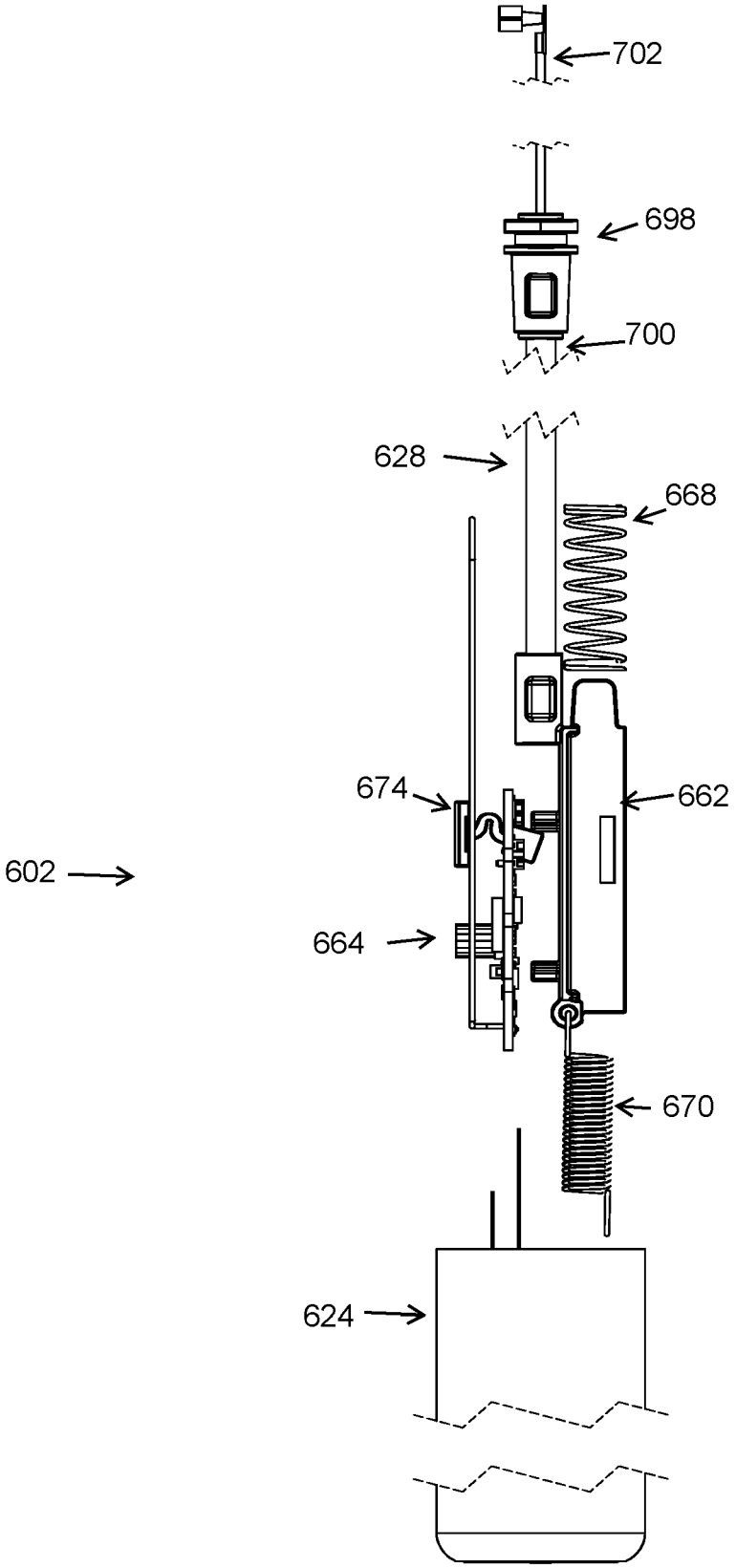
Figure 103:
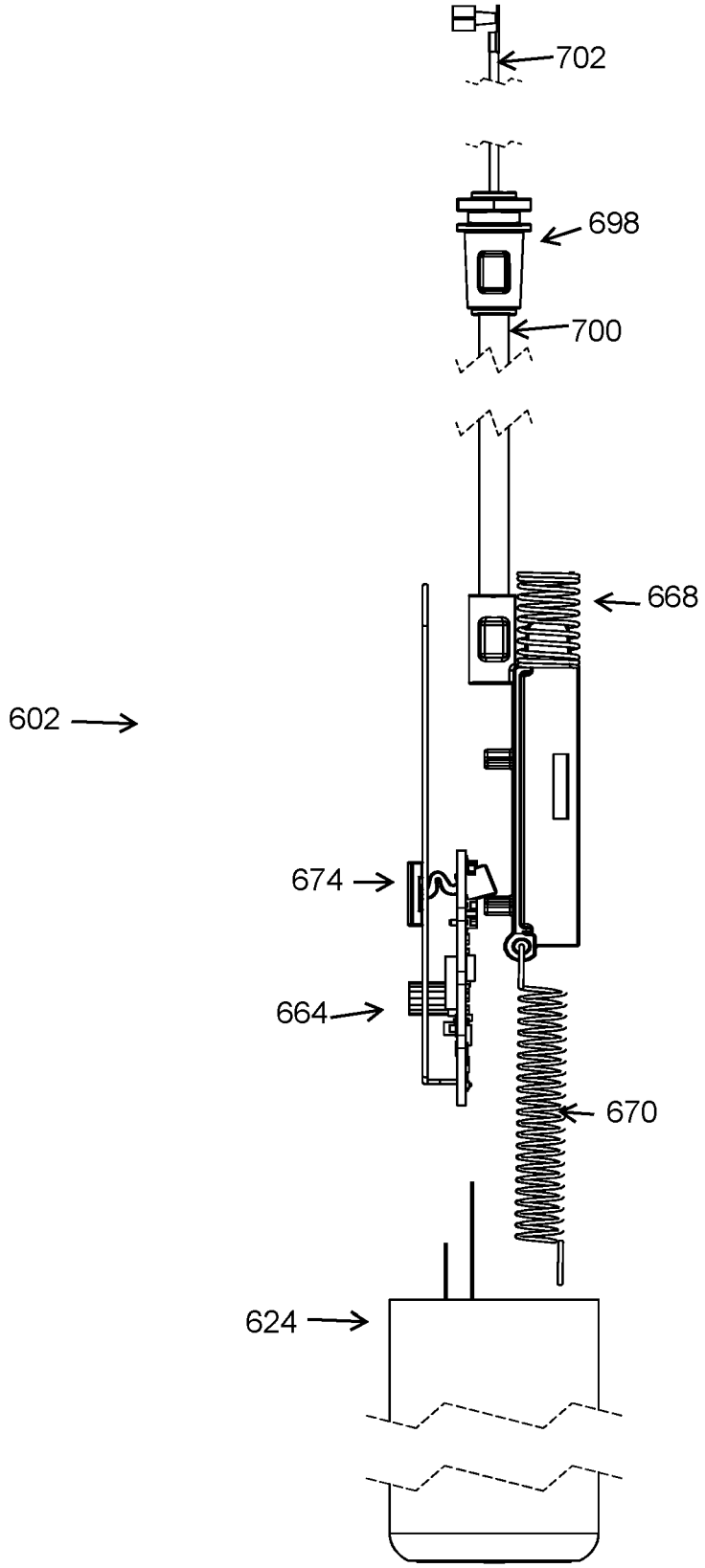
Figure 104:
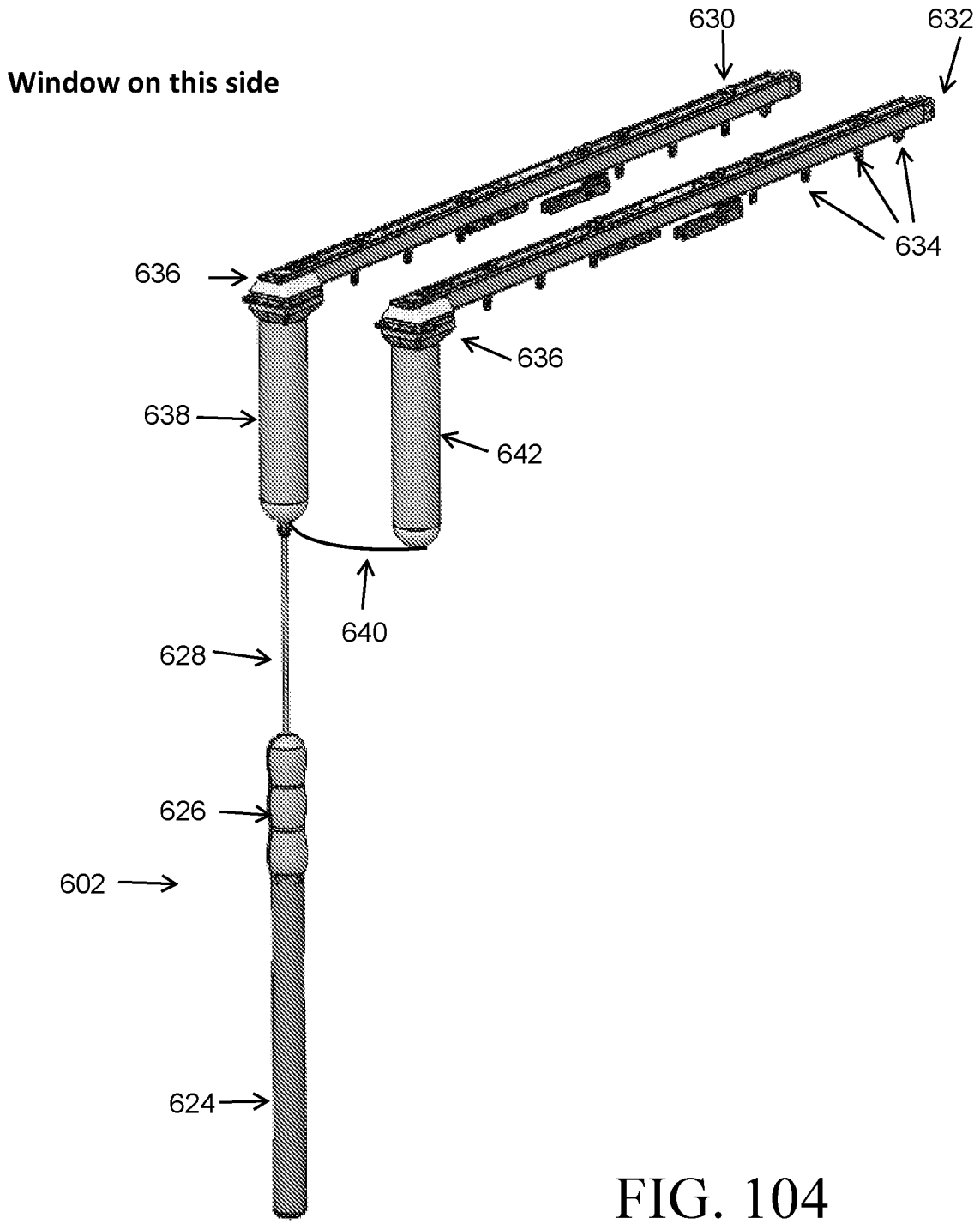
Figure 105:
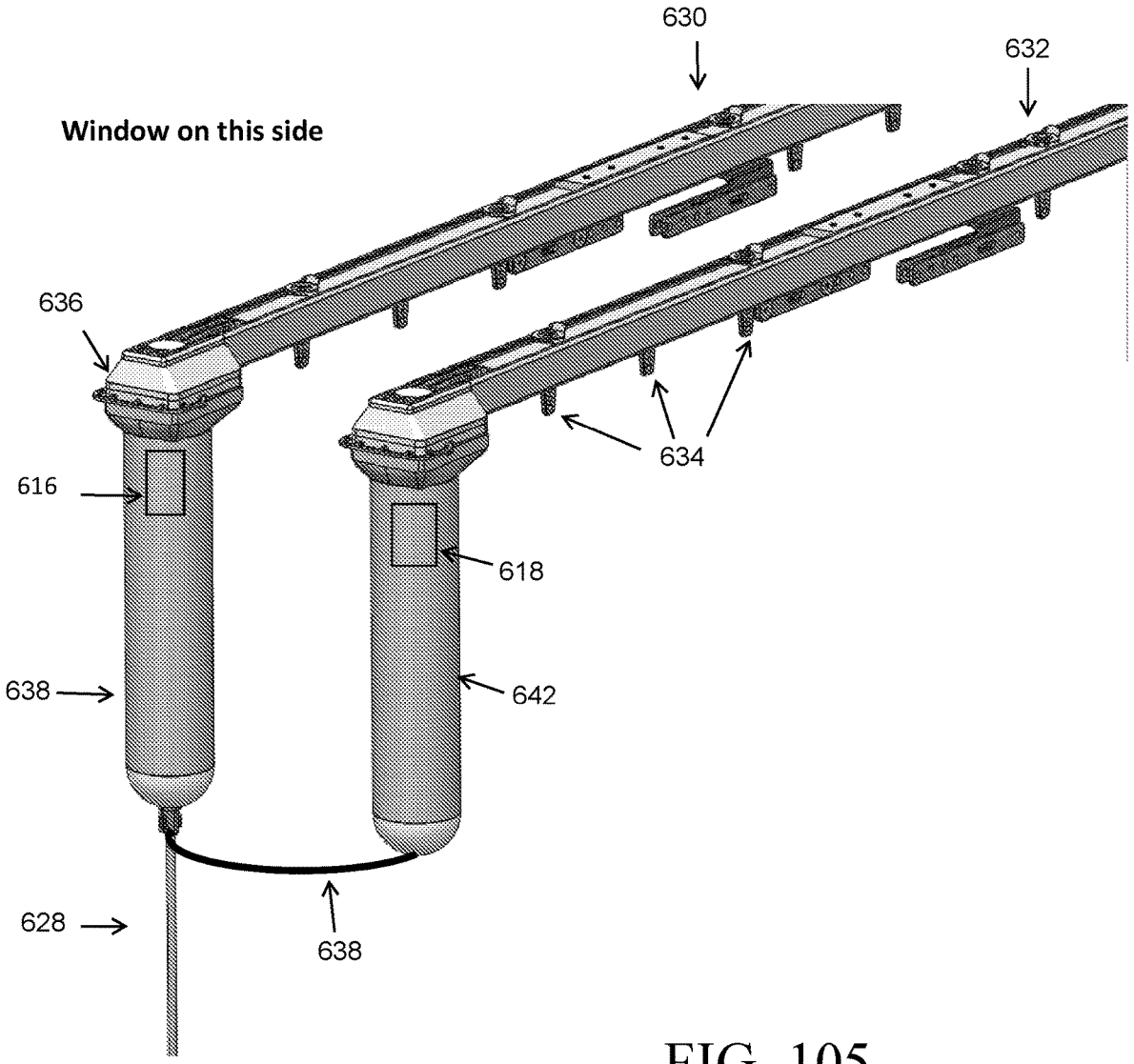
Figure 106:
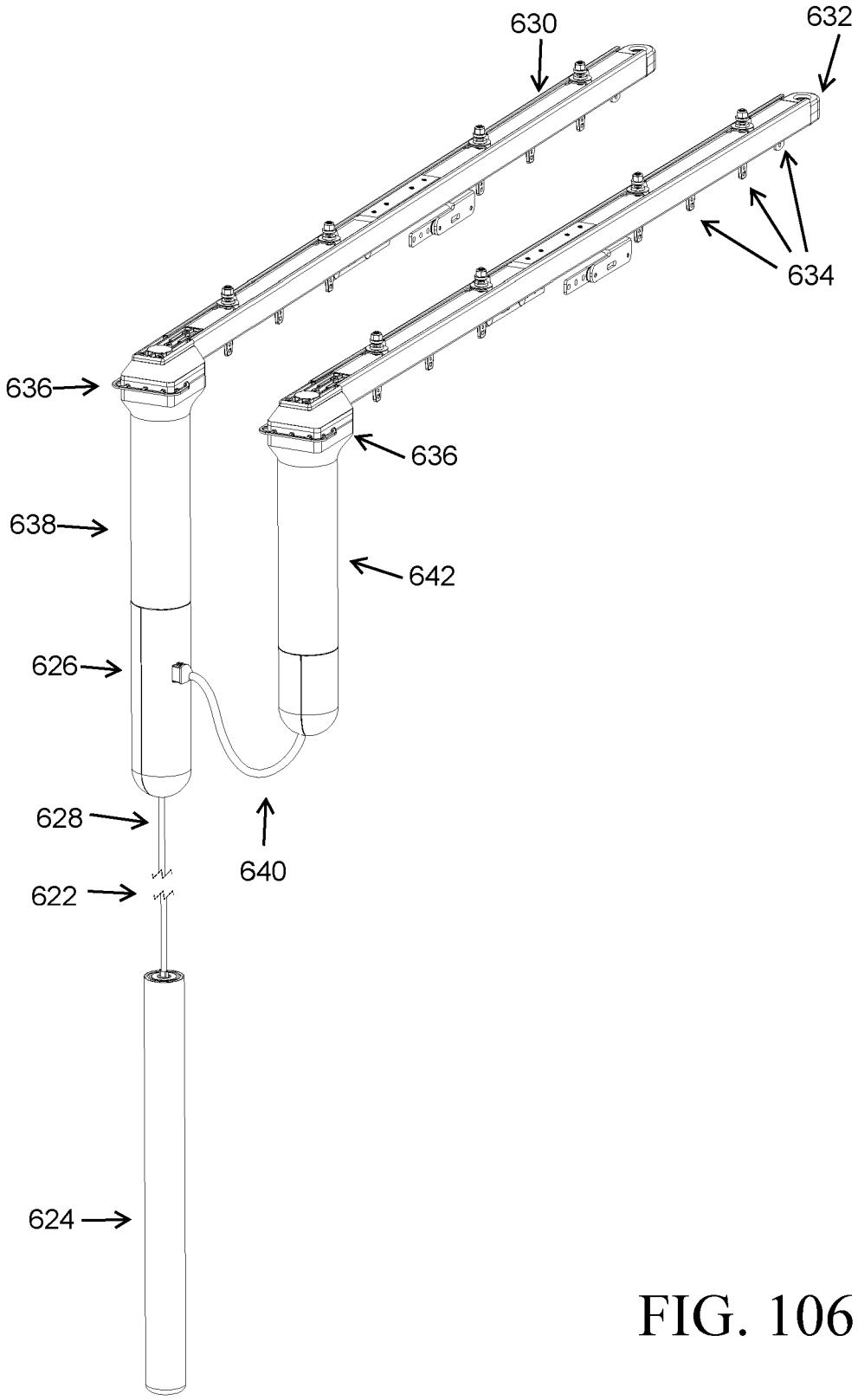
Figure 107:
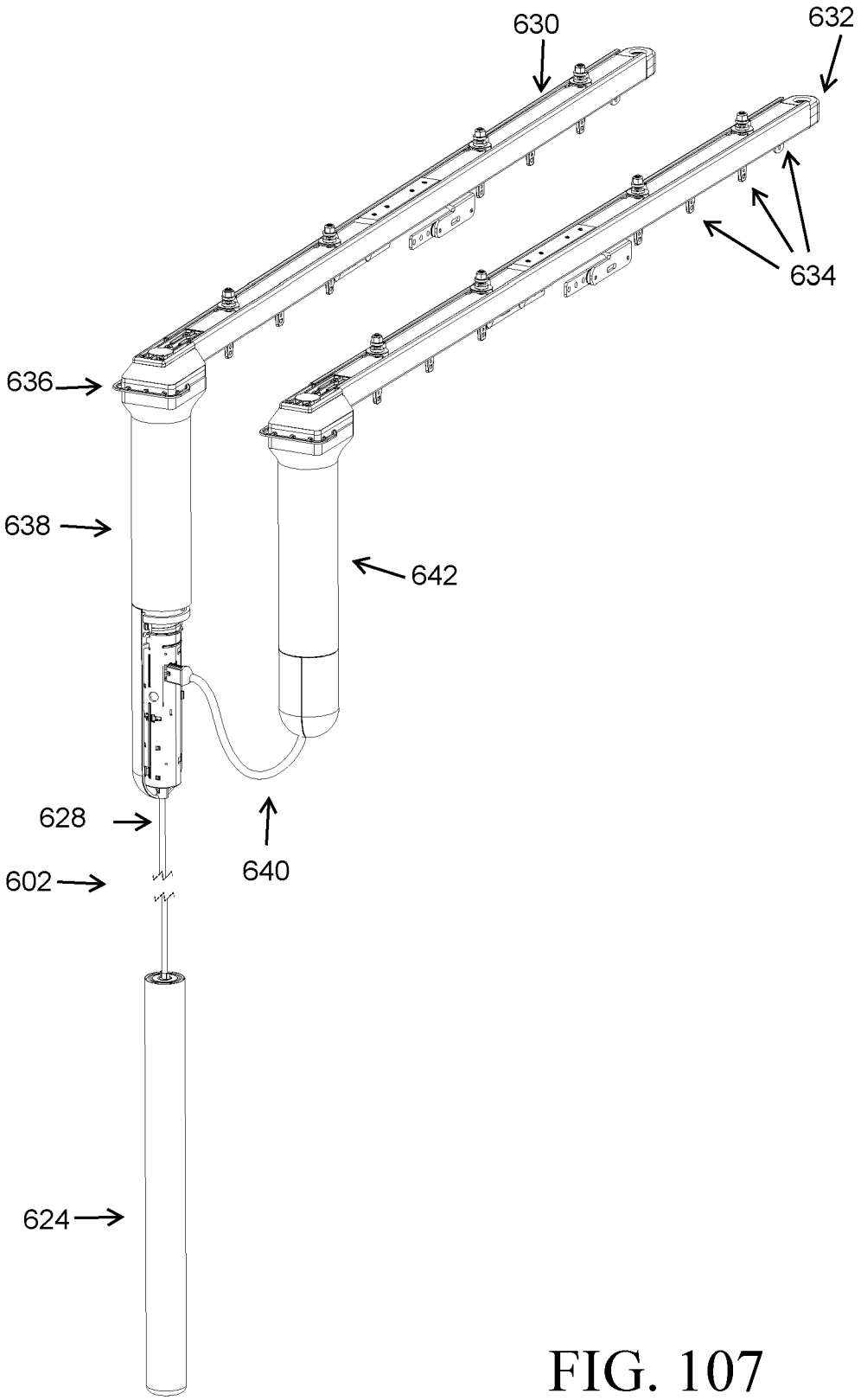

FIG. 82 is a perspective view of a motorized window covering system having a first rotating rod with a first motor and a first shade material connected thereto and a second rotating rod with a second motor and a second shade material connected thereto; the view also shows an external battery tube assembly that hangs down from a bracket supporting the first rotating tube and the second rotating tube wherein the external battery tube assembly provides power to the first motor and the second motor while also facilitating control of the operation of the first motor and the second motor;

FIG. 83 is a perspective view of the motorized window covering system shown in FIG. 82, the view showing the first shade material and the second shade material removed;

FIG. 84 is an exploded perspective view of the external battery tube assembly shown in FIGS. 82 and 83, the view showing the battery housing with its hollow interior that is configured to receive a plurality of batteries; the view showing the controller housing formed of a pair of housing portions; the view showing the moveable member and the stationary member positioned within the hollow interior of the controller housing; the view showing the moveable member connected to the conduit that connects to the motorized window covering system; the view also showing a cover member that covers the controller housing;

FIG. 85 is a side elevation view of the external battery tube assembly of FIGS. 82-84; the view showing the exterior surface of the battery housing, controller housing and conduit of the external battery tube assembly;

FIG. 86 is a side elevation view of the external battery tube assembly of FIG. 85; the view showing cover member removed from the controller housing;

FIG. 87 is a side elevation view of the external battery tube assembly of FIG. 86; the view showing a housing portion removed from the controller housing; the view showing the printed circuit board of the stationary member positioned within the hollow interior of the controller housing;

FIG. 88 is another side elevation view of the external battery tube assembly of FIG. 86 the view taken from the opposite side as FIG. 87; the view showing a housing portion removed from the controller housing; the view showing the printed circuit board of the stationary member positioned within the hollow interior of the controller housing; the view also showing the moveable member positioned within the hollow interior of the controller housing;

FIG. 89 is a side elevation view of the external battery tube assembly of FIG. 85; the view showing cover member removed from the controller housing; the view showing the seam-line where the two housing portions connect together to form the controller housing;

FIG. 90 is a side elevation view of the controller housing, the view showing the housing portions removed, the view showing the moveable member and the stationary member positioned within the controller housing; the view showing the upper spring and lower spring connected to the moveable member; the view showing the moveable member and stationary member positioned in a resting position or an equilibrium position where the detector is positioned between the upper and lower engagement members;

FIG. 91 is a side elevation view of the controller housing shown in FIG. 90, the view showing all but the detector of the stationary member removed;

FIG. 92 is a side elevation view of the external battery tube assembly; the view showing cover member removed from the controller housing;

FIG. 93 is a side elevation view of the external battery tube assembly of FIG. 92; the view showing a housing portion removed from the controller housing; the view showing the printed circuit board of the stationary member positioned within the hollow interior of the controller housing; the view also showing the moveable member positioned within the hollow interior of the controller housing;

FIG. 94 is a side elevation view of the external battery tube assembly of FIG. 92; the view showing a housing portion removed from the controller housing; the view showing the moveable member positioned within the hollow interior of the controller housing; the view showing the upper spring and the lower spring connected to the moveable member;

FIG. 95 is a side elevation view of the external battery tube assembly of FIG. 94; the view showing cover member removed from the controller housing; the view showing the seam-line where the two housing portions 654 connect together to form the controller housing;

FIG. 96 is a side elevation view of the controller housing, the view showing the housing portions removed, the view showing the moveable member and the stationary member positioned within the controller housing; the view showing the upper spring and lower spring connected to the moveable member; the view showing the moveable member and stationary member positioned in a resting position or an equilibrium position where the detector is positioned between the upper and lower engagement members;

FIG. 97 is a side elevation view of the controller housing shown in FIG. 96, the view showing all but the detector of the stationary member removed;

FIG. 98 is a side elevation view of the controller housing, the view showing the housing portions removed, the view showing the moveable member and the stationary member positioned within the controller housing; the view showing the upper spring and lower spring connected to the moveable member; the view showing the moveable member and stationary member positioned in a resting position or an equilibrium position where the detector is positioned between the upper and lower engagement members;

FIG. 99 is a side elevation view of the controller housing, the view showing the housing portions removed, the view showing the moveable member and the stationary member positioned within the controller housing; the view showing the upper spring and lower spring connected to the moveable member; the view showing the upper engagement member of the moveable member in engagement with the detector which is indicative of a user imparted pull or lift, depending on the arrangement, of the external battery tube assembly;

FIG. 100 is a side elevation view of the controller housing, the view showing the housing portions removed, the view showing the moveable member and the stationary member positioned within the controller housing; the view showing the upper spring and lower spring connected to the moveable member; the view showing the lower engagement member of the moveable member in engagement with the detector which is indicative of a user imparted pull or lift, depending on the arrangement, of the external battery tube assembly;

FIG. 101 is a side elevation view of the controller housing, the view showing the housing portions removed, the view showing the moveable member and the stationary member positioned within the controller housing; the view showing the upper spring and lower spring connected to the moveable member; the view showing the moveable member and stationary member positioned in a resting position or an equilibrium position where the detector is positioned between the upper and lower engagement members;

FIG. 102 is a side elevation view of the controller housing, the view showing the housing portions removed, the view showing the moveable member and the stationary member positioned within the controller housing; the view showing the upper spring and lower spring connected to the moveable member; the view showing the upper engagement member of the moveable member in engagement with the detector which is indicative of a user imparted pull or lift, depending on the arrangement, of the external battery tube assembly;

FIG. 103 is a side elevation view of the controller housing, the view showing the housing portions removed, the view showing the moveable member and the stationary member positioned within the controller housing; the view showing the upper spring and lower spring connected to the moveable member; the view showing the lower engagement member of the moveable member in engagement with the detector which is indicative of a user imparted pull or lift, depending on the arrangement, of the external battery tube assembly;

FIG. 104 is a perspective view of a motorized window covering system having a first track with a first motor that supports and operates a first shade material connected thereto and a second track with a second motor that supports and operates a second shade material connected thereto; the view also shows an external battery tube assembly that hangs down from the first motor housing, the view also showing a cable connecting the first motor housing and the second motor housing; wherein the external battery tube assembly provides power to the first motor and the second motor while also facilitating control of the operation of the first motor and the second motor;

FIG. 105 is a close-up view of the perspective view of FIG. 104;

FIG. 106 is a perspective view of a motorized window covering system similar to that presented in FIGS. 104 and 105 having a first track with a first motor that supports and operates a first shade material connected thereto and a second track with a second motor that supports and operates a second shade material connected thereto; the view also shows the controller housing of the external battery tube assembly is connected to the lower end of the first motor housing and the conduit and battery housing 624 hang downward therefrom; the view also showing a cable connecting the first motor housing and the second motor housing; wherein the external battery tube assembly provides power to the first motor and the second motor while also facilitating control of the operation of the first motor and the second motor;

FIG. 107 is the same view as that presented in FIG. 106, the view showing a housing portion removed from the controller housing, which in the arrangement of FIGS. 106 and 107 is connected to the lower end of the first motor housing;

FIG. 108 is a chart of the motor controller operation, the chart describes what happens when the external battery tube assembly is pulled or lifted during different operational states and for both single and dual motor motorized window covering systems.

DETAILED DESCRIPTION

Figure 1:
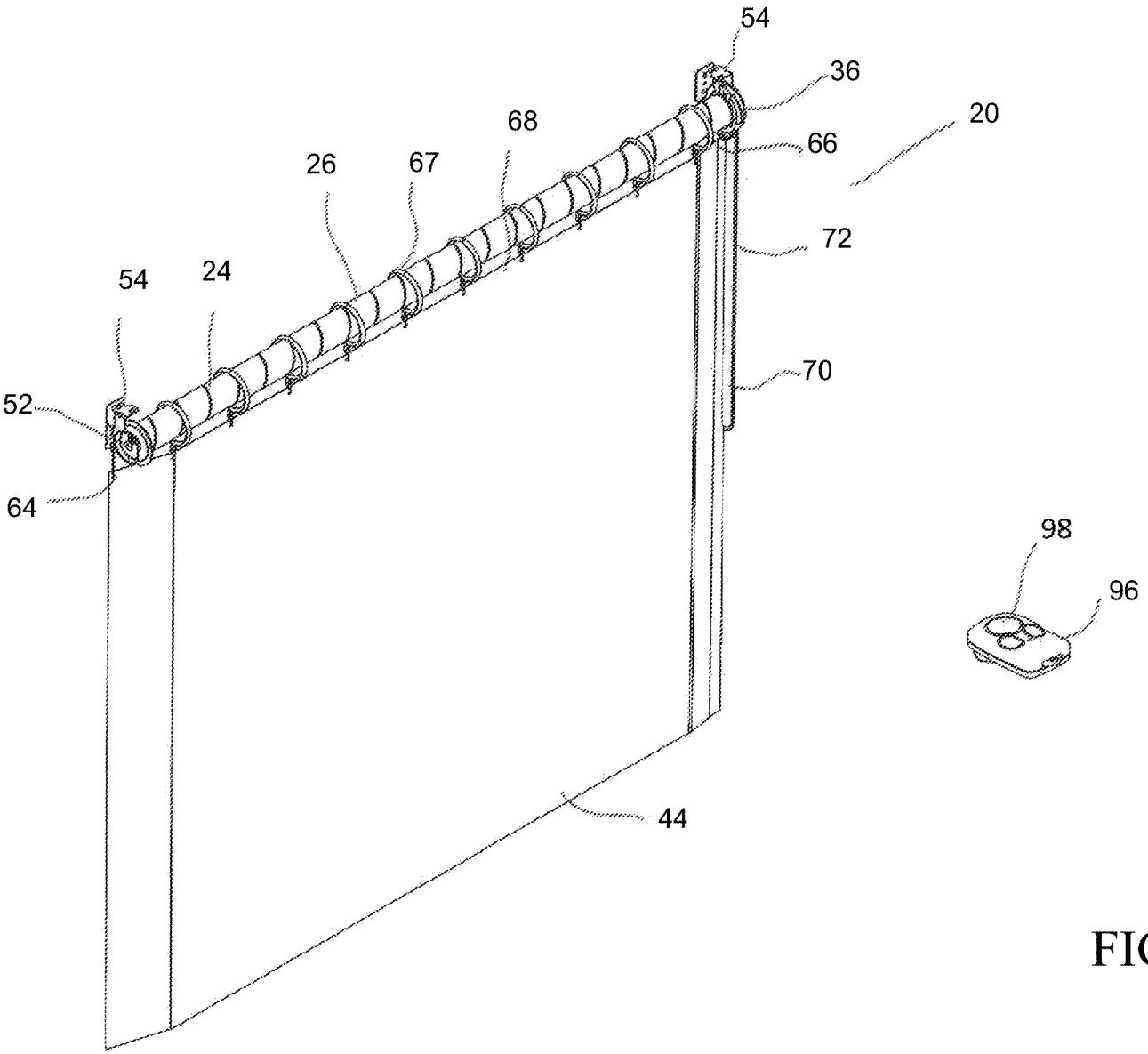
FIG. 1 is a perspective view of one embodiment of the curtain assembly showing a curtain in the deployed position and the window is covered.
Figure 2:
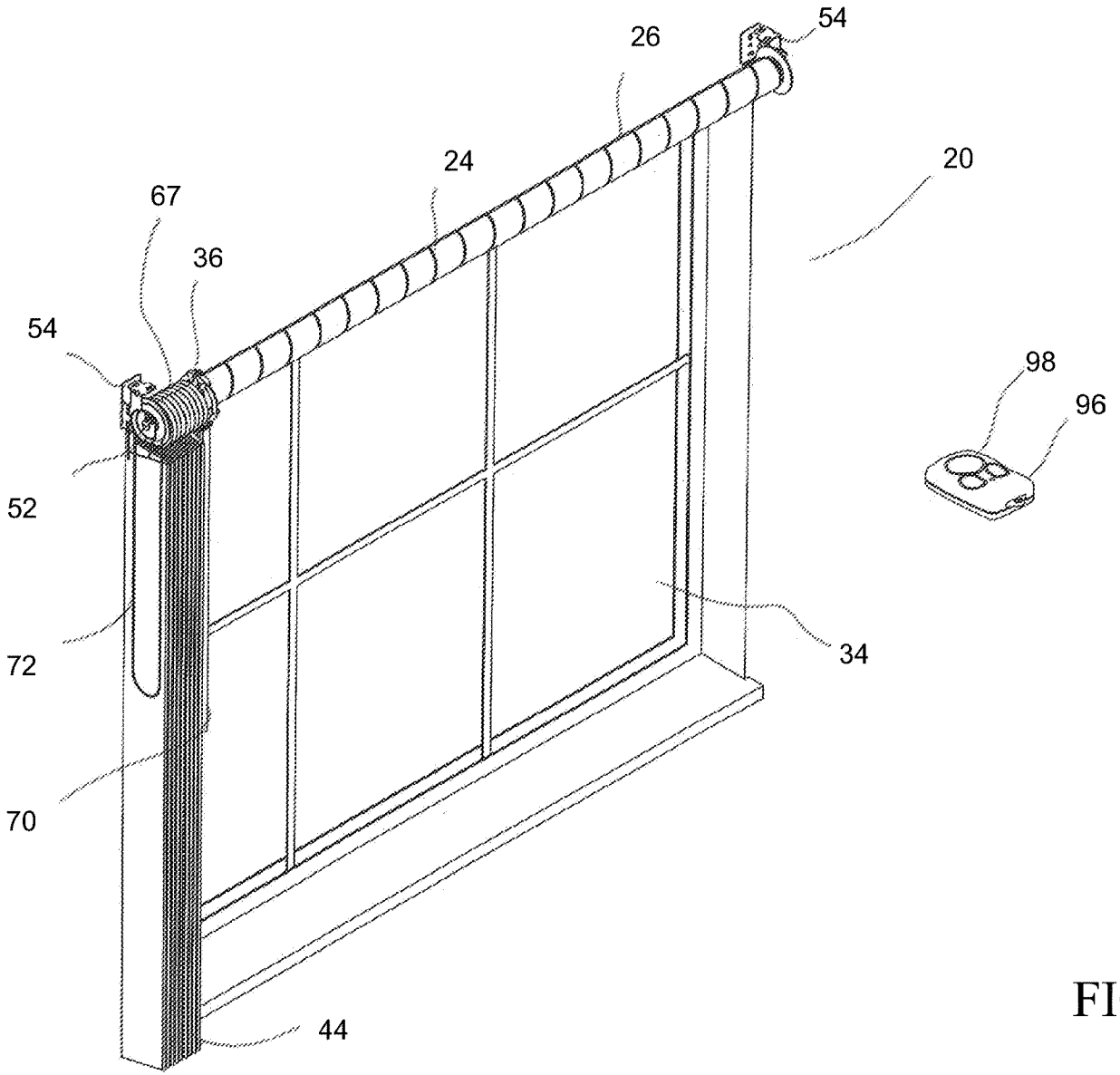
FIG. 2 is a perspective view of one embodiment of the curtain assembly showing the curtain in the stored position and the window is not covered.
Figure 3:
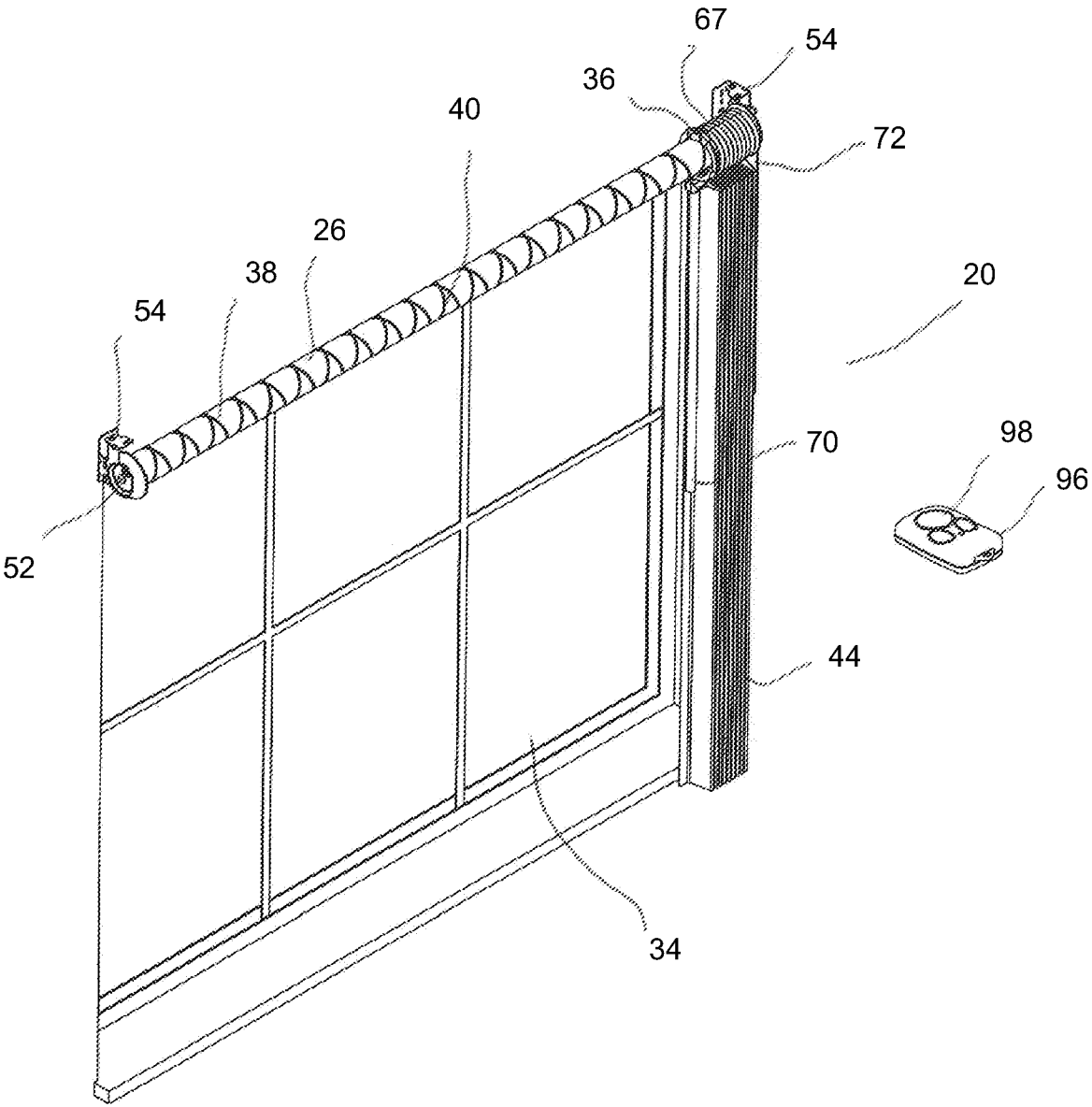
FIG. 3 is a perspective view of one embodiment of the curtain assembly showing a left hand curtain in the stored position.

Referring to FIG. 1, a curtain assembly 20 according to one embodiment of the invention is shown. The curtain assembly 20 comprises a rotatable drive element 22 wherein a helical guide structure 24 is formed into the outer surface 26 of the drive element 22, a drive attachment element 36 having a corresponding structure 62 that communicates with the helical guide structure 24 to move the drive attachment element 36 axially along the drive element 22 when the drive element 22 is rotated and a rotation assembly 32 (not shown) for rotating the drive element 22. In some embodiments of the invention, the helical guide structure 24 is a helical groove 24 and the corresponding structure 62 is a tooth. While the helical guide structure 24 is shown in FIGS. 1-3 as a helical groove, the helical guide structure 24 is not limited to a groove. Similarly, the corresponding structure 36 discussed in the embodiments below is a tooth 62 but is not limited to being a tooth. In some embodiments, one or more curtain supports 67 supported by the rotatable drive element 22 can also be utilized to support the curtain. The drive attachment element 36, as shown in FIGS. 1-3 will be explained further below.

Description of Curtains

As shown in FIG. 1, the curtain 44 used is composed of a single continuous panel of fabric that moves back and forth across the drive element 22 to the deployed position (covering the window) and to the stored position (not covering the window 34). The curtain 44 may extend to the right to the deployed position (covering the window 34) and then gather to the left to the stored position, uncovering the window 34. This is shown in FIGS. 1 and 2. For example, FIG. 1 shows that a curtain 44 extended to the right (deployed position) to cover the window 34 and FIG. 2 shows the curtain 44 gathered to the left (stored position) to uncover the window 34. In other embodiments, the curtain 44 may extend to the left to the deployed position (covering the window 34) and then gather to the right to the stored position (uncovering the window 34). For example, FIG. 3 shows a curtain assembly 20 wherein the curtain 44 is gathered to the right (stored position) to uncover the window 34. Although not shown, the curtain 44 in FIG. 3 would extend to the left to the deployed position to cover the window 34.

Figure 4:
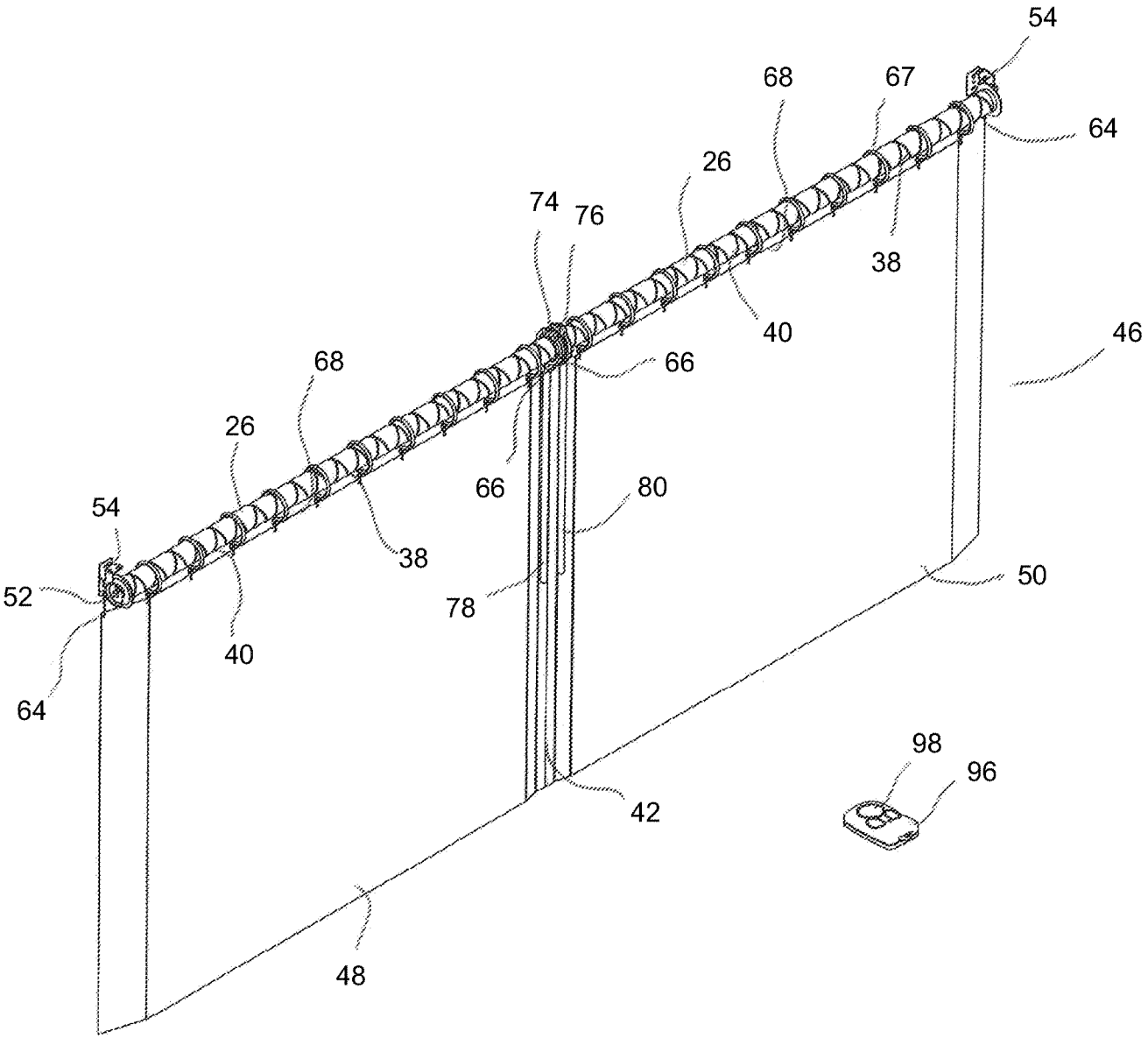
FIG. 4 is an enlarged perspective view of one embodiment of the curtain assembly showing a center closing curtain in the deployed position covering the window.

Again, although a curtain is used to describe a preferred embodiment of the invention, other embodiments utilize other window coverings, such as verticals and draperies. In some embodiments, the curtain 44 may be a center closing curtain 46. A center closing curtain 46 is composed of two fabric panels, a right panel 50 and a left panel 48 that meet in the center 42 of the window 34 to close and cover the window 34. FIG. 4 shows a curtain assembly 20 where a center closing curtain 46 is used and is in the deployed position. The window 34 is covered in this instance. For example, the right panel 50 extends to the left to the center of the window 42. The left panel 48 extends to the right to the center of the window 42.

Drive Element

Figure 5:
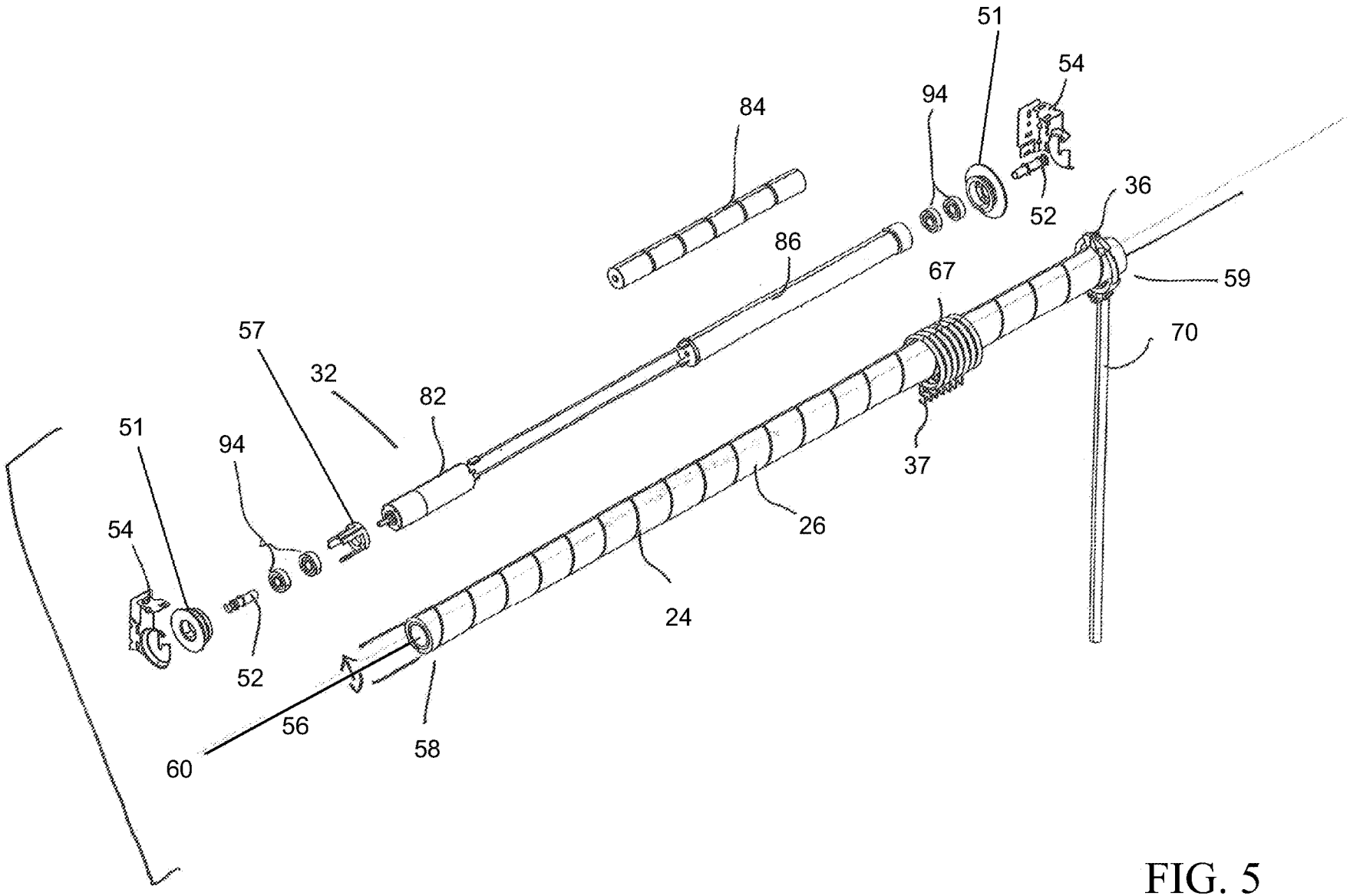
FIG. 5 is an enlarged perspective view of the components of the rotatable drive element according to one embodiment of the curtain assembly in which the rotation of the drive element is powered by a battery operated motor.

The curtain assembly 20 includes a drive element 22. FIGS. 5 and 6 show one embodiment of the drive element 22 in detail. A curtain 44 can be connected to the drive element 22 by one or more curtain supports 67 as explained below. Alternatively, at least a portion of the curtain can be supported by another structure adjacent to the rotatable drive element 22, such as a support guide (not shown).

The rotatable drive element 22 is designed to be installed above a window 34, or near the top of the window 34, similar to a traditional curtain rod. For example, as shown in FIG. 1, drive element 22 is mounted on axles 52 that are located and secured in the end brackets 54. The end brackets 54 are adapted for connection with, for example, a window frame, sash, or wall. The end brackets 54 may also include a rubber mounting disk 13, not shown, that is compressed, and, optionally, inserted into a finial 95 or other structure to create friction, when the drive element 22 is installed, to hold the drive element 22 firmly in place and minimize noise.

The drive element 22 may vary in size. For example, the drive element 22 may be the width of the window 34, narrower than the window 34, or wider than the window 34. The outer diameter 56 of the drive element 22 may similarly vary. In specific embodiments, the drive element has an outer diameter of the drive element that is 1 inch, 1¼ inches, 1½ inches, 2 inches, 1-2 inches, 1-1½ inches, 1½-2 inches, less than 1 inch, and/or greater than 2 inches. In some embodiments, the drive element 22 has a hollow portion that is sized to mount a motor 82 inside the hollow portion of the drive element 22 rather than mounting the motor 82 outside the drive element 22. Using the inside of the drive element 22 to conceal the motor 82 may give a more aesthetically pleasing design for a curtain assembly 20. Any number of materials, such as aluminum, other metals or alloys, plastics, wood, and ceramics, may be used to fabricate the drive element 22 provided the drive element 22 can support the weight of the curtain 44.

Although the FIGS. 5 and 6 show the outer surface of the drive element 22 as cylindrical in shape, the cross-sectional shape of the drive element 22 is not limited and may be non-circular. In an alternative embodiment, as shown in FIGS. 20 and 21, the rotatable drive element 22 may be tri-lobed.

Guide Structure

Figure 9:
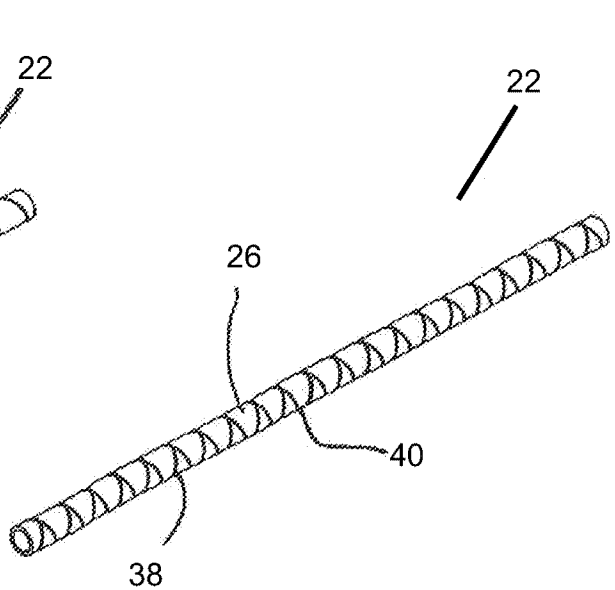
FIG. 9 is an enlarged perspective view of one embodiment of the curtain assembly showing the rotatable drive element with a clockwise helical groove and a counter clockwise helical groove.
Figure 8:
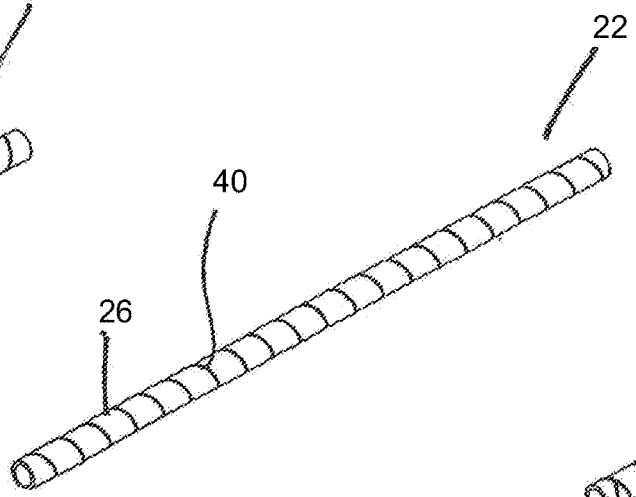
FIG. 8 is an enlarged perspective view of one embodiment of the curtain assembly showing the rotatable drive element with a counter clockwise helical groove.
Figure 7:
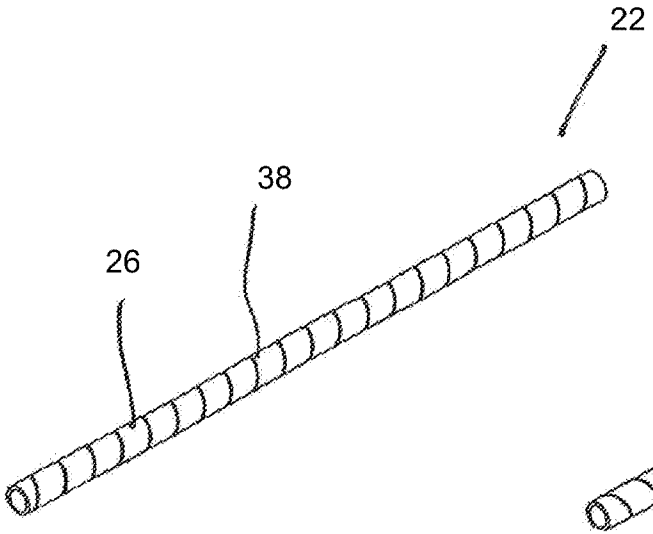
FIG. 7 is an enlarged perspective view of one embodiment of the curtain assembly showing the rotatable drive element with a clockwise helical groove.

The drive element 22 has at least one guide structure 24 formed, for example, on, or into, the outer surface 26 of the drive element 22. For convenience, as a preferred embodiment employs a one or more helical guide structure, it is understood that descriptions of embodiments of the invention having helical guide structures also applies to embodiments having guide structures with other patterns. A preferred guide structure 24 is a helical guide structure 24. Such a guide structure may be a groove in some embodiments, as shown in FIGS. 7-9. The helical guide structure 24, however, is not limited to being a helical groove. For example, the guide structure 24 may be a ridge, protrusion, or other structure that can communicate with the corresponding structure of the drive attachment element to axially move the drive attachment element along the drive element when the drive element is rotated.

The helical groove 24 can extend along a portion of, or the entirety of, the drive element 22. In a preferred embodiment, the helical groove extends from one distal end portion, referred to as the motor end 58, to the opposing distal end portion, referred to as the bearings end 59, of the drive element 22. Alternatively, the helical guide structure 24 can begin and end at any desired point along the longitudinal axis of the drive element 22, and/or stop and start over various portions of the drive element, depending on the application. The length of the helical groove 24 is a factor in determining how far a curtain 44 will travel across the drive element, i.e., the entire length of the drive element 22 as opposed to some shorter section of the drive element 22. The angle of the helical groove determines how far the drive attachment element will move along the drive element for a given amount of rotation of the drive element.

In an embodiment, the helical groove 24 is formed in either a clockwise direction or a counterclockwise direction. FIG. 7 illustrates a drive element 22 having a counter-clockwise helical groove 38. FIG. 8 illustrates a drive element 22 having a clockwise helical groove 40.

In one embodiment, the drive element 22 has two helical grooves 24, one formed in the clockwise direction and one formed in the counterclockwise direction. FIG. 9 illustrates a drive element 22 in which there are a counter clock-wise helical groove 38 and a clockwise helical groove 40. In yet other embodiments, the drive element 22 may have four helical grooves, two clockwise helical grooves 38 and two counter clockwise helical grooves 40 as shown in FIGS. 22-24.

When two clockwise helical grooves 38 or two counter-clockwise helical grooves 40 are utilized, the two clockwise helical grooves 38, or the two counter-clockwise helical grooves 40 are preferably spaced approximately 180 degrees apart. Other spacing can also be utilized. The clock-wise helical grooves 38 and the counterclockwise helical grooves 40 preferably form the same angle with the longitudinal axis. The profile of the helical grooves 38, 40 can be self-centering to allow the drive tooth 62 to traverse the inter-section of the clockwise helical groove 38 and the counter clockwise helical groove 40 without binding. A beveled groove, which allows such self-centering, is shown in FIG. 17.

The helical grooves 24 may be formed by forming grooves into the outer surface 26 of the drive element 22 such that the grooves 24 are recessed from the outer surface 26 of the drive element 22. Alternatively, the helical guide structures 24 may be formed as one or more protrusions that project or bulge from the outer surface 26 of the drive element 22. The protrusions may be formed in a variety of manners, for example, by winding material around the outer surface 26 of the drive element 22, forming, e.g., extruding the drive element in a manner that creates indentations in and/or projections from the outer surface of the drive element, or forming the drive element so as to have an outer surface able to apply a force in the longitudinal direction to a structure 62 of the corresponding drive attachment element 36 when the corresponding structure is engaged with the structure 24 upon rotation of the drive element about the longitudinal axis.

In an alternative embodiment, a sleeve, or outer tube 63, having helical guide structure 24 and sized to fit around a portion of the drive element 22 may be used. In this case, the drive sleeve has at least one helical groove 24 in a clockwise or counter clockwise direction formed on the outer surface of the sleeve. The sleeve/outer tube can be interconnected to an inner tube 61, or other inner drive element 9 (e.g., rod), that is rotated so as to cause the rotation of the sleeve/outer tube. The inner drive element 9 can provide sufficient stiffness to keep the sleeve from bending too much along the longitudinal axis of the sleeve from the weight of the curtains, so that the sleeve need not be sufficiently stiff to keep from bending too much along the longitudinal axis of the sleeve from the weight of the curtains. The drive element 22, which then comprises the inner drive element 9 and the outer tube or sleeve, again translates the torque from the rotation assembly to axially movement of the curtain support 67 or drive attachment element 36 across the drive element 22. In an embodiment, the drive sleeve is secured to the inner drive element to form the drive element 22 such that the sleeve does not slide up or down the inner drive element or rotate around the inner drive element 9. It may also be desired to remove the sleeve from the inner drive element 9 and replace it with another sleeve. Using a drive sleeve has the advantage that the geometry of the helical groove 24 including its length may be easily changed by removing the sleeve and replacing it without fabricating a new drive element 22.

The helical grooves 24 may also vary in angle and therefore, may differ in the amount of time (rotations of the drive element) that it takes to travel across the drive element 22. For example, a helical groove 24 with a larger angle, with respect to a plane through a cross-section of the drive element, may create a shorter path for the structure to travel and lead to a faster moving curtain 44 for a certain rotation speed of the drive element. In some embodiments, the angle of the helical grooves 24, with respect to a cross-sectional plane of the drive element, may vary along the drive element in the direction of the longitudinal axis 60 of the drive element 22 such that the curtain 44 may move at different speeds along the drive element 22, for a given rotational speed of the drive element, if desired. The angle of the helical groove 24, with respect to a cross-sectional plane of the drive element, varies from greater than 0 degrees and less than 90 degrees, preferably varies from 10 degrees to 80 degrees, more preferably varies from 20 degrees to 70 degrees, even more preferably varies from 30 degrees to 60 degrees, and is most preferably 45 degrees.

Rotation Assembly

The drive element 22 can be connected to a rotation assembly 33 for rotating the drive element 22, where the rotation of the drive element 22 moves the drive attachment element 36 along the drive element via the helical groove 24 of the drive element 22.

The rotation assembly 33 may be a pull cord 72 connected to the drive element 22 or a motor assembly 32. The drive element 22 may be rotated manually. For example, a pull cord 72 as shown in FIGS. 1-3 may be connected to the drive element 22 such that the drive element 22 can be manipulated manually to rotate when it is desired to deploy or store the curtain 44. The use of pull cords 72 is well known in the art.

A motor assembly 32 may be used to rotate the drive element 22. The motor 82 may be mounted either inside or outside the drive element 22. In one embodiment, the motor 82 is mounted inside the drive element 22 and generally concealed from plain view. Components including axles 52 and bearings 94 may also be located inside the rotatable drive element 22.

A slip ring 28 may be used to transfer current from the power supply external to the drive element 22 to the motor 82 in the drive element 22 as shown in FIG. 6. Alternatively, batteries 84 in a battery tube 86 may be used as shown in FIG. 5 to power the motor 82. The batteries 84 in the battery tube 86 may be in a spring loaded sleeve to assist with loading and unloading the batteries 84 from the battery tube. In some embodiments, a motor drive adapter 92 as shown in FIG. 6 may also be used to securely attach or connect the motor 82 to the drive element 22. In other embodiments, the motor housing fits tightly against the drive element 22 and turns the drive element 22 when the motor output shaft is held in end bracket 54 to prevent it from turning. FIG. 5 shows the interconnection of end caps 51, axles 52, bearings 94, bearing housings 57 (note the bearing housing 57 is shown on the motor end in FIG. 5, but the bearing housing 57 on the battery end is not shown), motor 82, and battery tube 86. FIG. 6 shows a slip ring 28, which is optional, and allows the circuit to be completed while rotating.

In a motorized operation, the user may push a button 98 on a remote control 96 to turn on the motor 82 to rotate the drive element 22 such that the curtain 44 moves across the drive element 22 between a stored position and a deployed position depending on the user's preference. The remote control 96 and button 98 are shown in FIGS. 1-3. In other embodiments, the motor 82 may respond to a signal from the remote control 96 that is initiated by a voice command to the remote control, which then causes the motor 82 to rotate the drive element 22.

The curtain assembly 20 may also include a remote control 96 having a control board that generates a signal when the user makes a selection on the remote control 96. The control board has a transmitter that can wirelessly communicate with a receiver that is remotely located from the transmitter. For example, the receiver may be located in the motor 82 in the drive element 22. The receiver receives the trans-mitted signal from the transmitter and transmits it to the motor 82, which will cause the motor 16 to turn on, rotate the drive element 22, and moves the curtain 44.

As the drive element rotates, either manually or by a motor 82, the curtain 44 is engaged on the drive element 22 and moves axially along the drive element 22 to either a deployed or stored position.

Curtain Support, Drive Attachment Element and Structure

The curtain assembly 20 can include a drive attachment element 36 having a structure 62 that communicates with the guide structure 24 to move the drive attachment element 36 axially along the drive element 22 when the drive element 22 is rotated. The curtain assembly can also include one or more idler attachment elements 67 that interconnect with the drive element to support the window covering, e.g. curtain. In specific embodiments, the drive attachment element 36 has a corresponding feature 62 that is a tooth 62 as described below.

Figure 12:
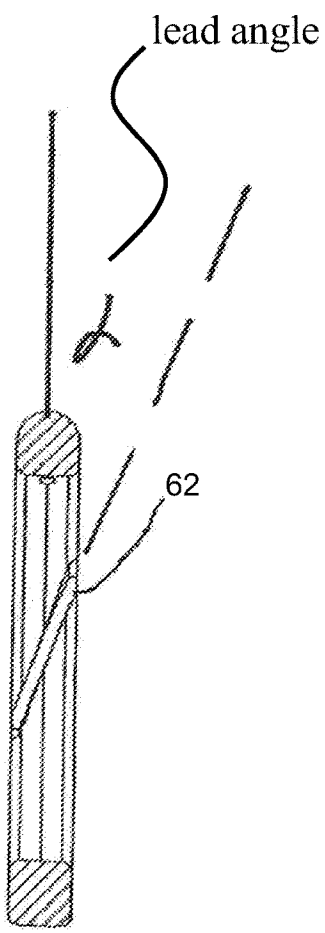
FIG. 12 is an enlarged cross-sectional view of the drive attachment element 36 showing the angle of the drive tooth 62 according to one embodiment.
Figure 10:
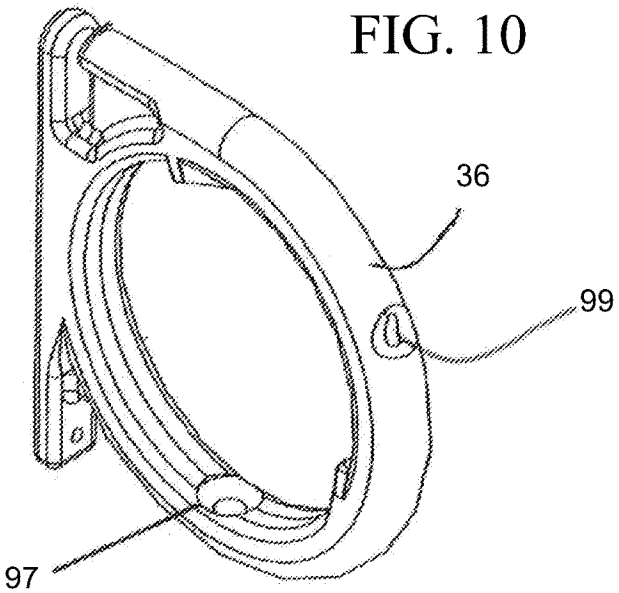
FIG. 10 is an enlarged perspective view of the drive attachment element according to one embodiment.
Figure 11:
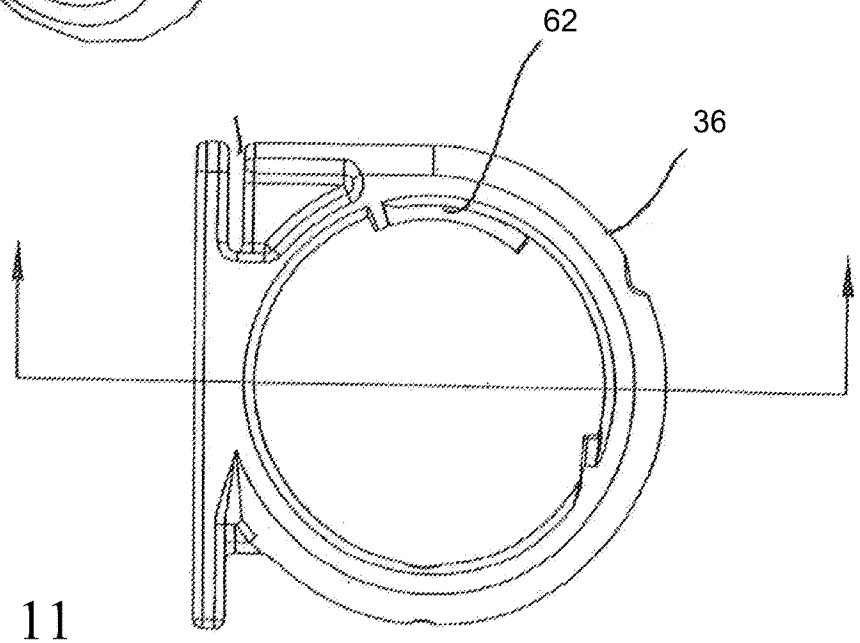
FIG. 11 is an enlarged side view of the drive attachment element 36 showing the structure 62 as a tooth according to one embodiment.

The curtain assembly 20 of the present invention may include in some embodiments at least one drive attachment element 36 having a feature 62 that communicates with a helical guide structure 24 to move the drive attachment element 36 axially along the drive element 22 when the drive element 22 is rotated. The helical guide structure may be a helical groove 24 and the feature 62 may be a tooth. Referring to FIG. 1, one end, such as the motor end, of the curtain can be fixed 64 and the adjacent opposing end, such as the bearings end, of the curtain 66 can be attached to the drive attachment element 36. The feature 62 as a tooth is shown in FIGS. 10-12. FIG. 10 shows an enlarged perspective view of the drive attachment element 36. FIG. 11 is an enlarged side view of the drive attachment element 36 showing the drive tooth 62 according to one embodiment. FIG. 12 is an enlarged cross-sectional view of the drive attachment element 36 showing the angle $\alpha$(approximately 30 degrees) of the drive tooth 62. This angle $\alpha$ is the same angle as the helical groove makes with respect to a cross-sectional plane of the drive element.

As shown in FIGS. 10-12, the drive attachment element 36 can be ring-shaped and slides over the drive element 22. A different construction, however, may be used for the drive attachment element 36. As an example, the drive attachment element may have one or more additional structures 62, which may follow a corresponding one or more additional grooves, and/or one or more of the structures 62 can be located at a different rotational position with respect to the longitudinal axis of the drive element when the structure is mounted onto the drive element. The drive attachment element 36 is preferably provided with a slot 99 into which a traditional curtain hook 37 can be used to connect the end of the curtain to the drive attachment element 36. Curtain pins and curtain rings that are well known in the art to hang curtains may be used.

The structure 62 is designed to communicate with or engage the helical groove 24 of the drive element to move the drive attachment element 36 axially along the drive element, thereby moving the curtain. In one embodiment, the feature is a tooth formed on an angle on the inner surface of the body of the drive attachment element. The angle $\alpha$ of the drive tooth 62 is specifically designed to engage the helical groove on the drive element 22. In an embodiment, a design consideration is to maximize the amount of contact between the rotating drive element 22 and the drive attachment element 36 to move the weight of the curtain. The location of the tooth 62 with respect to the drive attachment element 36, in some embodiments of the present invention, are adjustable such that the angle the location of the tooth makes with respect to the drive element when the drive attachment element is interconnected to the drive element is adjustable. This adjustability allows the user of the curtain assembly to set the correct location of the drive attachment element(s) 36 in relationship to the axial position along the drive element for a particular rotational position of the drive element, as where the tooth is positioned and where the helical groove is located for a particular angular position of the drive element determines the axial position of the drive attachment element and, therefore, the axial position of the point of the curtain attached to the drive attachment element. In this way, if it is desired for a distal end of the curtain to reach the distal end of the drive element at a particular degree of rotation of the drive element (e.g., 720°, or 3600°, then the relative rotational position of the tooth to the drive attachment element can be adjusted.

Figure 16:
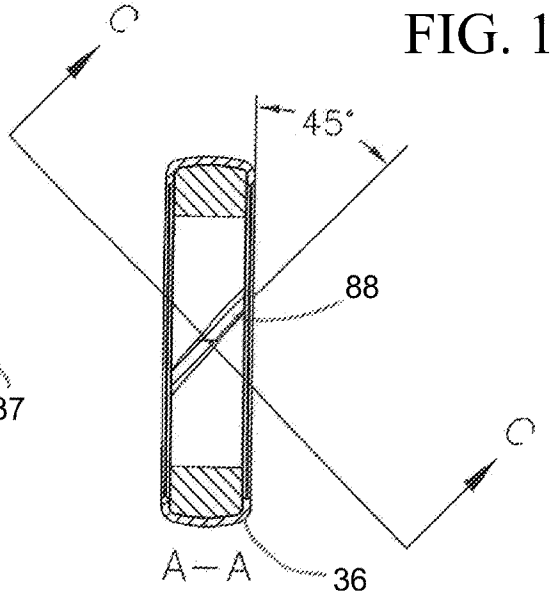
FIG. 16 is an enlarged cross-sectional view of the drive attachment element 36 showing the angle of the first drive tooth 88 according to one embodiment.
Figure 15:
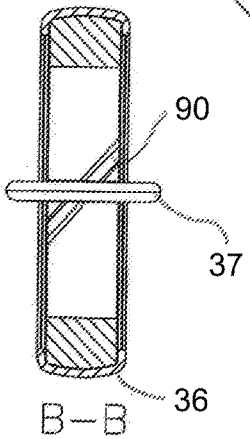
FIG. 15 is an enlarged cross-sectional view of the drive attachment element 36 showing the angle of the second drive tooth 90 according to one embodiment.
Figure 13:
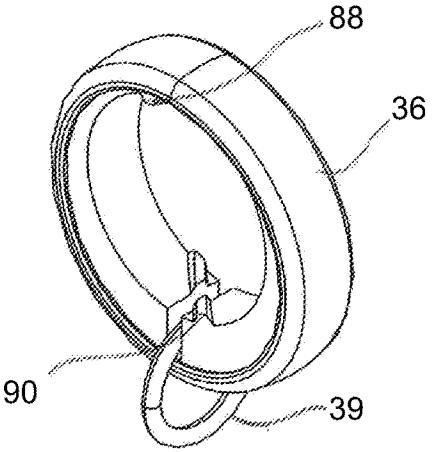
FIG. 13 is an enlarged perspective view of the drive attachment element having a first drive tooth and a second drive tooth according to one embodiment.
Figure 14:
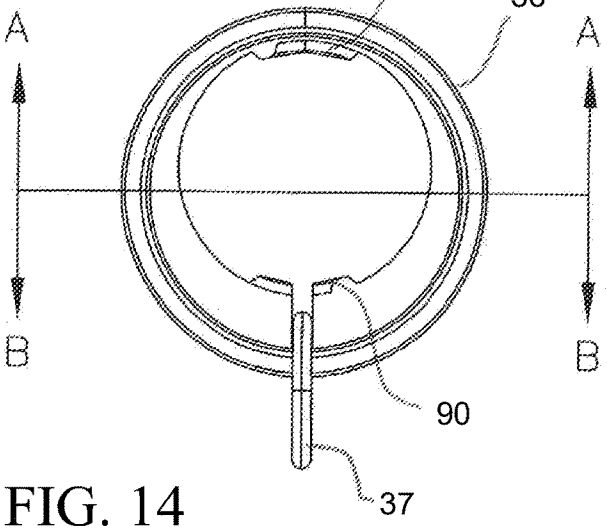
FIG. 14 is an enlarged side view of the drive attachment element 36 having a first drive tooth and a second drive tooth according to one embodiment.

In some embodiments, the drive attachment element 36 has a first drive tooth 88 and a second drive tooth 90 as shown in FIGS. 13-16. Both the first drive tooth 88 and the second drive tooth 90 are configured to communicate with different helical grooves 24 of the drive element 22. The first drive tooth 88 and the second drive tooth 90 are positioned inside the drive attachment element 36 at the top and the bottom of the drive attachment element 36, respectively. FIGS. 15 and 16 show cross-sectional views of the top and the bottom of the drive attachment element 36 which show the angle a, of the first drive tooth and the angle of the second drive tooth a2. The angles a, a2 are both 45 degrees. The angles a, a2 of the first drive tooth 88 and the second drive tooth 90 are not limited to 45 degrees and are configured to communicate with the corresponding helical groove 24 of the drive element 22. In a preferred embodiment, also shown in FIGS. 22-26, there are four helical grooves 24 in outer surface 26. Two are clockwise spirals 38 and two are counter-clockwise 40.

One issue with this type of helical pattern on center closing curtains is keeping the timing of the drive attachment elements and the helical groove such that the two curtains always meet in the center of the opening when the drive element is drive (rotated to the close position. This issue is further complicated by being able to cut down the length of the tube to fit smaller windows. If a quad-helix drive element (two clockwise and two counterclockwise helixes) is cut down to a length that is not a multiple of ½ the pitch of the helixes, the drive attachment elements of the right curtain and the left curtain (for a dual curtain assembly) may not meet in the middle of the drive element. See FIG. 26. The adjustable drive attachment element can allow the teeth to be repositioned inside the drive attachment element such that the drive attachment element can start from a different axial position along the drive element and end at the desired axial position in the center, or other desired axial position. This adjustment of the position of the tooth with respect to the drive attachment element can correct the offset caused by the odd length of the drive element, e.g., from cutting an end off, and allows the right curtain drive attachment element and the left attachment element to meet in the middle.

The gear teeth between the "Clicker" and "Gear Ring" parts of the adjustable drive attachment element, in a specific embodiment, do not allow the "Clicker" to rotate when it is on the tube. In this case, removing the adjustable drive attachment element from the drive element allows the user to adjust the "Clicker" manually by disengaging it from the Gear Ring. The outward force of the drive element on the Clicker's gear teeth essentially locks it into the Gear Ring. Specific embodiments allow the tooth to be repositioned about one inch in either direction. For a drive element where ½ the pitch length is two inches, rotating the tube 180 degrees before installing the adjustable drive attachment element changes the starting position by ½ pitch length, which will correct the adjustable drive attachment element's starting position to an acceptable degree. Although the structure 62 described in the embodiments above is a tooth, other embodiments for the structure 62 may be used as well.

Simple Attachment Elements

The curtain assembly 20 may further comprise a plurality of idle attachment elements 67 connected to the drive element 22 for sliding movement along the drive element 22. The remaining attachment points 68 of the curtain 34 that are not connected to the drive attachment element 36 can then be suspended from the drive element 22 using one or more idler attachment elements 67.

Referring to FIG. 1, the curtain has one fixed end 64 and an adjacent opposing end 66 that is connected to the drive attachment element 36. The remaining ends (or attachment points) of the curtain 68 are positioned between the fixed end 64 and the adjacent opposing end 66 that is connected to the drive attachment element 36. These remaining attachment points 68 may be suspended from the drive element 22 using a plurality of idler attachment elements 67. The idler attachment elements 67 are interconnected to the rotatable drive element 22 as shown in FIGS. 1-4. Such interconnection of idler attachment elements 67 can be such that the idler attachment element surrounds a portion of, or all of, the circumference of the cross-section of the drive element and hangs freely on the drive element. In other embodiments, the idler attachment elements can be also interconnected with a structure external to the drive element.

The idler attachment elements 67 may be shaped similar to the drive attachment element 36. In some embodiments, the idler attachment elements 67 may have a smooth bore to allow free movement along the drive element 22 as the curtain moves. In other embodiments, the idler attachment elements 67 may have a tooth to assist in the movement of the curtain across the drive element. In embodiments having a tooth, the drive element can have a region that frees the tooth when the simple attachment element reaches a certain axial region of the drive element, such as an end of the drive element, going one axial direction, and re-engages the tooth as the idler attachment element is pulled in the other axial direction out of the same axial direction.

As shown in FIGS. 1-4, the idler attachment elements 67 may be rings that slide over the drive element 22. The idler attachment elements 67 may be provided with a slot or a hole (not shown) into which a traditional curtain hook (or loop) 37 is used to attach the remaining attachment points 68 of the curtain 44 to the idler attachment element 67 as shown in FIGS. 4-6. Curtain pins and curtain rings that are well known in the art to hang curtains may be used.

Pull Rods and Programming

In some embodiments, the drive attachment element 36 has a single tooth 62 and is a loose fit on the drive element 22. In these cases, the curtain assembly 20 can include a draw rod 70 connected to the drive attachment element 36 wherein the drive tooth 62 is disengaged from the guide structure 24 of the drive element 22 by applying force on the draw rod 70. The draw rod 70 may be an elongated rod or any other mechanism that is configured to allow the user to manually disengage the drive attachment element 36 from the guide structure 24. The draw rod can then be used to axially move the drive attachment element along the drive element.

The motor 82 for the curtain assembly 20 may be programmed from the factory with a preset number (integer or fractional) of drive element 22 revolutions to move the curtain axially across the drive element 22. There are a variety of reasons, however, why this preset number of revolutions may change. For example, the drive element 22 may be shortened (e.g., cut) to accommodate a narrower window 34 or the curtain has been manually moved with the draw rod 70 and not moved by the pull cord 72.

Therefore, in an embodiment, the initial setup of the motor 82 is able to count the number of revolutions the drive element 22 makes to fully open and fully close the curtain 44. This setup may be accomplished by a setup routine in which a program button is pressed once on a remote control 96 to start the motor 82 moving the curtain 44 and then pressing the button a second time, either to stop the movement or after the movement has stopped, which stores the number of revolutions the curtain 44 has moved.

In a specific embodiment, the number of revolutions can be confirmed by pressing the program button a third time, which reverses the motor 82 and moves the curtain 44 in the opposite direction. Pressing the program button a fourth time, either to stop the curtain 44 or after the movement has stopped, can cause the number of counts to be compared, and set a new count in the memory to complete the set up routine. If the program button on the remote control 96 is not pressed the second time, the motor 82 can run until the preset count is reached, then shut off. Alternatively, the assembly can implement some sort of maximum axial distance detector or force detector, or clutch, such that the motor stops, or stops rotating the drive element, respectively, when a threshold force is encountered trying to move the drive attachment element.

If it is desired to automatically move the curtain after the curtain was manually moved, the user can press the program button twice on the remote control 96, which will cycle the curtain twice. This resynchronizes the curtain movement count by first moving the curtain to one distal end of the drive element followed by moving the curtain 44 to the opposite distal end of the drive section, i.e., two cycles.

When the curtain 44 is moved towards its fully deployed position, as shown in FIG. 1, the drive attachment element 36 is driven by the rotation of the helical groove 24 on the drive element 22 acting on the feature in the drive attachment element until the drive element 22 rotates a set number of revolutions and stops in the fully deployed position.

Center Closing Embodiments

Referring to FIG. 4, a specific embodiment of the curtain assembly 20 is shown in which the curtain 44 used is a center closing curtain 46. As described above, a center closing curtain 46 is composed of two fabric panels, a right panel 50 and a left panel 48, which meet in the center of the window 42 to close and cover the window 34.

The center closing curtain 46 is in the deployed position and the window 34 is covered in FIG. 4. The drive element 22 has a clockwise helical groove 38 and a counter clockwise helical groove 40 formed on the outer surface 26 of the drive element 22. The clockwise helical groove 38 and counter clockwise helical groove 40 have the same angle and oppose each other to create the correct movement of the center closing curtain 46 when the drive element 22 rotates.

To accommodate a center closing curtain 46, the curtain assembly 20 has a left drive attachment element 74 and a right drive attachment element 76 as shown in FIG. 4. The left drive attachment element 74 is connected to the adjacent opposing end 66 of the left panel 48 and the right drive attachment element 76 is connected to adjacent opposing end 66 of the right panel 50. In other words, the left panel 48 has a fixed end 64 and an adjacent opposing end 66 that is connected to the left drive attachment element 74. The right panel 50 has a fixed end 64 and an adjacent opposing end 66 that is connected to the right drive attachment element 76. There may also be a left draw rod 78 and a right draw rod 80 attached to the left drive attachment element 74 and the right drive attachment element 76, respectively.

The tooth 62 of the right drive attachment element 76 can follow the counter-clockwise helical groove 40 and the tooth 62 of the left drive attachment element 74 can follow the clockwise helical groove 38, such that when the drive element is rotated in a first rotational direction the left panel 48 and right panel 50 both close and when the drive element is rotated in the opposite direction the left panel 48 and right panel 50 both open. In a specific embodiment, the drive element has only one or more clockwise helical grooves 24 on the left end of the drive element, on which the closed left panel 48 hangs, and the drive element has only one or more counter-clockwise helical grooves on the right end of the drive element, on which the closed right panel 50 hangs.

Dual Curtain

Referring to FIGS. 27-30, a dual curtain assembly 1 is provided. The dual curtain assembly 1 comprises a rotatable drive element 22 wherein at least one helical structure 24 is formed on the outer surface 26 of the drive element 22; curtain drive elements 36A and 36B having a corresponding structure that communicates with the helical structure 24 to move the curtain supports axially along the drive element 22 when the drive element 22 is rotated and; a rotation assembly 33 for rotating the drive element 22.

In some embodiments of the invention, the helical structure 24 is a helical groove and the corresponding structure is a tooth. While the helical structure 24 is shown in FIGS. 27-30 as a helical groove, the helical structure is not limited to a groove. Similarly, the corresponding structure discussed below in some embodiments is a tooth but is not limited to being a tooth. In some embodiments, the curtain support includes an outer curtain outer curtain drive attachment element 36A and an inner curtain drive element 36B as shown in FIGS. 27-30 and explained further below.

The curtain assembly 1 may further comprise an outer curtain 44A and an inner curtain 44B; the outer curtain 44A is suspended from the rotatable drive element 22 while the inner curtain 44B is suspended from hooks 17 in carrier tracks 12 and 81 that move along the support guide 11. The rotatable drive element 22 comprises at least one drive element 22 having opposing distal end portions 35, 36, where the distal end having the motor can be referred to as the motor end 58 and the other distal end can be referred to as the bearing end 59, wherein at least one helical groove 24 is formed in either a clockwise direction or a counterclockwise direction on the outer surface 26 of the drive element 22 extending from one distal end portion 35, 36 of the drive element 22 to the opposing distal end portion 35, 36 of the drive element 22.

When the drive element 22 is rotated, either the outer curtain 44A or the inner curtain 44B will move along the drive element 22, while the other curtain is held in place in a non-driving or stall area. Once the moving driver attachment element 36A or 36B has reached a stall area at the end of the drive element 22, the non-moving driver attachment element will be tugged to engage the helical groove 24. This movement of the outer curtain 44A and the inner curtain 44B, along the helical groove 24 of the drive element 22 is explained in greater detail below. Whether the outer curtain 44A moves or the inner curtain 44B moves is determined by the sequence of the movement of the curtains. A system for selecting either the outer curtain 44A or the inner curtain 44B is explained below.

As shown in FIG. 27, the outer curtain 44A and inner curtain 44B may be composed of a single continuous panel of fabric that moves back and forth across the drive element 22 to the deployed position (covering the window 34) and to the stored position (not covering the window 34). Although, there is no limitation on the type of fabric used for the curtains 44A and 44B, in one embodiment, the outer curtain 44A is a blackout curtain and the inner curtain 44B is a sheer curtain. Using a blackout curtain with a sheer curtain to cover the same window 34 allows the user to use the sheer curtain when some light is desired and then also to use the blackout curtain when no light is desired. For example, the blackout curtain may be stored and the sheer curtain may be deployed, if some light is desired and privacy is needed. The blackout curtain may be deployed and the sheer curtain may be deployed when no light is desired. The blackout curtain may be stored and the sheer curtain may also be stored, when light is desired and privacy is not needed. The dual curtain assembly 1 disclosed herein allows for these combinations of positions for the outer curtain 44A (blackout curtain) and the inner curtain 44B (sheer curtain) as shown in FIGS. 27-30. [0140] FIG. 27 illustrates a curtain assembly 1 when the outer curtain 44A is a blackout curtain in the deployed position and the inner curtain 44B is a sheer curtain in the deployed position. Therefore, in FIG. 27, the window 34 is covered by the outer curtain 44A or the blackout curtain and the inner curtain 44B. FIG. 28 illustrates a curtain assembly 1 when the outer curtain 44A is a blackout curtain in the stored position and the inner curtain 44B is a sheer curtain in the deployed position. The window 34 is covered by the sheer curtain and the blackout curtain is stored in this instance. FIG. 29 illustrates a curtain assembly 1 when the outer curtain 44A is a blackout curtain in the stored position and the inner curtain 44B is a sheer curtain in the stored position. The window 34 is left uncovered in this instance.

FIG. 30 illustrates the preferred embodiment curtain assembly 1 when the outer curtain 44A is a blackout curtain in the deployed position and the inner curtain 44B is a sheer curtain in the deployed position. Therefore, in FIG. 27, the window 34 is covered by the outer curtain 44A or the blackout curtain and the inner curtain 44B. Further, the outer curtain has the stationary end attached to the end bracket 54 and the movable end wrapped around the other end bracket 54 on the distal end. There is also a cut away area to show the position of an external power supply 43.

Drive Element and Drive Section

The rotatable drive element 22 and drive element 22 will now be explained in detail below. The curtain assembly 1 includes a rotatable drive element 22. FIGS. 31 and 32 show the rotatable drive element 22 and its components in greater detail. Both the outer curtain 44A and the inner curtain 44B are connected to the rotatable drive element 22 by the outer curtain outer curtain drive attachment element 36A or the inner curtain attachment drive element 5 or various attachment and suspension elements as explained below. The rotation assembly 33 which rotates the drive element 22 moves the attachment drive elements which are connected to the curtains 44A and 44B separately across the drive element 22.

The rotatable drive element 22 is designed to be installed above a window 34 similar to a traditional curtain rod. For example, as shown in FIG. 27, drive element 22 is mounted on axles 52 that are located and secured in the end brackets 54. The end brackets 54 are adapted for connection with a window frame, sash or wall. The end brackets 54 may also include a rubber mounting disk 13 that is compressed when the drive element 22 is installed to hold the drive element 22 firmly in place and minimize noise.

The drive element 22 is connected to a rotation assembly 33 for rotating the drive element 22 wherein the rotation of the drive element 22 moves the outer curtain drive attachment element 36A and the inner curtain drive element 36B separately across the helical groove 24 of the drive element 22. The rotation assembly 33 may be a draw cord 72 connected to the drive element 22 or a motor 82. The drive element 22 may be rotated manually. For example, a draw cord 72 as shown in FIGS. 27-29 may be connected to the drive element 22 such that the drive element 22 can be manipulated manually to rotate when it is desired to deploy or store the curtains 44A or 44B. The use of pull cords 72 is well known in the art.

The drive element 22 may also be connected to a motor 82, which can be used to rotate the drive element 22. The motor 82 may be mounted either inside or outside the drive element 22. In one embodiment, the motor 82 is mounted inside the drive element 22 and generally concealed from plain view. Components including axles 52 and bearings 94 may also be located inside the rotatable drive element 22. A slip ring 28 may be used to transfer current from the power supply 43 external to the drive element 22 to the motor 82 in the drive element 22 as shown in FIG. 32. Alternatively, batteries 84 in a battery tube 86 may be used as shown in FIG. 31 to power the motor 82. The batteries 84 in the battery tube 86 may be in a spring loaded sleeve to assist with loading and unloading batteries 84 from the battery tube 86. In some embodiments, the motor drive adapter 27 as shown in FIG. 59 may also be used to securely attach or connect the motor 82 to the drive element 22. In other embodiments, the motor housing 53 fits tightly against the drive element 22 and turns the drive element 22 when the motor output shaft 87 is held in end bracket 54 to prevent it from turning.

In a motorized operation, the user may push a button 98 on a remote control 96 to turn on the motor 16 to rotate the drive element 22 such that the sequence selected curtain 44A or 44B moves across the drive element 22 between a stored position and a deployed position depending on the user's preference. The remote control 96 and button 98 are shown in FIGS. 27-29. In other embodiments, the remote control may respond to a voice command and send a signal to the motor controls, which then causes the motor 82 to rotate the drive element 22.

The curtain assembly 1 may also include a remote control 96 having a control board which generates a signal when the user makes a selection on the remote control 96. The control board has a transmitter which can wireless communicate with a receiver which is remotely located from the transmitter. For example, the receiver may be located in the drive element 22. The receiver receives the transmitted signal from the transmitter and transmits it to the motor 82, which will cause the motor 82 to turn on, rotate the drive element 22, and moves one of the curtains 44A or 44B.

As the drive element 22 rotates, either manually or by a motor 82, the outer curtain drive attachment element 36A or the inner curtain drive attachment element 36B is engaged on the drive element 22 and moves across the drive element 22 to either a deployed or stored position while the other curtain 44A or 44B remains in place. When the moving curtain 44A or 44B reaches the end of the drive element 22, the stationary curtain 44A or 44B will be pulled into engagement with the helical groove 24 and move across the drive element 22 to a new position.

The rotatable drive element 22 is preferably cylindrical in shape as shown in FIGS. 31, 32, 34, and 59, which shows the drive element 22 having an inner tube, referred to as an inner drive element 9, and an outer tube or sleeve 63. However, the shape of inner drive element 9 and an outer tube or sleeve 63 of the drive element 22 are not limited and can be non-circular. In an alternative embodiment, as shown in FIG. 60, the rotatable drive element 22 may be tri-lobed. In this case the drive element is a spiraled tube having creases that a ball bearing can ride in.

The drive element 22 may vary in size. For example, the drive element 22 may be the width of the window 34 or it may be wider than the window 34. There is no limitation on the diameter of the drive element 22 other than space needed inside a room. Preferably, the drive element 22 is configured to mount a motor 82 inside the drive element 22 rather than mounting the motor 82 outside the drive element 22. Using the inside of the drive element 22 to conceal the motor 82 may give a more aesthetically pleasing design for a curtain assembly 1 or 20. Any number of materials may be used to fabricate the drive element 22 provided the drive element 22 can sup-port the weight of the outer and inner curtains 44A, 44B.

The drive element 22 comprises a guide structure 24, such as a helical groove, over at least one or more portions of the length of the drive element 22. The drive element 22 has opposing distal end portions 35, 59 and may be any length along the longitudinal axis 60 of the drive element 22. The longitudinal axis 60 of the drive element 22 is shown in FIGS. 27-30. The length of the guide structure along the drive element 22 is a factor in determining how far the curtain 44A or 44B will travel across the drive element 22, i.e., the entire length of the drive element 22 as opposed to some shorter section of the drive element 22.

In an embodiment, the drive element 22 has at least one helical groove 24 that is formed in either a clockwise direction or a counterclockwise direction on the outer surface 26 of the drive element 22 extending from one distal end portion 35, 59 of the drive element 22 to the opposing distal end portion 35, 59 of the drive element 22. FIG. 49 illustrates a left hand drive element 22 in which the helical groove 24 is in a clockwise direction and also illustrates a right hand drive element 22 in which the helical groove 24 is in a counter-clockwise direction.

In some embodiments, the drive element 22 may have two helical grooves 24, one formed in the clockwise direction and one formed in the counterclockwise direction as shown in FIG. 59. A drive element 22 having a drive element 22 with helical grooves 24 in both directions is particularly useful for center closing curtains 46 as explained below.

In the preferred embodiment, the drive element 22 may have two helical grooves 24 in the same direction, where the inner drive attachment element 36B has two teeth 5*a* and 5*b* spaced 180 degrees apart and the outer drive attachment element 36A has two teeth 4*a* and 4*b* spaced 180 degrees apart, such that tooth 4*a*, and tooth 5*a*, engages one of the helical grooves and tooth 4*b*, and tooth 5*b*, engages the other helical groove at the same time, respectively, so as to add stability with respect to driving Drive attachment element 36A, and 36B, respectively.

In other embodiments, the drive element preferably has four helical grooves 24, two clockwise helical grooves 24 and two counterclockwise helical grooves 24 as shown in FIG. 59. A cross-sectional view of the rotatable drive element having four helical grooves 24, two clockwise helical grooves and two counterclockwise helical grooves is shown in FIG. 59. Helical grooves are preferably spaced approximately 180 degrees apart. The clockwise helical grooves 24 and the counterclockwise helical grooves 24 preferably opposed each other and are spaced 180 degrees apart. The profile of the helical grooves 24 is self-centering to allow the first outer drive tooth 4*a* and the first inner drive tooth 5*a* to traverse the intersection of the clockwise helical groove and the counter clockwise helical groove without binding.

The helical groove 24 forms a path through the drive element 22 of the drive element 22 as shown in FIGS. 27-30. As the drive element 22 rotates, one of the curtains 44A or 44B is pulled along the helical groove 24 across the drive element 22 into a deployed or stored position. Both the clock-wise and the counterclockwise helical grooves 24 will cause the curtain 44A or 44B to move axially across the drive element 22 when the drive element 22 rotates and the curtain drive elements 36A or 36B are engaged with the helical groove 24.

The helical grooves 24 may be formed by forming grooves into the outer surface 26 of the drive element 22 such that the grooves are recessed from the outer surface 26 of the drive element 22. Alternatively, the helical grooves 24 may be formed as protrusions that project or bulge from the outer surface 26 of the drive element 22. The protrusions may be formed any means, for example, by winding material around the outer surface 26 of the drive element 22.

The angle of the helical groove 24 may vary and therefore, may differ in the amount of time that it takes to travel across the drive element 22. For example, a helical groove 24 with a larger angle may create a shorter path for the curtain 44A, 44B to travel and result in a faster moving curtain 44A or 44B for a given rotational speed of the drive element. In some embodiments, the angle of the helical grooves 24 may vary along the drive element 22 such that the curtain 44A, 44B may move at different speeds along the drive element 22, for a given rotational speed of the drive element, if desired. The angle of the helical groove 24 preferably varies from 30 degrees to 60 degrees and is most preferably 45 degrees.

In an alternative embodiment, the drive element 22 may be formed from a drive sleeve or outer tube 63 that is sized to fit around a portion of an inner drive element 9, which can be, for example, an inner tube 61. In this case, the drive sleeve has at least one helical groove 24 in a clockwise or counter clockwise direction formed on the outer surface of the sleeve. The drive element 22 must be able to translate the torque from the rotation assembly to axially movement of the curtain support or attachment elements 36A, 36B across the drive element 22, and the drive sleeve may be made from a high lubricity material. Therefore, the drive sleeve can be secured to the inner drive element 9 such that the sleeve does not slide up or down the drive element 22 or rotate around the inner drive element 9. It may also be desired to remove the sleeve from the inner drive element 9 and replace it with another sleeve. Using a sleeve to form the drive element 22 has the advantage that the helical groove 24 or the length of the drive element 22 may be easily changed by removing the sleeve and replacing it without fabricating a new drive element 22.

Attachment Elements and Teeth

In some embodiments, the curtain assembly 1 may include at least one outer curtain drive attachment element 36A connected to the drive element 22 and has a drive teeth 4*a* and 4*b* that communicates with the helical groove 24 to move the outer curtain drive attachment element 36A axially along the drive element 22 when the drive element 22 is rotated. The outer curtain drive attachment element 36A is connected one end of the outer curtain 44A. The curtain assembly 1 may include at least one inner drive attachment element 36B connected to the drive element 22 and has a drive teeth 5*a* and 5*b* that communicates with the helical groove 24 to move the inner drive attachment element 36B axially along the drive element 22 when the drive element 22 is rotated. The inner drive attachment element 36B is connected one end of the inner curtain 44B.

FIGS. 45-47 show the front and cross-sectional views of the outer curtain drive attachment element 36A as well as the drive teeth 5*a* and 5*b*. Both the first outer drive tooth 5*a* and the second outer drive tooth 5*b* are configured to communicate with the helical groove 24 of the drive element 22. The first outer drive tooth 5*a* and the second outer drive tooth 5*b* are positioned inside the outer drive attachment element 36A which shows the angle a of one drive tooth and both the angles are 45 degrees.

FIGS. 39-41 show the front and cross-sectional views of an embodiment of an inner drive attachment element as well as the drive teeth 4*a* and 4*b*. Both the inner drive tooth 4*a* and the inner drive tooth 4*b* are configured to communicate with the helical groove 24 of the drive element 22. The inner drive tooth 4*a* and the inner drive tooth 4*b* are positioned inside the drive attachment element which shows the angle a of one drive tooth and both the angles are 45 degrees. In this embodiment, the inner carrier attachment post 31 is located at a portion of the inner drive attachment element designed to interconnect with a carrier in the inner curtain carrier track 81.

FIGS. 36-38 show the front and cross-sectional views of an alternative inner drive attachment element 36B as well as the drive teeth 4*a* and 4*b*. Both the inner drive tooth 4*a* and the inner drive tooth 4*b* are configured to communicate with the helical groove 24 of the drive element 22. The inner drive tooth 4*a* and the inner drive tooth 4*b* are positioned inside the drive attachment element which shows the angle α of one drive tooth and both the angles are 45 degrees. In this embodiment, the inner carrier attachment post 31 can be the same as the outer carrier attachment post 6 of FIGS. 45-47 designed to interconnect with a carrier in the outer curtain carrier track 12, and the attachment points of the inner curtain can attach via hooks to the receiver for hooks 99.

As shown in various figures, the outer curtain outer curtain drive attachment element 36A and the inner curtain drive element 36B are ring-shaped and slide over the drive element 22. Although a different construction may be used for the outer curtain outer curtain drive attachment element 36A and the inner curtain drive element 36B, they are be able to connect to the appropriate ends of the outer curtain 44A and the inner curtain 44B and engage the helical groove 24 and move across the drive element 22.

The outer curtain outer curtain drive attachment element 36A is preferably provided with a slot or a hole 99 into which a traditional curtain hooks or pins can be used to connect the ends and upper edge of the outer curtain 44A to the appropriate attachment element. FIG. 34 illustrates an example of the hole 99 and a pin hook 14 on an outer curtain idler attachment element 67A. In another embodiment, as shown in FIG. 60, a traditional curtain ring is used. The inner curtain 44B is suspended by S-hooks 17 in inner curtain carrier track 81 in support guide 11. Curtain pins, hooks and rings are well known in the art to hang curtains 44A, 44B.

The drive tooth 5*a* on the outer drive attachment element 36A and the drive tooth 4*a* on the inner drive attachment element 36B may have the same construction. The outer drive tooth 5*a* and the inner drive tooth 4*a* are both designed to engage with the helical groove 24 of the drive element 22 to drive the curtain 44A or 44B across the drive element 22. In one embodiment, the drive tooth 5*a* is formed on an angle inside the body of the outer curtain drive attachment element 36A. The angle is specifically designed to engage the helical groove 24 on the drive element 22. A design consideration is to maximize the contact between the rotating drive element 22 and the outer drive attachment element 36A and/or inner drive attachment element 36B to carry the weight of the curtain 44A or 44B. The outer curtain outer curtain drive attachment element 36A and the drive teeth 5*a* and the inner curtain drive attachment element 36B teeth and the inner curtain teeth 4*a*, in some embodiments of the present invention, are adjustable. The adjustability of these components allow the user of the curtain assembly to set the correct timing on the location of the outer curtain drive attachment element(s) 36A and inner curtain drive attachment element(s) 36B in relationship to the helical grooves 24.

Although the curtain support described in the embodiments above is an outer curtain outer curtain drive attachment element 36A and an inner curtain drive attachment element 36B, other embodiments for the curtain support may be used as well.

Outer Curtain Idler Attachments

The curtain assembly 1 may further comprise a plurality of outer curtain idler attachment 67A connected to the rotatable drive element 22 for sliding movement along the drive element 22 wherein the adjacent ends of the outer curtain 44A that are not connected to the outer curtain drive attachment element 36A are suspended from the drive element 22 using one or more outer idler attachment elements 67A.

The outer curtain 44A has the movable end connected to the outer drive attachment element 36A. The non-movable end of the outer curtain 44A can be attached to the end bracket 54. Outer idler attachment elements 67A may be used to suspend the remaining attachment points of outer curtain 44A to the drive element 22. The outer idler attachment elements 67A are connected to the rotatable drive element 22 as shown in FIGS. 31-32 and 34-35. An enlarged view of the outer idler attachment 67A is shown in FIGS. 42-44.

The outer idler attachment 67A may be shaped similar to the outer drive attachment element 36A and inner drive attachment element 36B. The outer idler attachment 67A can have a smooth bore to allow free movement along the drive element 22 of the tube as the curtain 44A is moved or may have a tooth on each outer idler attachment 67A to assist in the movement of the curtain 44A.

The outer idler attachments are also linked to the outer curtain carriers 69 by the insertion of the outer carrier attachment post 6 on the outer idler attachment elements 67A into the aperture 55 on outer curtain guide carrier 69. The outer current carriers are then positioned in the outer curtain carrier track 12 in the support guide 11. This prevents the outer curtain idler attachment 67A from rotating or binding the rotation of the element 22.

The outer curtain idler attachment 67A are preferably provided with a slot or a hole 99 into which a traditional curtain hook or pin can be used to attach the ends of the outer curtain 44A to the outer curtain idler attachment. FIG. 42 illustrates an example of this hole 99 and a pin hook 14 on an outer curtain idler attachment 67A.

The inner curtain 44B can have the stationary end connected to the end bracket 54 and other end attached to the inner drive attachment element 36B. The inner curtain carrier track 81 and hooks 17 may be used to suspend the remaining attachment points of the inner curtain 44B to the inner curtain carrier track 81 of the support guide 11 along the axis of the drive element 22.

The outer curtain 44A is connected to the outer drive attachment element 36A and the inner curtain 44B is attached to the inner drive attachment element 36B. This arrangement ensures that the outer curtain 44A and inner curtains 44B drive attachment elements 36A and 36B are linked together on the same drive element 22 and they are able to move in sequence across the drive element 22.

Outer Driver Stall Area and Inner Driver Stall Area

The curtain assembly 1 preferably includes at least one outer driver stall area 100 positioned to one end of the drive element 22 to engage and disengage the outer drive attachment element 36A from the helical groove 24 of the drive element 22.

The curtain assembly 1 also preferably includes at least one inner driver stall area 15 positioned on the distal end of the drive element 22 that is configured to hold the inner curtain drive element 36B in place while the outer drive attachment element 36A moves through the drive element 22.

FIGS. 33-34 show an outer driver stall area 100 at one distal portion 35, 59 of the drive element 22. FIG. 51 shows the inner driver stall area 15 at the opposing distal end 35, 59 of the drive element 22. FIG. 49 shows a rotatable drive element 22 having an outer driver stall area 100 at each distal end portion of the drive element 22 and an inner driver stall area 15 positioned in between the two stall area 100. The rotatable drive element 22 shown in FIG. 49 will accommodate the outer curtains 44A and inner curtains 44B, as center closing curtains.

Enlarged views showing details of the outer driver stall area 100 are shown in FIG. 34. The outer driver stall area 100 is a section of the drive element 22 along the drive element 22 without a helical groove 24 formed on the outer surface 26 of the drive element 22. The outer driver stall area 100 interrupts the movement of the outer curtain 44A or the inner curtain 44B along the helical groove 24 therefore allowing the curtain assembly 1 to change which attachment element (either the outer curtain drive attachment element 36A or the inner curtain drive element 36B) is engaged with the helical groove 24.

The outer driver stall area 100 also serves to collect or provide a space for the outer curtain idler attachment elements 67A as well as the outer curtain drive attachment element 36A. For example, when the outer curtain drive attachment element 36A is engaged and moves through the drive element 22, it will reach the outer driver stall area 100 at the end of the drive section. The outer driver stall area 100 stops the movement of the outer curtain drive attachment element 36A in the helical groove 24 and temporarily stores the outer curtain drive attachment element 36A. The outer curtain idler attachment elements 67A that are holding the remaining adjacent end of the curtain 44A are pushed by the outer curtain drive attachment element 36A and ultimately stack up in the outer driver stall area 100 until the outer curtain drive attachment element 36A becomes disengaged with the helical groove 24 and will remain stalled until the drive element 22 rotates in the opposite direction. As this disengagement occurs, the outer curtain drive attachment element 36A pushes against the outer curtain idler attachment 67A in the outer driver stall area 100 which moves the inter-curtain engager 49 toward the end bracket 54. The inner curtain 44B, being the correct length, pulls the inner curtain drive element out of the inner driver stall area 15 and into engagement with the helical grooves 24.

In some embodiments, the inner driver stall area 15 is positioned at the distal end 59 of the drive element 22 opposite the outer driver stall area 100 and functions to hold the inner curtain drive element 36B stalled in place. In other embodiments, at least one inner driver stall area 15 is positioned between two outer driver stall areas 100, as shown in FIG. 49. The position of the inner driver stall area 15 on the drive element 22 defines the end of the portion of the drive element 22 where the inner curtain drive element 36B travels on the drive element 22.

As described above, FIG. 27 shows a curtain assembly 1 when the outer curtain 44A (blackout) is in the deployed position and the inner curtain 44B is also in the deployed position. At this moment, the outer curtain 44A is fully extended and the curtain drive attachment element 36A is in the helical groove 24 at one distal end of the drive element 22 and the inner curtain drive element 36B is in the inner driver stall area 15 at the same end of the drive element 22. To change the positions of the curtains such that the outer curtain 44A is in the stored position and the inner curtain 44B stays in the deployed position as shown in FIG. 28, the drive element 22 starts to rotate in the opposite direction. The rotation of the drive element 22 will move the outer curtain drive attachment element 36A, attached to outer curtain 44A, collapsing curtain 44A into the stored position until outer curtain drive attachment element 36A moves into the outer driver stall area 100 where it will push against the outer idler attachment elements 67A in the outer driver stall area and force the inter-curtain engager 49 toward the end bracket 54 creating a tug pressure on the inner curtain 44B and the inner curtain drive element 36B because the inner curtain 44B is the correct length and extended. This tug pressure pulls the inner curtain drive element 36B out of the inner driver stall area 15 and into engagement with the helical groove 24 positioning the curtains as shown in FIG. 28. When the inner curtain 44B is fully extended, the inner curtain drive element 36B will move into the inner driver stall area 15. Because the inner curtain is now extended, the outer curtain drive attachment element 36A will be pulled into the helical groove 24 prepared to deploy the outer curtain 44A. Because the inner driver stall area 15 does not have a helical groove 24, the inner curtain attachment 36B element is prevented from moving or stalled along the drive element 22.

As the outer drive attachment element 36A moves through the drive element 22, the outer curtain 44A will move from the stored position to the fully deployed position and the outer drive attachment element 36A moves up to and against the inner curtain drive element 36B in the inner driver stall area 15 and stops the drive element 22 from rotating The curtain assembly 1 will then be as shown in FIG. 27, with the outer curtain 44A in the deployed position and the inner curtain 44B in the deployed position.

To move the inner curtain 44B to the stored position as shown in FIG. 29, the drive element 22 will rotate and the outer drive attachment element 36A moving into the outer driver stall area 100 will pull the inner curtain drive element 36B from the inner driver stall area 15 thereby engaging the inner curtain drive element 3613 with the helical groove 24. The inner curtain drive element 36B will move the curtain 3 through the drive element 22 from the deployed position to the stored position at the other distal end of the drive element 22 until the inner curtain drive element 36B pushes against the outer drive attachment element 36A and stops the drive element 22 from rotating. At this point, the inner drive attachment element 36B is engaged with the helical groove 24.

Guide Mechanism

The curtain assembly 1 preferably includes a support guide 11 wherein the guide means facilitates the movement of the outer and inner curtains 44A, 44B along the drive element 22 without misalignment. The support guide 11 may also assist with the spacing of the curtain panels when the outer curtain 44A or the inner curtain 44B is fully extended in the deployed position.

In one embodiment, the support guide 11 is an elongated pair of channels positioned parallel to the rotatable drive element 22. The support guide 11 is shown in several of the figures, including an end view in FIG. 48. The inner curtain carrier track 81 and the outer curtain carrier track 12 are the same part but are numbered differently and discussed differently because their functions are different. The inner curtain carriers 93 have apertures 55 where an inner carrier attachment post 31 on the inner curtain drive element 36B is inserted at one end of the inner curtain and an inner carrier attachment post 31 on the inter-curtain engager 49 is inserted on the other end. The remaining inner curtain carriers 93 have S-hooks 17 inserted into the aperture 55 as known in the art.

The outer drive attachment element 36A and the outer curtain idler attachment 67A preferably have a hanger pin hole 99 wherein the pin hooks 14 are connected to the attachment elements and support the outer curtain 44A. Further, these attachment elements 36A and 67A to the outer curtain 44A are guided and held from rotation by the insertion of the outer carrier attachment posts 6 into the apertures 55 in curtain carriers 69 riding in the outer curtain carrier track 12 in support guide 11.

This arrangement provides the user with the option of manually operating the movement of the curtains 44A or 44B across the drive element 22. For example, the user may decide to manually operate the curtain assembly 1. The user could turn off the motor 82 and rotate the drive element 22 manually by using the pull cord 72.

The motor 82 for the curtain assembly 1 may be programmed from the factory with a preset number of drive element 22 revolutions to move the curtain the width of the window 34 opening. However, there are a variety of reasons why this preset number of revolutions may change. For example, the drive element 22 may be shortened to accommodate a narrower window 34.

Therefore, the initial setup of the motor 82 may be able to count the number of revolutions the drive element 22 makes to fully open and fully close the curtains 44A or 44B. This may be accomplished by a setup routine where pressing a program button 98 on a remote control 96 once to start the motor 82 moving the curtain 44A, 44B and then pressing the button 98 another time to stop the movement which will store the number of revolutions the curtain 44A, 44B has moved.

The number of revolutions can be confirmed by pressing the program button 98 a third time, which will reverse the motor 16 and move the curtain 44A, 44B in the opposite direction. Pressing the program button 98 a fourth time will stop the curtain 44A, 44B, compare the counts, and set a new count in the memory to complete the set up routine. If the program button 98 on the remote control 96 is not pressed the inner time, the motor 82 will run until the preset count is reached, then the motor 82 will shut off. If the number of revolutions is ever lost, the controls can reset a zero position when the outer curtain drive attachment element 36A stops the drive element 22 from rotating when the outer curtain 44A is fully deployed, as shown in FIG. 52 or when the outer curtain 44A and the inner curtain 44B are fully stored and the inner curtain drive element 36B stops the drive element 22 from rotating, as shown in FIG. 54.

In specific embodiments, the drive element 22 stops rotating when the inner driver attachment element 36B and the outer driver attachment element 36A are brought into contact at either end of the drive element. When the inner driver attachment element 36B and the outer driver attachment element 36A are brought into contact, the inner driver attachment element 36B and the outer driver attachment element 36A bind together and their teeth bind in the drive element's grooves. The interconnection of the inner driver attachment element 36B and the outer driver attachment element 36A to the support guide 11 in opposite orientations helps to cause this binding. Once the inner driver attachment element 36B and the outer driver attachment element 36A bind together, the drive element is bound, and the controller board senses that the driver element is no longer rotating and stops running the motor.

In specific embodiments, the stall area 100 and/or 15 prevents one of the inner driver attachment element 36B and the outer driver attachment element 36A from moving down the drive element 22. When the inner driver attachment element 36B and the outer driver attachment element 36 meet each other, the axial force (down the rotational axis of the rotating drive element) binds the stalled driver to the still-driving driver. This, coupled with the weight of the curtain hanging from the outer driver and the interconnection of the inner driver attachment element 36B and the outer driver attachment element 36A to the support guide, causes the driver whose teeth are still engaged to the tube to bind up with the rotational drive element. At that point, this driver is being torqued so as to try and rotate around the axis of rotation and prevented from such rotation by the support guide, which stalls the motor and signals the controller board to stop running the motor.

The dual curtain assembly mounted in rubber mounting disk 13 increases the sensitivity of motion such that a person can pull on the stored or deployed curtain and activate the motor to move the curtain in the opposite direction from the last movement. The motor controls will count the number of revolutions and when the predetermined count is matched it will shut the motor down.

Center Closing Embodiments

An alternative embodiment of the dual curtain assembly 1 is shown in FIGS. 49 and 50 in which the outer curtain 44A and the inner curtain 44B are center closing curtains. A center closing curtain is composed of two fabric panels, a right panel and a left panel, that meet in the center of the window 34 to close and cover the window 34. In FIG. 50, the outer curtain 44A is a center closing blackout curtain that is in the deployed position and the inner curtain 44B is a center closing sheer curtain that is also in the deployed position. In FIG. 49, the outer curtain 44A is a center closing blackout curtain that is in the stored position and the inner curtain 44B is a center closing sheer curtain that is in the deployed position. In this embodiment, the drive element 22 of the drive element 22 preferably has four helical grooves 24, two formed in the clockwise direction and two formed in the counterclockwise direction. For example, the opposing helical grooves 24 shown in FIG. 59 create the correct movement of the center closing curtains with one motor 82 turning the drive element 22 in one direction. FIG. 59 shows an enlarged cross-sectional view of the rotatable drive element according to one embodiment of the curtain assembly showing the four helical grooves formed on the outer surface of the drive element. FIG. 59 also shows an enlarged perspective view of the rotatable drive element according to one embodiment of the curtain assembly showing the four helical grooves formed on the outer surface of the drive element.

To accommodate center closing curtains, the curtain assembly 1 has a left outer drive attachment element 36A, a right outer drive attachment element 36A, a left inner drive element 36B and a right inner drive attachment element 36B as shown in FIGS. 49 and 50. The left outer drive attachment element 36A is connected to one end of the left panel of the outer curtain 44A. The right outer drive attachment element 36A is connected to one end of the right panel of the outer curtain 44A. The left inner drive element 36B is connected to an adjacent end of the left panel of the inner curtain 44B and the opposite end of the inner curtain is attached to the end bracket 54. The right inner drive attachment element 36B is connected to adjacent end of the right panel of the inner curtain 44B and the opposite end of the inner curtain is attached to the end bracket 54.

FIG. 49 shows an embodiment of a rotatable drive element 22 in which the outer curtain 44A and the inner curtain 44B are both center closing curtains. There is an outer driver stall area 100 positioned at each distal end of the rotating drive element 22 and an inner driver stall area 15 positioned between the outer driver stall area s 100. For example, there is a left outer driver stall area 100 positioned along the drive element 22 to engage and disengage the left outer drive attachment element 36A from the helical groove 24 of the drive element 22 and a right outer driver stall area 100 positioned along the drive element 22 to engage and disengage the right outer drive attachment element 36A from the helical groove 24 of the drive element 22. The inner driver stall area 15 is configured to hold the left inner n drive element 36B in place while the left drive attachment element 36B moves through the drive element 22. The same inner driver stall area 15 is also configured to hold the right inner drive attachment element 36B in place while the right inner drive attachment element 36B moves through the drive element 22. Alternative embodiments can have two separate inner driver stall area 15. FIG. 49 illustrates that the left and right inner drive attachment elements 36B will meet in the center 42 of the window 34 when the outer curtain 44A is deployed and the inner curtain 44B is stored to minimize light leakage. Therefore, the single inner driver stall area 15 in some embodiments is wide enough to fit both the left inner curtain drive element 36B and the right inner curtain drive attachment element 36B.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

Alternative Arrangement

With reference to FIG. 63, an architectural covering 210 is presented. Architectural covering 210 is formed of any size, shape and design. As one example, as is shown, architectural covering 210 includes a first rotatable drive element 212 connected to a second rotatable drive element 213. The first and second rotatable drive elements 212, 213 are any form of a rotating member such as a rod, tube, threaded bar, or the like. In one arrangement, rotatable drive elements 212 and 213 are practically identical if not identical and therefore for simplicity reference to one shall be reference to the other, unless specified otherwise. In one arrangement, rotatable drive element 212 is an elongated hollow tube, having a helical guide structure 214 positioned in its surface, as is described in further detail in Applicant's related Application Ser. No. 61/702,093 filed on Sep. 17, 2012 entitled Rotatable Drive Element For Moving A Window Covering, which is fully incorporated by reference herein, including any related applications; and Applicant's related patent Application Ser. No. 61/810,949 filed on Apr. 11, 2013 entitled Rotatable Drive Element For Moving A Window Covering Including A Flexible Guide Arm And A Pointed Tooth Arrangement which is also fully incorporated by reference herein, including any related applications. The helical guide structure 214 can be a left-hand guide structure, a right-hand guide structure, or both, or a plurality or combination of left-hand guide structures and/or right-hand guide structures. Guide structure 214 can either be grooves, indentations, protrusions, threads or any other feature or the like. Guide structure 214 can either ground or machined into the surface or rotatable drive element 212, knurled into the surface of rotatable drive element 212 (as is described further herein), cast or formed into the surface of rotatable drive element 212, or created by any other means or methods known in the art.

Wall brackets 216 support rotatable drive element 212. Wall brackets 216 are any form of a connecting device which supports and connects rotatable drive element 212 to any structural element such as a wall adjacent a window, a ceiling, a frame structure or the like. As one example, in the arrangement shown, rotatable drive element 212 connects on one side to wall bracket 216 and a motor housing 218 connects on the opposite side.

In the arrangement shown, wall brackets 216 include a mounting plate 220 which connects to the wall, an extension arm 222, which extends between mounting plate 220 and a mounting member 224. Mounting member 224 is formed of any suitable size and shape and serves to connect to rotatable drive element 212 while allowing for functional movement, such as rotation, of the necessary parts. In one arrangement, as is shown, mounting member 224 is a generally circular collar which is sized and shaped to receive rotatable drive element 212 therein as is described further herein.

Mounting member 224 has an exterior side 226 and an interior side 228. Rotatable drive element 212 connects to the interior side 228 and motor housing 218 connects to the exterior side 228. A collar 230 extends inwardly from the mounting member 224 thereby separating the interior side 228 from the exterior side 226. In the arrangement shown, collar 230 has a flat and flush interior side 232 which extends into the open interior of mounting member 224 perpendicularly to the interior surface of mounting member 224. The exterior side of collar 230 has a protrusion 234 that extends outwardly from collar 230 in perpendicular alignment to collar 230 and in parallel spaced alignment to the interior surface of mounting member 224 thereby forming channel 236 between the interior surface of mounting member 224 and the exterior surface of protrusion 234. A step 238 is positioned between protrusion 234 and the end 240 of collar 230 which defines a circular interior through hole. Step 238 and channel 236 serve to engage and hold motor housing 218 while allowing portions of the motor housing 218 to extend through the open end 240 of collar 230 to engage and rotate rotatable drive element 212.

As is shown, the features of the interior side 232 of mounting member 224 are generally circular in shape so as to allow rotation of rotatable drive element 212. In contrast, key-features 242 are positioned in the exterior side 226 of mounting member 224. Key-features 242 are any aberration, deviation, irregularity, anomaly in the round features in the exterior side 226 of mounting member 224. Key-features 242 breakup the circular shape of the features in the exterior side 226 of mounting member 224 and thereby serve to prevent rotation of motor housing 218 when connected to bracket 216. In the arrangement shown, key-features 242 include a pair of semi-circular recesses in the mounting member 224 that extend all the way to the collar 230. A divider 246 extends partially between the two recesses 244 and provides separation thereto. Divider 246 is positioned in alignment with the center of extension arm 222 for added strength and ease of alignment.

Electrical contacts 248 are positioned in the key-features 232 at approximately the center of each recess 244 and extend outwardly from the exterior surface of collar 230 within channel 236. In the arrangement shown, electrical contacts 248 are circular spring loaded conductive plungers, however any other form of an electrical contact is hereby contemplated for use. Electrical contacts 248 are electrically connected to a conduit 250 which extends through a passageway 254 in extension arm 222 of bracket 216 and through a passageway 256 in mounting plate 220. Passageway 256 in mounting plate 220 is to the side of and intentionally separated from upper through hole 258 and lower through hole 260 so as to prevent conduit 250 from being damaged when mounting bracket 216. Through holes 258, 260 receive fasteners 262 (not shown), such as conventional screws which are used to attach brackets 216 to a wall, ceiling or other mounting structure. In the arrangement shown, the lower through hole 260 is positioned approximately in the lateral middle of mounting plate 220 whereas the upper through hole 258 is positioned laterally to one side of the mounting plate 220. This offset provides advantages during mounting, namely, a fastener 262 can be inserted in the bottom through hole 260 and then the bracket 216 can be rotated on the lower fastener 262 into place followed by a fastener 262 into the upper through hole 258 to complete installation.

The lower end of conduit 250 is connected to a socket assembly 264. Socket assembly 264 is any form of an electrical connector such as a USB port, a two-conductor socket, a three conductor socket, a four conductor socket, a five conductor socket, a six conductor socket, a phone jack, an Ethernet socket, or any other standard or non-standard socket used to connect conduit 250 to any other device or object electrically.

A components recess 266 is positioned in mounting plate 220 which is sized and shaped to receive a motor controller assembly 268, which is described further herein. Components recess 266 is formed of any suitable size, shape and design. As one example, in the arrangement shown, components recess 266 is positioned between the sidewalls 267 and front wall 269 of mounting plate 220 and positioned adjacent to the through holes 258, 260.

Motor Housing: Motor housing 218 is connected adjacent the exterior end of rotatable drive element 212. Motor housing 218 is connected to the exterior side 226 of mounting member 224 of bracket 216. Motor housing 218 is formed of any suitable size and shape. In one arrangement, as is shown, motor housing 218 is formed of a hollow tube 270 which is formed as an extension of rotatable drive element 212 and with approximately the same exterior size, shape, diameter and appearance of the rotatable drive element 212, as well as continuous extension of guide structure 214 therein. In this arrangement, when motor housing 218 is connected to the end of rotatable drive element 212, the length of rotatable drive element 212 is relatively seamlessly extended as is the length of guide structure 214. In one arrangement, as is shown, rotatable drive element 212 connects to the interior side 228 of mounting member 224. In this arrangement, mounting member 224 hides or covers the seam between rotatable drive element 212 and motor housing 218. In this arrangement, the motor housing 218 remains stationary as rotatable drive element 212 rotates, as is further described herein.

Motor housing 218 has an exterior end 272 and an interior end 274. Positioned within the open interior compartment of hollow tube 270 between interior end 274 and exterior end 274 is a motor 276. Motor 276 is any form of a motor that converts electrical energy to mechanical energy and provides rotation and torque. In the arrangement shown, motor 276 is connected to a transmission 278. Transmission 278 is any form of a device that transmits rotation of motor 276 and gears it such as a gear box, a planetary gear box or the like. Transmission 278 transmits the rotation of motor 276 and converts into the desirable speed useful for the application. The transmission 278 helps to maximize the torque produced by the motor 276 while maximizing battery life by reducing or minimizing power draw.

Transmission 278 is connected to a drive shaft 280 which extends outwardly from the interior end 274 of motor housing 218. Drive shaft 280 extends through motor end cap 282 which is connected to the interior end 274 of hollow tube 270.

Motor end cap 282 has a generally circular external ring 284 having an interior edge 286 and an exterior edge 288. Interior edge 286 connects to hollow tube 270 whereas the exterior edge 288 connects to mounting member 224 of bracket 216. A collar 290 extends inwardly from the ring 284 thereby separating the interior side 286 from the exterior side 288 and provides a mounting surface for mounting motor end cap 282 to the other components of motor housing 218. An opening 292 positioned in the collar 290 allows for the drive shaft 280 of transmission 278 to extend from the interior side 286 of motor end cap 282 to the exterior side 288 of motor end cap 282.

Key-features 294 are positioned in the exterior surface of motor end cap 282. Key-features 294 are any aberration, deviation, irregularity, anomaly in the generally round exterior surface of ring 284 of motor end cap 282. Key-features 294 breakup the circular shape of the motor end cap 282 and thereby serve to prevent rotation of motor housing 218 when connected to bracket 216. In the arrangement shown, key-features 294 include a pair of semi-circular protrusions that connect to one another. Key-features 294 extend from the exterior edge 288 of ring 284 to the collar 290 of motor end cap 282. A divider 296 extends partially between the two semi-circular protrusions and provides separation thereto. Divider 296 is positioned in alignment with the center of extension arm 222 for added strength and ease of alignment.

Electrical contacts 298 are positioned in the key-features 294 at approximately the center of each semi-circular protrusion, on the interior side of ring 284. Electrical contacts 298 extend outwardly from the exterior surface 288 of collar 290. Electrical contacts 298 are connected to electrical connectors 299 which extend through the motor end cap 282 and transmit the power received by electrical contacts 298 to the electrical components contained within motor housing 218. In the arrangement shown, electrical contacts 298 are circular spring loaded conductive plungers, however any other form of an electrical contact is hereby contemplated. Electrical contacts 298 are electrically connected to the motor 276 and motor controller assembly 268 as is described herein.

In the arrangement shown, a pair of fasteners 300 extends through the collar 290 and connects to the transmission 278, or any other component of the motor housing 218, thereby locking the two components together. A bearing 302 and motor coupler 304 is positioned over the drive shaft 280 held in place by a locking arrangement between motor coupler 304 connects and drive shaft 280. Motor coupler 304 has a rounded or angled nose 306 which tapers outwardly as it extends towards motor housing 218. The exterior periphery of motor coupler 304 adjacent motor housing 218 is formed in the shape of gears 308 or a gear tooth arrangement. That is, the external surface of motor coupler 304 near its base where motor coupler 304 connects to the motor housing 218. The gears 308 mesh with gears in or attached to the rotatable drive element 212 and serve to rotate rotatable drive element 212 when motor 276 and/or transmission 278 is rotated. The rounded or angled nose 306 eases alignment and insertion of the motor coupler 304 through bracket 216 and into the rotatable drive element 212. A shoulder 310 is positioned towards the motor housing 218 from gears 308 and nose 306 and extends outwardly past gears 308. Shoulder 310 serves as a stop for bearing 302 which is positioned around body 312 and held in place by clip 314.

In this arrangement, as motor 276 rotates, the drive shaft 280 of transmission 278 rotates which rotates motor coupler 304 which rotates bearing 302 within ring 284 of motor end cap 282.

The exterior end 272 of motor 276 is connected to a motor controller 268 (or in an alternative arrangement, the motor controller 268, or a portion of motor controller 268 is positioned in or connected to first bracket 216). Motor controller 268 includes all the components to control motor 276 and to control operation of the architectural covering 210. Motor controller 268 is any device which controls the operation of motor 276. In one arrangement, motor controller 268 is an electrical circuit board or PC board 316 which is electrically connected to a microprocessor 318 connected to memory 320, a receiver or transceiver 322 and an antenna 324. Micro-processor 318 is any programmable device that accepts analog or digital signals or data as input, processes it according to instructions stored in its memory 320, and provides results as output. Microprocessor 318 receives signals from receiver or transceiver 322 and processes them according to its instructions stored in its memory 320 and then controls motor 276 based on these signals. Memory 320 is any form of electronic memory such as a hard drive, flash, ram or the like. Antenna 324 is any electronic device which converts electric power into electromagnetic signals or electromagnetic waves, which are commonly known as radio waves or RF (radio frequency) (hereinafter collectively referred to as "electromagnetic signals" without limitation). Antenna 324 can transmit and/or receive these electromagnetic signals. In one arrangement these electromagnetic signals are transmitted via AM or FM RF communication, while any other range of RF is hereby contemplated such as 433 MHz or 908 MHz. In the arrangement shown, a meandering monopole antenna or fractal antenna is used; however any other form of an antenna is hereby contemplated. Antenna 324 is positioned adjacent the exterior end 272 of motor housing 218 so as to be in the best position to receive electromagnetic signals without interference. In the arrangement shown, antenna 324 is positioned just inside of end cap 326. In an alternative arrangement, antenna 324 is incorporated within end cap 326. In another arrangement end cap 326 is replaced with a decorative finial; or alternatively a decorative finial is connected to end cap 326.

To detect rotation and track the position of rotatable drive element 212, a sensor assembly 328 is connected to motor housing 218. Sensor assembly 328 is any form of a device which senses the rotation or position of architectural covering 210, such as reed switches, mechanical encoders, magnetic encoders, or the like. In one arrangement, as is shown, sensor assembly 328 includes a magnet wheel 330 connected to a secondary motor shaft 332 extending outwardly from the exterior end 272 of motor 276 such that when motor 276 rotates, secondary motor shaft 332 rotates, thereby rotating magnetic wheel 330. Positioned adjacent to magnet 330 is at least one, and as is shown two, Hall Effect sensors 334 positioned opposite one another. In this arrangement, Hall Effect sensors 334 are connected to PC board 316 adjacent magnet 330 which extends into an opening in PC board 316. This arrangement using Hall Effect Sensors 334 is more fully described in Applicant's related patent application entitled Low-Power Architectural Covering Ser. No. 61/811,650 filed on Apr. 12, 2013 which is fully incorporated by reference herein.

Battery Tube Assembly: A battery tube assembly 336 is connected to the architectural covering 210. Battery Tube Assembly 336 is formed of any suitable size, shape and design. As one example, in the arrangement shown, the battery tube assembly 336 includes an elongated hollow tubular member 338 which is sized and shaped to receive a stack of conventional batteries 340 therein within close and acceptable tolerances such as A, AA, B, C or D cell batteries. The lower end of battery tube assembly 336 is closed by a battery end cap 342. The opposite, or upper end of battery tube assembly 336 is removeably and replaceably enclosed by a battery connector cap 344. Battery connector cap 344 is removeably and replaceably connected to battery tube assembly 336 by a key-slot 346 positioned in the elongated hollow tubular member which is in locking and mating communication with a protrusion in the battery connector cap 344. However, any other means of connecting battery connector cap 344 to elongated hollow tubular member 338 is hereby contemplated such as threads, a snap fit design, a button-lock design or the like. A transmission wire 346 which terminates in a plug 348 extends outwardly from battery connector cap 344 and transmits electricity to architectural covering 210. Plug 348 matingly and matchingly and removeably and replaceably connects to socket assembly 264 in mounting plate 220 of bracket 216.

A battery tube mounting bracket 350 is removeably and replaceably connected to the elongated hollow tubular member 338 and serves to mount and hold elongated hollow tubular member 338 therein. Battery tube mounting bracket 350 is formed of any suitable size, shape and design. As one example, in the arrangement shown, battery tube mounting bracket 350 is a generally elongated extrusion having a back wall 352 connected to its outward edges to sidewalls 354. The space between back wall 352 and opposing sidewalls 354 is sized and shaped to frictionally and tightly, but removeably, receive hollow elongated tubular member 338. To achieve this frictional engagement, the ends 356 sidewalls 354 angle or curve inward toward one another. In this arrangement, elongated hollow tubular member 338 can be forced within the space between sidewalls 354 and back wall 352; and elongated hollow tubular member 338 can be forced out of the space between sidewalls 354 and back wall 352. Elongated hollow tubular member 338 can be mounted within the vicinity of bracket 216 and motor housing 218 in either a vertical alignment (as is shown) in a perpendiculars alignment or in any other alignment by fastening battery tube mounting member 350 to the wall, ceiling or structure architectural covering 210 is mounted to. Mounting can be accomplished by passing conventional fasteners, such as screws or bolts, through the back wall 352 of battery tube mounting bracket 350.

Motor Coupler Sleeve: Rotatable drive element 212 connects to the motor housing 218 through connection of the motor coupler 304 to a motor coupler sleeve 360. Motor coupler sleeve 360 is an elongated hollow tubular member having an exterior surface 362 and an interior surface 364 which extend in generally parallel spaced relation to one another. The exterior surface 362 has gears or teeth therein that extend along a length of motor coupler sleeve 360. The gears or teeth in the exterior surface 362 of motor coupler sleeve 360 matingly and meshingly and removeably and replaceably engage and receive gears or teeth in the interior surface 366 of rotatable drive element 212 adjacent its open hollow end 368. A collar 370, or protrusion positioned in the exterior surface 362 of motor coupler sleeve 360 sets the distance at which motor coupler sleeve 360 can be inserted into the end 368 of rotatable drive element 212.

The interior surface 364 of motor coupler sleeve 360 also has gears or teeth therein that extend along a length of motor coupler sleeve 360. The gears or teeth in the interior surface 364 of motor coupler sleeve 360 matingly and meshingly and removeably and replaceably engage and receive gears 308 in the interior surface of motor coupler 304 of motor housing 218. In this arrangement, nose 306 of motor coupler 304 is inserted through the mounting member 224 of bracket 216 and into the hollow interior of motor coupler sleeve 360 such that the gears 308 of motor coupler 304 engage the teeth or gears in the interior surface 364 of motor coupler sleeve 360. A collar 370, or protrusion positioned in the exterior surface 362 of motor coupler sleeve 360 sets the distance at which motor coupler sleeve 360 can be inserted into the end 368 of rotatable drive element 212.

When motor coupler sleeve 360 is fully inserted within the hollow interior end 368 of rotatable drive element 212 and the motor coupler 304 is fully inserted into the hollow interior of motor coupler sleeve 360, rotation of motor coupler 304 causes rotation of rotatable drive element 212.

Center Coupler: Two rotatable drive elements 212 can connect to one another in end-to-end alignment through the use of a center coupler 372. The use of multiple center couplers 372 can be used to connect two, three, four or more rotatable drive elements 212 together without limit.

Center coupler 372 is formed of any suitable size, shape and design. As one example, in the arrangement shown, center coupler 372 is a pair of elongated hollow tubular members 374 (otherwise known as splines, or when combined as a single piece as a spline) connected at their inward facing edge to a bearing assembly 376. In one arrangement, bearing assembly 376 includes an individual bearing 378 associated with each elongated hollow tubular member 374. The exterior surface 380 of each elongated hollow tubular member 374 has gears or teeth therein that extend along a length of each elongated hollow tubular member 374. The gears or teeth in the exterior surface 380 of elongated hollow tubular member 374 matingly and meshingly and removeably and replaceably engage and receive gears or teeth in the interior surface 366 of rotatable drive element 212 adjacent its open hollow end 368.

In one arrangement, bearing assembly 376 allows for free and independent rotation of each elongated hollow tubular member 374 of center coupler 372 without affecting the other. This allows for rotation of two rotatable drive elements 212 free and independent of one another. This allows for individual control and operation of one side of architectural covering 210, such as when two motor housings 218 are associated with a two rotatable drive element 212 architectural covering 210, where each motor housing 218 controls only the rotatable drive element 212 it is connected to.

In an alternative arrangement, the two elongated hollow tubular members 374 are connected to one another, or only a single elongated hollow tubular member 374 is used. In this arrangement, the rotatable drive elements 212 do not rotate independently of one another. When two motor housings 218 are used with this arrangement, additional torque is provided by the combined force of two motors 276.

In one arrangement, the elongated hollow tubular members 374 are inserted all the way into the open ends 368 of rotatable drive elements until the ends 368 engage or approximately engage the bearing assembly 376. In this arrangement, rotatable drive elements are fully inserted over center coupler 372. In one arrangement, when fully inserted into opposing rotatable drive elements 212 no further support is necessary. In an alternative arrangement, center coupler 372 is connected to a bracket 216. That is, the bearing assembly 376 is held within the mounting member 220 of a bracket 216. When bearing assembly 376 is positioned within mounting member 220 of a bracket 216, rotatable drive elements 212 are free to rotate upon bearings 378. In this way, additional support is provided while still allowing for necessary rotation.

The center coupler 372 provides for easier installation by allowing the assembly of long rotatable drive elements 212 from shorter rotatable drive elements 212. This also reduces the cost and ease of shipping. In addition, in one arrangement, elongated hollow tubular members 374 of the center coupler 372 are formed of a material that has some bend to it. Suitable materials include plastic, rubber, composite UHMW material or the like. The benefits of this material, used in association with the hollow design of the tubular members 374 allow the center coupler 372 to provide some give to the two rotatable drive elements 212. This give or ability to slightly bend allows for the combined rotatable drive elements 212 to be installed on walls or in applications that are not exactly perfectly straight, or allows for less-precise alignment during installation. In one arrangement, motor coupler sleeve 360 is also made of the same material which allows for less-precise installation of motor housing 218 into motor coupler sleeve 360. The use of one of these plastic or composite materials also serves to reduce noise of the architectural covering 210 during use.

Multiple center couplers 370 can be used to connect any number of rotatable drive elements together.

Rotatable Drive Element Extension: In the arrangement shown in FIG. 63, only a single motor housing 218 is connected to the two rotatable drive elements 212, which drives the combined rotatable drive elements 212. A rotatable drive element extension 382 is connected to the exterior side 226 of the mounting member 214 of the second bracket 216. Rotatable drive element extension 382 is formed of any suit-able size, shape and design. As one example, in the arrangement shown, rotatable drive element extension 382 is simply a dummy motor housing lacking the internal drive components such as the motor 276, transmission 278 and motor controller assembly 268 and the like. In one arrangement, in all other ways, rotatable drive element extension 382 has an identical appearance and design to motor housing 218 described herein. In one arrangement, rotatable drive element extensions 382 do include the hollow tube, motor end cap 282, bearing 302 and motor coupler 304 so as to connect rotatable drive element 212 and allow rotation thereof. Motor housing 218 and rotatable drive element extension 382 are secured to brackets 216 by a locking-screw 384 which extends through mounting member 224 and engages the motor end cap 282 of motor housing 218 or rotatable drive element extension 382 after installation. Locking-screw 384 prevents the motor housing 218 or the rotatable drive element extension 382 from falling out of bracket 216. In this way, the end 368 of rotatable drive element 212 connected to the motor housing 218 is identified as the motor-side; whereas the end 368 of rotatable drive element 212 connected to the rotatable drive element extension 382 is identified as the non-motor side.

Idler Attachment Elements: Idler attachment elements 386 are connected to and positioned around rotatable drive element 212. Idler attachment elements 386 are formed of any suitable size and shape. In one arrangement, as is shown, idler attachment elements 386 are formed of a circular hoop member 388 which is sized and shaped to fit loosely around rotatable drive element 212. In one arrangement, a mounting ring 390 is connected to the circular hoop member 388 for attachment of shade material 392 which hangs down from idler attachment elements 386 and drive attachment elements 394.

Drive Attachment Elements: Drive attachment elements 394, like idler attachment elements 386 are connected to and positioned around rotatable drive element 212. A single drive attachment element 394 is positioned outside of, or at the end of the row of idler attachment elements 386. Drive attachment element 394 is formed of any suitable size, shape and design. In one arrangement, as is shown, drive attachment element 394 has a generally circular shape fit over and receives rotatable drive element 212 with a tooth engaged in the guide structure 214 such that when the rotatable drive element 212 rotates the drive attachment element 394 is driven along the length of rotatable drive element 212.

The idler attachment elements 386 and the driver attachment elements 394 are more fully described in applicant's related patent application Ser. No. 61/810,949 entitled Rotatable Drive Element For Moving A Window Covering Including A Flexible Guide Arm And A Pointed Tooth Arrangement filed on Apr. 11, 2013 which is fully incorporated by reference herein along with any related patent applications.

Assembly: The architectural covering 210 is assembled by connecting the opposing rotatable drive elements 212 by fully inserting the elongated hollow tubular members 374 of center coupler 372 into the open end 368 of each rotatable drive element 212 until each bearing 378 is adjacent the end 368 of rotatable drive element 212. Bearing assembly 376 may or may not be connected to a mounting member 224 of a center bracket 216 to provide additional support at the middle of combined rotatable drive element 212. In addition, motor coupler sleeves 360 are fully inserted in the open outward ends 368 of rotatable drive elements 212 until collar 370 engages the end 368 of each rotatable drive element 212.

Once the two rotatable drive elements 212 are combined and assembled, the location of the non-motor side bracket 216 of the architectural covering 210 is established by aligning the center of center coupler 372 with the center of the window or other structure architectural covering 210 is intended to cover. Alternatively, by the location of the bracket 216 of the non-motor end of the architectural covering 210 is established by measuring from the center of the desired application outwardly based on the length of the rotatable drive element 212. Once the location of bracket 216 of the non-motor end of the architectural covering 210 is located, the rotatable drive element 212 is removed and the non-motor side bracket 216 is installed with a fastener 262 inserted through the through holes 260, 262.

Once the non-motor side bracket 216 is installed, using the combined rotatable drive element 212 as a guide, the location of the motor-side bracket 216 is established. This is accomplished by inserting the end 368 of the non-motor side of drive element 212 into the recess of the interior side 228 of non-motor side bracket 216. Next, the recess of the interior side 228 of motor-side bracket 216 is installed over the motor-side end of rotatable drive element 212. In this way the position of the motor-side bracket 216 is located and the rotatable drive element 212 is removed to allow for installation of the second bracket 216.

Once the location of the motor-side bracket 216 is established, a fastener 262 is inserted into the lower through hole 260 of mounting plate 220, also known as the cantilever hole. Once the lower fastener 262 is inserted into the second bracket 216, the bracket 216 can rotate or cantilever thereon. Next, the non-motor end 368 of rotatable drive element 212 is again inserted into the non-motor side bracket 216. Next, the motor-side end of the rotatable drive element 212 is aligned with and inserted into the mounting member 224 of motor-side bracket 216 by rotating bracket 216 upon fastener 262. Once the motor-side bracket 216 is aligned with the rotatable drive element 212, the second fastener 262 is fastened into through hole 258 and thereby the installation of the opposing brackets 216 is complete.

Next the motor housing 218 and rotatable drive element extension 382 are connected to the exterior sides 226 of mounting members 224 of brackets 216. This is accomplished by aligning the key features 294 in the motor housing 218 and rotatable drive element extension 382 with the key features 242 of brackets 216. Once aligned, the motor housing 218 and rotatable drive element extension 382 are forced into tight frictional engagement with brackets 216 with the key-features 242, 294 in mating alignment and engagement with one another. In this position, the electrical contacts 298 of motor housing 218 are in electrical engagement with the electrical contacts 248 of motor-side bracket 216. Once the motor housing 218 and rotatable drive element extension 382 are fully inserted into or onto brackets 216, locking-screw 384 is tightened thereby ensuring motor housing 218 and rotatable drive element extension 382 do not accidentally separate from bracket 216.

Next, battery tube assembly 336 is installed by fastening battery tube mounting bracket 350 to a wall, ceiling or other structure, preferably behind the stack of shade material adjacent the motor-side bracket 216. Once the bracket 350 is installed, the elongated tube 338 is forced into the bracket 350 and the plug 348 is engaged into the socket assembly 264 thereby electrically connecting the power of batteries 340 to the components of motor housing 218.

In Operation—Single Motor Assembly: In the arrangement wherein only a single motor housing 218 is connected to the combined rotatable drive element 212 (such as is shown in FIGS. 63 and 64) the single motor housing 218 rotates both rotatable drive elements 212. In this arrangement, the motor housing 218 is installed on the left bracket 216 and locked in place by the mating engagement of key-features 242, 294 as well as the engagement of locking-screw 384, which prevents rotation of motor housing 218 when motor 276 rotates. With motor coupler 304 inserted into the motor coupler sleeve 360, as motor 276 rotates, the components of transmission 278 rotate which rotates drive shaft 280 which rotates motor coupler 304 on bearing 302. This rotation is transferred through the motor coupler sleeve 360 and thereby rotates the first rotatable drive element 212. The rotation of the first rotatable drive element 212 is transferred through center coupler 372 to rotate the second rotatable drive element 212. The end opposite motor housing 218 of the second rotatable drive element 212 rotates freely upon bearing 302 and is supported by the right bracket 216. In this way, a single motor housing 218 rotates dual rotatable drive elements 212. In this arrangement, when the center coupler 372 is supported by a bracket 216, the bearings 378 allow free rotation of the rotatable drive elements 212 within the mounting member 224 of the bracket 216.

Actuation: In this arrangement, motor 276 of architectural covering 210 can be actuated in any one of a plurality of methods and manners. Motorized control of architectural covering 210 can be implemented in several ways. As examples, the motor 276 can be actuated by tugging on the architectural covering 210, by using a remote control device using RF communication, by using a voice command and a voice command module, an internet enabled application, or any other method.

Tugging: One method of actuating the motor 276 is through tugging the architectural covering 210. This method and system is more fully described in Applicant's related patent application entitled Low-Power Architectural Covering Ser. No. 61/811,650 filed on Apr. 12, 2013 which is fully incorporated by reference herein. A tug is defined a small manual movement of the architectural covering. This tug is sensed by a tug sensor such as an accelerometer, hall effect sensors, reed switch or the like as is more fully described in Applicant's related patent applications. When the tug sensor senses the tug, the system is woken up from a sleep state. In sleep state, power use is minimized to maximize battery life. When the system is woken up, the tug sensor senses the tug and the Microprocessor 318 deciphers the tug and determines how to actuate the motor 276.

In one arrangement, the microprocessor 318 is programmed to recognize, one, two, three, or more tugs separated by a predetermined amount of time, such as between a quarter second and one and a half seconds. However any other amount of time between tugs is here by contemplated such as ¼ second, ½ second, ¾ second, 1 second, 1¼ seconds, 1½ seconds, 1¾ seconds, 2 seconds, and the like. When microprocessor 318 detects a single tug, pursuant to instructions stored in the memory 320 microprocessor 318 instructs motor 276 to go to a first corresponding position, such as open. When microprocessor 318 detects two tugs, pursuant to instructions stored in memory 320, the microprocessor 318 instructs motor 276 to go to a second corresponding position, such as closed. When microprocessor 318 detects three tugs, pursuant to instructions stored in memory 320 microprocessor 318 instructs motor 276 to go to a third corresponding position, such as half open. Any number of tugs and positions can be programmed.

Remote Control and Voice Control Operation: One method of actuating the motor 276 is through using a wireless remote 396. This method and system is more fully described in Applicant's related patent application entitled System and Method for Wireless Voice Actuation of Motorized Window Coverings Ser. No. 61/807,846 filed on Apr. 3, 2013 which is fully incorporated by reference herein. In that application, as is contemplated herein, a wireless remote 396 is actuated by the user, by pressing a button. When actuated, the wireless remote 396 transmits an electromagnetic signal over-the-air, which is received by the antenna 324 of the motor controller assembly 268. Once antenna 324 receives the electromagnetic signal it is transmitted to receiver or transceiver 322 which converts the signal and transmits it to microprocessor 318. Microprocessor 318 interprets the signal based on instructions stored in memory 320 and actuates the architectural covering 210 to the predetermined position. As is also presented in that application, is a voice actuation module 398, which receives a user's voice command, converts it to an electromagnet signal which is received by architectural covering 210 in the manner described herein.

Internet Control and Operation: One other method of actuating the motor 276 is through use of the internet and use of an electronic device. This method and system is more fully described in Applicant's related patent application entitled System and Method for Wireless Communication With and Control of Motorized Window Coverings Ser. No. 61/807,804 filed on Apr. 3, 2013 which is fully incorporated by reference herein. In that application, as is contemplated herein, motor 276 is actuated by a user having an internet enabled handheld device, such as a laptop, tablet or smartphone, which transmits a signal through the internet which is received at a gateway which then transmits an electromagnetic signal to the architectural coverings 210 as is described herein.

In Operation Dual Motor Assembly: In the arrangement wherein a motor housing 218 is connected to both ends of the combined rotatable drive element 212 there are two modes of operation. The first mode of operation includes where the center coupler 372 does not allow for independent rotation of rotatable drive elements 212. In this arrangement, the two motor housings 212 combine to contribute to the rotation of the combined rotatable drive elements 212. In this arrangement, a benefit is that the two motor housings 218 provide additional power and torque for the application. In this arrangement, a drawback is that the two motor housings 218 should be actuated simultaneously and be tuned to operate in cooperation with one another, otherwise one motor housing 218 will be working against the other.

In an alternative arrangement, center coupler 372 allows for independent rotation of rotatable drive elements 212 upon bearings 378. In this arrangement, a single motor housing 218 only rotates a single rotatable drive element 212. This eliminates coordinating opposing motor housings 218 as one will not affect the other. This also provides for independent actuation of one side of the architectural covering 210 while leaving the opposing side unaffected.

Coordination of Dual Motor Housings: In the arrangement wherein two motor housings 218 are used, coordination of the two motor housings 218 may be desired. That is, in some applications it is desirable to turn on and turn off motors 276 at the same time. In other applications it is also important to rotate the motors 276 at the same speed. There are multiple ways to accomplish this coordination. In one arrangement, the two motor housings 218 are connected by an electrical conduit, such as a wire, which transmits control signals from one motor housing 218 to the other motor housing 218. More specifically, the two motor controller assemblies 268 are connected to one another and communicate with one another. This ensures that when one motor housing 218 receives a control signal, such as through a tug or through a wireless or electromagnetic signal, that the control signal is relayed to the other motor housing 218. This ensures when one motor housing 18 receives a control signal so does the other motor housing 218.

In another arrangement, the two motor housings 218 are wirelessly connected to one another. In this arrangement, the motor controller assemblies 268 of each motor housing 218 have a transceiver 322, instead of a receiver, which allows for sending as well as receiving control signals. In this arrangement, when a control signal is received by one motor controller assembly 268, the transceiver 322 re-broadcasts or relays the control signal which is received by the transceiver 322 of the other motor controller assembly 268. In this way, the two motor controller assemblies 268 communicate with one another to ensure the control signals have been received by both motor controller assemblies 268.

Additional information is also transmitted from motor housing 218 to motor housing 218 in the ways described herein, such as wirelessly or through wired communication. This information can include as speed, location, state (such as awake or asleep mode) and the like so as to coordinate operation and actuation of the two motors 276.

Conductive Brackets: In one arrangement, the brackets 216 are formed of a conductive material such as steel, copper, aluminum, an alloy or the like. In this arrangement, the bracket 216 itself can be used as a pathway or conductor for carrying electricity from battery tube assembly 336. In this way, when plug 348 connects to socket assembly 264 a conduit 250 or wire can be eliminated because this conduit 250 has been replaced by the bracket itself. This reduces cost of the system and eases the assembly by eliminating a part.

Components Recess: In one arrangement, the motor controller assembly 268 is positioned within the components recess 266 of bracket 216. In this arrangement, all the necessary components for controlling motor 276 are positioned within the bracket 216. As one example, antenna 324, receiver or transceiver 322, memory 320 and microprocessor 318 are positioned within components recess 266 of bracket 216. This arrangement allows for a smaller motor housing 218 which improves the aesthetic appearance of design.

Knurling: In one arrangement, guide structure 214 can be formed into the exterior surface of the rotatable drive elements 212, motor housings 218 and rotatable drive element extensions 382. Knurling is a method used to cut or roll a pattern onto a material such as plastic or metal. This process is typically performed on a lathe, though in some cases a hand knurling tool will be used instead. A knurled object may have a threaded, diamond, crisscrossed or straight line pattern imparted on it that adds both functionality and pleasing aesthetics. Knurling is often meant to provide a better gripping surface than offered by the bare material.

The primary method used to knurl objects is a lathe process that uses a very hard roller to press the desired shape into the work material. A roller with a reverse imprint of the desired knurl is held in a knuckle or jig and then pressed into the piece being worked on. The main configurations used for this type of knurling contain either one or two rollers. A straight knurl can be pressed by one roller, but any type of a diamond or crisscrossed design will require rollers with opposing patterns. The drawback of this process is that the rollers need to be matched to the unique outer diameter of each workpiece, so it is best for the mass production of many identical components.

In the arrangement shown, a crisscrossed or diamond pattern is knurled into the surface of rotatable drive elements 212. Knurling is a fast, inexpensive, durable, accurate and efficient method of imparting the guide structure 214 into the surface of the rotatable drive element 212. An example of the knurled surface imparted into the surface of rotatable drive element 212 is shown in FIG. 73 which is a diamond shaped pattern, a crisscrossed pattern or a cross-threaded pattern. This pattern shows a high-density of threads which extend in a left-hand-rotation as well as a right-hand-rotation. This pattern also shows an extremely high-density of threads. Knurling is a desirable process because to impart this amount of threads in the surface of a rotatable drive element 212 by any other process would be extremely complicated and extremely time consuming.

Drive attachment element 394 engages the threaded and cross threaded pattern of the knurled surface. The interior surface 399A of drive attachment element has a tooth 399B that matingly engages the threads of the knurled pattern. As the rotatable drive element 212 is rotated, the tooth 399B of the drive element 212 rides along in the recesses or threads of the knurled surface which, depending on the direction of rotation, drives the drive attachment element 394 along the length of the rotatable drive element thereby opening and/or closing the architectural covering 210. A similar arrangement is more fully described in Applicant's related patent Application Ser. No. 61/702,093 filed on Sep. 17, 2012 entitled Rotatable Drive Element For Moving A Window Covering, which is fully incorporated by reference herein, including any related applications; and Applicant's related patent Application Ser. No. 61/810,949 filed on Apr. 11, 2013 entitled Rotatable Drive Element For Moving A Window Covering Including A Flexible Guide Arm And A Pointed Tooth Arrangement which is also fully incorporated by reference herein, including any related applications.

In one arrangement, an aluminum material is desirable for use as the rotatable drive element 212 for the ease of which a knurling process can be performed. To improve the sliding of the driver attachment element 394 there over, a composite material is used for the interior surface 399A of drive attachment element 394 and tooth 399B. To further improve the sliding of the driver attachment element 394 over the knurled surface of the rotatable drive element, a coating is imparted over the knurled surface of rotatable drive element 212 such as a Teflon material, anodizing or any other low friction coating.

Tooth Arrangement: To also improve the sliding of the drive attachment element 394 over the knurled surface of the rotatable drive element 212 the interior surface 399A of rotatable drive element 212 has a lower density of teeth than the surface of rotatable drive element 212 has density of knurled threads. That is, as one example there is only one tooth 399B for every two knurled threads in the surface of the rotatable drive element 212. As another example, there is only one tooth 399B for every three knurled threads in the surface of the rotatable drive element 212. As another example, there is only one tooth 399B for every four knurled threads in the surface of the rotatable drive element 212. Other contemplated aspect ratios of teeth 399B to knurled threads include 1 for 5, 1 for 6, 1 for 7, 1 for 8, 1 for 9, 1 for 10, 1 for 11, 1 for 12, 1 for 15, 1 for 20, 1 for 25, 1 for 50, 1 for 75, 1 for 100 and the like. The reduction in the number of teeth 399B reduces the friction between the drive attachment element 394 and the rotatable drive element 212 which causes smoother operation and less consumption of energy.

Flexible Driver: An improved drive attachment element 438 is presented. Drive attachment elements 438 are connected to and positioned around rotatable drive element 212. Drive attachment element 438 is formed of any suitable size, shape and design. In one arrangement, as is shown, drive attachment element 438 has a main body 440 that has a generally circular shape with an outside diameter surface 442 positioned in approximate parallel spaced relation to an inner diameter surface 444. The inner diameter 444 of drive attachment element 438 is larger than the outer diameter of rotatable drive element 212, such that drive attachment element 438 can fit over and receive rotatable drive element 212. Main body 440 of drive attachment elements 438 are positioned within a decorative ring 445, which, in one arrangement, has a similar outward appearance to the idler attachment elements 386. In one arrangement, the decorative ring 445 of drive attachment element 438 and idler attachment element 386 are practically identical, or identical with the only difference being the component(s) positioned within the decorative ring 445. In one arrangement, the interior components, such as drive attachment elements 438, rotate within a groove positioned within the inside diameter surface of decorative ring 445.

In one arrangement, decorative ring 445 is made of a metallic material, whereas the interior components are made of a plastic, composite or other non-metallic material. In one arrangement an acetyl-type of plastic is used, especially over a Teflon-coated rotatable drive element as a low coefficient of friction occurs there between.

The main body 440 of drive attachment element 438 has a top region 446 which is generally unitary in nature, whereas the bottom region 448 terminates in separate opposing arms 450. Arms 450 are formed of any suitable size, shape and design. In the arrangement shown, arms 450 generally continue the arcuate curve of main body 440 of drive attachment element. Each arm 450 terminates in a hook portion 452. In one arrangement, opposing arms 450 are separated from one another and are flexible such that main body 440 can be placed over rotatable drive element 212 between arms 450. In one arrangement, a space is positioned between the ends of opposing arms 450; whereas in an alternative arrangement, no such space is positioned between opposing arms 450 and opposing arms 450 are in frictional engagement with one another. As can also be seen, each opposing arm 450 is aligned with one side of main body 440, that is, one arm 450 is aligned with the right side of main body 450, whereas the other arm 450 is aligned with the left side of main body 440. This staggering, or offset, allows the ends of hook portions 452 of opposing arms 450 to overlap, or extend past one another.

Hook portions 452 are formed of any suitable size, shape and design. In one arrangement, as is shown, hook portions 452 extend into the open interior of main body 440 with an arcuately curved exterior convex surface 454 connected at point or end 456 to an arcuately curved interior concave surface 458. Points 456 do not extend into the open interior of main body 440 to the point where they engage or interfere with rotatable drive element 212 when positioned therein. As opposing arms 450 overlap one another, opposing hook portions 452 also overlap one another. In the arrangement shown, opposing points 456 are in approximate horizontal alignment with one another, and the overlapped interior concave surfaces 458 form a space or opening 460 there between. Opening 460 is sized and shaped to receive a connection member 434, as is described herein, such as a ring, as is shown. The arcuately curved and concave surfaces 458 help to hold connection member 434 therein. In addition, when a connection member 434 is placed between the arcuately curved concave surfaces 458 of hook portions 452, connection members 434 prevent arms 450 from separating from one another, thereby providing rigidity to the bottom region 448 and main body 440 as a whole. As an example, when weight is applied to connection member 434 (such as the weight of a heavy curtain 436) arms 450 deflect or bend away from one another, thereby capturing connection member 434 between interior concave surfaces 458, which defines the maximum amount that arms 450 will bend away from one another.

Guide arms 462 are connected to drive attachment elements 438. Guide arms 462 are formed of any size, shape or design. In one arrangement, as is shown, guide arms 462 are connected to the interior surface of main body 440, or the inside diameter surface 444. In one arrangement, when viewed from the side, guide arms 462 extend the entire distance from a first lateral side 464 of drive attachment element 438 to a second lateral side 466 of drive attachment element 438. Guide arms 462 connect at their upper edge to the inside diameter surface 444 at pivot point 468 and extend downwardly and inwardly at an angle therefrom to where guide arm 462 terminates at end 470. Guide arms 462 have an interior surface 472 and an exterior surface 474. In one arrangement, as is shown, interior surface 472 and exterior surface 474 extend in generally parallel spaced relation to one another. Also, as is shown, guide arms 462 arcuately curve in the same general manner as main body 440 and rotatable drive element 212. That is the exterior surface 474 of guide arm 462 is generally convex in nature, and interior surface 472 of guide arm 462 is generally concave in nature. In one arrangement, this curvature is in the form of a partial portion of a circle. In one arrangement, the interior surface 472 of guide arm 462 arcuately curves in parallel spaced relation to the exterior surface of rotatable drive element 212, such that the interior surface 472 of guide arm 462 matchingly and matingly receives the exterior surface of rotatable drive element 212.

Guide arm 462 elastically pivots at pivot point 468. That is, opposing guide arms 462, with one guide arm 462 positioned opposite one another on the interior surface 444 of drive attachment elements 438, are initially biased to angle towards one another. Said another way, opposing guide arms 462 angle towards the open interior of drive attachment elements 438. To promote this pivoting, or bias pivot point 468 is intentionally weakened or designed to flex. In one arrangement, as is shown, when viewed from the side, a recess 476 is positioned at the intersection of guide arm 462 and main body 440, and/or adjacent pivot point 468. In one arrangement, as is shown, this recess 476 is, when viewed from the side, a semi-circular recess. This thinning of the material at pivot point 468 encourages bending, without breaking with the semi-circular recess 476 providing a rounded surface to ensure guide arm 462 resists cleaving or breaking at pivot point 462, thereby providing a longer useful life.

Guide arms 462 flex upon pivot point 468 between a maximum engagement position 478, and a maximum deflection position 480. A first bumper 482 is positioned in the inside diameter surface 444 of main body 440 and correspondingly positioned across from a second bumper 484 positioned in the exterior surface 474 of guide arm 462. Bumpers 482, 484 extend outwardly, or protrude, from their respective surfaces 444, 474. When bumpers 482, 484 engage one another, guide arm 462 is at its maximum deflection position 480.

At least one tooth 486, if not a plurality of teeth, extends outwardly from the interior surface of guide arms 462. Tooth 486, is formed of any suitable size and shape and design. In the arrangement shown, when viewed from the side, tooth 486 has a generally elongated shape with sidewalls 488 positioned in parallel spaced relationship with one another. Sidewalls 488 terminate at tooth ends 490. In this arrangement, tooth ends 490 are rounded or pointed so as to smoothly slide over any aberrations, burrs or abnormalities in rotatable drive element 212. In this arrangement, teeth 486 are sized and shaped to matingly receive the grooves or protrusions in rotatable drive element 212. That is, when helical guide structure 214 is a rounded groove, or semi-circular groove, teeth 486 are sized and shaped to be similarly rounded or semi-circular such that teeth 486 are received in the rounded groove of helical guide structure 214. Teeth 486 are positioned in angular alignment such that they extend across the side-to-side 464, 466 width of guide arms 462 at approximately the same angle $\alpha$ as the grooves in rotatable drive element 212. As can be seen in this arrangement, opposing teeth 486 on opposing guide arms 462 are essentially inverses of one another, or mirror images of one another.

In this arrangement, drive attachment element 438 is positioned over rotatable drive element 212 by sliding drive attachment element 438 over an end of rotatable drive element 212. Alternatively, drive attachment element 438 is positioned over rotatable drive element 212 by deflecting opposing arms 450, such that rotatable drive element 212 is received within the open interior within inside diameter surface 444. Once in this position, guide arms 462 engage the exterior surface of rotatable drive element 212 and opposing teeth 486 align with and fit within the helical guide structure 214 in the exterior surface of rotatable drive element 212. When teeth 486 are received within helical guide structure 214, the maximum engagement position 478 is achieved. In this position, due to gravitational forces in combination with the inward bias of guide arms 462, teeth 486 are forcibly held within the grooves of helical guide structure 214.

In this arrangement, as rotatable drive element 212 is rotated, drive attachment element 438 is driven along the lateral length of rotatable drive element 212 from end to end. Care is taken to ensure that drive attachment element 438 is oriented in the correct manner, such that when the rotatable drive element 212 is rotated, the drive attachment element 438 travels in the desired linear direction.

When drive attachment element 438 is positioned over rotatable drive element 212, arms 450 again overlap one another and connection member 434 is positioned in the space 460 between opposing hook portions 452. This connection member 434 prevents arms 450 from separating from one another, prevents drive attachment element 438 from coming off of rotatable drive element 212 and further adds structural rigidity to the lower end of drive attachment element 438. In addition, decorative ring 445 prevents arms 450 from separating from one another. That is, while arms 450 can be compressed to be inserted within the interior diameter of decorative ring 445, once positioned therein, when the outside surface of arms 450 engage the interior surface of decorative ring 445, the decorative ring 445 prevents any further extension of arms 450 away from one another.

As the rotatable drive element 212 rotates, teeth 486 ride within helical guide structure 214 thereby driving drive attachment elements 438 along the length of rotatable drive element 212. As the drive attachment element 438 encounters aberrations, burrs, size variations in the rotatable drive element 212 or any other abnormality in the surface of rotatable drive element 212, guide arms 462 deflect, bend or pivot at pivot point 468, inwardly or outwardly. In this way, the inward bias, as well as the outward flexibility of guide arms 462 compensates for variations, burrs, etc. in the rotatable drive element 212. This allows for more consistent operation of drive attachment elements 438 and prevents dislodgement of teeth 486 from helical guide structure 214; as well as preventing rotation of drive attachment elements 438 on rotatable drive element 212 when an aberration, burr or other abnormality is encountered.

Pointed Tooth Driver: In an alternative arrangement, instead of teeth 486 being smooth and rounded, teeth 486 are sharp, flat, square and pointed. More specifically, in this arrangement, teeth 486 have a flat upper surface 492 that arcuately curves in parallel spaced relation to the inside diameter surface 444. When viewed from the side, opposing side panels 494 connect at their bottom edge to the inside diameter surface 444. Opposing side panels 494 angle inwardly towards one another from their bottom edge to their top edge where they connect to flat upper surface 492, at which point side panels 494 terminate. Like flat upper surface 492, opposing side panels 494 similarly arcuately curve in relation to inside diameter surface 444. Alternatively, side panels 494 are flat and square and do not arcuately curve in relation to inside diameter surface 444. In this arrangement the pair of opposing end panels 496 form the tooth end 490. As is shown, opposing end panels 496 connect at their rearward upper edge to the flat upper surface 492 and angle inwardly toward one another and downwardly toward inside diameter surface 444. In this arrangement, opposing end panels 496 connect at their lower edge to inside diameter surface 444, and connect at their inward edge to one another at seam line seam line 498 which terminates at point 500 which is the intersection of opposing side panels 494 and inside diameter surface 444. In this arrangement, opposing panels and seam line 498 form a pointed wedge.

In one arrangement, teeth 486 are positioned within recessed groove 502. Recessed groove 502 is recessed below the inner diameter surface 444 and is generally flat and positioned in parallel spaced relation to inside diameter surface 444 and outside diameter surface 442. The edges 504 of recessed groove 502 are extend in parallel spaced relation to one another and generally perpendicular to the inside diameter surface 444 and outside diameter surface 442. In one arrangement, recessed groove 502 and edges 504 thereof, extend in parallel spaced relation with the length of teeth 486. In one arrangement, teeth 486 are approximately positioned in the center of groove 502. In the arrangement shown, teeth 486 are positioned across main body 440 from one another, in one arrangement a tooth 486 is positioned approximately at the 12-o-clock position and a second tooth is positioned approximately at the 6-o-clock position; however any other position is hereby contemplated.

In this arrangement, teeth 486 protrude outwardly from recessed groove 502 such that the flat upper surface 492 of teeth 486 extend above the inside diameter surface 444 of recessed groove 502. This spacing around teeth 486 allows provides an area or space between teeth and inside diameter surface 444 which allows for the passage of burrs 506 that have a tendency to form adjacent the upper edge of helical guide structure 214. It is also hereby contemplated to use grooves 502 in association with the flexible guide arms 462 described above.

In the arrangement wherein one tooth 486 protrudes from the top center of main body 440, and a second tooth protrudes from the bottom center of main body 440, this arrangement prevents or resists vertical tilting of drive element 438. In the arrangement wherein one tooth 486 protrudes from the left side of main body 440, and a second tooth protrudes from the right side of main body 440, this arrangement prevents lateral tilting of drive element 438. As such, each arrangement is particularly well suited for specific applications.

Also, in the alternative arrangement, drive attachment element 438 includes has a main body 440 that has a generally circular shape with an outside diameter surface 442 positioned in approximate parallel spaced relation to an inside diameter surface 444. The inner diameter 444 of drive attachment element 438 is larger than the outer diameter of rotatable drive element 212, such that drive attachment element 438 can fit over and receive rotatable drive element 212. In this arrangement, main body 440 of drive attachment element 438 has a top region 446 which is generally unitary in nature, wherein the main body 440 forms a solid continuous circle.

In this arrangement, arms 450 are formed of any suitable size, shape and design. In the arrangement shown, arms 450 are connected to the outside diameter surface 442 of main body 440. In the arrangement shown, opposing arms 450 connect to main body 440 at approximately the 2-o-clock to 3-o-clock region and the 9-o-clock to 10-o-clock region as one example. Arms 450 arcuately curve around main body 440 of drive attachment element from top region 446 to bottom region 448. Each arm 450 terminates in a hook portion 452.

In one arrangement, in a static position the ends of opposing arms 450 are separated from one another by a space 508. As can also be seen, each opposing arm 450 is aligned with one side of main body 440, that is, one arm 450 is aligned with the right side of main body 450, whereas the other arm 450 is aligned with the left side of main body 440; however such staggering is not required.

Hook portions 452 are formed of any suitable size, shape and design. In one arrangement, as is shown, hook portions 452 extend upwardly towards main body 440. Hook portions 452 have a straight or arcuately curved convex exterior surface 454 connected at point or end 456, which is flat, to a straight or arcuately curved interior concave surface 458. Opposing arms 450 are flexible and pend at pivot point 510. In the arrangement shown, a connection member 434 is held between opposing flat exterior surfaces 454 of hook portions 452. When a connection member 434 is placed between the opposing exterior surfaces 454 of hook portions 452, connection members 434 prevent arms 450 from bending towards one another which prevents main body 440 from coming out of decorative ring 445.

In Operation: A drive attachment element 438 is positioned over rotatable drive element 212 such that teeth 486 are received within the helical guide structure 214. Drive attachment element 438 is followed by a plurality of idler attachment elements which are also positioned over rotatable drive element 212.

In a two-way opening arrangement, a pair of opposing drive attachment elements 438 are positioned over rotatable drive element 212, one at each end of rotatable drive element 212, followed by a plurality of idler attachments 386.

A connection member 434 is positioned over arms 450 and between opposing hook portions 452 such that connection member 434 is held there between. Next shade material or a drapery is connected to connection members 434 by any means known in the art.

In this arrangement, as rotatable drive element 212 is rotated, teeth 486 ride within helical guide structure 214. As rotatable drive element 212 is rotated, drive attachment elements 438 are driven across the length of rotatable drive element 212. When burrs 506, or other manufacturing variances or deviations are encountered, the guide arms 462 flex and allow passage of the burrs 506 without interrupting operation.

When burrs 506, or other manufacturing variances or deviations are encountered the sharp teeth 486 tend to slide past the burr 506 without dislodging teeth 486 from guide structure 214. In addition, burrs 506 tend to pass within recessed groove 502, between the narrowed flat upper surface 492 of teeth 486 and the inside diameter surface 444 without engaging or interrupting operation.

Additional Alternative Arrangement

With reference to FIGS. 82-106 an alternative embodiment of a motorized window covering system 600 is presented that is controlled, in one manner of operation by user engagement of an external battery tube assembly 602, such as by pulling or lifting the external battery tube assembly 602. Instead of pulling or lifting the external battery tube assembly 602 to control operation of the motorized window covering system 600, in alternative arrangements the battery tube assembly 602 may be controlled by sensing a button press, by sensing a twist, by sensing a squeeze or by capacitive touch sensing. While motorized window covering 600 may be controlled using external battery tube assembly 602, use of the external battery tube assembly 602 to control operation of the motorized window covering 600 does not prevent control through other modes such as use of remote 96, manual movement, tugging, control-over-internet, or any other manner of control.

Motorized window covering system 600 is formed of any suitable size, shape and design and is configured to open and close shade material. Motorized window covering system 600 may be formed of a rotating rod arrangement, a track arrangement, a roller shade, a honeycomb shade, a venetian shade, a roman shade, or any other form of a motorized shade or barrier.

Rotating Rod Arrangement: In one arrangement, as is shown in FIGS. 82 and 83 motorized window covering system 600 includes a first rod 604 and a second rod 606 that are supported by brackets 608 that connect to a structure, such as a wall adjacent a window. In this arrangement, first rod 604 and second rod 606 have a plurality of rings 610 positioned there around the rods 604, 606. A first shade material 612 is connected to first rod 604 by rings 610, and a second shade material 614 is connected to second rod 606 by rings 610.

At least one of the rings 610 connected to the first rod 604 and second rod 606 are in communication with a feature, such as a helical groove, positioned in the external surface of the rod 604, 606, as is described further herein. As first rod 604 or second rod 606 rotate, the rings 610 that are in communication with the feature of the respective rod 604, 606 are driven across the length of the respective rod 604, 606, thereby opening, or closing, the respective shade material 612, 614 connected to that rod 604, 606, as is described further herein.

A first motor 616 (not visible but within the rod or finial) is operatively connected to the first rod 604 such that operation of the first motor 616 rotates the first rod 604; and a second motor 618 (not visible but within the rod or finial) is operatively connected to the second rod 606 such that operation of the second motor 618 rotates the second rod 606. As the motor 616, 618 is rotated, so rotates the respective rod 604, 606. As the rod 604, 606 rotates, the rings 610 that are in communication with the feature of the respective rod 604, 606 are driven across the length of the respective rod 604, 606, thereby opening, or closing, the respective shade material 612, 614 connected to that rod 604, 606, as is described further herein.

First motor 616 and second motor 618 are connected to first rod 604 and second rod 606 by any manner, method or means. In one arrangement, as is further described herein, motor 616, 618 is positioned within the hollow interior of rod 604, 606. In another arrangement, as is further described herein, motor 616, 618 is positioned within a finial 620 connected to an end of the rod 604, 606, as is further described herein. Regardless of where motor 616, 618 are positioned and how motor 616, 618 is connected to rod 604, 606, as motor 616, 618 rotates so rotates respective rod 604, 606.

An external battery tube assembly 602 is connected to motorized window covering system 600. External battery tube assembly 602 is formed of any suitable size, shape and design and is configured to provide power to the first motor 616 and second motor 618 as well as provide one manner of controlling operation of first motor 616 and second motor 618. In the arrangement shown, as one example, external battery tube assembly 602 includes the component pieces of a battery housing 624, a controller housing 626 and a conduit 628, among other components, as is further described herein.

In the arrangement presented in FIGS. 82 and 83, external battery tube assembly 602 is connected to and hangs down from bracket 608 by conduit 628. That is, the upper end of conduit 628 connects to bracket 608 and the lower end of conduit 628 connects to the upper end of external battery tube assembly 602. External battery tube assembly 602 hangs downward from bracket 608 the length of conduit 628. Conduit 628 provides support for external battery tube assembly 602 while also distributing power and/or control signals from external battery tube assembly 602 to first motor 616 and second motor 618.

Track Arrangement: In another arrangement, as is shown in FIGS. 104-107 motorized window covering system 600 includes a first track 630 and a second track 632 that are supported by brackets (not shown) that connect to a structure, such as a wall adjacent a window. In this arrangement, first track 630 and second track 632 have a plurality of carriers that slide along the length of the first track 630 and second track 632 by movement of a belt or other component positioned within the first track 630 and second track 632. A first shade material 612 is connected to first track 630 by carriers 634, and a second shade material 614 is connected to second track 632 by carriers 634.

A first motor 616 (not visible but positioned within first motor housing 638) is operatively connected to the first track 630 such that operation of the first motor 616 moves the internal belt or other components within the first track 630 which move the carriers 634 connected to the first track 630; and a second motor 618 (not visible but positioned within second motor housing 642) is operatively connected to the second track 532 such that operation of the second motor 618 moves the internal belt or other components within the second track 632 which move the carriers 634 connected to the second track 632. As the motor 616, 618 is rotated, so moves the carriers 634 connected to the respective track 630, 632 thereby opening the respective shade material 612, 614 connected to the respective track 630, 632.

First motor 616 and second motor 618 are connected to first track 630 and second track 632 by any manner, method or means. In one arrangement, as is shown, first motor 616 and second motor 618 is connected to first track 630 and second track 632, respectively, by connection to an end member 636. End member 636 is any device or component that connects to the end of track 630, 632 and facilitates connection of motor 616, 618 to track 630, 632 while also operatively connecting motor 616, 618 to the internal components of track 630, 632 such that operation of motor 616, 618 moves carriers 634.

An external battery tube assembly 602 is connected to motorized window covering system 600. In the arrangement presented in FIGS. 104 and 105, external battery tube assembly 602 is connected to and hangs down from the lower end of first motor housing 638 that houses first motor 616, although in an alternative arrangement, the external battery tube assembly 602 is connected to and hangs down from the lower end of second motor housing 642 that houses second motor 618, although in yet another alternative arrangement, external battery tube assembly 602 is connected to and hangs down from the lower end of both the first motor housing 638 that houses first motor 616 and the second motor housing 642 that houses second motor 618. A cable 640 extends between first motor housing 638 and second motor housing 642 that houses second motor 618. Cable 640 provides power from external battery tube assembly 602 to second motor 618 in this arrangement.

External battery tube 602 is connected to motorized window covering system 600 by conduit 628. More specifically, the upper end of conduit 628 connects to the lower end of the first motor housing 638 and the lower end of conduit 628 connects to the upper end of external battery tube assembly 602.

The difference between the arrangement of FIGS. 104 and 105 and the arrangement of FIGS. 106 and 107 is that in the arrangement of FIGS. 104 and 105 the controller housing 626 of external battery tube assembly 602 is connected to the upper end of battery housing 624; whereas, in contrast, in the arrangement of FIGS. 106 and 107 the controller housing 626 of external battery tube assembly 602 is connected to the lower end of first motor housing 642. Otherwise the arrangements FIGS. 104 and 105 and FIGS. 106 and 107 are similar.

External Battery Tube Assembly: External battery tube assembly 602 is formed of any suitable size, shape and design and is configured to provide power to the first motor 616 and second motor 618 as well as provide one manner of controlling operation of first motor 616 and second motor 618, such as by pulling and/or lifting the battery tube assembly 602. In the arrangement shown, as one example, external battery tube assembly 602 includes the component pieces of a battery housing 624, a controller housing 626 and a conduit 628, among other components, as is further described herein.

Battery Housing: Battery housing 624 is formed of any suitable size, shape and design and is configured to house and hold a plurality of batteries therein for the supply of power to the first motor 616 and second motor 618. In the arrangement shown, battery housing 624 includes a generally cylindrical member that extends a length between an upper end 644 and a lower end 646 and has a hollow interior 644 that is sized and shaped to receive a plurality of batteries therein within close tolerances. In the arrangement shown, the upper end 644 of battery housing 624 includes a threads that facilitate connection of battery housing 624 to the lower end of controller housing 626. Using threads to engage and connect battery housing 624 to controller housing 626 provides a secure connection while also allowing for the easy removal and re-connection of battery housing 624 to controller housing 626 for the purposes of removing and replacing spent batteries. However any other manner or method of connecting battery housing 624 to controller housing 626 is hereby contemplated for use, such as a spring loaded locking arrangement, a snap-fit arrangement, a friction fit arrangement, or any other manner of connecting two components together. A spring member 650 is placed within battery housing 624 which applies pressure to the batteries within battery housing 624 and helps to facilitate and maintain an electrical connection between the batteries.

Controller Housing: Controller housing 626 is formed of any suitable size, shape and design and is configured to house and hold an actuator mechanism (also referred to simply as actuator) 652. In the arrangement shown, controller housing 626 includes a pair of housing portions 654 that each form a portion of the controller housing 626 when connected together. In the arrangement shown, a pair of housing portions 654 are shown being used that connect to one another along a seam-line between the two components. In the arrangement shown, each housing portion 654 forms approximately half of the controller housing 626. While a pair of housing portions 654 are shown being used any other number of housing portions 654 are contemplated for use as controller housing 626.

In the arrangement shown, as one example, controller housing 626 is generally cylindrical in shape and extends a length from an upper end 656 to a lower end 658. In the arrangement shown, the lower end 658 of controller housing 626 includes threads that facilitate connection of the lower end 658 of controller housing 626 to the upper end 644 of battery housing 624. Using threads to engage and connect battery housing 624 to controller housing 626 provides a secure connection while also allowing for the easy removal and re-connection of battery housing 624 to controller housing 626 for the purposes of removing and replacing spent batteries. However any other manner or method of connecting battery housing 624 to controller housing 626 is hereby contemplated for use, such as a spring loaded locking arrangement, a snap-fit arrangement, a friction fit arrangement, or any other manner of connecting two components together.

In the arrangement shown, as one example, the upper end 656 of controller housing 626 includes a collar 660 that provides an opening in the upper end 656 of controller housing 626 and facilitates the passage of conduit 628 there through. Conduit 628 passes through collar 660 and collar 660 allows for motion of conduit 628 relative to collar 660. Conduit 628 extends from the interior of controller housing 626, through collar 660 positioned in the upper end 656 of controller housing 626 and upward until it engages the motorized window covering system 600 as is further described herein.

A moveable member 662 is connected to the lower end of conduit 628 and positioned within the hollow interior of controller housing 626. Moveable member 662 is moveable with respect to a stationary member 664 that is also positioned within the hollow interior of the controller housing 626. An upper spring 668 is positioned adjacent the upper side of moveable member 662 and a lower spring 670 is positioned adjacent the lower side of moveable member 662.

In the arrangement shown, as one example, stationary member 664 is connected to one of the housing portions 654 in a rigid or fixed manner such that the stationary member 664 as affixed and immobile within the controller housing 626. In one arrangement, the stationary member 664 is held within locating features within controller housing 626 which prevents movement of the stationary member 664 within controller housing. In one arrangement, the stationary member 664 is clam-shelled between the two housing portions 654 which holds the stationary member 664 in place. In another arrangement, stationary member 664 is screwed, bolted, snap-fitted or connected to one of the housing portions 654 by any other manner, method or means so that it is held in a fixed position.

In one arrangement, stationary member 664 includes a printed circuit board member 672 that is generally square or rectangular in shape and is generally planar in shape. This printed circuit board member 672 houses or holds the electronic components needed for operation of the external battery tube assembly 602 and/or the motorized window covering system 600. In the arrangement shown, printed circuit board member 672 also includes a detector 674.

Detector 674 is any device that detects specified motion of the external battery tube assembly 602 or detects motion of the external battery tube assembly 602 beyond a predetermined threshold or in a predetermined direction. In one arrangement, as is shown, detector 674 is a malleable switch mechanism which forms an electrical contact when bent beyond a predetermined threshold and in a predetermined direction. However, detector 674 may be formed of any other form of a sensor or a switch. As examples, detector 674 may be an optical sensor, a vibration sensor, a motion sensor, a magnetic sensor, a stress or strain sensor, an accelerometer or any other form of a sensor.

In the arrangement shown, moveable member 662 is essentially suspended within the hollow interior of controller housing 626. That is, upper spring 668 is positioned between the upper end of moveable member 662 and the upper end of the hollow interior of controller housing 626, and the lower spring 670 is positioned between the lower end of moveable member 662 and the lower end of the hollow interior of controller housing 626. In this arrangement, the upper spring 668 provides a resistive force that resists compression, and the lower spring 670 provides a resistive force that resists extension. When the weight of the external battery tube assembly 602 is balanced with the resistive forces of the upper spring 668 and the lower spring 670, the moveable member 662 is held in equilibrium within the hollow interior of the controller housing 626. That is, moveable member 662 is essentially suspended in-tension within the hollow interior of controller housing 626.

When the external battery tube assembly 602 is pulled downward by a user that applies greater force than the forces provided by the upper spring 668 and the lower spring 670, the upper spring 668 compresses and the lower spring 670 stretches and the moveable member 662 moves upward within the hollow interior of the controller housing 626 relative to the stationary member 664. In contrast, when the external battery tube assembly 602 is lifted upward by a user that applies a greater force than the relative weigh of the external battery tube assembly, the upper spring 668 extends and the lower spring 670 compresses and the moveable member 662 moves downward within the hollow interior of the controller housing 626 relative to the stationary member 664.

Moveable member 626 includes a pair of engagement members 676 that extend outward from moveable member 626 toward stationary member 664, or more specifically toward printed circuit board 672 and detector 674. In the arrangement shown, engagement members 676 are positioned in approximate parallel spaced alignment to one another. When in a resting position, or an equilibrium position, detector 674 is positioned approximately in the middle between the spaced engagement members 676. In this arrangement, detector 674 does not send a signal as it is not engaged or does not detect motion. This arrangement is shown in FIGS. 90, 91, 96 and 97.

When the external battery tube assembly 602 is pulled downward, the upper spring 668 compresses and the lower spring 670 stretches and the moveable member 662 moves upward within the hollow interior of the controller housing 626 relative to the stationary member 664. As the external battery tube assembly 602 is pulled downward, the lower-positioned engagement member 676 connected to the stationary member 664 engages the lower side of detector 674. As the engagement member 676 engages the detector 674, the detector 674 deflects and once deflected to or beyond a predetermined amount or a threshold amount, detector 674 transmits a signal, or a pull signal, which is used to control operation of the motorized window covering system 600 as is further described herein. This arrangement is shown FIGS. 100 and 103. Alternatively the opposite operation occurs when the stationary and moveable components are reversed, and the reverse arrangement is hereby contemplated for use.

When the external battery tube assembly 602 is lifted upward, the upper spring 668 extends and the lower spring 670 compresses and the moveable member 662 moves downward within the hollow interior of the controller housing 626 relative to the stationary member 664. As the external battery tube assembly 602 is lifted upward, the upper-positioned engagement member 676 connected to the stationary member 664 engages the upper side of detector 674. As the engagement member 676 engages the detector 674, the detector 674 deflects and once deflected to or beyond a predetermined amount or a threshold amount, detector 674 transmits a signal, or a lift signal, which is used to control operation of the motorized window covering system 600 as is further described herein. This arrangement is shown FIGS. 99 and 102. Alternatively the opposite operation occurs when the stationary and moveable components are reversed, and the reverse arrangement is hereby contemplated for use.

In the arrangement shown, a cover member 678 is placed over the external surface of controller housing 626. Cover member 678 is any device that covers all or a portion of external battery tube assembly 602 and provides an improved aesthetic appearance. In one arrangement, cover member 678 is formed of a compressible material with a high coefficient of friction that provides an improved and comfortable grip for the user.

Actuator mechanism or actuator 652 is formed of any or all of the components that facilitate the detection of a movement of the external battery tube assembly 602 and thereby facilitates control of the motorized window covering system 600. In one arrangement, the actuator mechanism or actuator 652 may be considered just the detector 674 or switch or sensor that senses motion of the external battery tube assembly 602. In another arrangement, the actuator mechanism or actuator 652 may be considered all of the components that work in concert to detect motion of the external battery tube 602 including the detector 674, the stationary member 664 and the moveable member 662. In yet another arrangement, the actuator mechanism or actuator 652 may be considered any part or portion of the components that work in concert to detect motion of the external battery tube 602.

Conduit: Conduit 628 is formed of any suitable size, shape and design and is configured to support external battery tube assembly 602 as it hangs down from motorized window covering 600 as well as carry power and/or control signals to the motors 616, 618. In the arrangement shown, as one example, conduit 628 includes a lug 698 that connects to an upper end and lower end of a sheath 700. The upper lug 698 connects to motorized window covering 600 and lower lug 698 connects to moveable member 662. The lower lug connects to the moveable member 662 and/or the controller housing 626 within the hollow interior of controller housing 626. Sheath 700 extends between the upper lug 698 and lower lug 698 and supports the weight of external battery tube assembly 602. Sheath 700 is hollow and allows the passage of wires 702 there through. Wires 702 carry power and/or control signals to motorized window covering 600. The use of lugs 698 and sheath 700 take the weight off of wires 702 and provide a durable and strong connection between external battery tube assembly 602 and motorized window covering 600 while taking the stress off of wires 702 and thereby not effecting the electrical connection between external battery tube assembly 602 and motorized window covering 600. As one example, in FIGS. 82 and 83 upper lug 698 connects to bracket 608 of motorized window covering system 600. As another example, in FIGS. 104 and 105 upper lug connects to the lower end of first motor housing 638. As yet another example, in FIGS. 106 and 107 the upper lug connects to the lower end of controller housing 626 that connects to the lower end of first motor housing 638.

Alternative Location of Controller Housing: In FIGS. 82-105 controller housing 626 is connected to the upper end of battery housing 624. In an alternative arrangement, with reference to FIGS. 106 and 107, the controller housing 626 is connected to the lower end of the first motor housing 638 and the battery housing 624 hangs down from the controller housing 626 by conduit 628. The configuration and operation of this alternative arrangement where controller housing 626 is connected to the lower end of the first motor housing 638 is similar if not identical to the arrangement presented herein wherein the controller housing 626 is connected to the upper end of battery housing 624 while accommodating for the structural differences there between.

Single Motor Operation and Dual Motor Operation: The external battery tube assembly 602 presented may be used to control one motor 616 or two motors 616, 618.

Single Motor Operation: When external battery tube assembly 602 is used to control a single motor 616, only one way actuation of the external battery tube assembly 602 is required, however two-way actuation may be used. That is, when only a single motor 616 is to be controlled by external battery tube assembly 602 there are essentially three options for how the motor 616 may be controlled: (1) the external battery tube assembly 602 operates in a one-way manner by pulling of the external battery tube assembly 602 only (2) the external battery tube assembly 602 operates in a one-way manner by lifting of the external battery tube assembly 602 only, or (3) the external battery tube assembly 602 operates in a two-way manner by pulling of the external battery tube assembly 602 as well as by lifting of the external battery tube 602.

Single Motor Operation—One Way Operation: When external battery tube assembly 602 operates in a one-way manner, such as by only pulling or only lifting, the configuration of the controller housing 626 can be simplified by removal of the components that facilitate actuation in the non-used manner. That is, as an example, one of the engagement members 676 and one of the springs 668, 664, among other components that facilitates the non-used motion (either pulling or lifting) may be removed. Removing these non-used components may reduce the cost of the external battery tube assembly 602 and improve the robustness of the external battery tube assembly 602.

When only one-way operation is used with a single motor 616 motorized window covering system 600, the motorized window covering system 600 may be controlled by the external battery tube assembly 602 in any of the following manners:

When the motor 616 is not moving, and the external battery tube assembly 602 is pulled or lifted the detector 674 detects the movement (either a lift or a pull) and the motor 616 is activated to move in the opposite direction as the last move. This movement continues until the fully opened position is reached, the fully closed position is reached, or until another actuation of the external battery tube assembly 602 is detected.

When the motor 616 is not moving, and the external battery tube assembly 602 is pulled or lifted the detector 674 detects the movement (either a lift or a pull) and the motor 616 is activated to move in the opposite direction as the last move if the motorized window covering system 600 is in the fully opened or fully closed position, and the motor 616 is activated to move in the same direction as the last move if the motorized window covering system 600 is not in the fully opened or fully closed position. This movement continues until the fully opened position is reached, the fully closed position is reached, or until another actuation of the external battery tube assembly 602 is detected.

When the motor 616 is moving, and the external battery tube assembly 602 is pulled or lifted the detector 674 detects the movement (either a lift or a pull) and the motor 616 is deactivated and the motorized window covering system 600 stops at the position of the lift or pull of the external battery tube assembly 602.

When the motor 616 is moving, and the external battery tube assembly 602 is pulled or lifted the detector 674 detects the movement (either a lift or a pull) and the motor 616 is activated to move in the opposite direction as the current move until the fully opened position is reached, the fully closed position is reached, or until another actuation of the external battery tube assembly 602 is detected.

Single Motor Operation—Two Way Operation: When external battery tube assembly 602 operates in a two-way manner, such as by pulling and lifting the operation may be identical as that identified above with respect to the "Single Motor Operation—One Way Operation." That is, the external battery tube assembly 602 treats both a pull and a lift the same and controls the motor 616 in the same way regardless of whether the actuation is a lift or a pull of the external battery tube assembly 602.

In an alternative arrangement, when external battery tube assembly 602 operates in a two-way manner, such as by pulling and lifting, the difference between a lift and a pull of the external battery tube assembly 602 is distinguished and the motor 616 is controlled differently.

With reference to the upper chart on FIG. 108, "Satellite" Drapery Motor Controller Operation—Mode 1" when two-way operation is used with a single motor 616 motorized window covering system 600, the motorized window covering system 600 may be controlled by the external battery tube assembly 602 in any of the following manners:

When the motor 616 is moving in the open direction, and the external battery tube assembly 602 is pulled the detector 674 detects the movement (a pull) and the motor 616 is deactivated.

When the motor 616 is moving in the open direction, and the external battery tube assembly 602 is lifted the detector 674 detects the movement (a lift) and the motor 616 is deactivated.

When the motor 616 is not moving, and the external battery tube assembly 602 is pulled the detector 674 detects the movement (a pull) and the motor 616 is activated to move in the close direction. This movement continues until the fully closed position is reached or until another actuation of the external battery tube assembly 602 is detected. (It is contemplated that this may be reversed.)

When the motor 616 is not moving, and the external battery tube assembly 602 is lifted the detector 674 detects the movement (a lift) and the motor 616 is activated to move in the open direction. This movement continues until the fully opened position is reached or until another actuation of the external battery tube assembly 602 is detected. (It is contemplated that this may be reversed.)

When the motor 616 is moving in the close direction, and the external battery tube assembly 602 is pulled the detector 674 detects the movement (a pull) and the motor 616 is deactivated.

When the motor 616 is moving in the close direction, and the external battery tube assembly 602 is lifted the detector 674 detects the movement (a lift) and the motor 616 is deactivated.

With reference to the lower chart on FIG. 108, "Satellite" Drapery Motor Controller Operation—Mode 2" when two-way operation is used with a single motor 616 motorized window covering system 600, the motorized window covering system 600 may be controlled by the external battery tube assembly 602 in any of the following manners:

When the motor 616 is moving in the open direction, and the external battery tube assembly 602 is pulled the detector 674 detects the movement (a pull) and the motor 616 is deactivated.

When the motor 616 is moving in the open direction, and the external battery tube assembly 602 is lifted the detector 674 detects the movement (a lift) and the motor 616 is deactivated.

When the motor 616 is not moving, and the external battery tube assembly 602 is pulled the detector 674 detects the movement (a pull) and the motor 616 is activated to move in the opposite direction as the last move. This movement continues until the fully closed position is reached or until another actuation of the external battery tube assembly 602 is detected. (It is contemplated that this may be reversed.)

When the motor 616 is not moving, and the external battery tube assembly 602 is lifted the detector 674 detects the movement (a lift) and the motor 616 is activated to move in the opposite direction as the last move. This movement continues until the fully opened position is reached or until another actuation of the external battery tube assembly 602 is detected. (It is contemplated that this may be reversed.)

When the motor 616 is moving in the close direction, and the external battery tube assembly 602 is pulled the detector 674 detects the movement (a pull) and the motor 616 is deactivated.

When the motor 616 is moving in the close direction, and the external battery tube assembly 602 is lifted the detector 674 detects the movement (a lift) and the motor 616 is deactivated.

Dual Motor Operation: When external battery tube assembly 602 operates in a two-way manner and two motors 616 and 618 are controlled by a single external battery tube assembly 602, the external battery tube assembly 602 distinguishes between a lift and a pull and uses this distinction to facilitate control of two motors 616, 618 using only a single external battery tube assembly 602.

With reference to the upper chart on FIG. 108, "Satellite" Drapery Motor Controller Operation—Mode 1" as well as the lower chart on FIG. 108, "Satellite" Drapery Motor Controller Operation—Mode 2" when two-way operation is used with a dual motor 616, 618 motorized window covering system 600, the motorized window covering system 600 may be controlled by the external battery tube assembly 602 in any of the following manners:

When the first motor 616 moving, and the external battery tube assembly 602 is pulled the detector 674 detects the movement (a pull) and the first motor 616 is deactivated.

When the first motor 616 moving, and the external battery tube assembly 602 is lifted the detector 674 detects the movement (a lift) and the first motor 616 is deactivated.

When the first motor 616 is not moving, and the external battery tube assembly 602 is pulled the detector 674 detects the movement (a pull) and the first motor 616 is activated to move in a direction opposite the last direction of movement.

When the first motor 616 is not moving, and the external battery tube assembly 602 is lifted the detector 674 detects the movement (a lift) and nothing occurs. That is the first motor 616 is allowed to remain in a deactivated state.

When the second motor 618 moving, and the external battery tube assembly 602 is pulled the detector 674 detects the movement (a pull) and the second motor 618 is deactivated.

When the second motor 618 moving, and the external battery tube assembly 602 is lifted the detector 674 detects the movement (a lift) and the second motor 618 is deactivated.

When the second motor 618 is not moving, and the external battery tube assembly 602 is pulled the detector 674 detects the movement (a pull) and nothing occurs. That is the second motor 618 is allowed to remain in a deactivated state.

When the second motor 618 is not moving, and the external battery tube assembly 602 is lifted the detector 674 detects the movement (a lift) and the second motor 618 is activated to move in a direction opposite the last direction of movement.

Presented above are some examples of the manners in which the external battery tube assembly 602 may be used to control operation of one motor 616 or two motors 616 and 618 of motorized window covering system 600. It is contemplated that the pulls and lifts can be reversed, as can be the directions of motion to provide a similar but different user experience.

One of the benefits of the motorized window covering system 600 having an external battery tube assembly 602 that hangs down from a bracket 608 or a first motor housing 638 and that controls operation of the motorized window covering system 600 is that the external battery tube assembly 602 is always in the same position as it is affixed to the motorized window covering system 600. This avoids the constant problem of having to find lost remote controls 96 (note that this motorized window covering system 600 may also be controlled by a remote control 96). In addition, the external battery tube assembly 602 is positioned in a convenient but hidden position just behind the "stack" of the shade material at the outside of the motorized window covering system 600.

While a number of alternatives or embodiments are presented herein, the features of any embodiment can be used or combined with the features of any other embodiment. That is, the features presented herein are contemplated to be used together in any combination.

Alternative Methods of Operation: In an alternative arrangement, external battery tube assembly 602 is used to control operation of motorized window covering system 600 in a manner other than pulling or lifting the external battery tube assembly 602.

Buttons: In one arrangement, the external battery tube assembly 602 includes one or more buttons 680 therein that when engaged transmit a signal that is used to control operation of motorized window covering system 600 as is described herein. One or more buttons 680 may be placed in any portion of the external battery tube assembly 602 such as in the exterior surface of the controller housing 626, in the exterior surface of the battery housing 624, or in any other portion of the external battery tube assembly 602.

In one arrangement, only a single button 680 is presented as part of external battery tube assembly 602. In this arrangement, when the single button 680 is pressed it is treated in a similar fashion to a signal transmitted when a one-way operation external battery tube assembly 602 is actuated (such as an external battery tube 602 that can only be pulled or can only be lifted) as is further described herein.

In another arrangement, two buttons 680 are presented as part of external battery tube assembly 602. In this arrangement, when two buttons 680 are pressed, the signals transmitted are treated in a similar fashion to a signals transmitted when a two-way operation external battery tube assembly 602 is actuated (such as an external battery tube 602 that can be both pulled as well as lifted) as is further described herein. That is, one button 680 is associated with one of the curtains 612, 614 and the other of the buttons 680 is associated with the other of the curtains 612, 614.

In another arrangement, three buttons 680 are presented as part of external battery tube assembly 602. In this arrangement, when three buttons 680 are presented in one arrangement the one button 680 is a dedicated open button, another button 680 is a dedicated close button 680 and another button 680 is a dedicated stop button or jog button.

In another arrangement, four buttons 680 are presented as part of external battery tube assembly 602. This arrangement is particularly well suited for dual curtain motorized window covering systems 600. In this arrangement, one pair of buttons 680 is associated with one of the curtains 612, 614 and the other pair of buttons 680 is associated with the other of the curtains 612, 614. When this arrangement is used with only a single curtain motorized window covering system 600 in one arrangement both pairs of buttons 680 operate identically, or in another arrangement one pair of buttons 680 is functional while the other pair of buttons 680 is nonfunctional.

In another arrangement, six buttons 680 are presented as part of external battery tube assembly 602. This arrangement is particularly well suited for dual curtain motorized window covering systems 600. In this arrangement, one group of three buttons 680 is associated with one of the curtains 612, 614 and the group of three buttons 680 is associated with the other of the curtains 612, 614. In one arrangement, for each group of three buttons 680, one button 680 is a dedicated open button, another button 680 is a dedicated close button 680 and another button 680 is a dedicated stop button or jog button. When this arrangement is used with only a single curtain motorized window covering system 600 in one arrangement both groups of three buttons 680 operate identically, or in another arrangement one group of three buttons 680 is functional while the other group of three buttons 680 is nonfunctional.

In another arrangement, any number of buttons 680 may be presented in addition to an open button 680 and a close button 680. These buttons 680 may be grouped into only a single group, which is well suited for use with a single curtain motorized window covering system 600, or they may be grouped into two groups, which is well suited for use with a dual curtain motorized window covering system 600, where one group of buttons 680 is associated with one of the curtains 612, 614 and the other group of buttons 680 is associated with the other of the curtains 612, 614. In this arrangement, the open button 680 is dedicated to moving the associated curtain 612, 614 to the open position, the close button 680 is dedicated to moving the associated curtain 612, 614 to the close position and the intermediary buttons 680 are dedicated to moving the associated curtain 612, 614 to predetermined positions between the open position and the closed position. As one example, when five buttons 680 are presented, the three intermediary buttons 680 between the open button 680 and the closed button 680 are dedicated to move the associated curtain 612, 614 to a third of the way open position, to a half of the way open position, and a two thirds of the way open position, respectively. However any other predetermined position is hereby contemplated for use.

Any other buttons 680 are hereby contemplated for use as part of external battery tube assembly 602 and are contemplated for purposes other than moving curtain 612, 614 such as an on/off button, a program button, or any other functionality. In addition, varying signals may be transmitted using the same buttons 680 depending on the number of times the button 680 is pressed (such as sending one signal in response to a single press, sending a second signal in response to a double press or and sending a third signal in response to a triple press), depending on the duration of press (such as a sending a first signal in response to a press lasting less than a first predetermined amount of time, sending a second signal in response to a press lasting more than a first predetermined amount of time, and sending a third signal in response to a press lasting more than a second predetermined amount of time), or depending on the amount or pressure applied during a press (such as sending a first signal in response to a light press, and sending a second signal in response to a hard press), or any other configuration or arrangement.

Twisting: In one arrangement, the external battery tube assembly 602 includes one or more twist sensors 682 that are configured to sense when all or a portion of external battery tube assembly 602 is twisted.

In one arrangement, a twist sensor 682 is presented as part of external battery tube assembly 602. In this arrangement, the twist sensor 682 may be configured to detect only a one-way only twist (such as only clockwise or only counterclockwise) or the twist sensor 682 is able to detect a clockwise and a counterclockwise twist but transmits the same signal regardless of the direction of twist. In another arrangement, a twist sensor 682 can detect both clockwise and counterclockwise twists and is configured to transmit unique signals for a clockwise twist and a counterclockwise twist.

When the external battery tube assembly 602 includes a twist sensor 682 that can only detect a one-way twist, or transmits the same signal in response to a clockwise and counterclockwise twist, it is treated in a similar fashion to a signal transmitted when a one-way operation external battery tube assembly 602 is actuated (such as an external battery tube 602 that can only be pulled or can only be lifted, or sends the same signal when it is either pulled or lifted) as is further described herein.

When the external battery tube assembly 602 is includes a twist sensor 682 that can detect a clockwise and counterclockwise and transmits a unique signal for a clockwise twist and a counterclockwise twist it is treated in a similar fashion to a signal transmitted when a two-way operation external battery tube assembly 602 is actuated (such as an external battery tube 602 that can be pulled or lifted) as is further described herein.

In one arrangement, external battery tube assembly 602 includes two twist sensors 682 that are configured to detect twists of different portions of external battery tube assembly 602. In addition, varying signals may be transmitted using the twist sensor 682 depending on the number of times the twist sensor 682 is twisted (such as sending one signal in response to a single twist, sending a second signal in response to a double twist or and sending a third signal in response to a triple twist), depending on the duration of twist (such as a sending a first signal in response to a twist lasting less than a first predetermined amount of time, sending a second signal in response to a twist lasting more than a first predetermined amount of time, and sending a third signal in response to a twist lasting more than a second predetermined amount of time), or depending on the amount or pressure applied during a twist (such as sending a first signal in response to a light twist, and sending a second signal in response to a hard twist), or depending on the amount or travel applied during a twist (such as sending a first signal in response to a small or short twist, and sending a second signal in response to a large or long twist), or any other configuration or arrangement.

Squeeze: In one arrangement, the external battery tube assembly 602 includes one or more squeeze sensors 684 that are configured to sense when all or a portion of external battery tube assembly 602 is squeezed.

In one arrangement, a squeeze sensor 684 is presented as part of external battery tube assembly 602. When the external battery tube assembly 602 includes a single squeeze sensor 684 it is treated in a similar fashion to a signal transmitted when a one-way operation external battery tube assembly 602 is actuated (such as an external battery tube 602 that can only be pulled or can only be lifted, or sends the same signal when it is either pulled or lifted) as is further described herein.

To provide additional functionality, in another arrangement, a second squeeze sensor 684 is included as part of external battery tube assembly 602. In this arrangement, the first squeeze sensor 684 and second squeeze sensor 684 detect squeezes of different portions of the external battery tube assembly, such as the first squeeze sensor 684 detecting a squeeze of the lower portion of the external battery tube assembly 602 and the second squeeze sensor 684 detecting a squeeze of the upper portion of the external battery tube assembly 602. When external battery tube assembly 602 is includes a two squeeze sensors 684 it is treated in a similar fashion to a signal transmitted when a two-way operation external battery tube assembly 602 is actuated (such as an external battery tube 602 that can be pulled or lifted) as is further described herein.

In addition, varying signals may be transmitted using the squeeze sensor 684 depending on the number of times the squeeze sensor 684 is squeezed (such as sending one signal in response to a single squeeze, sending a second signal in response to a double squeeze or and sending a third signal in response to a triple squeeze), depending on the duration of squeeze (such as a sending a first signal in response to a squeeze lasting less than a first predetermined amount of time, sending a second signal in response to a squeeze lasting more than a first predetermined amount of time, and sending a third signal in response to a squeeze lasting more than a second predetermined amount of time), or depending on the amount or pressure applied during a squeeze (such as sending a first signal in response to a light squeeze, and sending a second signal in response to a hard squeeze), or depending on the amount or travel applied during a squeeze (such as sending a first signal in response to a small or short squeeze, and sending a second signal in response to a large or long squeeze), or any other configuration or arrangement.

Capacitive Touch: In one arrangement, the external battery tube assembly 602 includes one or more capacitive touch sensors 686 that are configured to sense when all or a portion of external battery tube assembly 602 is touched.

In one arrangement, a capacitive touch sensor 686 is presented as part of external battery tube assembly 602.

When the external battery tube assembly 602 includes a capacitive touch sensor 686 it is treated in a similar fashion to a signal transmitted when a one-way operation external battery tube assembly 602 is actuated (such as an external battery tube 602 that can only be pulled or can only be lifted, or sends the same signal when it is either pulled or lifted) as is further described herein.

When using a capacitive touch sensor 686 a conductive portion of the external battery tube assembly 602 acts as an antenna. The capacitive touch sensor 686 works by giving the antenna a positive charge imbalance and then a negative one. It does this over and over very rapidly, so positive and negative voltages appear on the conductive portion of the external battery tube assembly 602. In other words, the outside of the conductive portion of the external battery tube assembly 602 has vibrating static electricity on its surface. As the capacitive touch sensor 686 moves charge into and out of the antenna, it measures the tiny flow of charge in the conductor leading to the antenna. As long as the antenna is not touched, this flow of charge always is less than a predetermined value. However, when the conductive portion of the external battery tube assembly 602, or antenna, is touched, the capacitive touch sensor 686 senses an increased power draw due to an increase in surface area drawing a charge. When the capacitive touch sensor 686 senses the higher current it then sends a signal similar to a tug or lift signal.

To provide additional functionality, in another arrangement, a second capacitive touch sensor 686 is included as part of external battery tube assembly 602 that is associated with a second conductive portion of the external battery tube assembly 602. When external battery tube assembly 602 is includes a two capacitive touch sensors 686 it is treated in a similar fashion to a signal transmitted when a two-way operation external battery tube assembly 602 is actuated (such as an external battery tube 602 that can be pulled or lifted) as is further described herein.

Tilt: In one arrangement, the external battery tube assembly 602 includes one or more tilt sensors 688 that are configured to sense when external battery tube assembly 602 is tilted.

In one arrangement, a tilt sensor 688 is presented as part of external battery tube assembly 602. In this arrangement, the tilt sensor 688 may be configured to detect a tilt without regard to direction. In another arrangement, a tilt sensor 688 can detect and distinguish between tilts in different directions, such as left and right and is configured to transmit unique signals for a left tilt and a right tilt, for example. To shorten the length of this long disclosure, the operation of the tilt sensor 688 is similar to that of a twist sensor 682 presented herein and reference is made thereto.

Multiple Modes of Operation: As is described herein, battery tube assembly 602 may be used in many manners to operate one or more motors 616, 618 of motorized window covering system 600 such as a tug, lift, touch, tilt, twist or the like. It is to be understood that use of any one manner or method of operation is not to the exclusion of others. That is, multiple forms of operation may be incorporated within any one system or any combination of these features may be incorporated within any one system.

Two Motors One Motor Controller: An expensive portion of the motorized window covering system 600 presented herein is the electronic components that control the motor(s) 616, 618 which include printed circuit board member 672 and the electronic components thereon, which include a microprocessor as is described herein. One advantage to the system presented herein is that a single motor controller may be used to control two motors 616, 618. This reduces the cost of the motorized window covering system 600 by eliminating one of the motor controllers.

From the above discussion it will be appreciated that the motorized drapery apparatus, system and method of use presented improves upon the state of the art.

Specifically, the motorized drapery apparatus, system and method of use shown and described herein is easy to use, efficient, simple, accurate, inexpensive, has a minimum number of parts, and has an intuitive design. Thus, one of ordinary skill in the art would easily recognize that all of the stated objectives have been accomplished.

It will be appreciated by those skilled in the art that other various modifications could be made to the device with-out parting from the spirit and scope of this invention. All such modifications and changes fall within the scope of the claims and are intended to be covered thereby.

What is claimed is:

1. A motorized window covering system, comprising:

a first track;

a first shade material operatively connected to the first track;

a second track;

a second shade material operatively connected to the second track;

a first motor housing;

the first motor housing having a first motor;

the first motor housing operatively connected to the first track such that operation of the first motor opens or closes the first shade material;

a second motor housing;

the second motor housing having a second motor;

the second motor housing operatively connected to the second track such that operation of the second motor opens or closes the second shade material;

a controller housing;

the controller housing having a single motor controller;

the single motor controller electrically connected to the first motor and the second motor;

the single motor controller configured to control operation of the first motor and the second motor;

a battery housing;

the battery housing positioned below the first motor housing;

the battery housing connected to the first motor housing by a conduit;

the battery housing having at least one battery therein;

a detector;

a movable member;

wherein the detector and the movable member are operably connected to the battery housing;

wherein the conduit operatively electrically connects the battery housing to the single motor controller;

wherein the battery housing is configured to be tugged;

wherein when the battery housing is tugged, the movable member engages the detector and causes the detector to be deflected;

wherein when the detector is deflected beyond a predetermined amount, a signal is sent which is configured to control operation of the motorized window covering system.

2. The motorized window covering system of claim 1, wherein the controller housing is directly connected to the first motor housing.

3. The motorized window covering system of claim 1, wherein the controller housing is directly connected to the battery housing that hangs down from the first motor housing.

4. The motorized window covering system of claim 1, wherein the single motor controller includes a microprocessor that controls operation of the first motor and the second motor.

5. The motorized window covering system of claim 1, wherein the single motor controller includes a printed circuit board that has electronic components that control operation of the first motor and the second motor.

6. The motorized window covering system of claim 1, wherein the single motor controller is configured to control operation of the first motor and the second motor based on a user initiated tug.

7. The motorized window covering system of claim 1, wherein the single motor controller is configured to control operation of the first motor and the second motor based on a user initiated twist.

8. The motorized window covering system of claim 1, wherein the single motor controller is configured to control operation of the first motor and the second motor based on a user initiated press of a button.

9. The motorized window covering system of claim 1, wherein the single motor controller is configured to control operation of the first motor and the second motor based on a user initiated capacitive touch.

10. A motorized window covering system, comprising:
a first rod;
a first shade material operatively connected to the first rod;
a second rod;
a second shade material operatively connected to the second rod;
a first motor housing;
the first motor housing having a first motor;
the first motor housing operatively connected to the first rod such that operation of the first motor opens or closes the first shade material;
a second motor housing;
the second motor housing having a second motor;
the second motor housing operatively connected to the second rod such that operation of the second motor opens or closes the second shade material;
a controller housing;
the controller housing having a single motor controller;
the single motor controller electrically connected to the first motor and the second motor;
the single motor controller configured to control operation of the first motor and the second motor;
a battery housing;
the battery housing positioned below the first motor housing;
the battery housing connected to the first motor housing by a conduit;
the battery housing operatively connected to the single motor controller;
the battery housing having at least one battery therein;
a detector;
a movable member;
wherein the detector and the movable member are operably connected to the battery housing;
wherein the conduit is configured to deliver power from the battery housing to the single motor controller;
wherein the battery housing is configured to be tugged;
wherein when the battery housing is tugged, the movable member engages the detector and causes the detector to be deflected;
wherein when the detector is deflected beyond a predetermined amount, a signal is sent which is configured to facilitate control of operation of the first motor and second motor.

11. The motorized window covering system of claim 10, wherein the first rod rotates.

12. The motorized window covering system of claim 10, wherein the second rod rotates.

13. The motorized window covering system of claim 10, wherein the controller housing is directly connected to the first motor housing.

14. The motorized window covering system of claim 10, wherein the controller housing is directly connected to the battery housing that hangs down from the first motor housing.

15. The motorized window covering system of claim 10, wherein the single motor controller includes a microprocessor that controls operation of the first motor and the second motor.

16. The motorized window covering system of claim 10, wherein the single motor controller includes a printed circuit board that has electronic components that control operation of the first motor and the second motor.

17. The motorized window covering system of claim 10, wherein the single motor controller is configured to control operation of the first motor and the second motor based on a user initiated tug.

18. The motorized window covering system of claim 10, wherein the single motor controller is configured to control operation of the first motor and the second motor based on a user initiated twist.

19. The motorized window covering system of claim 10, wherein the single motor controller is configured to control operation of the first motor and the second motor based on a user initiated press of a button.

20. The motorized window covering system of claim 10, wherein the single motor controller is configured to control operation of the first motor and the second motor based on a user initiated capacitive touch.

21. A motorized window covering system, comprising:
a first track;
a first shade material operatively connected to the first track;
a second track;
a second shade material operatively connected to the second track;
a first motor housing;
the first motor housing having a first motor;
the first motor housing operatively connected to the first track such that operation of the first motor opens or closes the first shade material;
a second motor housing;
the second motor housing having a second motor;
the second motor housing operatively connected to the second track such that operation of the second motor opens or closes the second shade material;
a controller housing;
the controller housing having a single motor controller;
the single motor controller electrically connected to the first motor and the second motor;
the single motor controller configured to control operation of the first motor and the second motor;
a battery housing;

the battery housing positioned below the first motor housing;

the battery housing connected to the first motor housing by a conduit;

the battery housing operatively connected to the single motor controller;

the battery housing having at least one battery therein;

a detector;

a movable member;

wherein the detector and the movable member are operably connected to the battery housing;

wherein the conduit is configured to deliver power from the battery housing to the controller housing;

wherein when the battery housing is pulled, the movable member engages the detector and causes the detector to be deflected;

wherein when the detector is deflected beyond a predetermined amount, a signal is sent which initiates control of operation of the motorized window covering system.

22. The motorized window covering system of claim 21, wherein the first shade material is connected to a first rod.

23. The motorized window covering system of claim 21, wherein the first shade material is connected to a first track.

24. The motorized window covering system of claim 21, wherein the second shade material is connected to a second rod.

25. The motorized window covering system of claim 21, wherein the second shade material is connected to a second track.

26. The motorized window covering system of claim 21, wherein the controller housing is directly connected to the first motor housing.

27. The motorized window covering system of claim 21, wherein the controller housing is directly connected to the battery housing that hangs down from the first motor housing.

28. The motorized window covering system of claim 21, wherein the single motor controller includes a microprocessor that controls operation of the first motor and the second motor.

29. The motorized window covering system of claim 21, wherein the single motor controller includes a printed circuit board that has electronic components that control operation of the first motor and the second motor.

30. The motorized window covering system of claim 21, wherein the single motor controller is configured to control operation of the first motor and the second motor based on a user initiated tug.

31. The motorized window covering system of claim 21, wherein the single motor controller is configured to control operation of the first motor and the second motor based on a user initiated twist.

32. The motorized window covering system of claim 21, wherein the single motor controller is configured to control operation of the first motor and the second motor based on a user initiated press of a button.

33. The motorized window covering system of claim 21, wherein the single motor controller is configured to control operation of the first motor and the second motor based on a user initiated capacitive touch.

34. A motorized window covering system, comprising:

a first shade material;

a second shade material;

a first motor operatively connected to the first shade material such that operation of the first motor moves the first shade material;

a second motor operatively connected to the second shade material such that operation of the second motor moves the second shade material;

a power source configured to provide power to the first motor and the second motor; and a controller housing;

the controller housing having a single motor controller;

the single motor controller electrically connected to the first motor and the second motor;

the single motor controller configured to control operation of the first motor and the second motor;

a battery housing;

the battery housing operatively connected to the single motor controller;

the battery housing connected to the first motor by a conduit;

the battery housing having at least one battery therein;

a detector;

a movable member;

wherein the detector and the movable member are operably connected to the battery housing;

wherein the conduit operatively electrically connects the battery housing to the controller housing;

wherein when the battery housing is pulled the movable member engages the detector and causes the detector to be deflected;

wherein when the detector is deflected beyond a predetermined amount, a signal is sent which initiates control of operation of the motorized window covering system.

35. The motorized window covering system of claim 34, wherein the single motor controller includes a printed circuit board and a microprocessor.

36. A motorized window covering system, comprising:

a first motor housing having a first motor;

a second motor housing enclosing a second motor;

a conduit configured to provide power to the first motor housing;

a cable extending between the first motor housing and the second motor housing that provides power to the second motor housing; and a single motor controller configured to control operation of the first motor and second motor;

wherein operation of the first motor opens or closes a first shade material; and wherein operation of the second motor opens or closes a second shade material;

a battery housing;

the battery housing operatively connected to the single motor controller;

the battery housing connected to the first motor housing by the conduit;

the battery housing having at least one battery therein;

a detector;

a movable member;

wherein the detector and the movable member are operably connected to the battery housing;

wherein the conduit operatively electrically connects the battery housing to the single motor controller;

wherein the battery housing is configured to be tugged;

wherein when the battery housing is tugged, the movable member engages the detector and causes the detector to be deflected;

wherein when the detector is deflected beyond a predetermined amount, a signal is sent which is configured to control operation of the motorized window covering system.

37. The motorized window covering system of claim 36, wherein the single motor controller includes a printed circuit board and a microprocessor.

* * * * *